US006682170B2

(12) United States Patent
Hotomi et al.

(10) Patent No.: US 6,682,170 B2
(45) **Date of Patent: *Jan. 27, 2004**

(54) IMAGE FORMING APPARATUS

(75) Inventors: Hideo Hotomi, Nishinomiya (JP); Masaki Asano, Nishinomiya (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/054,592

(22) Filed: Apr. 3, 1998

(65) Prior Publication Data

US 2002/0054186 A1 May 9, 2002

(30) Foreign Application Priority Data

| | | |
|---|---|---|
| Apr. 7, 1997 | (JP) | 9-087879 |
| May 21, 1997 | (JP) | 9-131158 |
| May 21, 1997 | (JP) | 9-131159 |
| May 21, 1997 | (JP) | 9-131456 |
| May 26, 1997 | (JP) | 9-135239 |
| May 26, 1997 | (JP) | 9-135387 |
| May 26, 1997 | (JP) | 9-135388 |
| Sep. 24, 1997 | (JP) | 9-258295 |

(51) Int. Cl.[7] ..... B41J 2/21; B41J 2/205; B41J 29/38

(52) U.S. Cl. ..... 347/43; 347/15; 347/9

(58) Field of Search ..... 347/43, 40, 41, 347/15, 9

(56) References Cited

U.S. PATENT DOCUMENTS

| | | | | | |
|---|---|---|---|---|---|
| 4,614,967 | A | * | 9/1986 | Sayanagi | 347/40 |
| 4,630,076 | A | * | 12/1986 | Yoshimura | 347/43 |
| 4,860,026 | A | * | 8/1989 | Matsumoto et al. | 347/40 |
| 4,952,942 | A | * | 8/1990 | Kanome | 347/43 |
| 5,614,931 | A | * | 3/1997 | Koike et al. | 347/43 |
| 5,742,306 | A | * | 4/1998 | Gompertz et al. | 347/43 |
| 5,949,453 | A | * | 9/1999 | Harris et al. | 347/43 |
| 5,984,449 | A | * | 11/1999 | Tajika et al. | 347/15 |
| 6,024,438 | A | * | 2/2000 | Koike et al. | 347/43 |
| 6,050,676 | A | * | 4/2000 | Sugimoto et al. | 347/43 |

FOREIGN PATENT DOCUMENTS

| | | | | | |
|---|---|---|---|---|---|
| JP | 60-056557 | A | | 4/1985 | |
| JP | 61-054943 | A | | 3/1986 | |
| JP | 4011216852 | A | * | 8/1989 | 347/40 |
| JP | 01-228862 | A | | 9/1989 | |
| JP | 06-199031 | | | 7/1994 | |
| JP | 06-312519 | A | | 11/1994 | |
| JP | 06-328678 | A | | 11/1994 | |
| JP | 06-340094 | A | | 12/1994 | |
| JP | 08-157731 | | | 6/1996 | |

* cited by examiner

*Primary Examiner*—Thinh Nguyen
(74) *Attorney, Agent, or Firm*—Sidley Austin Brown & Wood LLP

(57) ABSTRACT

An ink jet printer includes heads for jetting ink of yellow, magenta, cyan and black, and a head for jetting ink lower in tone than the aforementioned ink. The voltage applied to a head can be changed to change the size of a dot to be printed. Tone control can be provided depending on the tone of ink and dot size to improve image quality.

25 Claims, 142 Drawing Sheets

FIG. 10

| MOST SIGNIFICANT | LEAST SIGNIFICANT |
|---|---|
| DATA FOR NORMAL COLOR | DATA FOR PHOTO COLOR |

FIG. 11

NORMAL Y INK

| | COMPOSITION RATIO (wt%) | |
|---|---|---|
| SOLVENT | WATER | 74.5 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/Bayer Y-CA 51092 | 2.5 |
| ADDITIVE | SURFACTANT/OLFINE E1010 | 0.8 |
| | pH ADJUSTING AGENT/$NaHCO_3$ | 0.2 |

FIG. 12

NORMAL M INK

| | COMPOSITION RATIO (wt%) | |
|---|---|---|
| SOLVENT | WATER | 74.5 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/BASF RED FF-3282 | 2.5 |
| ADDITIVE | SURFACTANT/OLFINE E1010 | 0.8 |
| | pH ADJUSTING AGENT/$NaHCO_3$ | 0.2 |

FIG. 13

NORMAL C INK

| | COMPOSITION RATIO (wt%) | |
|---|---|---|
| SOLVENT | WATER | 74.0 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/Bayer CY-BG | 3.0 |
| ADDITIVE | SURFACTANT/OLFINE E1010 | 0.8 |
| | pH ADJUSTING AGENT/$NaHCO_3$ | 0.2 |

FIG. 14

NORMAL K INK

| | COMPOSITION RATIO (wt%) | |
|---|---|---|
| SOLVENT | WATER | 77.9 |
| | POLYHYDRIC ALCOHOL/DEG | 6.0 |
| | POLYHYDRIC ALCOHOL ETHER/TGB | 6.0 |
| | THICKENER/PEG #400 | 4.5 |
| COLORING MATERIAL | DYE/Bayer BK-SP | 4.6 |
| ADDITIVE | SURFACTANT/OLFINE E1010 | 0.8 |
| | pH ADJUSTING AGENT/$NaHCO_3$ | 0.2 |

FIG. 15

PHOTO Y INK

| | COMPOSITION RATIO (wt%) | |
|---|---|---|
| SOLVENT | WATER | 76.3 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/Bayer Y-CA 51092 | 0.7 |
| ADDITIVE | SURFACTANT/OLFINE E1010 | 0.8 |
| | pH ADJUSTING AGENT/$NaHCO_3$ | 0.2 |

FIG. 16

PHOTO M INK

| | COMPOSITION RATIO (wt%) | |
|---|---|---|
| SOLVENT | WATER | 76.3 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/BASF RED FF-3282 | 0.7 |
| ADDITIVE | SURFACTANT/OLFINE E1010 | 0.8 |
| | pH ADJUSTING AGENT/$NaHCO_3$ | 0.2 |

FIG. 17

PHOTO C INK

| | COMPOSITION RATIO (wt%) | |
|---|---|---|
| SOLVENT | WATER | 76.2 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/Bayer CY-BG | 0.8 |
| ADDITIVE | SURFACTANT/OLFINE E1010 | 0.8 |
| | pH ADJUSTING AGENT/$NaHCO_3$ | 0.2 |

FIG. 18

PHOTO K INK

| | COMPOSITION RATIO (wt%) | |
|---|---|---|
| SOLVENT | WATER | 81.3 |
| | POLYHYDRIC ALCOHOL/DEG | 6.0 |
| | POLYHYDRIC ALCOHOL ETHER/TGB | 6.0 |
| | THICKENER/PEG #400 | 4.5 |
| COLORING MATERIAL | DYE/Bayer BK-SP | 1.2 |
| ADDITIVE | SURFACTANT/OLFINE E1010 | 0.8 |
| | pH ADJUSTING AGENT/$NaHCO_3$ | 0.2 |

FIG. 29
(30)
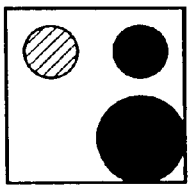
(31)
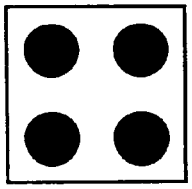
(32)
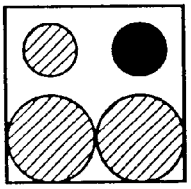
(33)
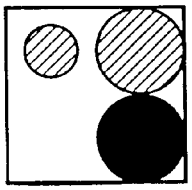
(34)
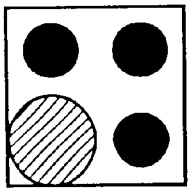

FIG. 30
(35)
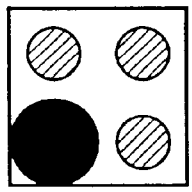
(36)
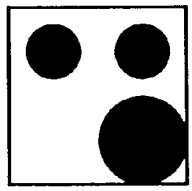
(37)
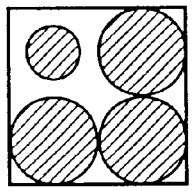
(38)
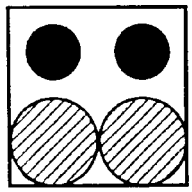
(39)
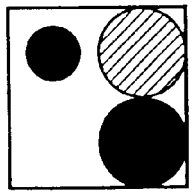

FIG. 31
(40)
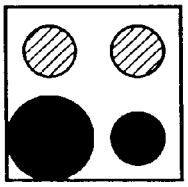
(41)
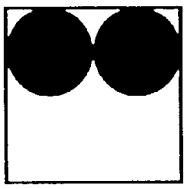
(42)
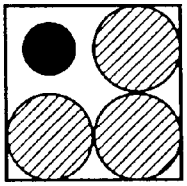
(43)
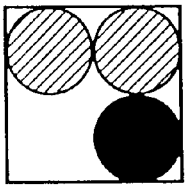
(44)
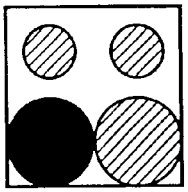

FIG. 32
(45)
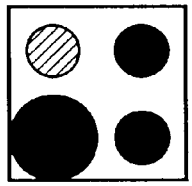
(46)
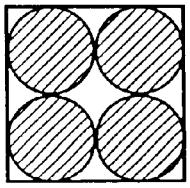
(47)
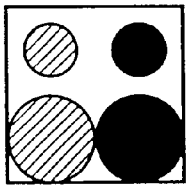
(48)
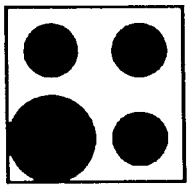
(49)
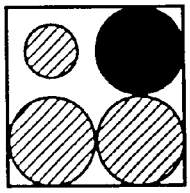

FIG. 33
(50)
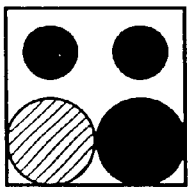
(51)
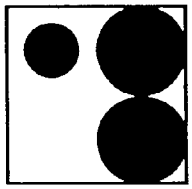
(52)
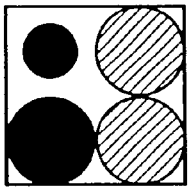
(53)
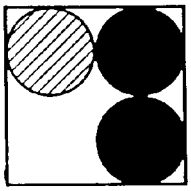
(54)
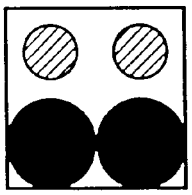

FIG. 34
(55)
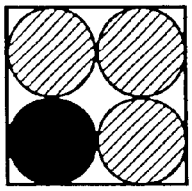
(56)
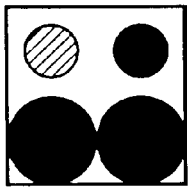
(57)
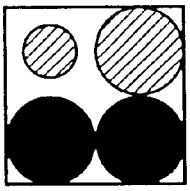
(58)
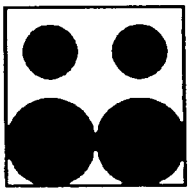
(59)
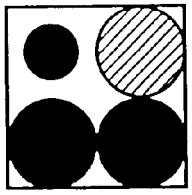

FIG. 35
(60)
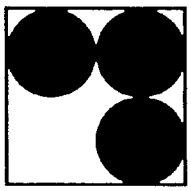
(61)
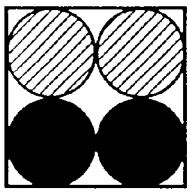
(62)
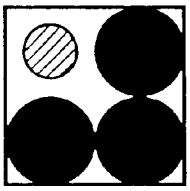
(63)
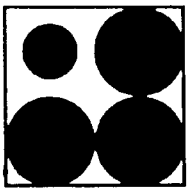
(64)
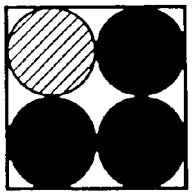

FIG. 36
(65)
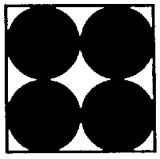
FIG. 38
(0)
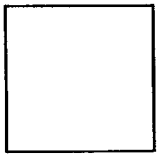
(1)
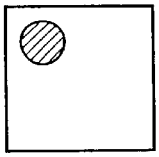
(2)
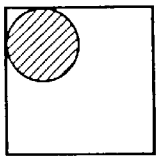
(3)
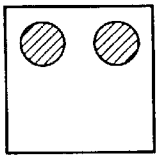
(4)
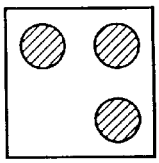

FIG. 40
(10)
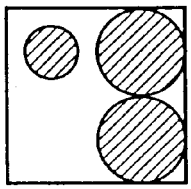
(11)
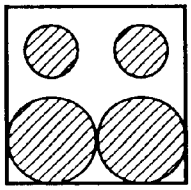
(12)
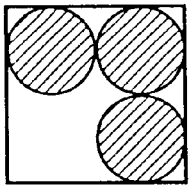
(13)
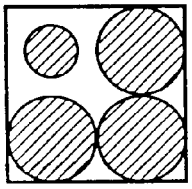
(14)
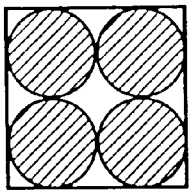

FIG. 43
(10)
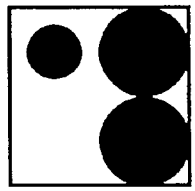
(11)
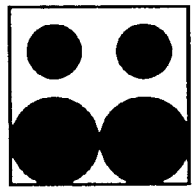
(12)
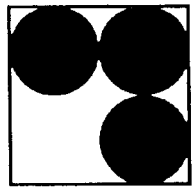
(13)
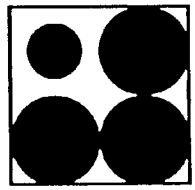
(14)
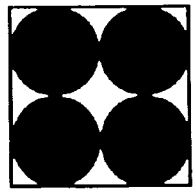

FIG. 49

NORMAL Y INK

| | COMPOSITION RATIO (wt%) | |
|---|---|---|
| SOLVENT | WATER | 76.0 |
| | POLYHYDRIC ALCOHOL/DEG | 11.0 |
| | POLYHYDRIC ALCOHOL ETHER/TGB | 6.5 |
| | THICKENER/PEG #400 | 3.0 |
| COLORING MATERIAL | DYE/Bayer Y-CA 51092 | 2.5 |
| ADDITIVE | SURFACTANT/OLFINE E1010 | 0.8 |
| | pH ADJUSTING AGENT/$NaHCO_3$ | 0.2 |

FIG. 50

NORMAL M INK

| | COMPOSITION RATIO (wt%) | |
|---|---|---|
| SOLVENT | WATER | 75.5 |
| | POLYHYDRIC ALCOHOL/DEG | 11.0 |
| | POLYHYDRIC ALCOHOL ETHER/TGB | 6.5 |
| | THICKENER/PEG #400 | 3.5 |
| COLORING MATERIAL | DYE/BASF RED FF-3282 | 2.5 |
| ADDITIVE | SURFACTANT/OLFINE E1010 | 0.8 |
| | pH ADJUSTING AGENT/$NaHCO_3$ | 0.2 |

FIG. 51

NORMAL C INK

| | COMPOSITION RATIO (wt%) | |
|---|---|---|
| SOLVENT | WATER | 75.0 |
| | POLYHYDRIC ALCOHOL/DEG | 11.0 |
| | POLYHYDRIC ALCOHOL ETHER/TGB | 6.5 |
| | THICKENER/PEG #400 | 3.5 |
| COLORING MATERIAL | DYE/Bayer CY-BG | 3.0 |
| ADDITIVE | SURFACTANT/OLFINE E1010 | 0.8 |
| | pH ADJUSTING AGENT/$NaHCO_3$ | 0.2 |

FIG. 52

NORMAL K INK

| | COMPOSITION RATIO (wt%) | |
|---|---|---|
| SOLVENT | WATER | 78.9 |
| | POLYHYDRIC ALCOHOL/DEG | 6.0 |
| | POLYHYDRIC ALCOHOL ETHER/TGB | 6.0 |
| | THICKENER/PEG #400 | 3.5 |
| COLORING MATERIAL | DYE/Bayer BK-SP | 4.6 |
| ADDITIVE | SURFACTANT/OLFINE E1010 | 0.8 |
| | pH ADJUSTING AGENT/$NaHCO_3$ | 0.2 |

FIG. 53

PHOTO Y INK

| | COMPOSITION RATIO (wt%) | |
|---|---|---|
| SOLVENT | WATER | 77.9 |
| | POLYHYDRIC ALCOHOL/DEG | 11.0 |
| | POLYHYDRIC ALCOHOL ETHER/TGB | 6.5 |
| | THICKENER/PEG #400 | 3.0 |
| COLORING MATERIAL | DYE/Bayer Y-CA 51092 | 0.6 |
| ADDITIVE | SURFACTANT/OLFINE E1010 | 0.8 |
| | pH ADJUSTING AGENT/$NaHCO_3$ | 0.2 |

FIG. 54

PHOTO M INK

| | COMPOSITION RATIO (wt%) | |
|---|---|---|
| SOLVENT | WATER | 77.4 |
| | POLYHYDRIC ALCOHOL/DEG | 11.0 |
| | POLYHYDRIC ALCOHOL ETHER/TGB | 6.5 |
| | THICKENER/PEG #400 | 3.5 |
| COLORING MATERIAL | DYE/BASF RED FF-3282 | 0.6 |
| ADDITIVE | SURFACTANT/OLFINE E1010 | 0.8 |
| | pH ADJUSTING AGENT/$NaHCO_3$ | 0.2 |

FIG. 55

PHOTO C INK

| | COMPOSITION RATIO (wt%) | |
|---|---|---|
| SOLVENT | WATER | 77.3 |
| | POLYHYDRIC ALCOHOL/DEG | 11.0 |
| | POLYHYDRIC ALCOHOL ETHER/TGB | 6.5 |
| | THICKENER/PEG #400 | 3.5 |
| COLORING MATERIAL | DYE/Bayer CY-BG | 0.7 |
| ADDITIVE | SURFACTANT/OLFINE E1010 | 0.8 |
| | pH ADJUSTING AGENT/$NaHCO_3$ | 0.2 |

FIG. 56

PHOTO K INK

| | COMPOSITION RATIO (wt%) | |
|---|---|---|
| SOLVENT | WATER | 82.3 |
| | POLYHYDRIC ALCOHOL/DEG | 6.0 |
| | POLYHYDRIC ALCOHOL ETHER/TGB | 6.0 |
| | THICKENER/PEG #400 | 3.5 |
| COLORING MATERIAL | DYE/Bayer BK-SP | 1.2 |
| ADDITIVE | SURFACTANT/OLFINE E1010 | 0.8 |
| | pH ADJUSTING AGENT/$NaHCO_3$ | 0.2 |

· WAVEFORM FOR Vo ≦ 15V

· WAVEFORM FOR Vo > 15V

FIG. 72

| | EMBODIMENT 1 | EMBODIMENT 2 | EMBODIMENT 3 | EMBODIMENT 4 | COMPARATIVE EXAMPLE 1 |
|---|---|---|---|---|---|
| ROUGHNESS OBSERVED WITH MAGNIFYING GLASS | ○ | ○ | ○ | ○ | × |
| MEASUREMENT BY MICRODENSITOMER | △ | ○ | ○ | ○ | × |

FIG. 81
(15)
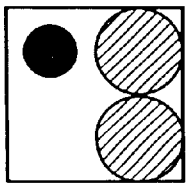
(16)
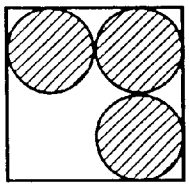
(17)
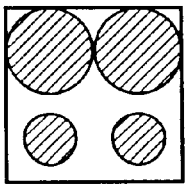
(18)
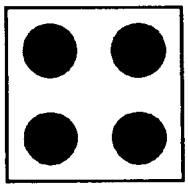
(19)
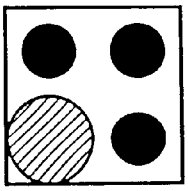

FIG. 82
(20)
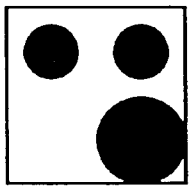
(21)
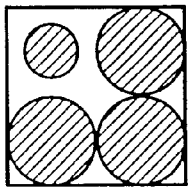
(22)
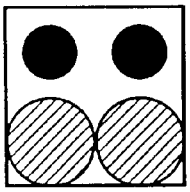
(23)
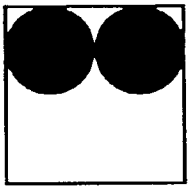
(24)
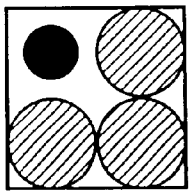

FIG. 83
(25)
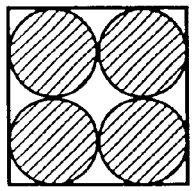
(26)
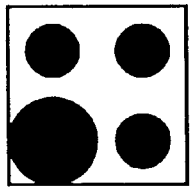
(27)
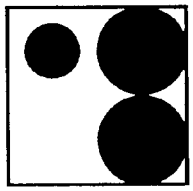
(28)
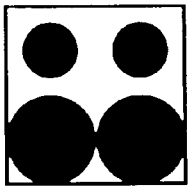
(29)
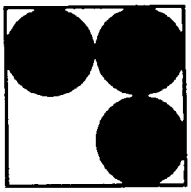

FIG. 84
(30)
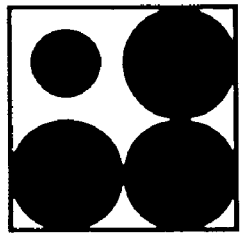
(31)
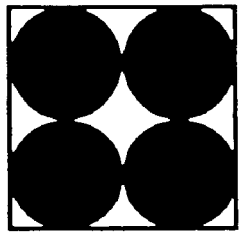

FIG.122

| | INK JET PRINTER AS EMBODIMENT 4-1 | INK JET PRINTER AS EMBODIMENT 4-2 | INK JET PRINTER AS EMBODIMENT 4-3 | INK JET PRINTER AS CONVENTIONAL EXAMPLE 4-1 | INK JET PRINTER AS CONVENTIONAL EXAMPLE 4-2 |
|---|---|---|---|---|---|
| SMOOTHNESS | ○ | ○ | ○ | × | △ |
| TONE JUMP | NONE | NONE | NONE | OBSERVED | OBSERVED |

FIG. 132

Bo INK

| | COMPOSITION RATIO (wt%) | |
|---|---|---|
| SOLVENT | WATER | 74.5 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/Kayanol Milling Ultra Sky SE (NIPPON KAYAKU CO., LTD) | 2.5 |
| ADDITIVE | SURFACTANT/OLFINE E1010 | 0.8 |
| | pH ADJUSTING AGENT/$NaHCO_3$ | 0.2 |

FIG. 133

Go INK

| | COMPOSITION RATIO (wt%) | |
|---|---|---|
| SOLVENT | WATER | 74.5 |
| | POLYHYDRIC ALCOHOL/DEG | 11.0 |
| | POLYHYDRIC ALCOHOL ETHER/TGB | 6.5 |
| | THICKENER/PEG #400 | 4.0 |
| COLORING MATERIAL | DYE/Cosmolan Green 3GL (SUMITOMO CHEMICAL CO., LTD) | 3.0 |
| ADDITIVE | SURFACTANT/OLFINE E1010 | 0.8 |
| | pH ADJUSTING AGENT/$NaHCO_3$ | 0.2 |

FIG. 134

Ro INK

| | COMPOSITION RATIO (wt%) | |
|---|---|---|
| SOLVENT | WATER | 74.5 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/Suminol Leveling Red 6BL (SUMITOMO CHEMICAL CO., LTD) | 2.5 |
| ADDITIVE | SURFACTANT/OLFINE E1010 | 0.8 |
| | pH ADJUSTING AGENT/$NaHCO_3$ | 0.2 |

FIG. 150

Mpo INK

| | COMPOSITION RATIO (wt%) | |
|---|---|---|
| SOLVENT | WATER | 76.3 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/BASF RED FF-3282 | 0.7 |
| ADDITIVE | SURFACTANT/OLFINE E1010 | 0.8 |
| | pH ADJUSTING AGENT/$NaHCO_3$ | 0.2 |

FIG. 151

Cpo INK

| | COMPOSITION RATIO (wt%) | |
|---|---|---|
| SOLVENT | WATER | 76.2 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/Bayer CY-BG | 0.8 |
| ADDITIVE | SURFACTANT/OLFINE E1010 | 0.8 |
| | pH ADJUSTING AGENT/$NaHCO_3$ | 0.2 |

FIG. 152

Ypo INK

| | COMPOSITION RATIO (wt%) | |
|---|---|---|
| SOLVENT | WATER | 76.3 |
| | POLYHYDRIC ALCOHOL/DEG | 11.0 |
| | POLYHYDRIC ALCOHOL ETHER/TGB | 6.5 |
| | THICKENER/PEG #400 | 4.5 |
| COLORING MATERIAL | DYE/Bayer Y-CA 51092 | 0.7 |
| ADDITIVE | SURFACTANT/OLFINE E1010 | 0.8 |
| | pH ADJUSTING AGENT/$NaHCO_3$ | 0.2 |

FIG. 153

Kpo INK

| | COMPOSITION RATIO (wt%) | |
|---|---|---|
| SOLVENT | WATER | 81.3 |
| | POLYHYDRIC ALCOHOL/DEG | 6.0 |
| | POLYHYDRIC ALCOHOL ETHER/TGB | 6.0 |
| | THICKENER/PEG #400 | 4.5 |
| COLORING MATERIAL | DYE/Bayer BK-SP | 1.2 |
| ADDITIVE | SURFACTANT/OLFINE E1010 | 0.8 |
| | pH ADJUSTING AGENT/$NaHCO_3$ | 0.2 |

FIG. 156

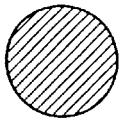

---- DOT IN NORMAL COLOR INK (Y, M, C AND K)

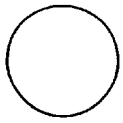

---- DOT IN PHOTO COLOR INK (Yp, Cp, Mp AND Kp)

FIG. 158

| TYPE OF INK / COLOR | EXAMPLE 6-1 (PENETRANT: 2%) | EXAMPLE 6-2 (PENETRANT: 4%) | EXAMPLE 6-3 (PENETRANT: 7%) | COMPARATIVE EXAMPLE 6-1 (PENETRANT: 0%) |
|---|---|---|---|---|
| Kp | △ | △ | ○ | × |
| (Yp) | — | — | — | — |
| Mp | ○ | ○ | ○ | △ |
| Cp | △ | ○ | ○ | × |

FIG. 162

| TYPE OF INK / COLOR | EXAMPLE 7-1 (PENETRANT: 2%) | EXAMPLE 7-2 (PENETRANT: 4%) | EXAMPLE 7-3 (PENETRANT: 7%) | COMPARATIVE EXAMPLE 7-1 (PENETRANT: 0%) |
|---|---|---|---|---|
| Kp | △ | △ | ○ | × |
| (Yp) | — | — | — | — |
| Mp | ○ | ○ | ○ | △ |
| Cp | △ | ○ | ○ | × |

IMAGE FORMING APPARATUS

BACKGROUND OF THE INVENTION

1. Field of the Invention

The present invention relates to an image forming apparatus, and more specifically to an image forming apparatus which employs various types of ink to form color images on a recording medium.

2. Description of the Related Art

Recently, ink jet printers have generally been put to practical use as image forming apparatuses which have been conventionally known as those forming color images on a recording medium. For example, an ink jet printer forming color images has four ink jet heads storing respective color ink of cyan, magenta, yellow and black. The ink jet heads appropriately jet ink drops to form color images on a recording medium.

An ink jet printer is also known which has an ink jet head storing a type of ink of low density referred to as photo ink for each color of cyan, magenta and yellow in addition to the aforementioned ink jet heads for high definition color image formation. The photo ink is superior in reproduction of light colors, and provides better reproduction of photograph images, as compared with when the photo ink is not used.

However, a demand for an image forming apparatus capable of high definition image reproduction has been increasingly growing in recent years.

This application is based on Application Nos. 9-087879, 9-131456, 9-131158, 9-131159, 9-135239, 9-135387, 9-135388 and 9-258295 filed in Japan, the contents of which are hereby incorporated by reference.

SUMMARY OF THE INVENTION

An object of the present invention is to provide an image forming apparatus capable of high quality image reproduction.

Another object of the present invention is to provide an image forming apparatus capable of high definition image reproduction.

Still another object of the present invention is to provide an image forming apparatus capable of reproducing images with an increased number of tones.

In order to achieve the above objects, an image forming apparatus in one aspect of the present invention includes: a first printer head using a first toning material to form a first image on a recording medium; a second print head using a second toning material to form a second image on the recording medium, the tone of the second toning material being different from the tone of the first toning material; and a controller controlling the first and second print heads to form the first and second images on the recording medium, at least one of the first and second print heads being controlled in multiple levels.

An image forming apparatus in another aspect of the present invention includes a first group of a plurality of print heads each containing ink of a different color, and a second group of a plurality of print heads each containing ink of a different color. Each ink for the second group of print heads is different in permeability to recording sheet from each ink for the first group of print heads.

An image forming apparatus in still another aspect of the present invention includes: a first print head using a first toning material to form a first image on a recording medium; a second print head using a second toning material to form a second image on the recording medium, the tone of the second toning material is lighter than the tone of the first toning material; and a controller controlling the first and second print heads to form the first and second images on the recording medium, wherein the first print head initially forms an image at a predetermined position on the recording medium and the second print head then forms an image at the predetermined position on the recording medium.

An image forming apparatus in still another aspect of the present invention includes: a first print head using a first ink to form a first image on a recording medium; a second print head using a second ink to form a second image on the recording medium, the tone of the second ink is lighter than the tone of the first ink; and a controller controlling the first and second print heads to form the first and second images on the recording medium, wherein the maximum diameter of an ink dot reproduced by the first print head is smaller than the maximum diameter of an ink dot reproduced by the second print head.

An image forming apparatus in still another aspect of the present invention includes: a first group of print heads which contain toning materials of primary colors for printing, respectively; a second group of print heads which contain toning materials, respectively, each of the toning materials of said second group of print heads being different in color than any ones of the toning materials of said first group; and controller which controls said first and second groups of print heads, said controller controlling at least one of said first and second groups of heads at a plurality of levels.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 10 describes data output from dither processing portion 114.

FIGS. 11, 12, 13, and 14 describe respective compositions of normal yellow ink, normal magenta ink, normal cyan ink and normal black ink.

FIGS. 15, 16, 17 and 18 describe respective compositions of photo yellow ink, photo magenta ink, photo cyan ink and photo black ink.

FIGS. 23–36 show patterns of matrixes for tones 0–65.

FIGS. 38–40 show patterns of matrixes for tones 0–14 for Comparative Example 1-1.

FIGS. 41–43 show patterns of matrixes for tones 0–14 for Comparative Example 1-2.

FIGS. 49, 50, 51, and 52 describe respective compositions of normal yellow ink, normal magenta ink, normal cyan ink and normal black ink in Embodiment 2-1.

FIGS. 53, 54, 55 and 56 describe respective compositions of photo yellow ink, photo magenta ink, photo cyan ink and photo black ink in Embodiment 2-1 of the present invention.

FIG. 72 describes effects of Embodiments 2-1 to 2-4.

FIGS. 78–84 show patterns for tones 0–31.

FIG. 122 describes evaluations of images by ink jet printers as Examples 4-1 to 4-3 on a recording sheet and images printed by ink jet printers as Conventional Examples 4-1 and 4-2 on a recording sheet.

FIGS. 132, 133 and 134 describe respective compositions of Bo ink, Go ink and Ro ink according to an embodiment of the present invention.

FIGS. 150, 151, 152 and 153 describe respective compositions of Mpo ink, Cpo ink, Ypo ink and Kpo ink according to Embodiment 6-1 of the present invention.

FIG. 156 is a view illustrating the types of dots for illustrating a dot pattern of an embodiment of the present invention.

FIG. 158 describes an effect of the present invention when the content by percentage of a penetrant is changed.

FIG. 162 describes an effect of the present invention when the amount of a penetrant is changed.

DESCRIPTION OF THE PREFERRED EMBODIMENTS

Embodiment 1-1

An ink jet printer according to Embodiment 1-1 of the present invention will now be described with reference to the drawings.

Figure 1:
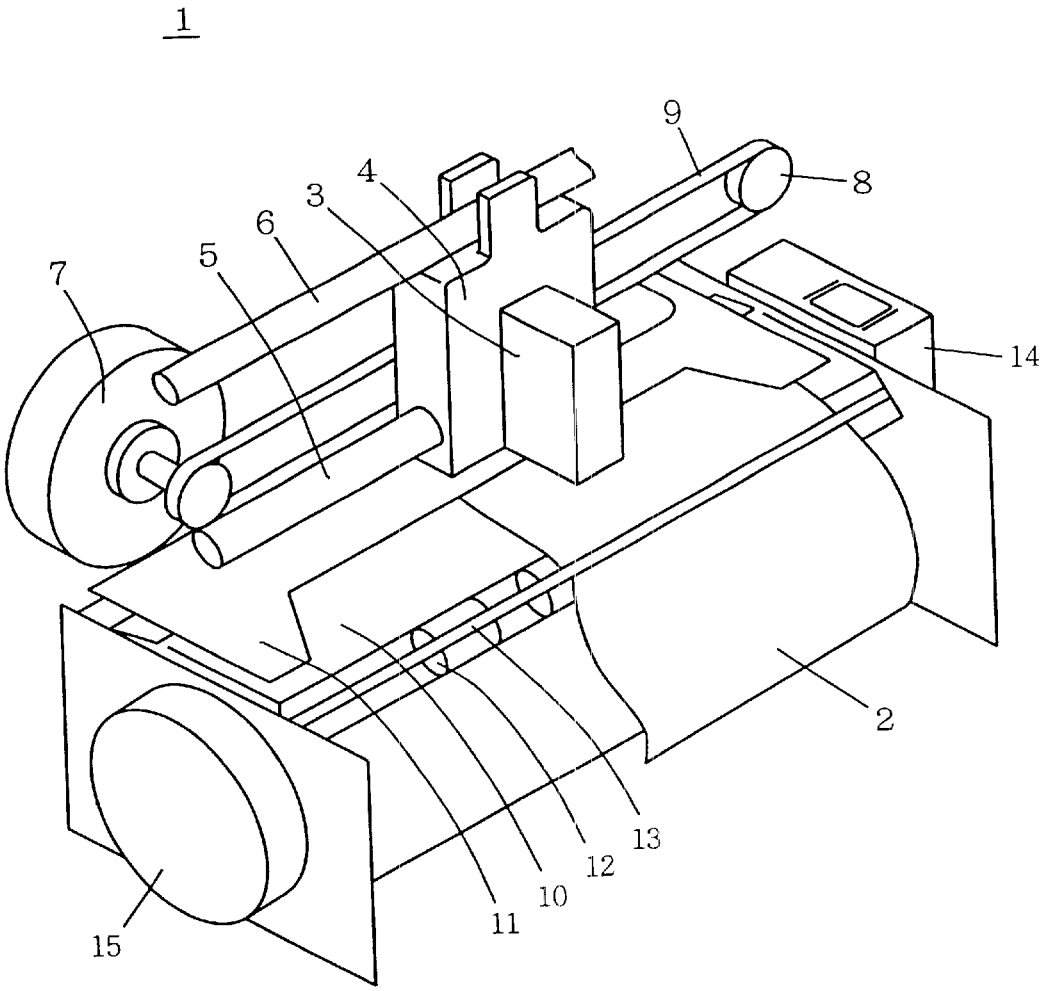
FIG. 1 is a perspective view of an ink jet printer according to Embodiment 1-1 of the present invention.

FIG. 1 is a perspective view schematically showing a structure of an ink jet printer 1 according to Embodiment 1-1 of the present invention.

Ink jet printer 1 is for printing an ink image on a recording sheet 2 as a recording medium, such as a printing sheet and a thin plastic film. Ink jet printer 1 includes a printer head 3 as an ink jetting printer head, a carriage 4 which holds printer head 3, sliding axes 5 and 6 for reciprocating carriage 4 in parallel with a recording side of recording sheet 2, a driving motor 7 for reciprocating carriage along sliding axes 5 and 6, a timing belt 9 for transforming the revolution of driving motor 7 into reciprocation of carriage 4, and an idle pulley 8.

Ink jet printer 1 also includes a platen 10 also serving as a guide plate which guides recording sheet 2 along a transporting path, a sheet presser plate 11 which presses recording sheet 2 between sheet presser plate 11 and platen 10 to prevent rising of recording sheet 2, a discharger roller 12 for discharging recording sheet 2, a spurring roller 13, a recovery system 14 which washes the nozzle surface of printer head 3 for jetting ink to recover a satisfactory amount of ink jetted, and a sheet feeding knob 15 for manually feeding recording sheet 2.

Recording sheet 2 is delivered by manual feeding or a sheet feeder device, such as a cut sheet feeder, to a recording portion at which printer head 3 and platens 10 are opposed to each other. Meanwhile, the revolution of a sheet feeding roller (not shown) is controlled to control sheet transportation to the recording portion.

A piezoelectric element (PZT) is applied in printer head 3. The piezoelectric element receives voltage and is thus distorted. The distortion changes the volume of a channel filled with ink. The change of the volume allows the ink to be jetted from a nozzle provided at the channel and an image is thus recorded on recording sheet 2.

Carriage 4 provides main scanning by means of driver motor 7, idle pulley 8 and timing belt 9 in the lateral direction of recording sheet 2 (i.e., the transverse direction of recording sheet 2), and printer head 3 mounted to carriage 4 records one line of an image. Each time one line of an image is completely recorded, recording sheet 2 is fed in the longitudinal direction and is subjected to subscanning and the next line of the image is recorded thereon.

Thus, an image is recorded on recording sheet 2. Recording sheet 2 passing through the recording portion is discharged by discharging roller 12 arranged downstream of the direction in which recording sheet 2 is transported and by spurring roller 13 abutting against discharging roller 12.

Figure 2:
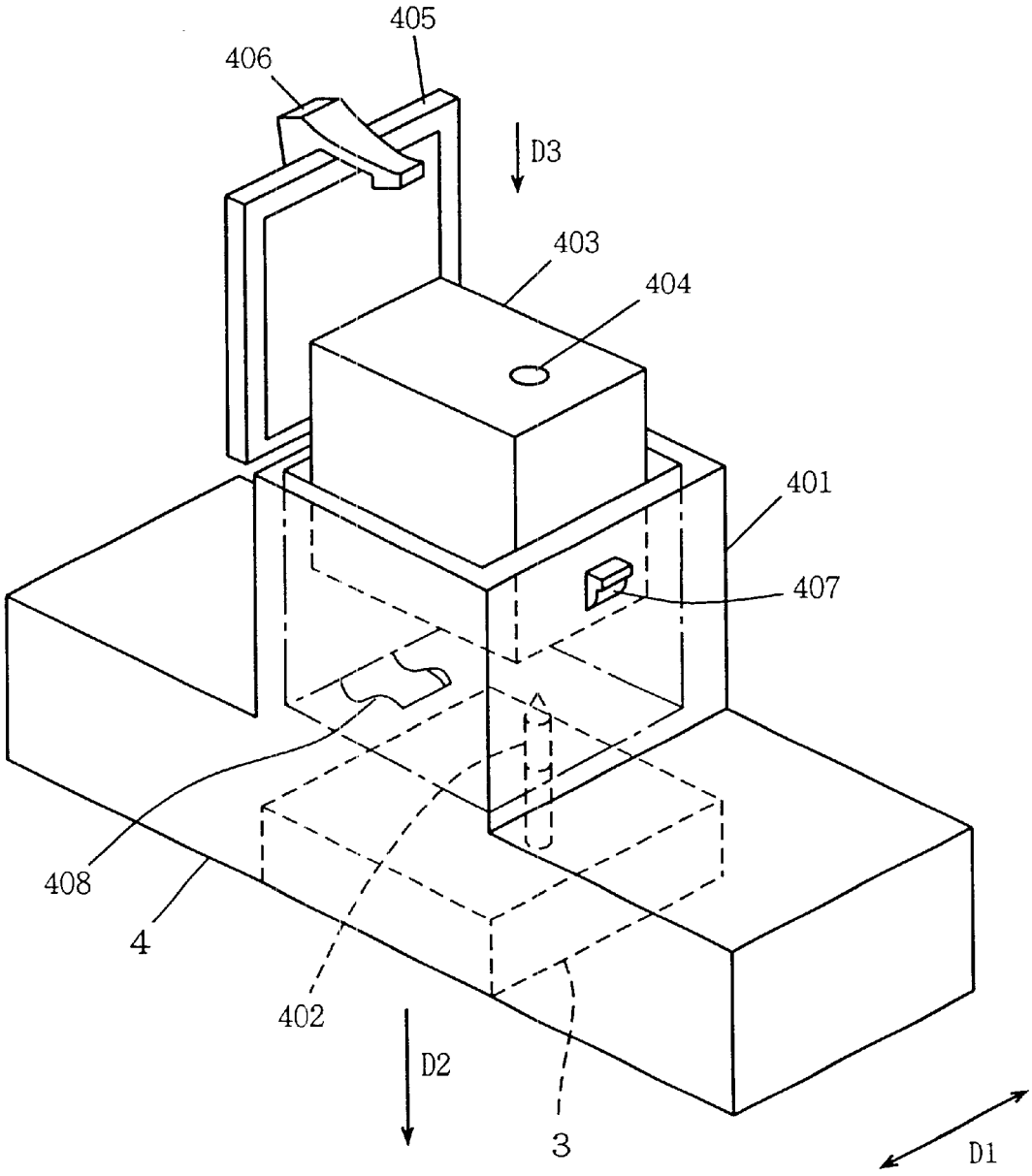
FIG. 2 is a perspective view of a printer head 3 shown in FIG. 1.

FIG. 2 is a perspective view showing a configuration a periphery of carriage 4.

Included in the periphery of carriage 4 are: a casing 401 for housing an ink cartridge 403 for storing ink; a lid 405 of casing 401; an ink receiver and feeder pin 402 which renders ink cartridge 403 removable and also receives and feeds ink to printer head 3; a biased clutch 406 for fixing lid 405 to casing 401 when lid 405 is closed; a biased clutch stopper 407; and a plate spring 408 which cooperates with lid 405 to hold ink cartridge 403 while pressing ink cartridge 403 in the direction opposite to the direction in which ink cartridge 403 is housed (i.e., the direction of arrow D3). When carriage 4 is moved in the direction of arrow D1 shown in the figure, main scanning is provided and ink drops are jetted in the direction of arrow D2.

Figure 3:
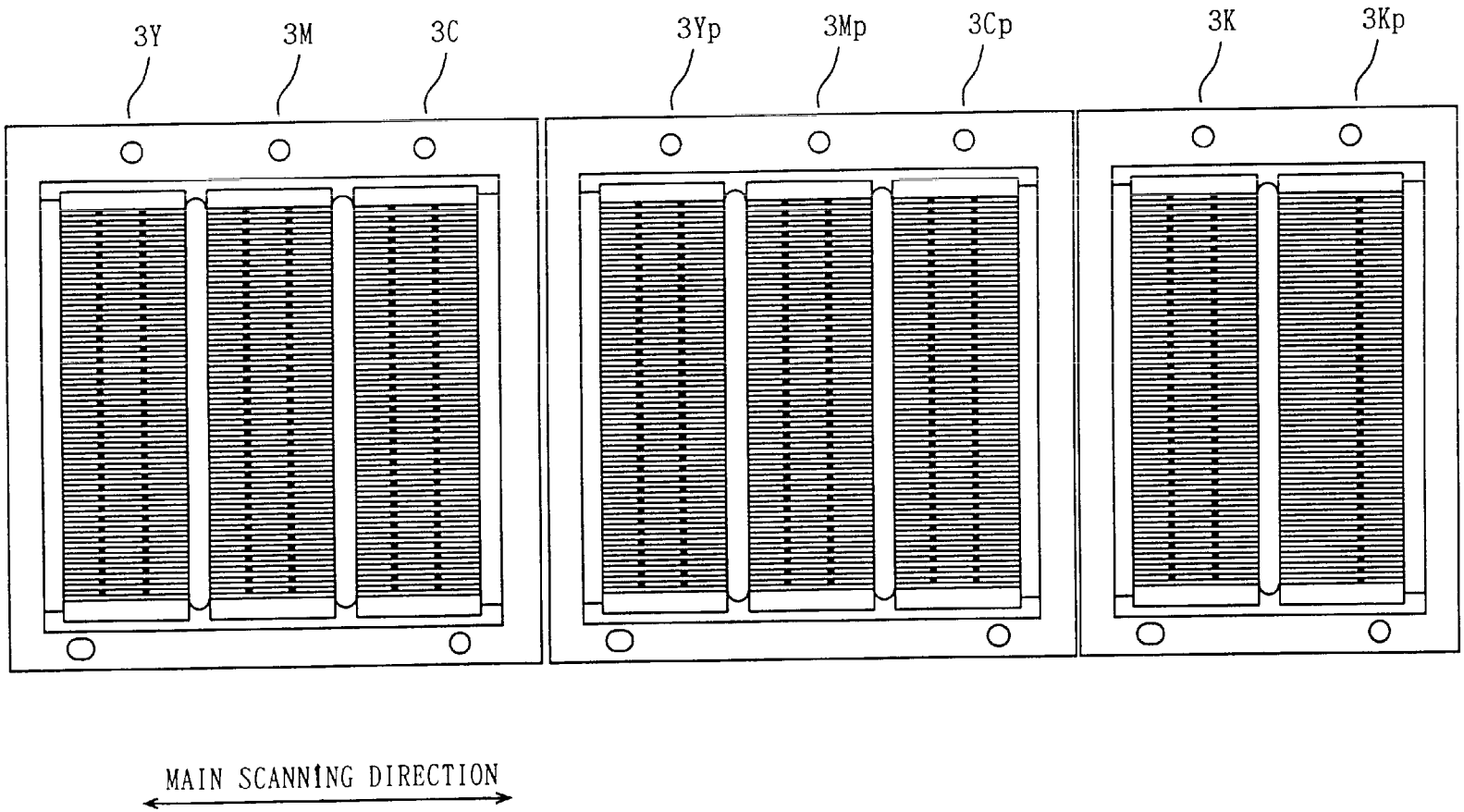
FIG. 3 is a plan view of printer head 3 seen from the nozzle side.

FIG. 3 shows the FIG. 1 printer head 3 at a side provided with a nozzle.

Printer head 3 shown in the FIG. 3 includes: a head 3Y for yellow ink, a head 3M for magenta ink and a head 3C for cyan ink which jet normal ink of yellow, magenta and cyan, respectively; a head Yp for yellow photo ink, a head Mp for magenta photo ink and a head Cp for cyan photo ink which jet photo ink of yellow, magenta and cyan, respectively; and a head 3K for black ink which jets normal ink of black and a head 3Kp for black photo ink which jets photo ink of black.

It should be noted that normal ink here refers to ink with normal tone and photo ink here refers to ink which is lighter in tone than normal ink.

The present embodiment employs both normal ink and photo ink with respect to yellow color. However, yellow ink has a low stimulation value for human eye, or human eye is less sensitive to yellow ink. Accordingly, even if photo yellow ink and a head therefor, such as driver and the like, are not provided, images can be printed without significantly degrading their image quality (particularly tone) and thus photo yellow ink is not necessarily required.

Figure 4:
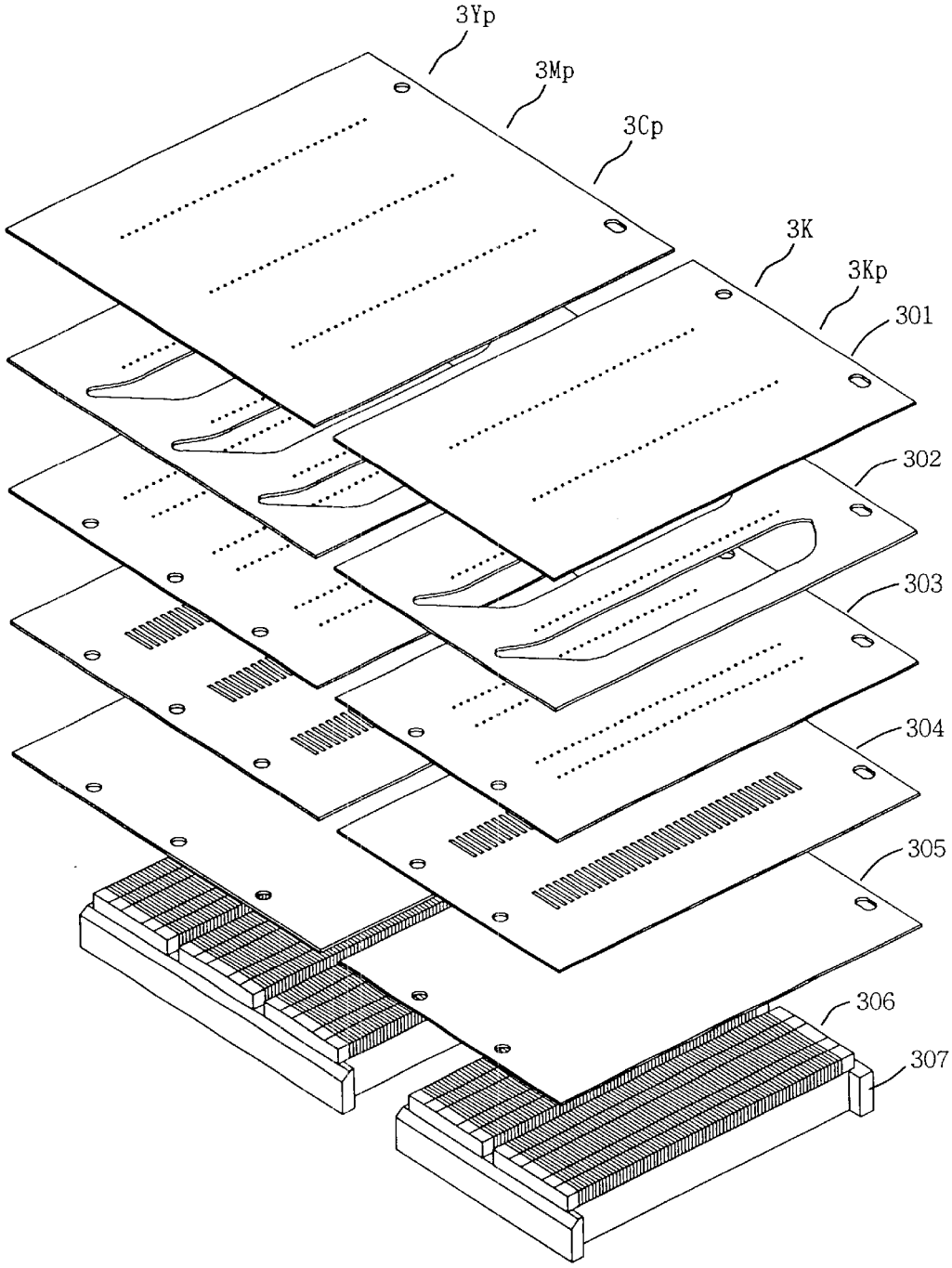
FIG. 4 is an exploded, perspective view of printer head 3.
Figure 5:
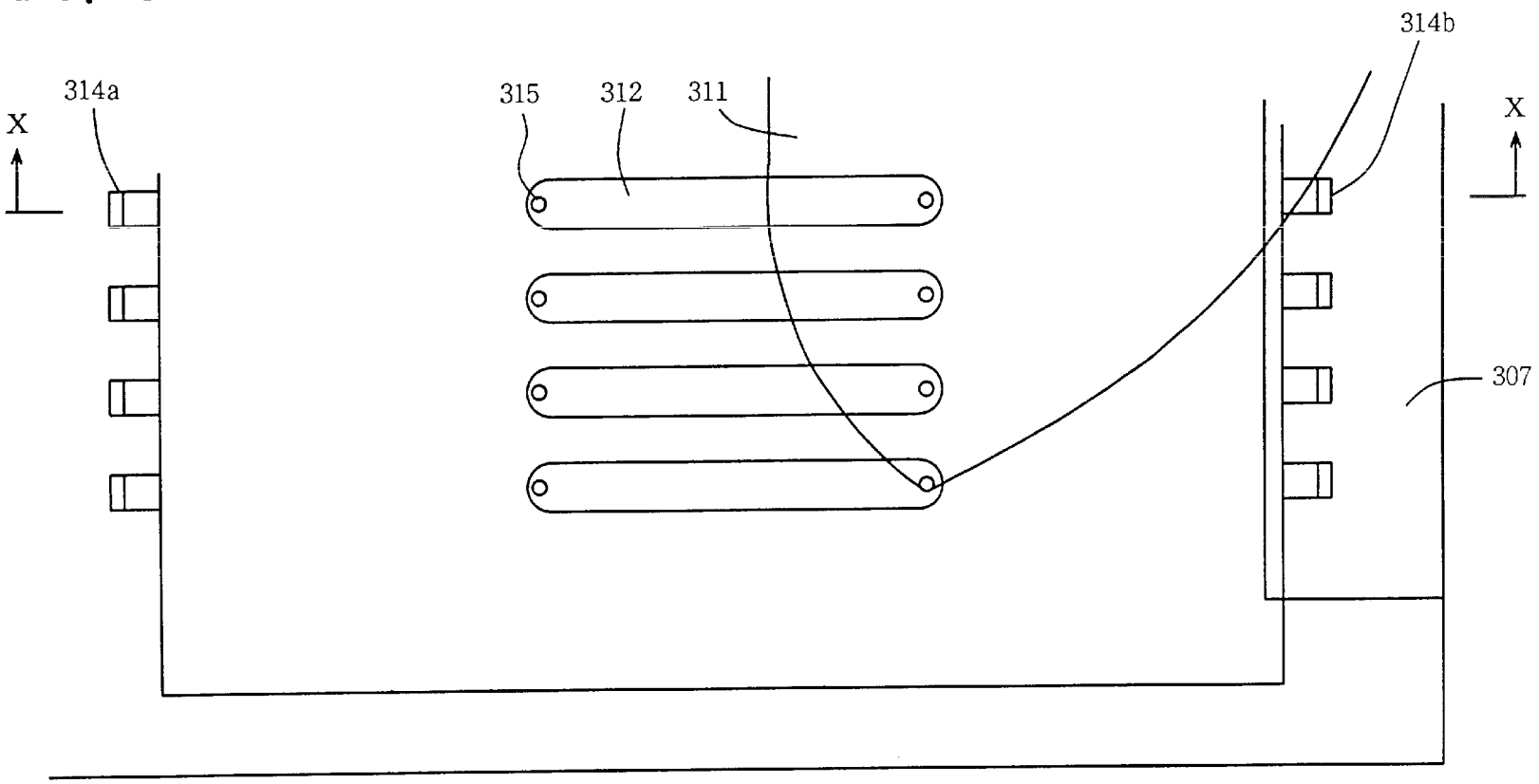
FIG. 5 is a plan view for describing an ink path within printer head 3.
Figure 6:
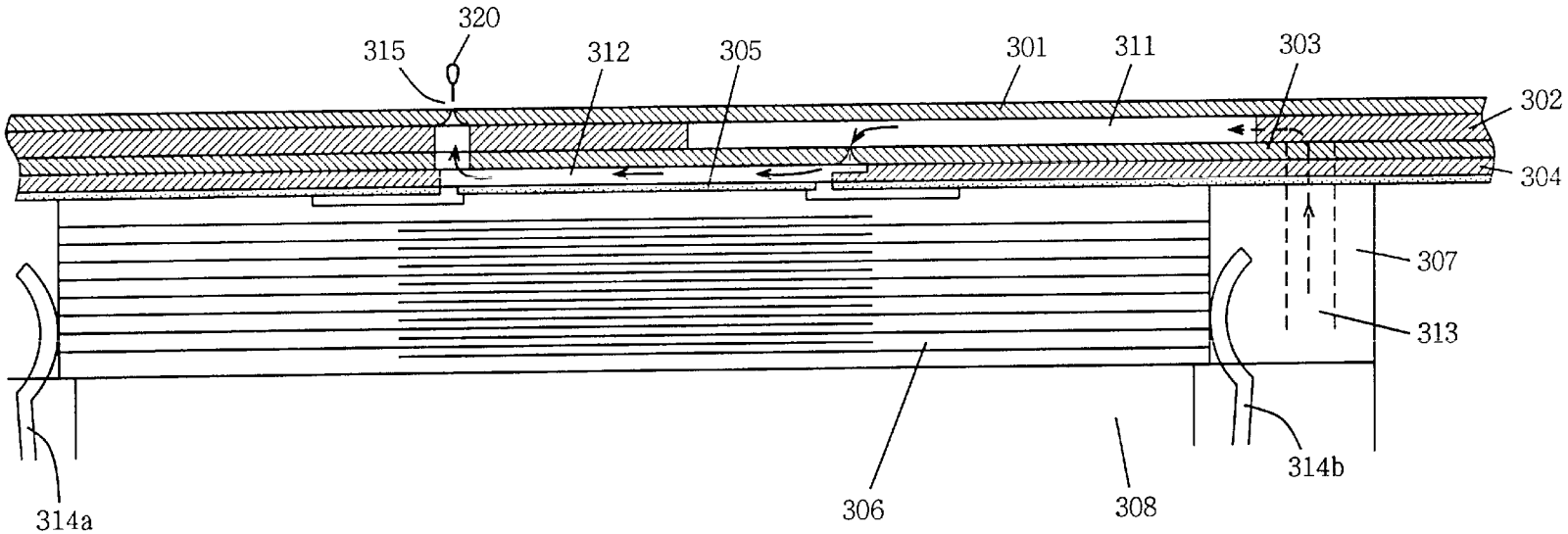
FIG. 6 is a cross section taken along line X—X of FIG. 5.

FIG. 4 is an exploded perspective view of a portion of printer head 3 shown in FIG. 3. FIG. 5 is a plan view of a printer head 3 seen at nozzle plate 301, for describing a flow of ink in printer head 3. FIG. 6 is a cross section taken along line X—X of FIG. 5.

Referring to the figures, the printer head has a head holder 307, a piezoelectric element (PZT) 306, a diaphragm 305, a channel plate 304, an inlet plate 303, a common ink chamber plate 302, and a nozzle plate 301 deposited from the bottom.

PZT 306 is connected to a lead frame 314*a,* 314*b.*

As shown in FIG. 6, the deposition of all the parts allows an ink introducing path 313, common ink chamber 311, ink chamber 312 and nozzle 315 to form a series of spaces. Ink flows through the series of spaces and ink 320 is jetted via nozzle 315 onto recording sheet 2 to form an image.

The ink flow in printer head 3 will now be described with reference to FIGS. 5 and 6.

Ink is supplied from ink cartridge 403 (FIG. 2) via ink receiver and feeder pin 402 (FIG. 2) to printer head 3. Via ink introducing path 313 in the printer head, the ink is introduced into common ink chamber 311. The ink in the common ink chamber is sent to ink chamber 312.

When voltage is applied between lead frames 314*a* and 314*b,* PZT 306 is deformed in a thickness direction of the PZT 306. The volume of ink chamber 312 is thus reduced and ink 320 is jetted towards recording sheet 2 (FIG. 1) via nozzle 315.

The degree of deformation of PZT 306 changes in proportion to the voltage applied to PZT 306. Accordingly, the voltage applied can be controlled to control the amount of ink jetted with one deformation of the PZT and thus change the diameter of a dot printed on the recording sheet.

Figure 7:
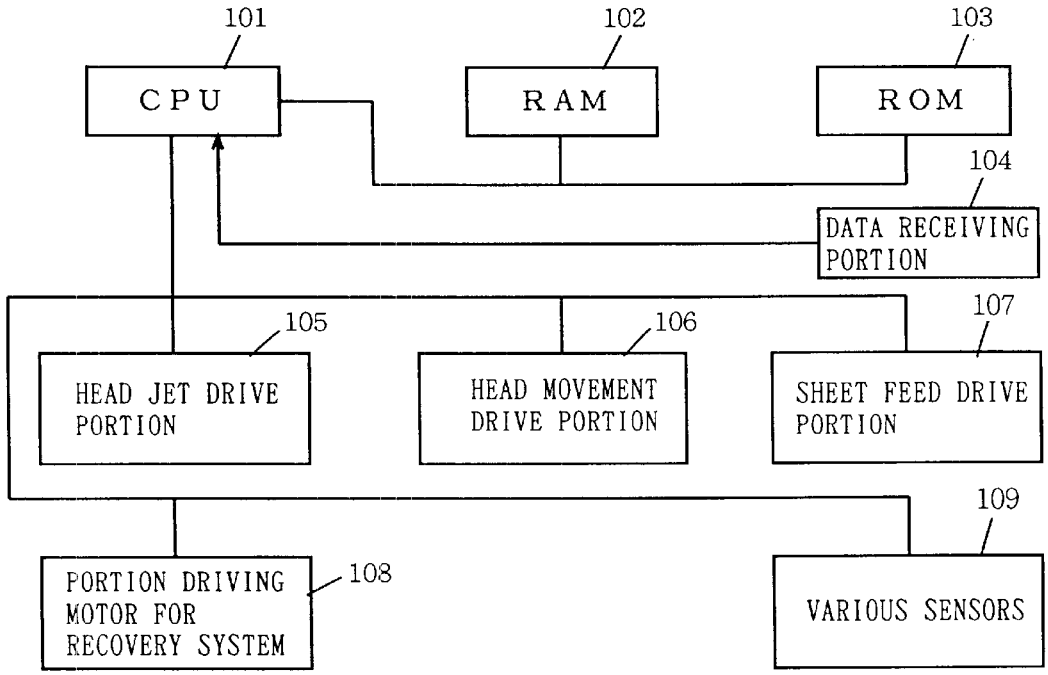
FIG. 7 is a block diagram showing a control circuit of the ink jet printer.

FIG. 7 is a block diagram schematically showing a control portion of ink jet printer 1.

The control portion of ink jet printer 1 includes a CPU 101, a RAM 102, a ROM 103, a data receiver portion 104, a head jet drive portion 105, a head movement driver portion 106, a sheet feed driver portion 107, a driver portion 108 for a motor of a recovery system, and various sensors 109.

CPU 101, which provides general control, uses RAM 102 as required and runs a program stored in ROM 103. The program includes: a portion based on image data read from data receiver portion 104 for controlling head jet driver portion 105, head movement driver portion 106, sheet feed driver portion 107 and various sensors 109 to record an image on recording sheet 2; and a portion which controls driver portion 108 for a motor of a recovery system and various sensors 109 to recover the nozzle surface of printer head 3 to a satisfactory condition.

Data receiver portion 104 is connected to an host computer or the like to receive image data to be recorded.

According to a control from CPU 101, head jet driver portion 105 drives PZT 306 of printer head 3, head movement driver portion 106 drives driver motor 7 for moving carriage 4 holding printer head 3 in the lateral direction, and sheet feed driver portion 107 drives a sheet feeding roller. According to a control from CPU 101, driver portion 108 for a motor of a recovery system drives a motor and the like required for recovering a satisfactory condition of the nozzle surface of printer head 3.

Figure 8:
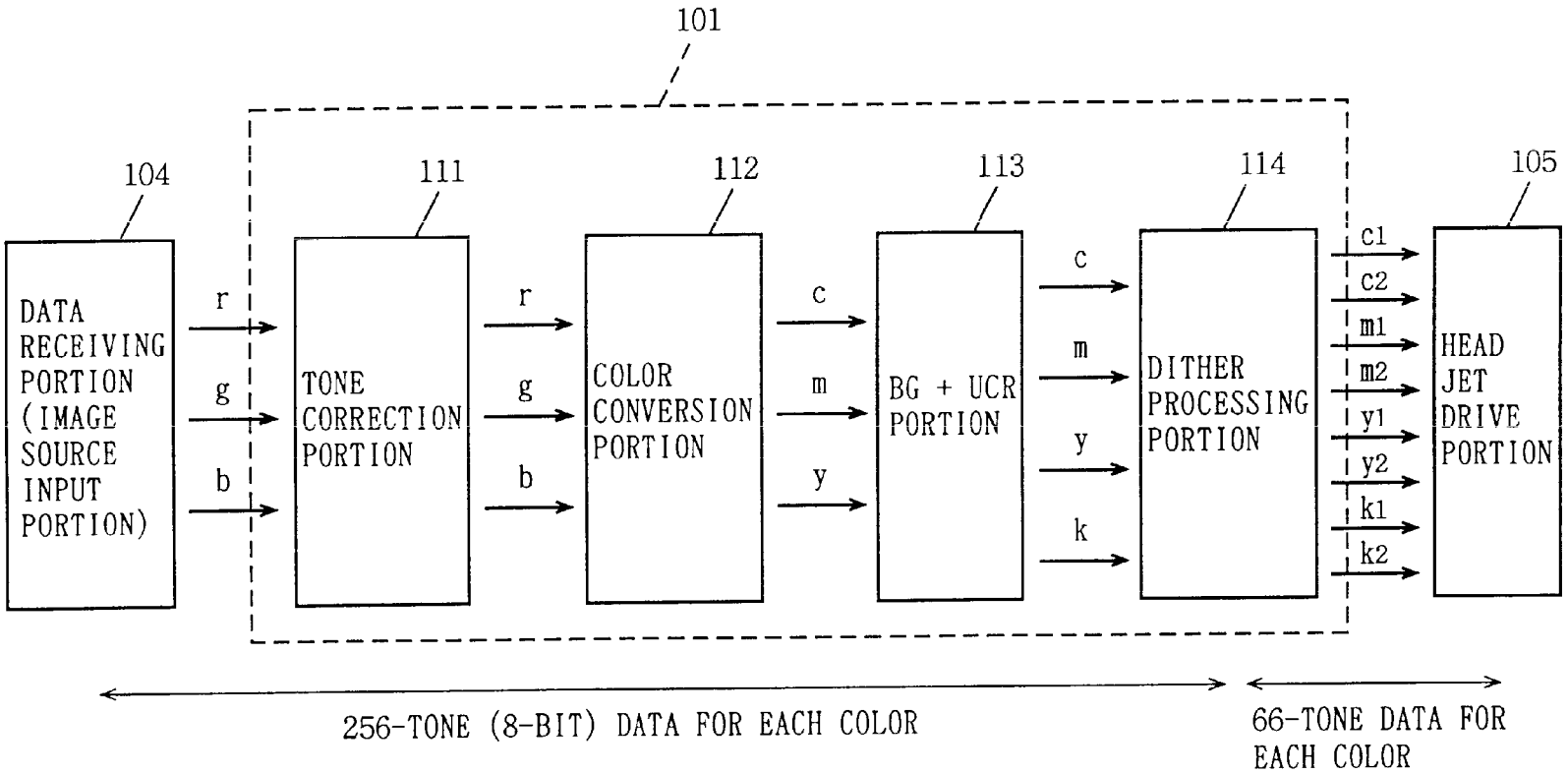
FIG. 8 is a block diagram showing a specific configuration of a CPU 101 shown in FIG. 7.

FIG. 8 is a block diagram showing a configuration of CPU 101 shown in FIG. 7.

CPU 101 shown in FIG. 8 includes: a tone correction portion 111 which receives signals r, g and b corresponding to red, green and blue colors from data receiver portion (an image source input portion) 104 and provides tone correction to the signals; a color conversion portion 112 which converts the data of r, g, and b to which tone correction has been applied into data of signals c, m and y corresponding to cyan, magenta and yellow colors; a black generation (BG)+under-color removal (UCR) portion 113 which separates gray component from the converted signals of the three colors, replaces the gray component with a black signal and outputs data k corresponding to black color; and a dither processing portion 114 which applies dither processing to the data and outputs data for normal color and data for photo color for each color.

Head jet driver portion 105 receives data to which dither processing has been applied. Head jet driver portion 105 drives each color head.

Figure 9:
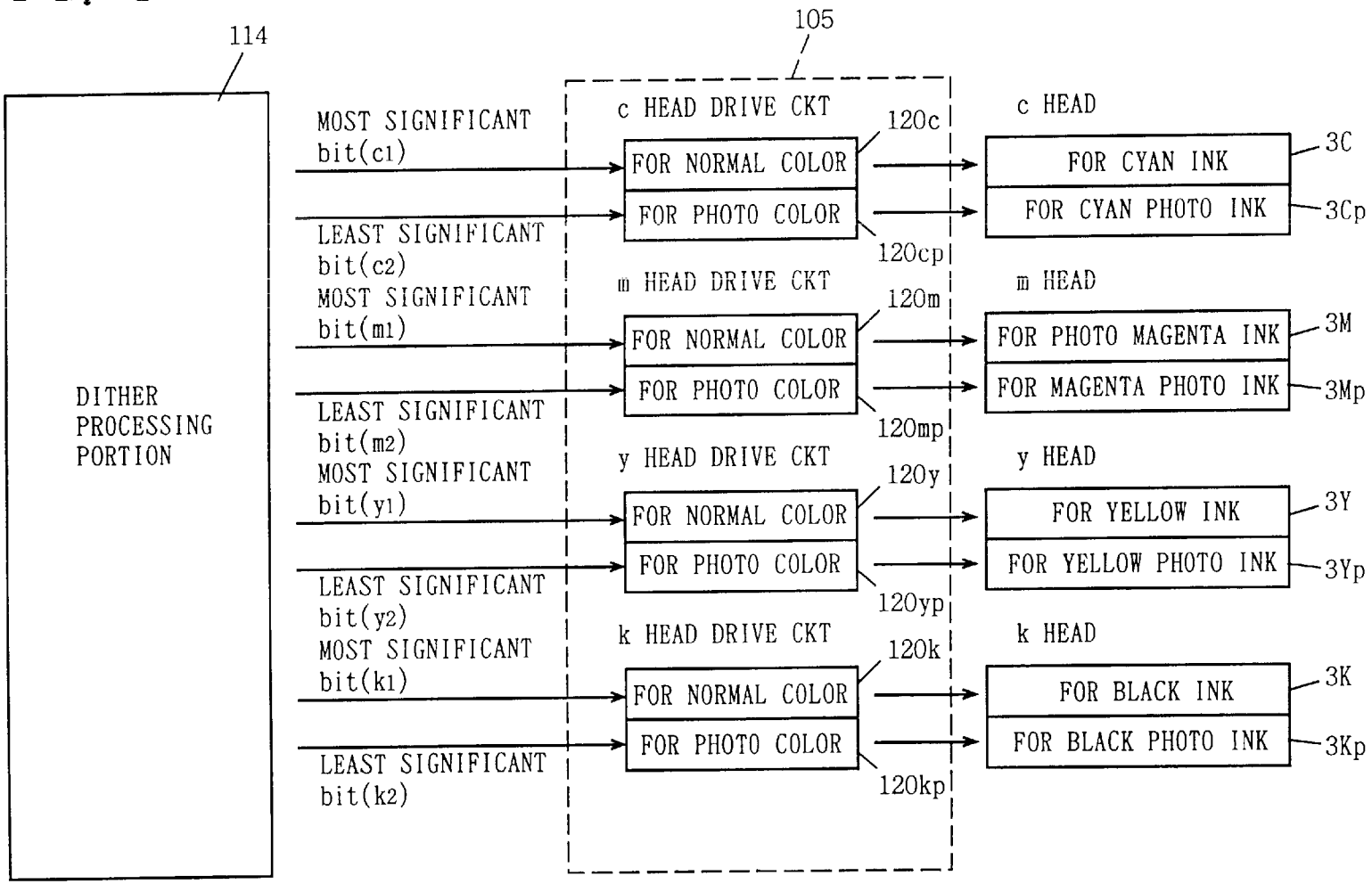
FIG. 9 is a block diagram showing a configuration of a dither processing portion 114, a head jet drive portion 105 and each color head.

FIG. 9 is a block diagram illustrating a relation between the FIG. 8 dither processing portion 114, FIG. 8 head jet driver portion 105 and each color head.

Referring to the figure, head jet driver portion 105 includes a driver circuit **120*c* for normal color which drives a head 3C for cyan ink, a driver circuit 120*cp* for photo color which drives a head 3Cp for cyan photo ink, a driver circuit 120*m* for normal color which drives a head 3M for magenta ink, a driver circuit 120*mp* for photo color which drives a head 3Mp for magenta photo ink, a driver circuit 120*y* for normal color which drives a head 3Y for yellow ink, a driver circuit 120*yp* for photo color which drives a head 3Yp for yellow photo ink, a driver circuit 120*k* for normal color which drives a head 3K for black ink, and a driver circuit 120*kp* for photo color which drives a head 3**Kp for black photo ink.

The driver circuits receive from dither processing portion 114 data $c_1$, $c_2$, $m_1$, $m_2$, $y_1$, $y_2$, $k_1$ and $k_2$, respectively, for driving their respective heads.

The data corresponding to one color input to a driver circuit for normal color and a driver circuit for photo color is included in a most significant bit and a least significant bit of one data.

More specifically, referring to FIG. 10, a most significant bit and a least significant bit of data input to a driver circuit are input to a driver circuit for normal color and a driver circuit for photo color, respectively.

FIG. 11 describes a composition of normal yellow ink used in an ink jet printer of the present embodiment.

The normal yellow ink contains water of 74.5%, polyhydric alcohol/diethylene glycol (DEG) of 11%, polyhydric alcohol ether/triethylene glycol monobutyl ether (TGB) of 6.5%, and a thickener/polyethelene glycol (PEG) #400 of 4.5% as the solvent. It also contains dye/Bayer Y-CA 51092 of 2.5% as a coloring material. It also contains a surfactant/Olfine E1010 of 0.8% and a pH adjusting agent/$NaHCO_3$ of 0.2% as additives.

FIG. 12 describes a composition of normal magenta ink used in an ink jet printer of the present embodiment.

The normal magenta ink contains water of 74.5%, polyhydric alcohol/PEG of 11%, polyhydric alcohol/TGB of 6.5%, and a thickener/PEG #400 of 4.5% as the solvent. It also contains a dye/BASF RED FF-3282 of 2.5% as a coloring material. It also includes a surfactant/Olfine E1010 of 0.8%, and a pH adjusting agent/$NaHCO_3$ of 0.2% as additives.

FIG. 13 describes a composition of normal cyan ink used in an ink jet printer of the present embodiment.

The normal cyan ink contains water of 74%, polyhydric alcohol/DEG of 11%, polyhydric alcohol/TGB of 6.5%, a thickener/PEG #400 of 4.5% as the solvent. It also contains a dye/Bayer CY-BG of 3.0% as a coloring material. It also contains a surfactant/Olfine E1010 of 0.8%, and a pH adjusting agent/$NaHCO_3$ of 0.2% as additives.

FIG. 14 describes a composition of normal black ink used in an ink jet printer of the present embodiment.

The normal black ink contains water of 77.9%, polyhydric alcohol/DEG of 6.0%, polyhydric alcohol ether/TGB of 6.0%, and a thickener/PEG #400 of 4.5% as the solvent. It also contains a dye/Bayer BK-SP of 4.6% as a coloring material. It also contains a surfactant/Olfine E1010 of 0.8%, and a pH adjusting agent $NaHCO_3$ of 0.2% as additives.

FIG. 15 describes a composition of photo yellow ink used in an ink jet printer of the present embodiment.

The photo yellow ink contains water of 76.3%, polyhydric alcohol/DEG of 11%, polyhydric alcohol ether/TGB of 6.5%, a thickener/PEG #400 of 4.5% as the solvent. It also contains a dye/Bayer Y-CA 51092 of 0.7% as a coloring material. It also contains a surfactant/Olfine E1010 of 0.8%, and a pH adjusting agent/$NaHCO_3$ of 0.2% as additives.

FIG. 16 describes a composition of photo magenta ink used in an ink jet printer of the present embodiment.

The photo magenta ink contains water of 76.3%, polyhydric alcohol/DEG of 11.0%, polyhydric alcohol ether/TGB of 6.5%, a thickener/PEG #400 of 4.5% as the solvent. It also contains a dye/BASF RED FF-3282 of 0.7% as a coloring material. It also contains a surfactant/Olfine E1010 of 0.8% and a pH adjusting agent/$NaHCO_3$ of 0.2% as additives.

FIG. 17 describes a composition of photo cyan ink used in an ink jet printer of the present embodiment.

The photo cyan ink contains water of 76.2%, polyhydric alcohol/DEG of 11.0%, polyhydric alcohol ether/TGB of 6.5% and a thickener/PEG #400 of 4.5% as the solvent. It also contains a dye/Bayer CY-BG of 0.8% as a coloring material. It also contains a surfactant/Olfine E1010 of 0.8% and a pH adjusting agent/$NaHCO_3$ of 0.2% as additives.

FIG. 18 describes a composition of photo black ink used in an ink jet printer of the present invention.

The photo black ink contains water of 81.3%, polyhydric alcohol/DEG of 6.0%, polyhydric alcohol ether/TGB of 6.0% and a thickener/PEG #400 of 4.5% as the solvent. It also contains a dye/Bayer BK-SP of 1.2% as a coloring material. It also contains a surfactant/Olfine E1010 of 0.8% and a pH adjusting agent/$NaHCO_3$ of 0.2% as additives.

Figure 19:
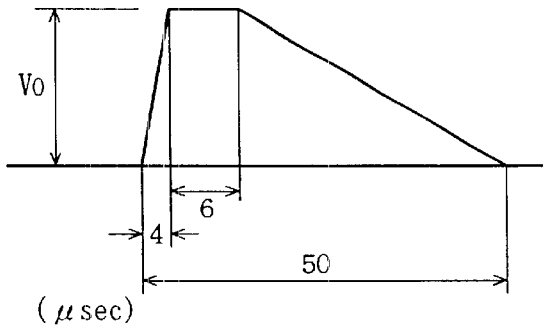
FIG. 19 is a waveform diagram of a voltage applied to PZT 306.

FIG. 19 shows a waveform of a pulse of a voltage applied to PZT 306.

Referring to the figure, PZT 306 receives a voltage $V_0$ which changes depending on the diameter of a dot to be printed. It requires four $\mu$sec from application of the voltage until the voltage reaches the value $V_0$. Thereafter, voltage $V_0$ is applied for 6 $\mu$sec. Then, 40 $\mu$sec is required for the voltage to reach 0. In other words, one pulse is applied for 50 $\mu$sec in total.

Figure 20:
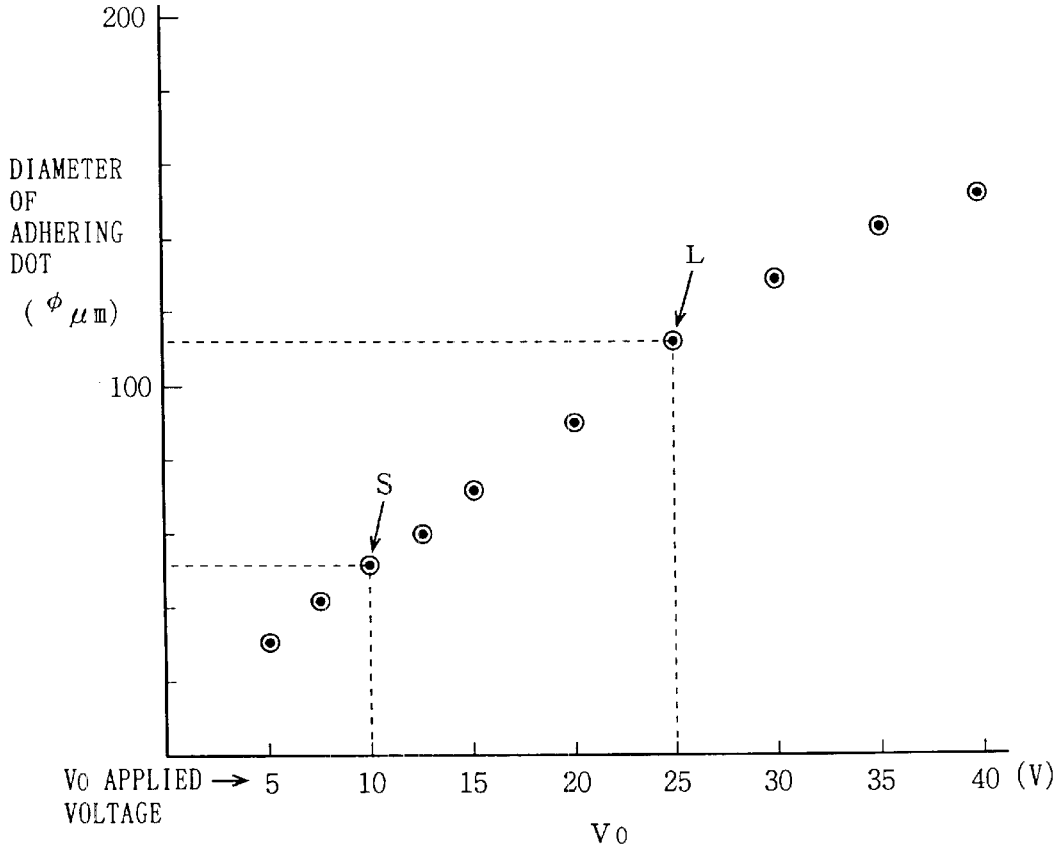
FIG. 20 represents a relation between a voltage applied to PZT 306 and the diameter of a dot adhering to a recording sheet 2.

FIG. 20 represents a relation between voltage $V_0$ applied to PZT 306 and the diameter ($\mu$m) of a dot adhering to recording sheet 2 due to the application of the voltage.

As shown in the figure, the diameter of an adhering dot increases as a voltage applied is increased.

Of a plurality of levels of applied voltage indicated in FIG. 20, the present invention adapts two levels of voltage, i.e., 10V and 25V. In the figure, a dot S is a dot printed with application of a voltage of 10V, and a dot L is a dot printed with application of a voltage of 25V.

Figure 21:
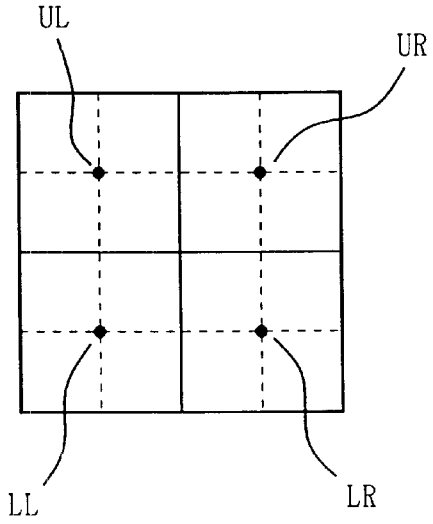
FIG. 21 is a view illustrating a matrix of 2×2 applied in Embodiment 1-1.

More specifically, a matrix of 2×2 shown in FIG. 21 is applied as a method of image tone reproduction in the present embodiment. More specifically, the tone of a single pixel is controlled depending on whether a dot is printed at any of the four positions of 2×2, the diameter of the dot printed, and whether normal ink or photo ink is used as the ink used for printing.

A dot is printed such that the center of the dot is placed at the center of each portion of the matrix. In FIG. 21, the center of the upper left portion of the matrix is denoted as UL, the center of the upper right portion as UR, the center of the lower left portion as LL and the center of the lower right portion as LR.

Figure 22:
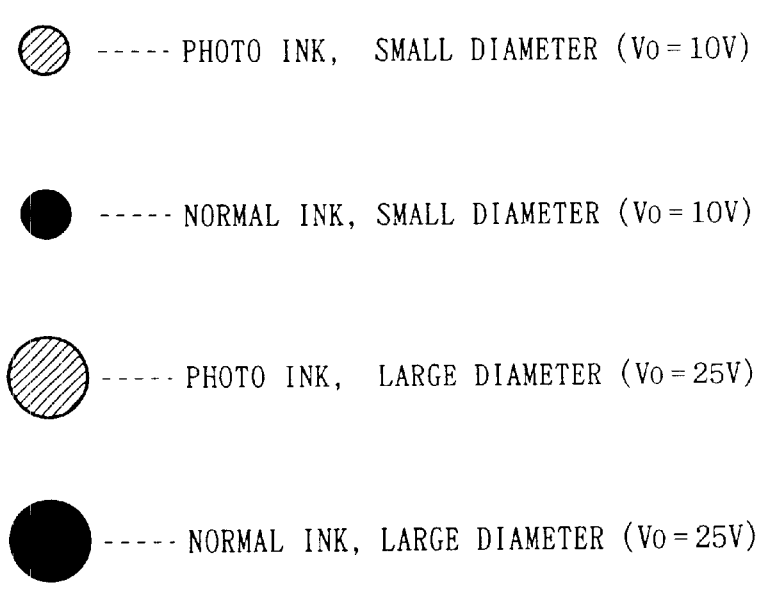
FIG. 22 illustrates the types of dots applied in Embodiment 1-1.
Figure 23:
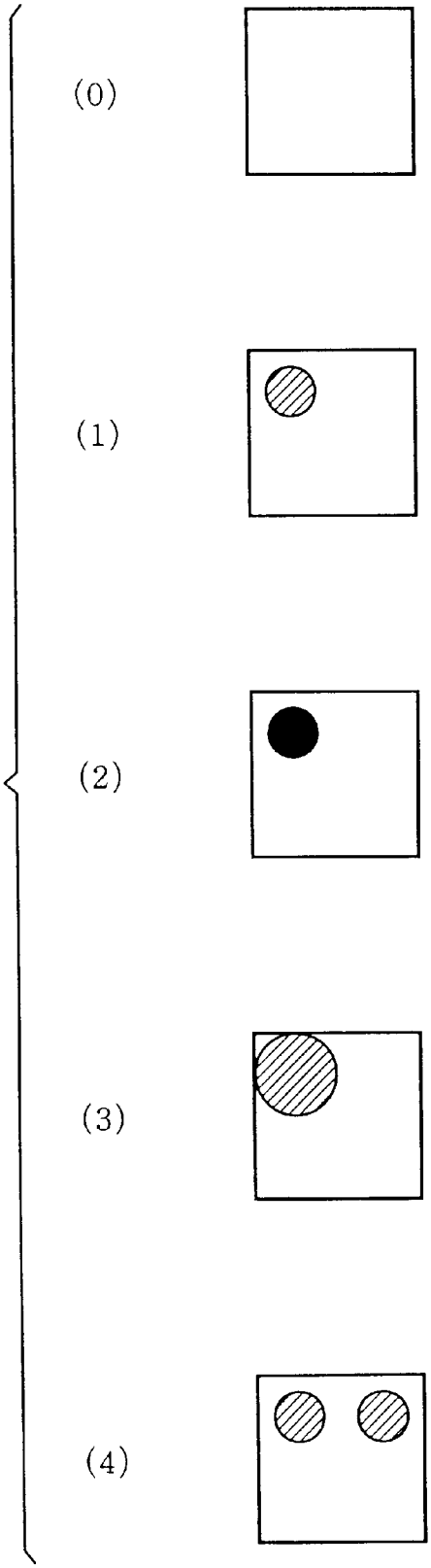
Figure 24:
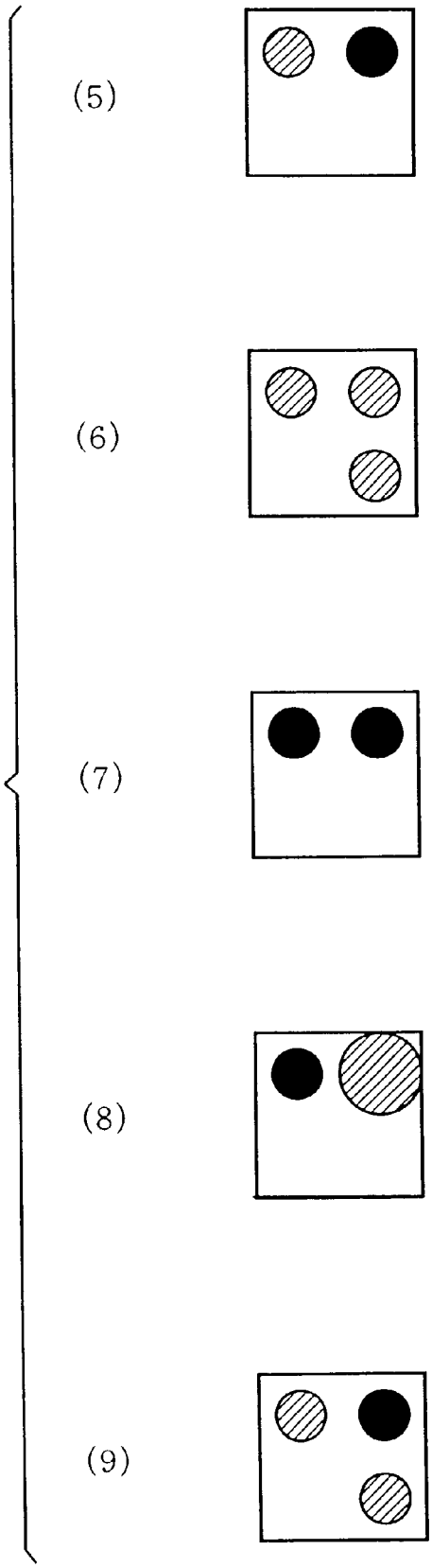
Figure 25:
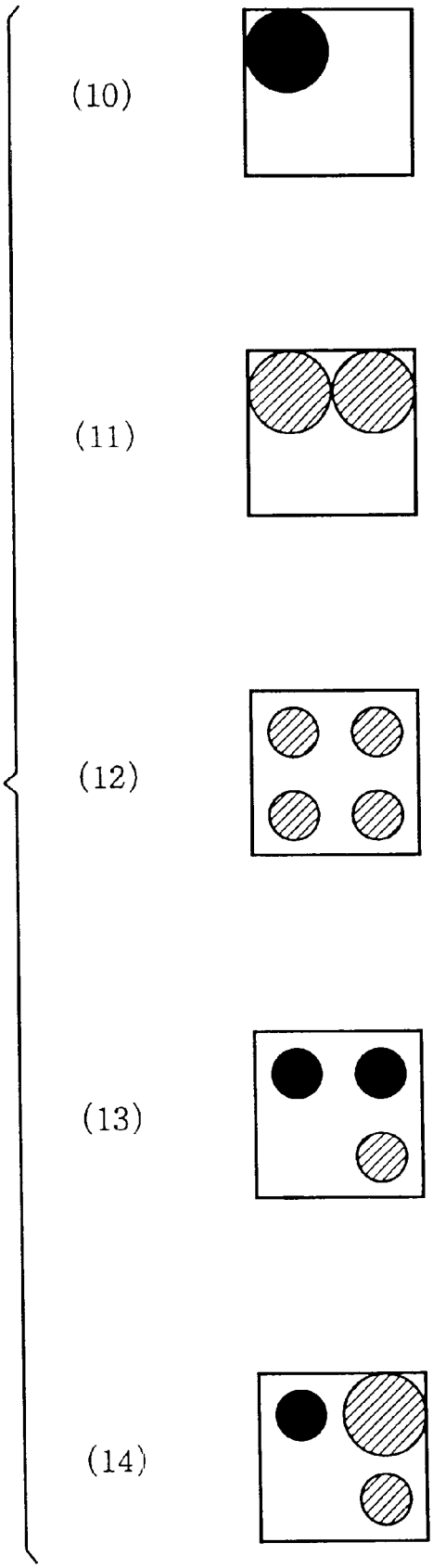
Figure 26:
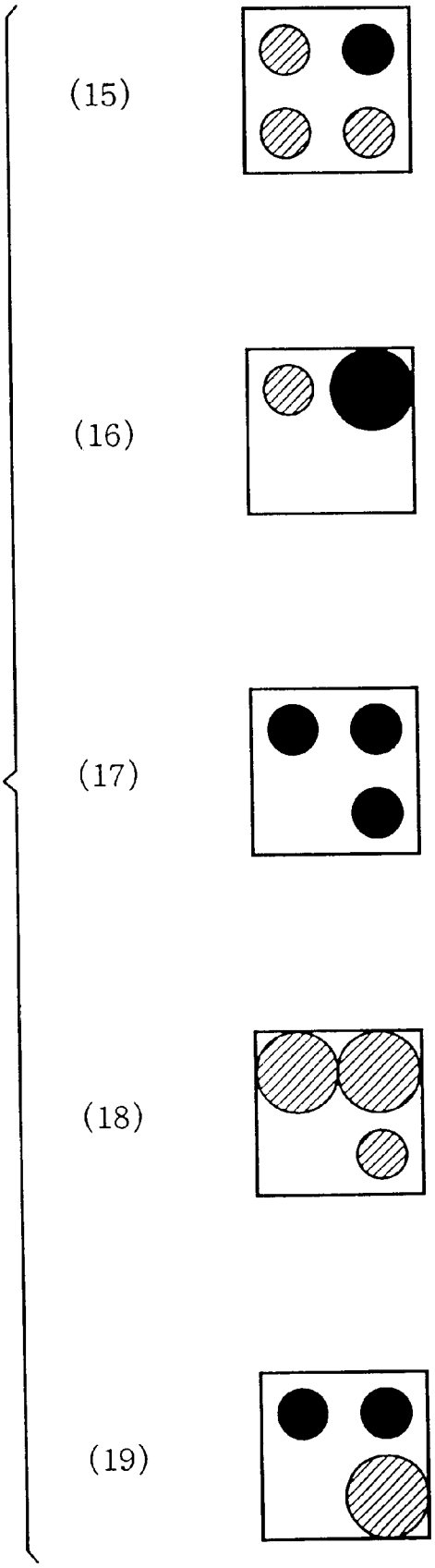
Figure 27:
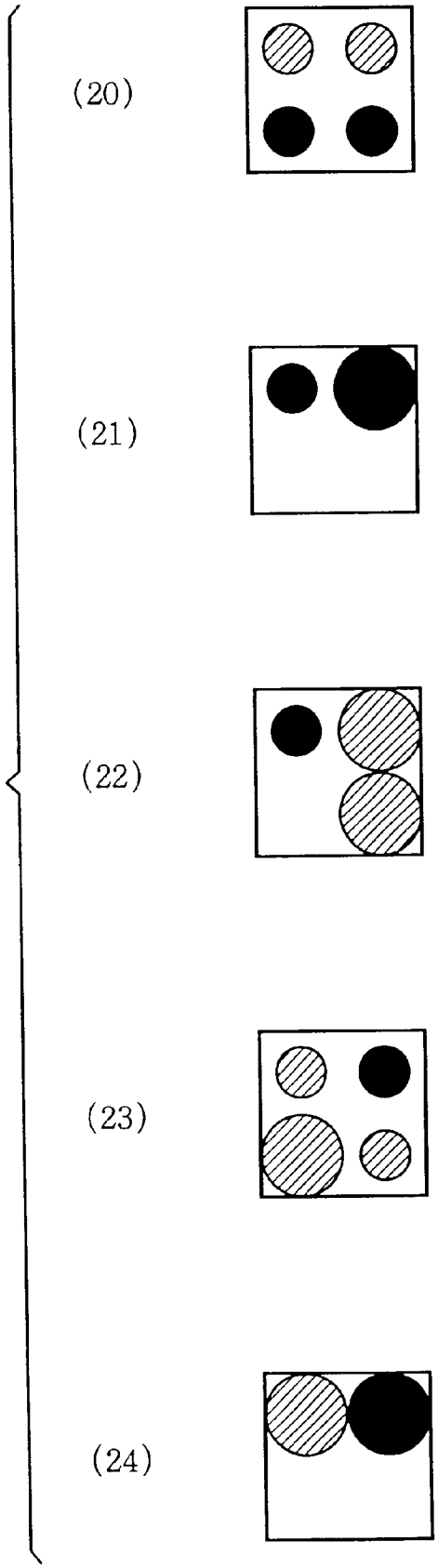
Figure 28:
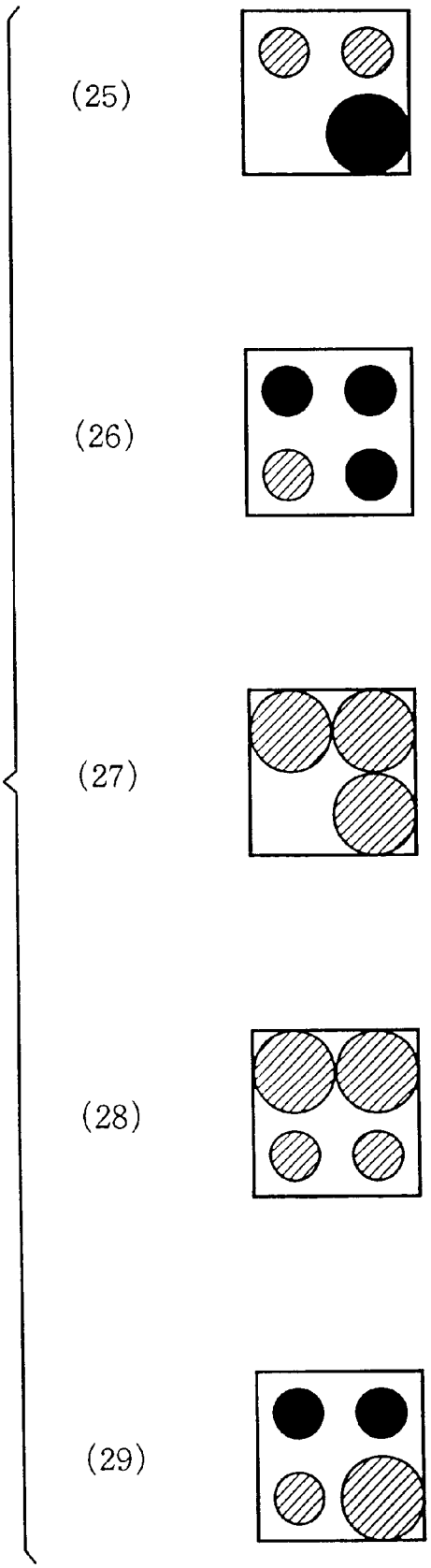

FIG. 22 shows the types of dots printed on the matrix shown in FIG. 21.

Referring to the figure, the types of dots includes a dot of a smaller diameter in photo ink (applied voltage:10V), a dot of the smaller diameter in normal ink (applied voltage:10V), a dot of a larger diameter in photo ink (applied voltage:25V), and a dot of the larger diameter in normal ink (applied voltage:25V).

The levels in optical density of the dots when they are printed separately are as follows: a dot of the smaller diameter in photo ink<a dot of the smaller diameter in normal ink<a dot of the larger diameter in photo ink<a dot of the larger diameter in normal ink.

FIGS. 23–36 show matrix patterns corresponding to tones applied in the present embodiment. In the figures, a square represents a matrix of 2×2 shown in FIG. 21 and a circle shown in a square is any of the four types of dots shown in FIG. 22. A number on the left side of a square refers to the tone of an pixel for which the matrix pattern is printed. The present embodiment can print 66 tones of tones 0–65.

The dots printed for their respective tones will now be described.

For tone 0, no dot is printed in the matrix.

For tone 1, a dot of smaller diameter in photo ink is printed in a matrix at the upper left position.

For tone 2, a dot of smaller diameter in normal ink is printed in a matrix at the upper left position.

For tone 3, a dot of larger diameter in photo ink is printed in a matrix at the upper left position.

For tone 4, a dot of smaller diameter in photo ink is printed in a matrix at each of the upper left and right positions.

For tone 5, a dot of smaller diameter in photo ink is printed in a matrix at the upper left position and a dot of smaller diameter in normal ink is printed in the matrix at the upper right position.

For tone 6, a tone of smaller diameter in photo ink is printed in a matrix at each of the upper left and right and lower right positions.

For tone 7, a dot of smaller diameter in normal ink is printed in a matrix at each of the upper left and right positions.

For tone 8, a dot of smaller diameter in normal ink is printed in a matrix at the upper left position and a dot of larger diameter in photo ink is printed in the matrix at the upper right position.

For tone 9, a dot of smaller diameter in photo ink is printed in a matrix at each of the upper left and lower right positions and a dot of smaller diameter in normal ink is printed in the matrix at the upper right position.

For tone 10, a dot of larger diameter in normal ink is printed in a matrix at the upper left position.

For tone 11, a dot of larger diameter in photo ink is printed in a matrix at each of the upper right and left positions.

For tone 12, a dot of smaller diameter in photo ink is printed in a matrix at each of the upper left and right and lower left and right positions.

For tone 13, a dot of smaller diameter in normal ink is printed in a matrix at the upper left and right positions and a dot of smaller diameter in photo ink is printed in the matrix at the lower right position.

For tone 14, a dot of smaller diameter in normal ink is printed in a matrix at the upper left position, a dot of larger diameter in photo ink is printed in the matrix at the upper right position, and a dot of smaller diameter in photo ink is printed in the matrix at the lower right position.

For tone 15, a dot of smaller diameter in photo ink is printed in a matrix at the upper and lower left and lower right positions and a dot of smaller diameter in normal ink is printed in the matrix at the upper right position.

For tone 16, a dot of smaller diameter in photo ink is printed in a matrix at the upper left position and a dot of larger diameter in normal ink is printed in the matrix at the upper right position.

For tone 17, a dot of smaller diameter in normal ink is printed in a matrix at each of the upper left and right and lower right positions.

For tone 18, a dot of larger diameter in photo ink is printed in a matrix at the upper left and right positions and a dot of smaller diameter in photo ink is printed in the matrix at the lower right position.

For tone 19, a dot of smaller diameter in normal ink is printed in a matrix at each of the upper left and right positions and a dot of larger diameter in photo ink is printed in the matrix at the lower right position.

For tone 20, a dot of smaller in photo ink is printed in a matrix at each of the upper left and right positions and a dot of smaller diameter in normal ink is printed in the matrix at each of the lower left and right positions.

For tone 21, a dot of smaller diameter in normal ink is printed in a matrix at the upper left position and a dot of larger diameter in normal ink is printed in the matrix at the upper right position.

For tone 22, a dot of smaller diameter in normal ink is printed in a matrix at the upper left position and a dot of larger diameter in photo ink is printed in the matrix at each of the upper and lower right positions.

For tone 23, a dot of smaller diameter in photo ink is printed in a matrix at each of the upper left and lower right positions, a dot of smaller diameter in normal ink is printed in the matrix at the upper right position, and a dot of larger diameter in photo ink is printed in the matrix at the lower left position.

For tone 24, a dot of larger diameter in photo ink is printed in a matrix at the upper left position and a dot of larger diameter in normal ink is printed in the matrix at the upper right position.

For tone 25, a dot of smaller diameter in photo ink is printed in a matrix at each of the upper left and right positions and a dot of larger diameter in normal ink is printed in the matrix at the lower right position.

For tone 26, a dot of smaller diameter in normal ink is printed in a matrix at each of the upper left and right and lower right positions and a dot of smaller diameter in photo ink is printed in the matrix at the lower left position.

For tone 27, a dot of larger diameter in photo ink is printed in a matrix at each of the upper left and right and lower right positions.

For tone 28, a dot of larger diameter in photo ink is printed in a matrix at each of the upper left and right positions and a dot of smaller diameter in photo ink is printed in the matrix at each of the lower left and right positions.

For tone 29, a dot of smaller diameter in normal ink is printed in a matrix at each of the upper left and right positions, a dot of smaller diameter in photo ink is printed in the matrix at the lower left position, and a dot of larger diameter in photo ink is printed in the matrix at the lower right position.

For tone 30, a dot of smaller diameter in photo ink is printed in a matrix at the upper left position, a dot of smaller diameter in normal ink is printed in the matrix at the upper right position, and a dot of larger diameter in normal ink is printed in the matrix at the lower right position.

For tone 31, a dot of smaller diameter in normal ink is printed in a matrix at each of the upper left and right and lower left and right positions.

For tone 32, a dot of smaller diameter in photo ink is printed in a matrix at the upper left position, a dot of smaller diameter in normal ink is printed in the matrix at the upper right position, and a dot of larger diameter in photo ink is printed in the matrix at each of the lower left and right positions.

For tone 33, a dot of smaller diameter in photo ink is printed in a matrix at the upper left position, a dot of larger diameter in photo ink is printed in the matrix at the upper right position, as a dot of larger diameter in normal ink is printed in the matrix at the lower right portion.

For tone 34, a dot of smaller diameter in normal ink is printed in a matrix at each of the upper left and right and lower right positions and a dot of larger diameter in photo ink is printed in the matrix at the lower left position.

For tone 35, a dot of smaller diameter in photo ink is printed in a matrix at each of the upper left and right and lower right positions and a dot of larger diameter in normal ink is printed in the matrix at the lower left position.

For tone 36, a dot of smaller diameter in normal ink is printed in a matrix at each of the upper left and right positions and a dot of larger diameter in normal ink is printed in the matrix at the lower right position.

For tone 37, a dot of smaller diameter in photo ink is printed in a matrix at the upper left position and a dot of larger diameter in photo ink is printed in the matrix at each of the upper right and lower left and right positions.

For tone 38, a dot of smaller diameter in normal ink is printed in a matrix at each of the upper left and right positions and a dot of larger diameter in photo ink is printed in the matrix at each of the lower left and right positions.

For tone 39, a dot of smaller diameter in normal ink is printed in a matrix at the upper left position, a dot of larger diameter in photo ink is printed in the matrix at the upper right position, and a dot of larger diameter in normal ink is printed in the matrix at the lower right position.

For tone 40, a dot of smaller diameter in photo ink is printed in a matrix at each of the upper left and right positions, a dot of larger diameter in normal ink is printed in the matrix at the lower left position, and a dot of smaller diameter in normal ink is printed in the matrix at the lower right position.

For tone 41, a dot of larger diameter in normal ink is printed in a matrix at each of the upper left and right positions.

For tone 42, a dot of smaller diameter in normal ink is printed in a matrix at the upper left position and a dot of larger diameter in photo ink is printed in the matrix at the each of the upper right and lower left and right positions.

For tone 43, a dot of large diameter in photo ink is printed in a matrix at each of the upper left and right positions and a dot of larger diameter in normal ink is printed in the matrix at the lower right position.

For tone 44, a dot of smaller diameter in photo ink is printed in a matrix at each of the upper left and right positions, a dot of larger diameter in normal ink is printed in the matrix at the lower left position, and a dot of larger diameter in photo ink is printed in the matrix at the lower right position.

For tone 45, a dot of smaller diameter in photo ink is printed in a matrix at the upper left position, a dot of smaller diameter in normal ink is printed in the matrix at each of the upper and lower right positions, and a dot of larger diameter in normal ink is printed in the matrix at the lower left position.

For tone 46, a dot of larger diameter in photo ink is printed in a matrix at each of the upper left and right and lower left and right positions.

For tone 47, a dot of smaller diameter in photo ink is printed in a matrix at the upper left position, a dot of smaller diameter in normal ink is printed in the matrix at the upper right position, a dot of larger diameter in photo ink is printed in the matrix at the lower left position, and a dot of larger diameter in normal ink is printed in the matrix at the lower right position.

For tone 48, a dot of smaller diameter in normal ink is printed in a matrix at each of the upper left and right and lower right positions, and a dot of larger diameter in normal ink is printed in the matrix at the lower left position.

For tone 49, a dot of smaller diameter in photo ink is printed in a matrix at the upper left position, a dot of larger diameter in normal ink is printed in the matrix at the upper right position, and a dot of larger diameter in photo ink is printed in the matrix at each of the lower left and right positions.

For tone 50, a dot of smaller diameter in normal ink is printed in a matrix at each of the upper left and right positions, a dot of larger diameter in photo ink is printed in the matrix at the lower left position, and a dot of larger diameter in normal ink is printed in the matrix at the lower right position.

For tone 51, a dot of smaller diameter in normal ink is printed in a matrix at the upper left position, and a dot of larger diameter in normal ink is printed in the matrix at each of the upper end lower right positions.

For tone 52, a dot of smaller diameter in normal ink is printed in a matrix at the upper left position, a dot of larger diameter in photo ink is printed in the matrix at each of the upper and lower right positions, and a dot of larger diameter in normal ink is printed in the matrix at the lower left position.

For tone 53, a dot of larger diameter in photo ink is printed in a matrix at the upper left position, and a dot of larger diameter in normal ink is printed in the matrix at each of the upper and lower right positions.

For tone 54, a dot of smaller diameter in photo ink is printed in a matrix at each of the upper left and right positions and a dot of larger diameter in normal ink is printed in the matrix at each of the lower left and right positions.

For tone 55, a dot of larger diameter in photo ink is printed in a matrix at each of the upper left and right and lower right positions and a dot of larger diameter in normal ink is printed in the matrix at the lower left position.

For tone 56, a dot of smaller diameter in photo ink is printed in a matrix at the upper left position, a dot of smaller diameter in normal ink is printed in the matrix at the upper right position, and a dot of larger diameter in normal ink is printed in the matrix at each of the lower left and right positions.

For tone 57, a dot of smaller diameter in photo ink is printed in a matrix at the upper left position, a dot of larger diameter in photo ink is printed in the matrix at the upper right position, and a dot of larger diameter in normal ink is printed in the matrix at each of the lower left and right positions.

For tone 58, a dot of smaller diameter in normal ink is printed in a matrix at each of the upper left and right positions, and a dot of larger diameter in normal ink is printed in the matrix at each of the lower left and right positions.

For tone 59, a dot of smaller diameter in normal ink is printed in a matrix at the upper left position, a dot of larger diameter in photo ink is printed in the matrix at the upper right position, and a dot of larger diameter in normal ink is printed in the matrix at each of the lower left and right positions.

For tone 60, a dot of larger diameter in normal ink is printed in a matrix at each of the upper left and right and lower right positions.

For tone 61, a dot of larger diameter in photo ink is printed in a matrix at each of the upper left and right positions, and a dot of larger diameter in normal ink is printed in the matrix at each of the lower left and right positions.

For tone 62, a dot of smaller diameter in photo ink is printed in a matrix at the upper left position, and a dot of larger diameter in normal ink is printed in the matrix at each of the upper right and lower left and right positions.

For tone 63, a dot of smaller diameter in normal ink is printed in a matrix at the upper left position, and a dot of larger diameter in normal ink is printed in the matrix at each of the upper right and lower left and right positions.

For tone 64, a dot of larger diameter in photo ink is printed in a matrix at the upper left position, and a dot of larger diameter in normal ink is printed in the matrix at each of the upper right and lower left and right positions.

For tone 65, a dot of larger diameter in normal ink is printed in a matrix at each of the upper left and right and lower left and right positions.

Figure 37:
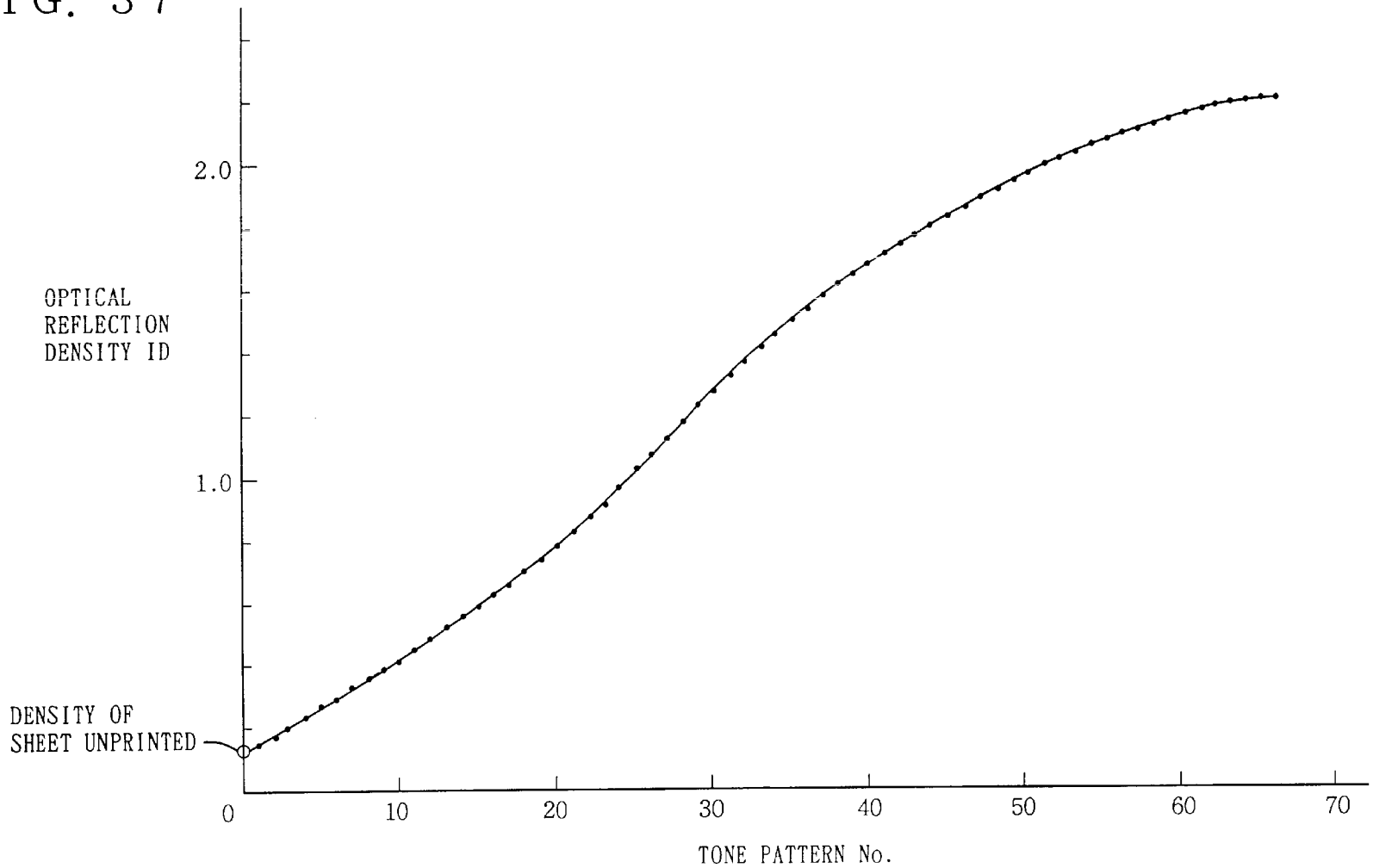
FIG. 37 represents a relation between patterns printed for respective tones and the optical densities thereof.

FIG. 37 is a graph of a value of optical density (ID) of an image when each of the matrixes shown in FIGS. 23–36 forms an image.

Sakura Densitometer (PDA65) is used as an optical density measuring device. The sheet used for measurement is a superfine (SF) sheet available from EPSON. As the measuring method, the pattern of each of the matrixes shown in FIGS. 23–26 is printed on the sheet over an area no less than 5×5 mm and the optical density thereof is measured. It should be noted that the sheet itself prior to printing has an optical density of approximately 0.12.

It can be understood from the graph that in the present embodiment, optical density can smoothly be increased from tone 0 through tone 65. Thus, an image formed by the image forming apparatus of the present embodiment does not have any abrupt change in optical density between a tone and another tone adjacent thereto, and an improved reproduction of the image can be thus achieved.

Figure 39:
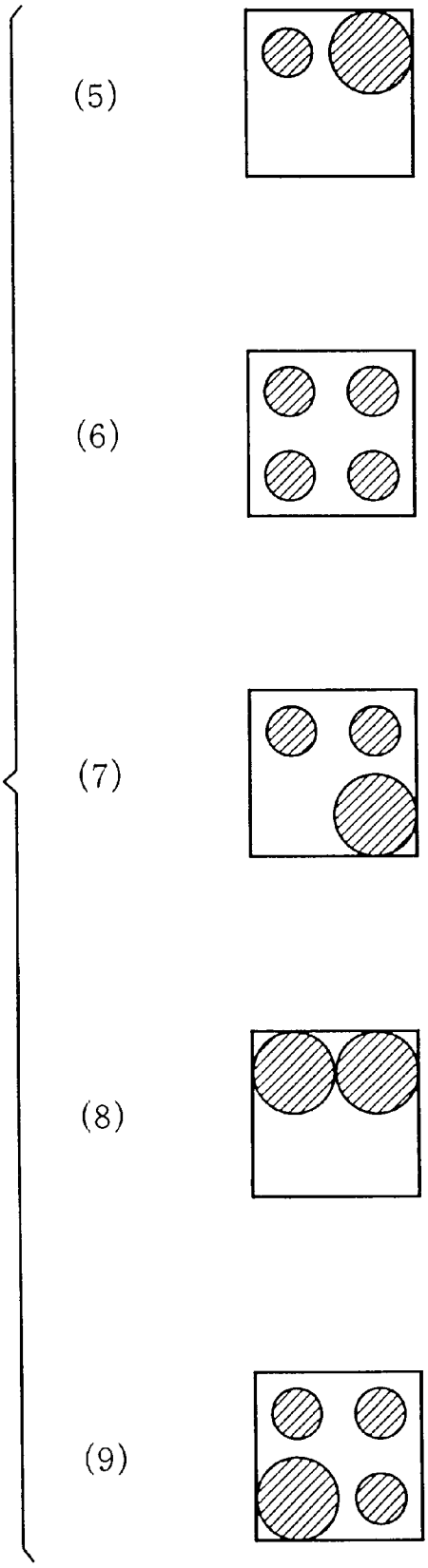

FIGS. 38–40 show comparative example 1-1 for the present embodiment. This comparative example is identical with the first embodiment in that the matrix of 2×2 shown in FIG. 21 and two sizes of, i.e., larger and smaller diameters of dots are used for tone control. However, it uses only photo ink as the ink used.

Figure 41:
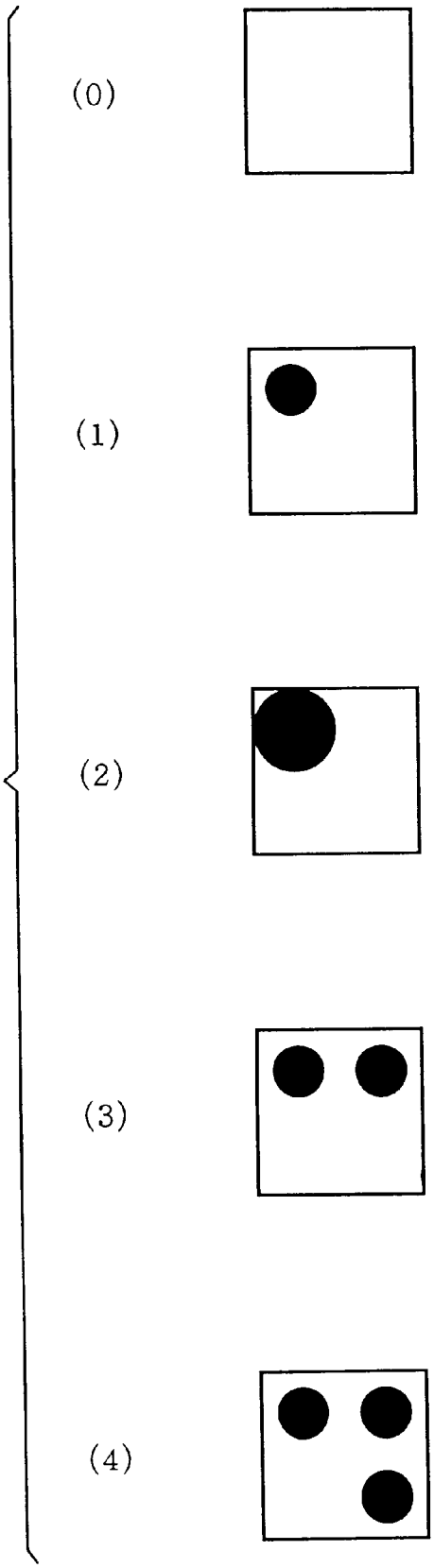
Figure 42:
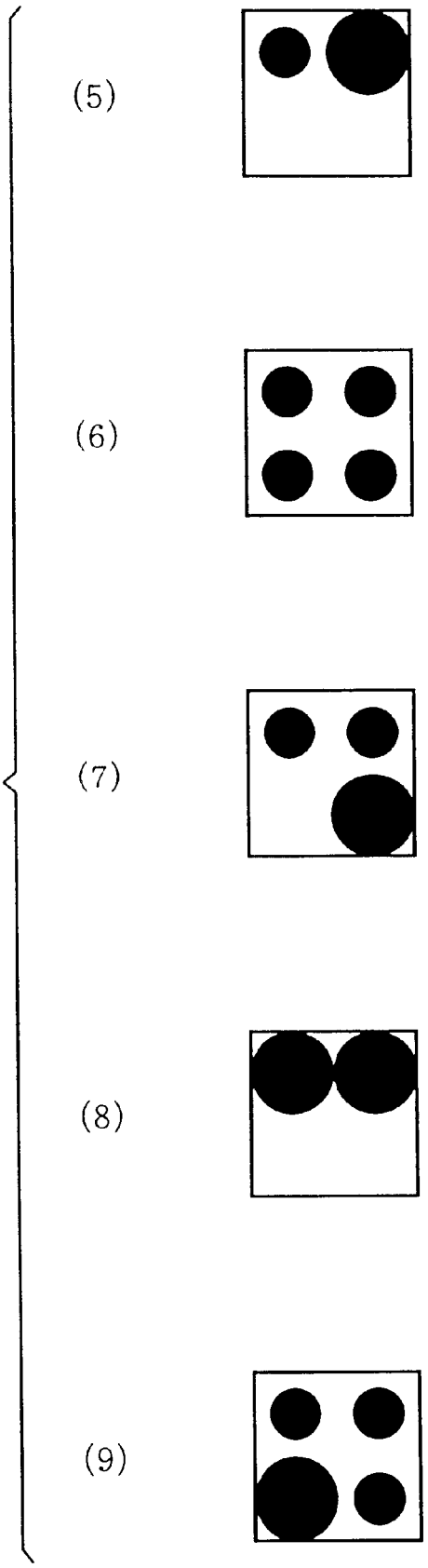

FIGS. 41–43 show Comparative Example 1-2, which has patterns which are similar to those of Comparative Example 1-1 but are printed in normal ink.

With these comparative examples, 15 tones of tones 0–14 can be printed. However, the number of the tones is smaller than that of the present embodiment, which employs both of normal ink and photo ink and can thus reproduce a large number of tones.

Embodiment 1-2

The hardware configuration of an ink jet printer according to Embodiment 1-2 is identical to that of Embodiment 1-1 and thus a description thereof will not be repeated.

While Embodiment 1-1 provides tone control by means of a matrix of 2×2, Embodiments 1-2 provides tone control depending on the diameter of dot and the density of ink rather than using a matrix.

Figure 44:
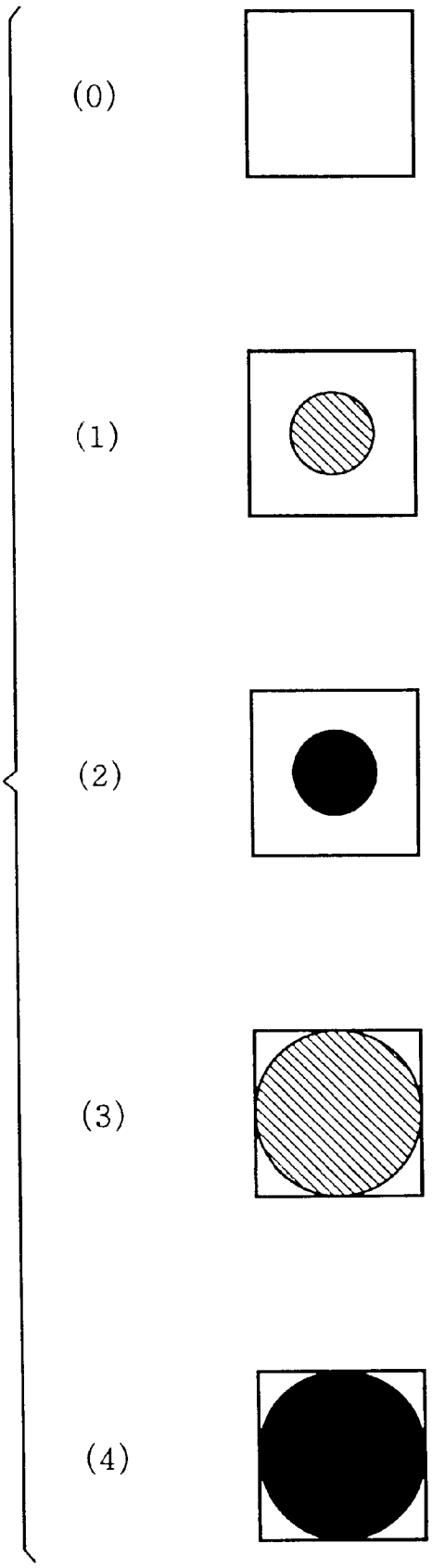
FIG. 44 shows dots for tones 0–4 for Embodiments 1-2.

More specifically, the four types of dots shown in FIG. 22 can be used to print an image with the five tones of tones 0–4 shown in FIG. 44.

Referring to FIG. 44, for tone 0, no dot is printed.

For tone 1, a dot of smaller diameter is printed in photo ink.

For tone 2, a dot of smaller diameter is printed in normal ink.

For tone 3, a dot of larger diameter is printed in photo ink.

For tone 4, a dot of larger diameter is printed in normal ink.

Figure 45:
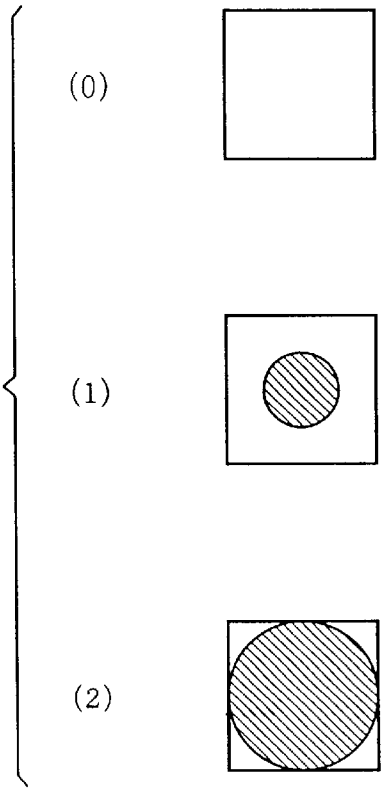
FIG. 45 shows dots for tones 0–2 for Comparative Example 1-3.
Figure 46:
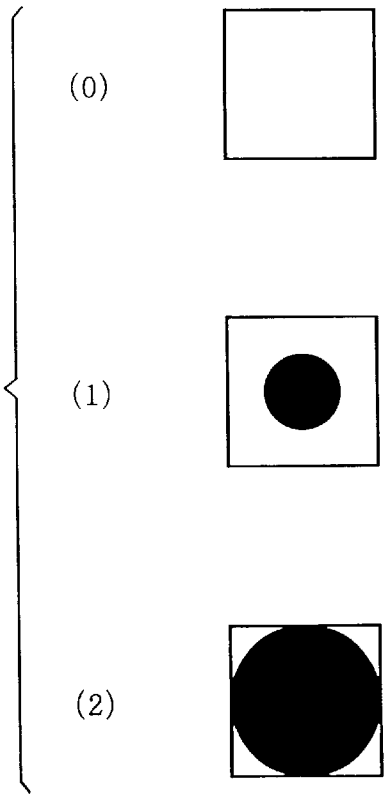
FIG. 46 shows dots for tones 0–2 for Comparative Example 1-4.

FIG. 45 shows Comparative Example 1-3, wherein only photo ink is used to provide tone control by dots of larger and smaller diameters. FIG. 46 shows Comparative Examples 1-4, wherein only normal ink is used to provide tone control in a manner similar to FIG. 45.

In these comparative examples, an image can be printed in the three tones of tones 0–2. However, the number of the tones is smaller than that of the tones of Embodiment 1-2, which uses both of normal ink and photo ink and can thus reproduce a large number of tones.

Modification

While Embodiment 1-1 provides tone control by means of a matrix of 2×2, a matrix of 3×3 or more can also be used to obtain more tones.

Figure 47:
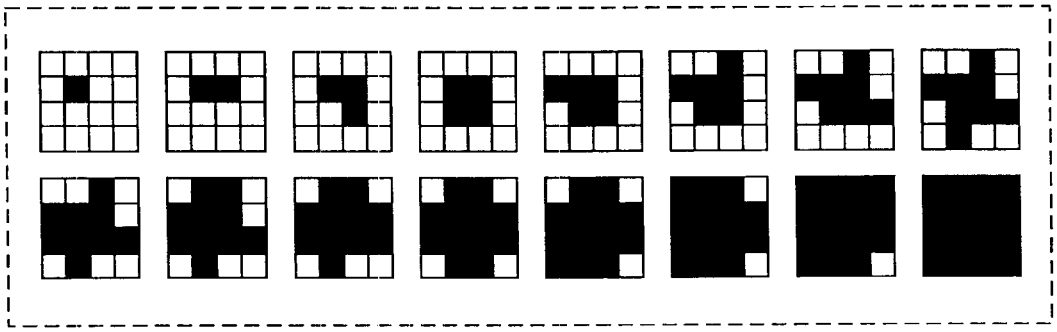
FIG. 47 is a view for describing Modification 1-1.
Figure 48:
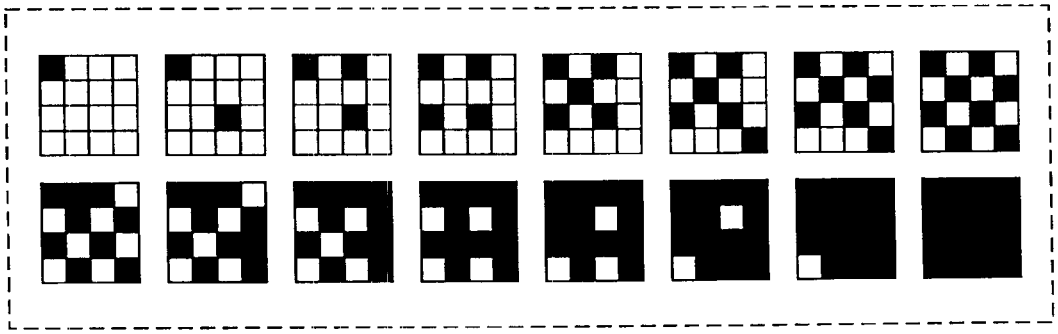
FIG. 48 is a view for describing Modification 1-2.

A threshold matrix employed in dither method can also be added to reproduce a single pixel according to the FATTENING TYPE pattern shown in FIG. 47 or the BAYER TYPE pattern shown in FIG. 48. Applying a threshold matrix used in dither method in addition to the control by means of normal color and photo color and to the control through changes of the diameter of dot further improve image reproduction in low tone.

While the present embodiment employs dots of two different diameters, i.e. larger and smaller diameters, a larger number of different diameters of dots can also be employed to obtain more tones.

Furthermore, the present invention has normal ink and photo ink consumed by the same amount. Accordingly, the both types of ink can be completely used and thus not be wasted if a cartridge for one type of ink is integrated with that for the other type of ink.

Embodiment 2-1

An ink jet printer according to Embodiment 2-1 of the present invention will now be described with reference to the figures.

The schematic configuration of an ink jet printer 1 according to Embodiment 2-1 of the present invention is as in FIGS. 1–10 and the description thereof.

FIG. 49 describes a composition of normal yellow ink used in an ink jet printer of the present embodiment.

The normal yellow ink contains water of 76.0%, polyhydric alcohol/DEG of 11.0%, polyhydric alcohol ether/TGB of 6.5%, and a thickener/PEG #400 of 3.0% as the solvent. It also contains a dye/Bayer Y-CA 50192 of 2.5% as a coloring material. It also contains a surfactant/Olfine E1010 of 0.8% and a pH adjusting agent/$NaHCO_3$ of 0.2% as additives.

FIG. 50 describes a composition of normal magenta ink used in an ink jet printer according to the present embodiment.

The normal magenta ink contains water of 75.5%, polyhydric alcohol/DEG of 11.0%, polyhydric alcohol ether/TGB of 6.5% and a thickener/PEG #400 of 3.5% as the solvent. It also contains a dye/BASF RED FF-3282 of 2.5% as a coloring material. It also contains a surfactant/Olfine E1010 of 0.8% and a pH adjusting agent/$NaHCO_3$ of 0.2% as additives.

FIG. 51 describes a composition of normal cyan ink used in an ink jet printer of the present embodiment.

The normal cyan ink contains water of 75.0% , polyhydric alcohol/DEG of 11.0%, polyhydric alcohol ether/TGB of 6.5% and a thickener/PEG #400 of 3.5% as the solvent. It also contains a dye/Bayer CY-BG of 3.0% as a coloring material. It also contains a surfactant/Olfine E1010 of 0.8% and a pH adjusting agent/$NaHCO_3$ of 0.2% as additives.

FIG. 52 describes a composition of normal black ink used in an ink jet printer of the present embodiment.

The normal black ink contains water of 78.9% , polyhydric alcohol/DEG of 6.0%, polyhydric alcohol ether/TGB of 6.0% and a thickener/PEG of #400 of 3.5% as the solvent. It also contains a dye/Bayer BK-SP of 4.6% as a coloring material. It also contains a surfactant/Olfine E1010 of 0.8% and a pH adjusting agent/$NaHCO_3$ of 0.2% as additives.

FIG. 53 describes a composition of photo yellow ink used in an ink jet printer of the present embodiment.

The photo yellow ink contains water of 77.9%, polyhydric alcohol/DEG of 11.0%, polyhydric alcohol ether/TGB of 6.5% and a thickener/PEG #400 of 3.0% as the solvent. It also contains a dye/Bayer Y-CA 51092 of 0.6% as a coloring material. It also contains a surfactant/Olfine E1010 of 0.8% and a pH adjusting agent/$NaHCO_3$ of 0.2% as additives.

FIG. 54 describes a composition of photo magenta ink used in an ink jet printer of the present embodiment.

The photo magenta ink contains water of 77.4% polyhydric alcohol/DEG of 11.0%, polyhydric alcohol ether/TGB of 6.5% and a thickener/PEG #400 of 3.5% as the solvent. It also contains a dye/BASF RED FF-3282 of 0.6% as a coloring material. It also contains a surfactant/Olfine E1010 of 0.8% and a pH adjusting agent/$NaHCO_3$ of 0.2 as additives.

FIG. 55 describes a composition of photo cyan ink used in an ink jet printer of the present embodiment.

The photo cyan ink contains water of 77.3%, polyhydric alcohol/DEG of 11.0%, polyhydric alcohol ether/TGB of 6.5% and a thickener/PEG #400 of 3.5% as the solvent. It also contains a dye/Bayer CY-BG of 0.7% as a coloring material. It also contains a surfactant/Olfine E1010 of 0.8% and a pH adjusting agent/$NaHCO_3$ of 0.2% as additives.

FIG. 56 describes a composition of photo black ink used in an ink jet printer of the present embodiment.

The photo black ink contains water of 82.3%, polyhydric alcohol/DEG of 6.0%, polyhydric alcohol ether/TGB of 6.0% and a thickener/PEG #400 of 3.5% as the solvent. It also contains a dye/Bayer BK-SP of 1.2% as a coloring material. It also contains a surfactant/Olfine E1010 of 0.8% and a pH adjusting agent/$NaHCO_3$ of 0.2% as additives.

Figure 57:
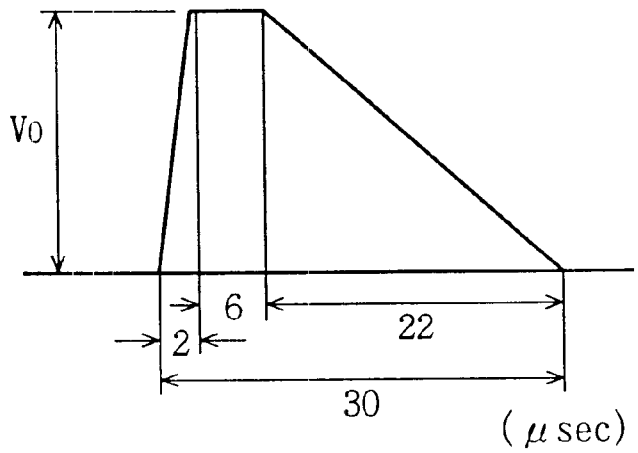
FIG. 57 is a waveform diagram of a pulse of a voltage ($V_0 \leqq 15V$) applied to PZT 306.
Figure 58:
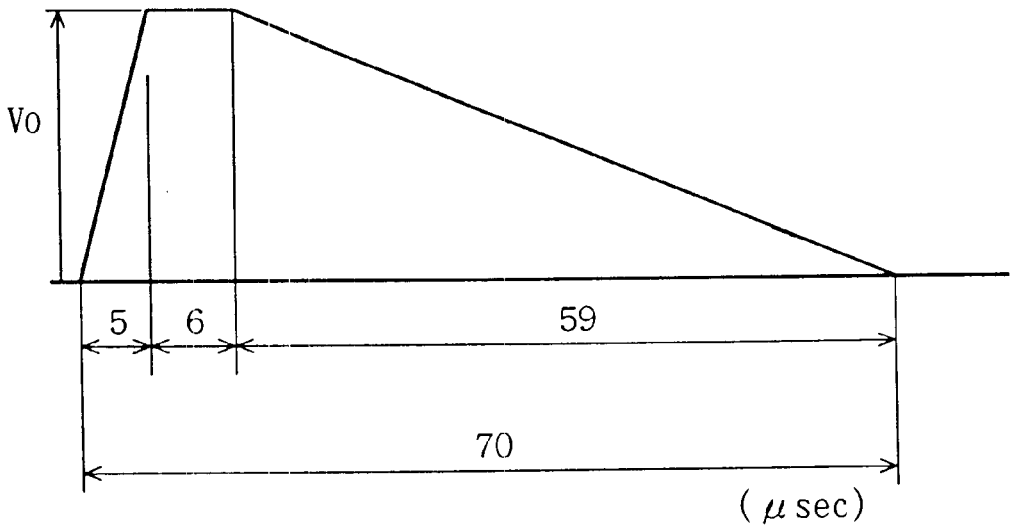
FIG. 58 is a waveform diagram of a pulse of a voltage ($V_0 > 15V$) applied to PZT 306.

FIGS. 57 and 58 represent waveforms of pulses of voltages applied to PZT 306.

FIG. 57 shows a waveform when the maximum voltage value $V_0$ of the pulse is no more than 15V. FIG. 58 shows a waveform when the maximum voltage value $V_0$ of the pulse exceeds 15V. PZT 306 receives voltage $V_0$ which changes depending on the diameter of a dot to be printed.

Referring to FIG. 57, for $V_0 \leqq 15V$, a time period of 2 μsec is required from application of the voltage until the voltage reaches value $V_0$. Thereafter, voltage $V_0$ is applied for 6 μsec. Then, 22 μsec is required for the voltage to reach 0. In other words, a single pulse is applied for 30 μsec in total.

Referring to FIG. 58, for $V_0 > 15V$, the time period of 5 μsec is required from application of the voltage until the voltage reaches value $V_0$. Thereafter, voltage $V_0$ is applied for 6 μsec. Then, 59 μsec is required for the voltage to reach 0. In other words, a single pulse is applied for 70 μsec in total.

Figure 59:
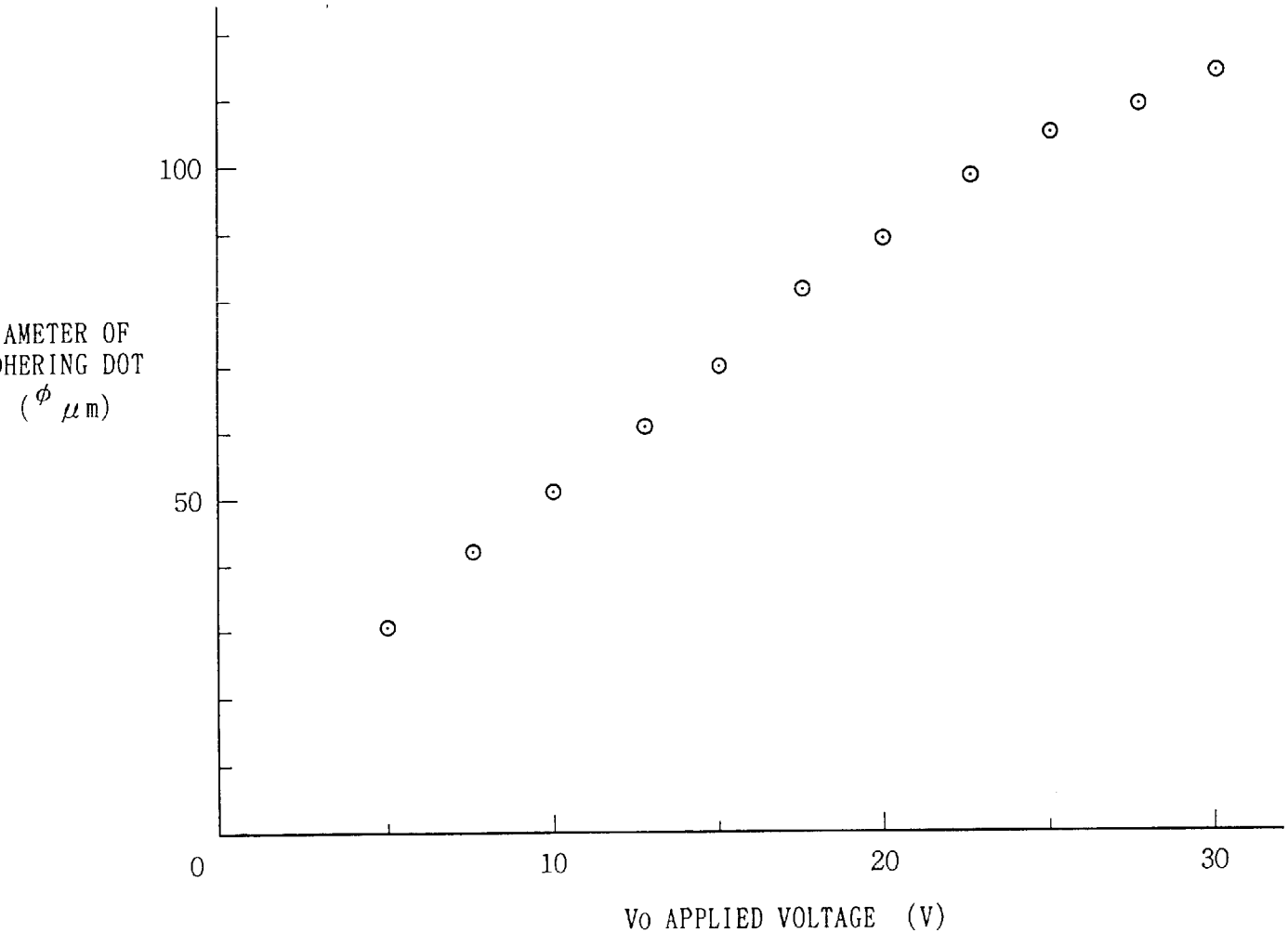
FIG. 59 represents a relation between voltage $V_0$ applied to PZT 306 and the diameter of a dot formed by application of the voltage.

FIG. 59 represents a relation between voltage $V_0$ applied to PZT 306 and the diameter (μm) of a dot adhering to recording sheet 2 due to the application of the voltage.

As shown in the figure, the diameter of an adhering dot increases as the voltage applied is increased.

Figure 60:
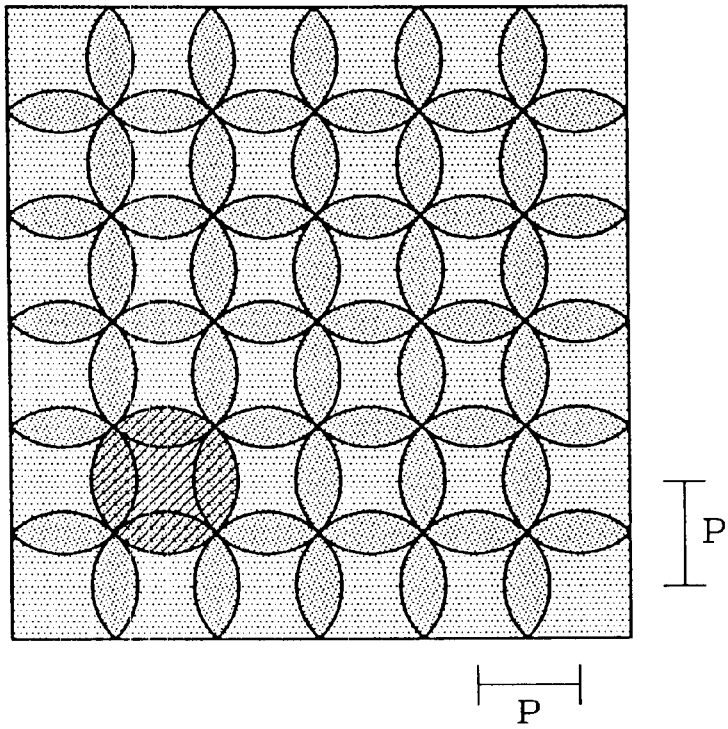
FIGS. 60 and 61 show respective solid images printed in normal ink, wherein the respective voltages $V_0$ applied to PZT 306 are 22.5V and 15V.

FIG. 60 shows a solid image printed in normal ink with a voltage $V_0$ of 22.5V applied to PZT 306. A hatched portion is a single dot.

The present embodiment provides printing in 360 dpi. Thus, a pitch P between dots is 70.6 μm. The distance between dots obliquely arranged is $1.414 \times P \approx 99.8$ μm. With a voltage $V_0$ of 22.5V applied to PZT 306, the diameter of a dot printed is approximately 100 μm and an entire sheet can thus be filled with ink.

Figure 61:
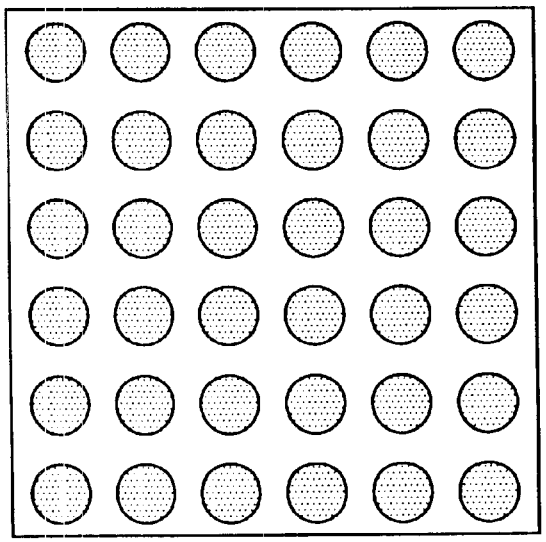

FIG. 61 shows a solid image printed in normal ink with a voltage $V_0$ of 15V applied to PZT 306. The pitch between dots is similar to that of dots in FIG. 60, i.e. 70.6 μm, although the diameter of a dot is approximately 70 μm. In this image, the area to which ink adheres is approximately half that of the image shown in FIG. 60, resulting in approximately half the optical density thereof.

Normal ink and photo ink have almost the same physical properties, such as viscosity. Accordingly, when the PZT receives voltage under the same conditions, photo color ink can also provide printing the patterns shown in FIGS. 62 and 63.

Figure 62:
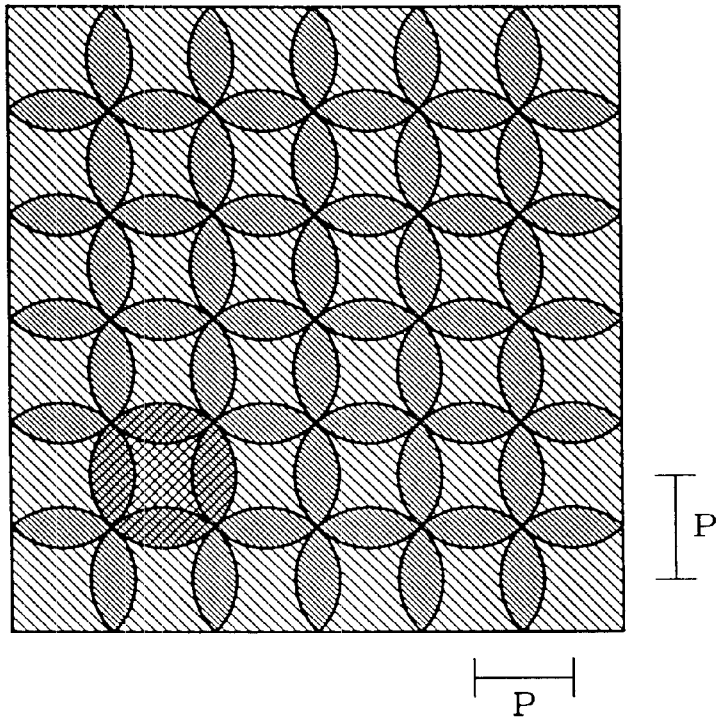
FIGS. 62 and 63 show respective solid images printed in photo ink, wherein the respective voltages $V_0$ applied to PZT 306 are 22.5V and 15V.
Figure 63:
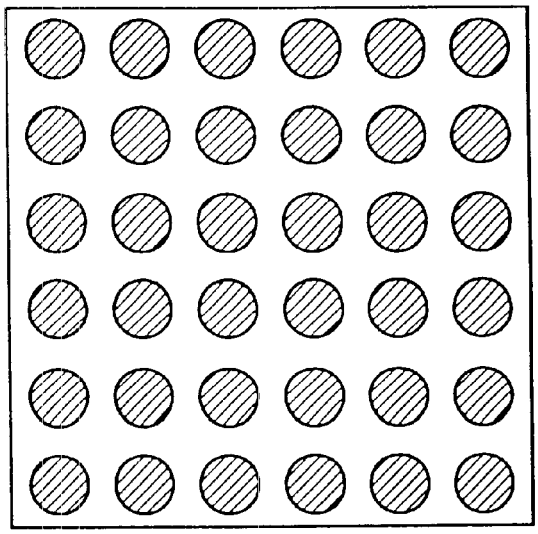
Figure 64:
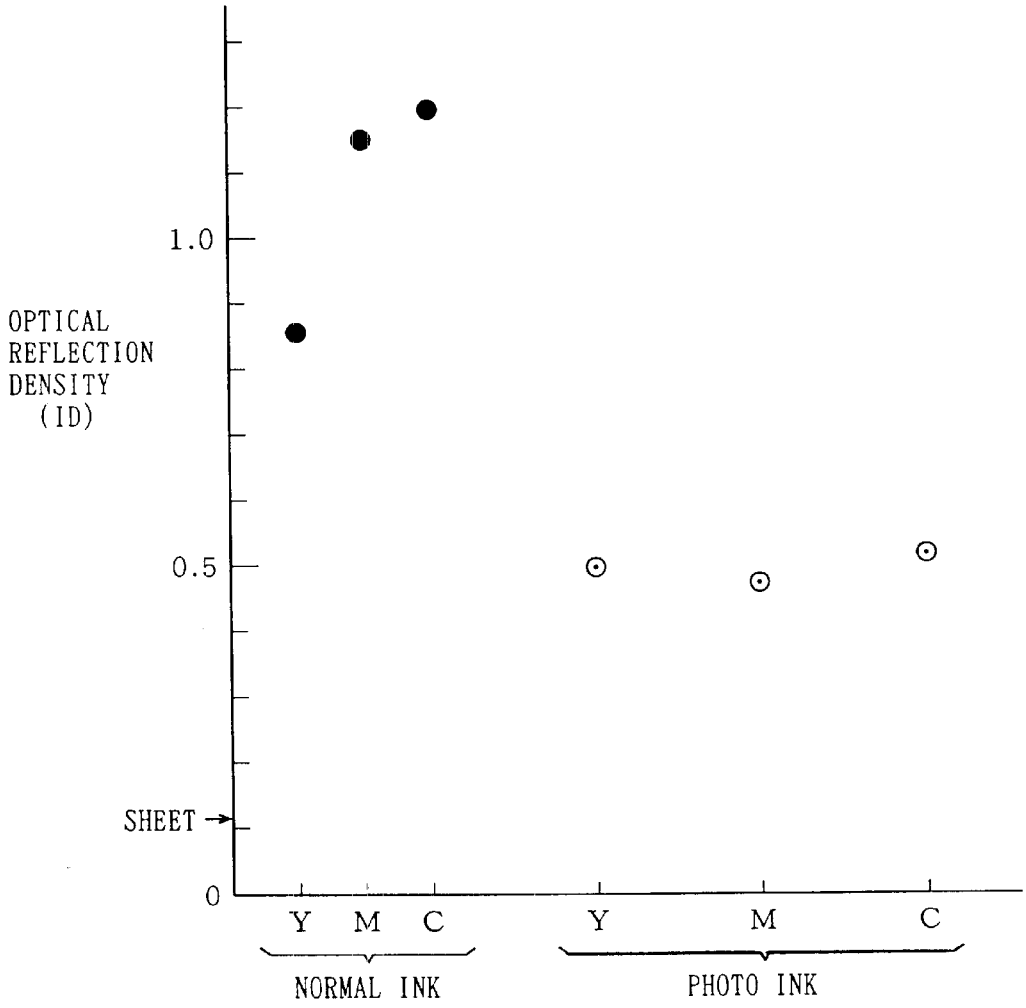
FIG. 64 represents optical densities of solid images in normal ink and photo ink.

FIG. 64 represents optical density or image density (ID) when the solid image shown in FIG. 60 or 62 is formed with normal ink and photo ink of yellow Y, magenta M and cyan C.

The optical density was measured using Sakura Densitometer PDA 65 manufactured by Sakura (KONICA CORP. incumbent) and super fine (SF) sheet available from EPSON as the sheet for measurement. A solid image is formed on the sheet at an area of no less than 5 mm×5 mm and complementary color filters are used to measure the density. More specifically, blue filter is applied for yellow ink, green filter is applied for magenta ink and red filter is applied for cyan ink.

As can be seen from the figure, the optical density of photo ink is approximately half that of normal ink. Accordingly, normal ink and photo ink appropriately used together can result in more tones.

Figure 65:
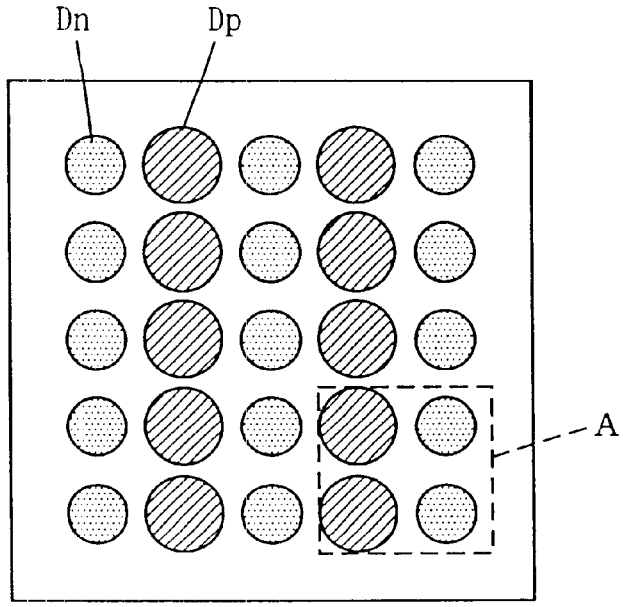
FIGS. 65, 66, 67 and 68 show patterns printed in Embodiments 2-1, 2-2, 2-3 and 2-4, respectively.

FIG. 65 shows a pattern in forming a solid image using photo ink and normal ink in the present embodiment. The pattern is formed of a dot Dn in normal ink and a dot Dp in photo ink. The diameter of dot Dp in photo ink is larger than that of dot Dn in normal ink.

The increased diameter of dot Dp in photo ink can reduce the roughness resulting from the granularity of ink dots of the image.

Embodiments 2-2 to 2-4

The hardware configuration of Embodiments 2-2 to 2-4 is the same as that of Embodiment 2-1. Embodiments 2-2 to 2-4 are characterized in that dot Dp in photo ink of an increased diameter overlaps a dot in normal ink.

Figure 66:
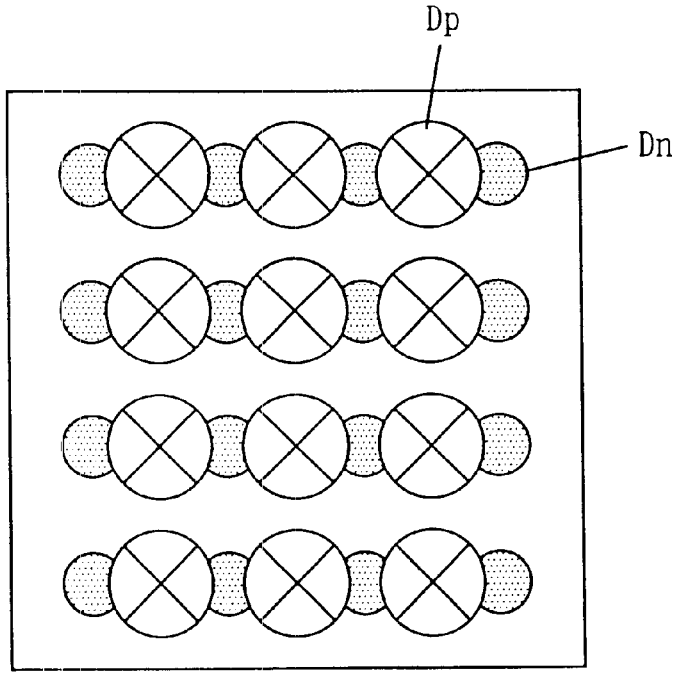
Figure 67:
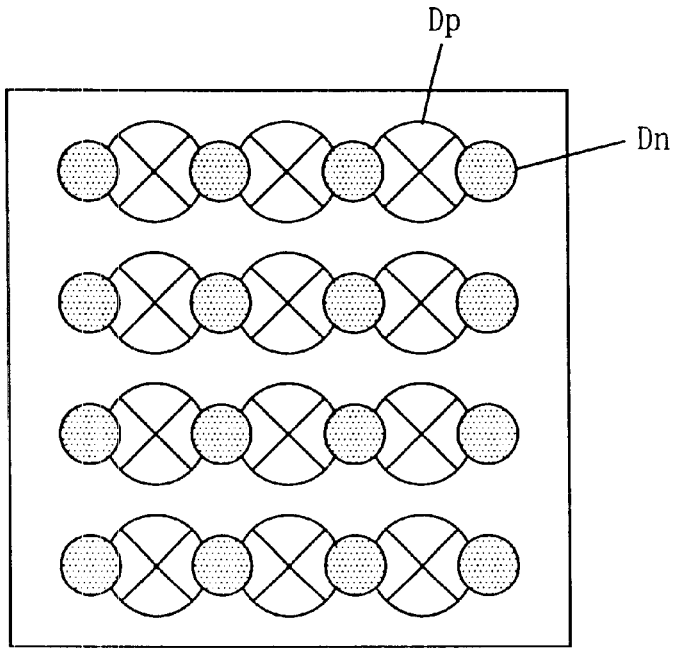
Figure 68:
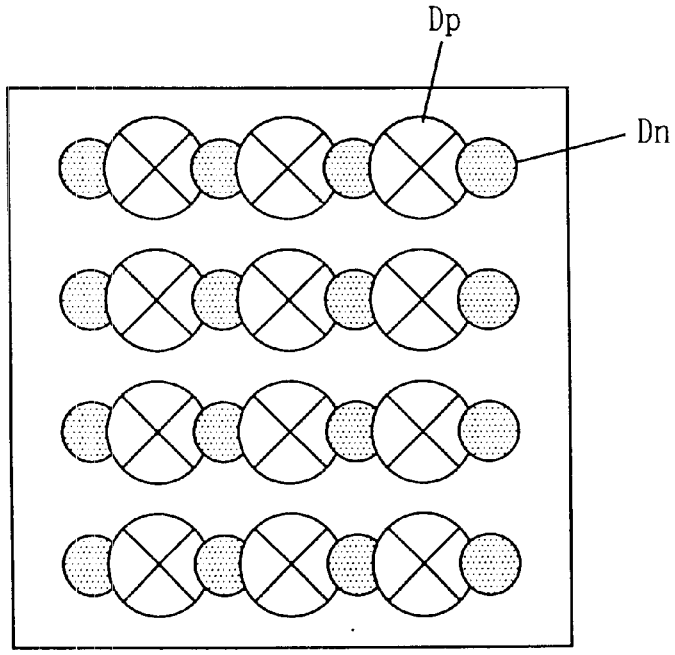

FIGS. 66–68 show patterns in forming solid images with photo ink and normal ink in Examples 2-2 to 2-4.

In Embodiment 2-2 shown in FIG. 66, dot Dn of smaller diameter is initially printed in normal ink and dot Dp of larger diameter is then printed in photo ink such that dot Dp overlaps dot Dn.

In Embodiment 2-3 shown in FIG. 67, dot Dp of larger diameter is initially printed in photo ink and dot Dn of smaller diameter is then printed in normal ink such that dot Dn overlaps dot Dp.

In Embodiment 2-4 shown in FIG. 68, dot Dn of smaller diameter in normal ink and dot Dp of larger diameter in photo ink are alternately printed successively from the left side to the right side in the figure.

In particular, when a dot of larger diameter in photo ink is printed after a dot of smaller diameter in normal ink is printed, as described in Embodiments 2-2 and 2-4, the both types of ink appropriately bleed by the time when they have fixed. Accordingly, the roughness of images printed is less remarkable and smoother image quality can be obtained.

COMPARATIVE EXAMPLE

Figure 69:
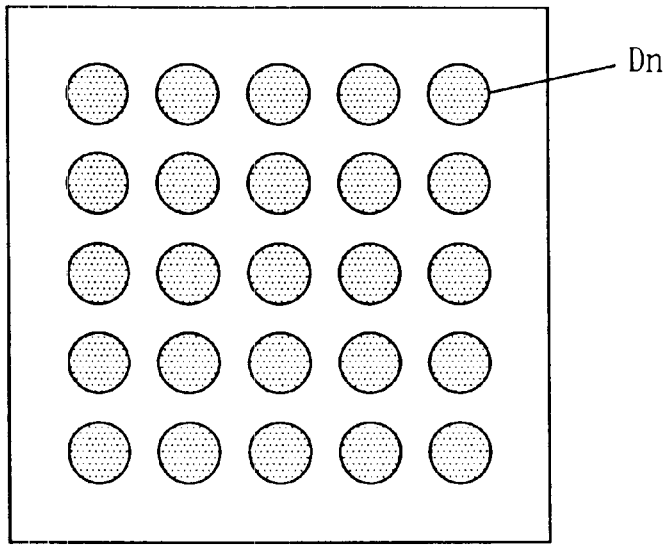
FIGS. 69 and 70 show Comparative Examples 2-1 and 2-2, respectively.

FIG. 69 shows comparative example 2-1, which provides a solid image formed of only dots in normal ink.

Figure 70:
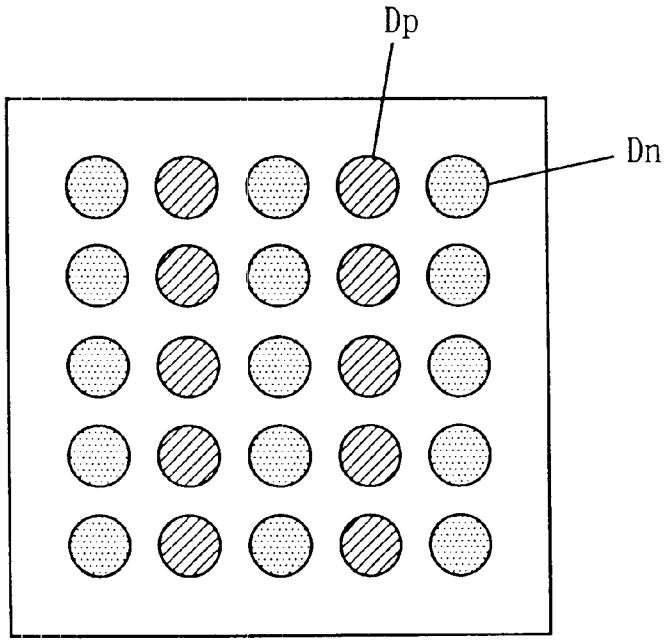

FIG. 70 is Comparative Example 2-2, which provides a solid image formed of a dot in normal ink and a dot in photo ink which are the same in diameter.

Effects of Embodiments 2-1 to 2-4

Figure 71:
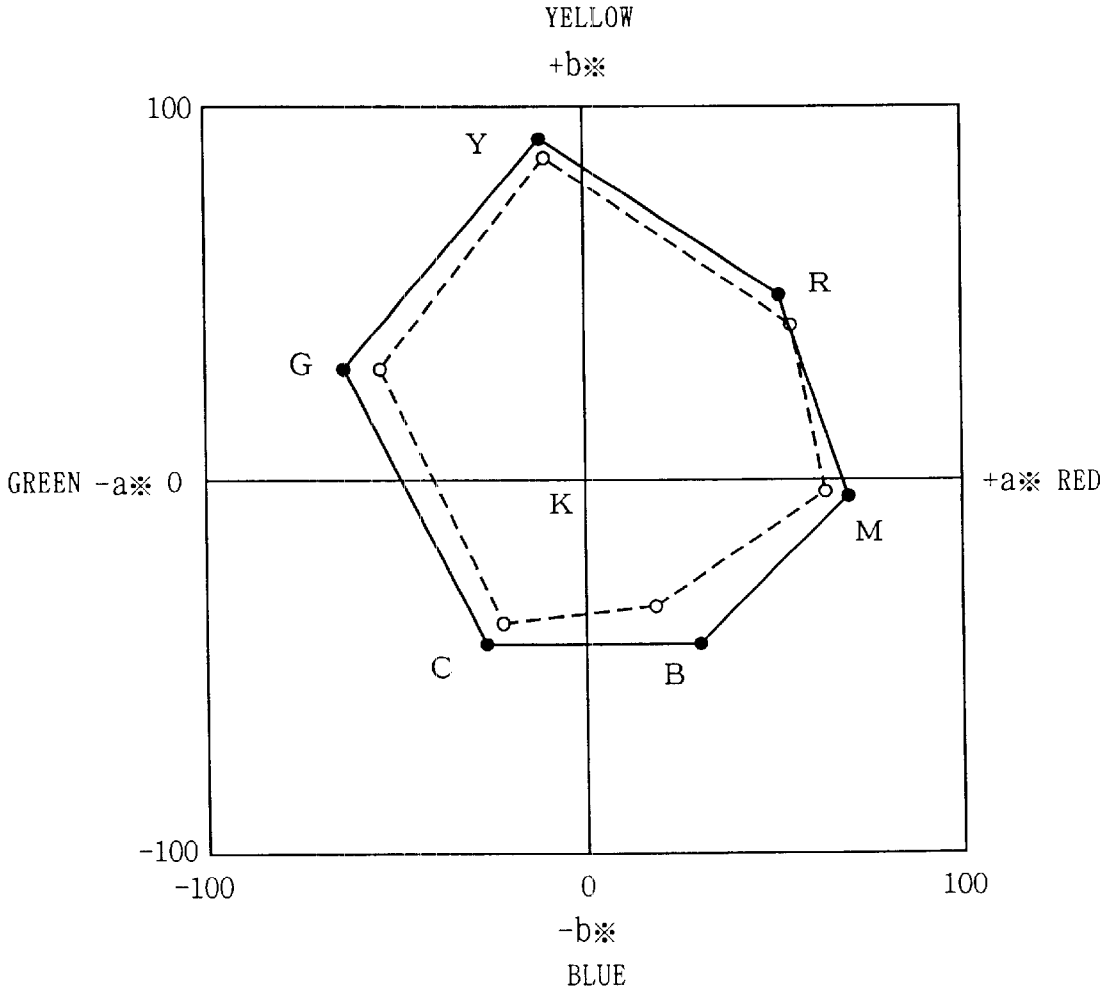
FIG. 71 is a view illustrating an effect of Embodiment 2-1.

FIG. 71 is a color reproduction chart (gamut) for illustrating an effect of Embodiment 2-1.

In the figure, the black circles represent a chart when any dot in a matrix of 2×2 assumed as a single pixel (surrounded by broken line A in FIG. 65 according to Embodiment 2-1), can have two different sizes to provide tone control. The white circles represent a chart when any dot in a matrix of 2×2 similarly assumed as a single pixel that is provided in normal ink only, can have two different sizes to provide tone control.

It is understood from the figure that according to Embodiment 2-1, the colored range expands to a denser, more colorful region and a brighter image can be obtained. In particular, it expands more widely at the blue (B) and green (G) regions.

FIG. 72 is a table of comparative results between the image qualities of Embodiments 2-1 to 2-4 and that of Comparative Example 2-1. Their roughnesses were measured by means of a magnifying glass for visual estimation as well as a micro densitometer.

In visual estimation by means of a magnifying glass, ○ represents good, Δ tolerable, and x poor.

Figure 73:
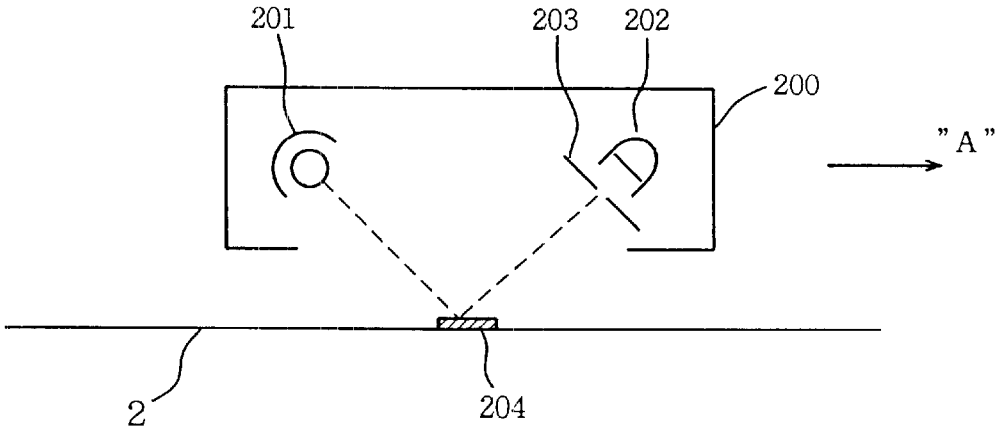
FIG. 73 illustrates a device for measuring roughness of images.
Figure 74:
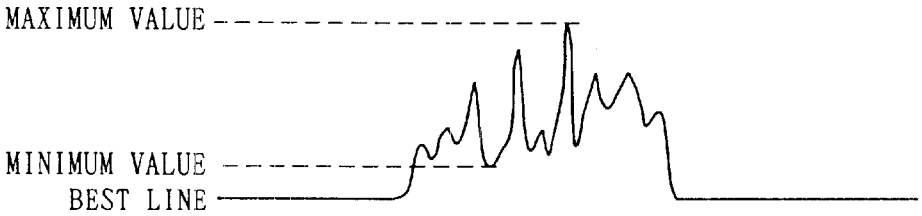
FIG. 74 represents a measured result of a rough image.
Figure 75:
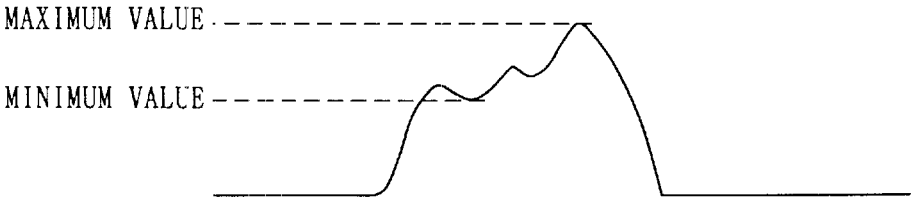
FIG. 75 represents a measured result of a less rough image.

The measurement by micro densitometer is as follows: referring to FIG. 73, ink 204 adhering to recording sheet 2 is scanned by a head 200 of a micro densitometer in direction A. Head 200 is formed of a light emitting element 201 as a light receiving portion 202 and a slit 203 of 20 $\mu$m is placed in front of light receiving portion 202. FIGS. 74 and 75 show waveforms of optical density obtained through the scanning. The maximum and minimum values of the waveforms are measured, excluding the base line. A large difference between the maximum value and the minimum value (FIG. 74) means that the image is rougher, and a small difference between the maximum value and the minimum value means that the image is less rough. Any of the embodiments and comparable example is estimated as good (○) if the maximum value minus the minimum value is no more than 0.15, available (Δ) if not less than 0.15 and not more than 0.2, and unavailable (x) if no less than 0.2.

As can be seen from FIG. 72, a result is obtained that while Comparative Example 2-1 is significantly rough, Embodiments 2-1 to 2-4 can be less rough.

Embodiment 2-5

Figure 76:
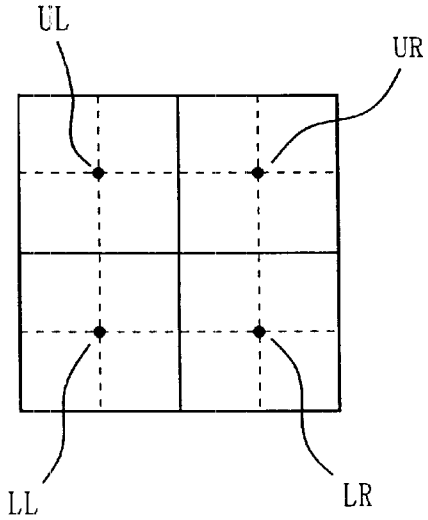
FIG. 76 is a view for illustrating a pixel in Embodiment 2–5.

The hardware configuration in Embodiment 2-5 is similar to that of Embodiment 2-1. The present embodiment provides image formation with any dot(s) in a matrix of 2×2 assumed as a single pixel. More specifically, referring to FIG. 76, an image is formed by printing or not printing a dot in a single pixel at each of the upper left, upper right, lower left and lower right positions (UL, UR, LL and LR).

Figure 77:
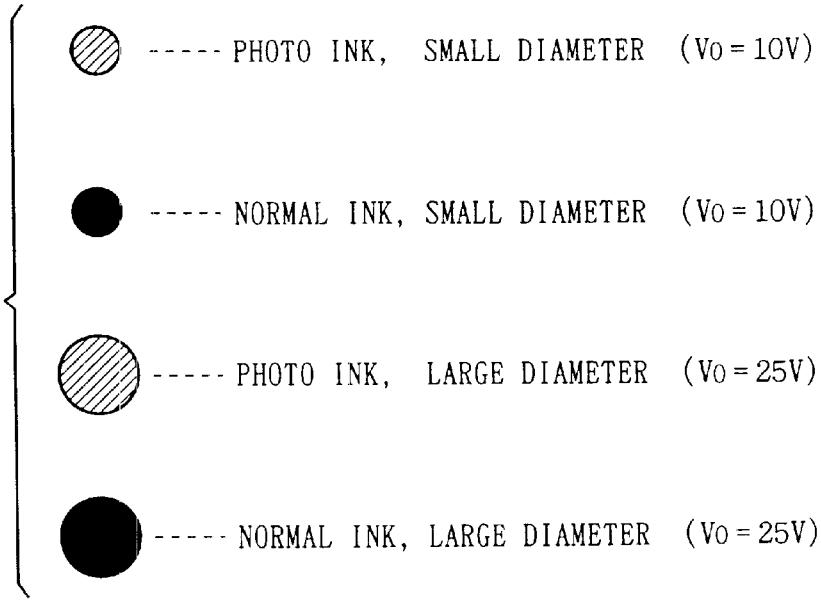
FIG. 77 depicts the types of dots printed for the pixel shown in FIG. 76.
Figure 78:
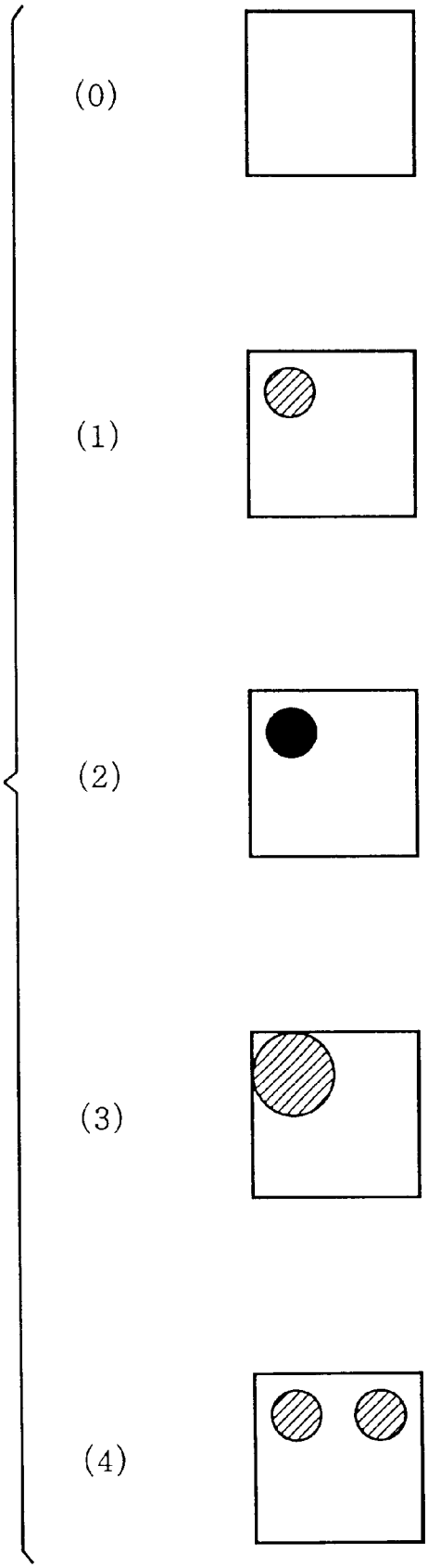
Figure 79:
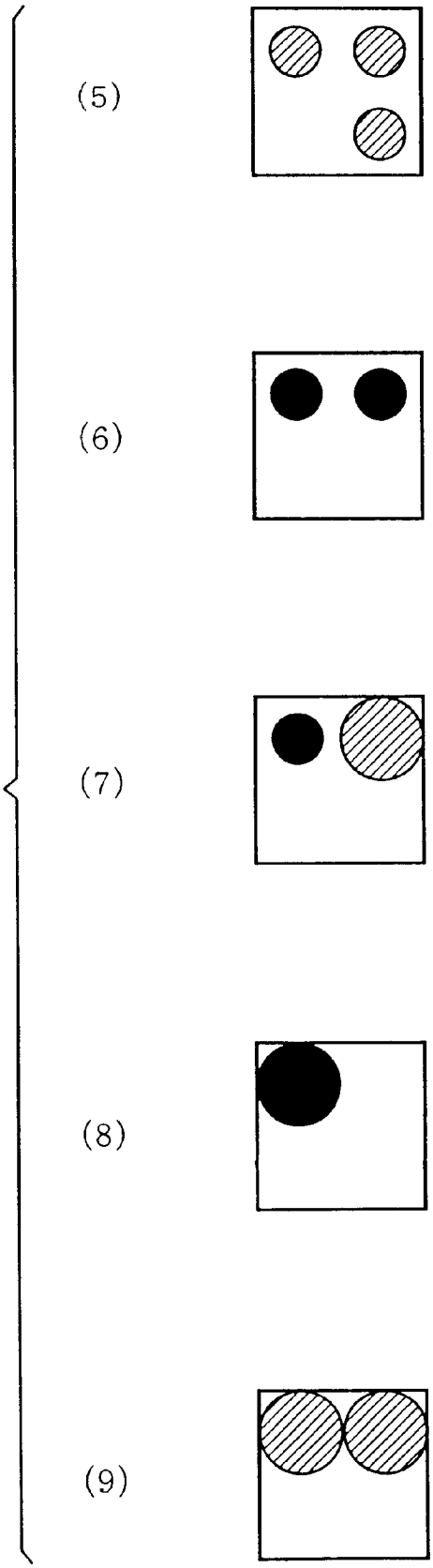
Figure 80:
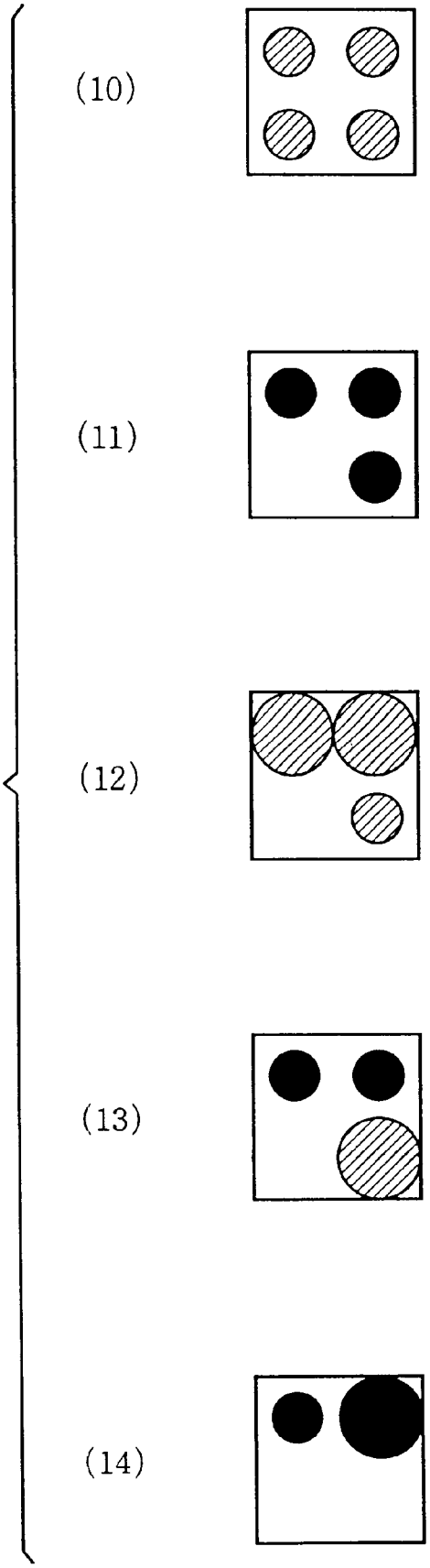

FIG. 77 shows the types of dots used. The present embodiment employs dots of smaller and larger diameters in photo ink and normal ink. A voltage $V_0$ applied to the PZT varies between 10V for printing a dot of smaller diameter and 25V for printing a dot of larger diameter.

32 tones of tones 0–31 can be printed as the tones of a single pixel. In each tone, the diameter of a dot in photo ink is larger than that of a dot in normal ink. As such, an image can be less rough and finer tone reproduction can be obtained.

FIGS. 78–84 show a pattern for each tone. In the figures, the numbers on the left side refer to tone numbers.

For tone 0, no dot is printed.

For tone 1, a dot of smaller diameter is printed in photo ink at the upper left position.

For tone 2, a dot of smaller diameter is printed in normal ink at the upper left position.

For tone 3, a dot of larger diameter is printed in photo ink at the upper left position.

For tone 4, a dot of smaller diameter is printed in photo ink at each of the upper left and right positions.

For tone 5, a dot of smaller diameter is printed in photo ink at each of the upper left and right and lower right positions.

For tone 6, a dot of smaller diameter is printed in normal ink at each of the upper left and right positions.

For tone 7, a dot of smaller diameter in normal ink and a dot of larger diameter in photo ink are printed at the upper left and right positions, respectively.

For tone 8, a dot of larger diameter is printed in normal ink at the upper left position.

For tone 9, a dot of larger diameter is printed in photo ink at each of the upper left and right positions.

For tone 10, a dot of smaller diameter is printed in photo ink at each of the upper left and right and lower left and right positions.

For tone 11, a dot of smaller diameter is printed in normal ink at each of the upper left and right and lower right positions.

For tone 12, a dot of larger diameter is printed in photo ink at each of the upper left and right positions and a dot of smaller diameter is printed in photo ink at the lower right position.

For tone 13, a dot of smaller diameter is printed in normal ink at each of the upper left and right positions, and a dot of larger diameter is printed in photo ink at the lower right position.

For tone 14, a dot of smaller diameter is printed in normal ink at the upper left position and a dot of larger diameter is printed in normal ink at the upper right position.

For tone 15, a dot of smaller diameter is printed in normal ink at the upper left position and a dot of larger diameter is printed in photo ink at each of the upper and lower right positions.

For tone 16, a dot of larger diameter is printed in photo ink at each of the upper left and right and lower right positions.

For tone 17, a dot of larger diameter is printed in photo ink at each of the upper left and right positions and a dot of smaller diameter is printed in photo ink at each of the lower left and right positions.

For tone 18, a dot of smaller diameter is printed in normal ink at each of the upper and lower left and right positions.

For tone 19, a dot of smaller diameter is printed in normal ink at each of the upper left and right end lower right positions and a dot of larger diameter is printed in photo ink at the lower left position.

For tone 20, a dot of smaller diameter is printed in normal ink at each of the upper left and right positions and a dot of larger diameter is printed in normal ink at the lower right position.

For tone 21, a dot of smaller diameter is printed in photo ink at the upper left position and a dot of larger diameter is printed in photo ink at each of the upper right and lower left and right positions.

For tone 22, a dot of smaller diameter is printed in normal ink at each of the upper left and right positions and a dot of larger diameter is printed in photo ink at each of the lower left and right positions.

For tone 23, a dot of larger diameter is printed in normal ink at each of the upper left and right positions.

For tone 24, a dot of smaller diameter is printed in normal ink at the upper left position and a dot of larger diameter is printed in photo ink at each of the upper right and lower left and right positions.

For tone 25, a dot of larger diameter is printed in photo ink at each of the upper and lower left and right positions.

For tone 26, a dot of smaller diameter is printed in normal ink at each of the upper left and right and lower right positions, and a dot of larger diameter is printed in normal ink at the lower left position.

For tone 27, a dot of smaller diameter is printed in normal ink at the upper left position and a dot of larger diameter is printed in normal ink at each of the upper and lower right positions.

For tone 28, a dot of smaller diameter is printed in normal ink at each of the upper left and right positions and a dot of larger diameter is printed in normal ink at each of the lower left and right positions.

For tone 29, a dot of larger diameter is printed in normal ink at each of the upper left and right and lower right positions.

For tone 30, a dot of smaller diameter is printed in normal ink at the upper left position and a dot of larger diameter is printed in normal ink at each of the upper right and lower left and right positions.

For tone 31, a dot of larger diameter is printed in normal ink at each of the upper and lower left and right positions.

Modification

The above embodiment can be modified as follows:

(1) Ink which does not contain dye and consists of only solvent and additive (i.e. transparent ink) is employed together with or in place of photo color ink.

Color mixing and bleeding by transparent ink can be utilized to reproduce intermediate tones. Furthermore, a single type of transparent ink can correspond to all colors and thus application of transparent ink in place of photo color ink can reduce the types of ink used and the number of head used and thus reduce the cost for manufacturing the printer.

(2) The type of coloring material varies between normal color ink and photo color ink the color of which corresponds to that of the normal color ink to expand color reproduction region and improve smoothness.

Embodiment 3-1

Described in the following are dot matrixes forming images printed by ink jet printers as Conventional Examples 3-1 to 3-3. These dot matrixes correspond to tones of an image to be printed and each dot matrix are specified by numbers starting from 0. For example, dot matrixes of five tones are specified as tones 0–4, respectively. In FIGS. 85–88 showing dot matrixes of the ink jet printers as Conventional Examples 3-1 to 3-3, a tone number specifying a tone is indicated above each dot matrix.

Figure 85:
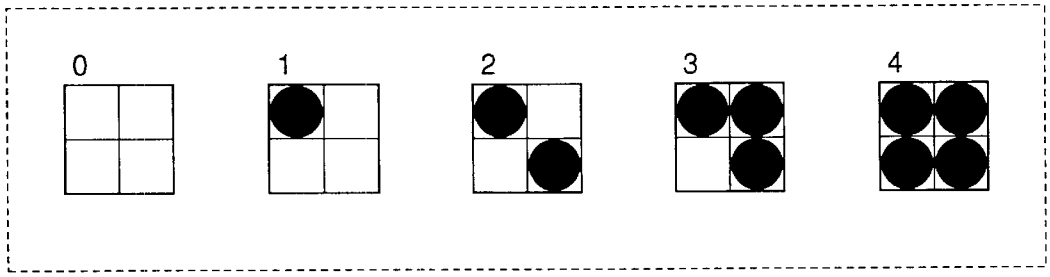
FIG.85 RELATED ART
FIG. 85 shows 5-tone dot matrixes forming an image printed by an ink jet printer as a Conventional Example 3-1.

FIG. 85 shows dot matrixes of 5 tones forming an image printed by the ink jet printer as Conventional Example 3-1.

For the ink jet printer as Conventional Example 3-1, only one type of dot forms the dot matrixes and 5 tones can thus be represented with a matrix formed of two rows and two columns.

Figure 86:
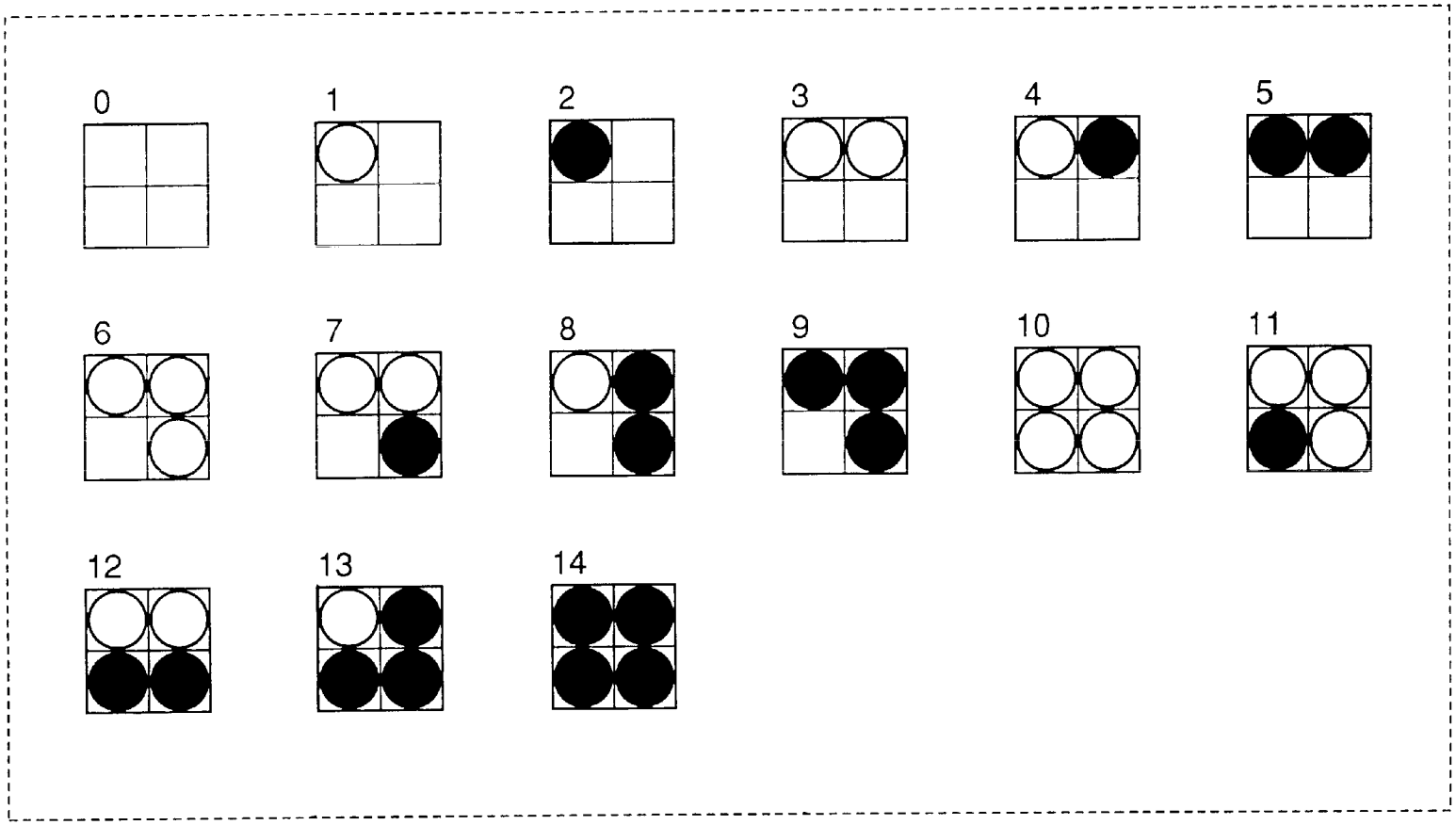
FIG.86 RELATED ART
FIG. 86 shows 15-tone dot matrixes forming an image printed by an ink jet printer as Conventional Example 3-2.

FIG. 86 shows dot matrixes of 15 tones forming an image printed by the ink jet printer as Conventional Example 3-2.

For the ink jet printer as Conventional Example 3-2, a dot forming the dot matrixes is provided in two types of ink, i.e., normal ink and photo ink, and 15 tones can thus be represented with a matrix formed of two rows and two columns.

Figure 87:
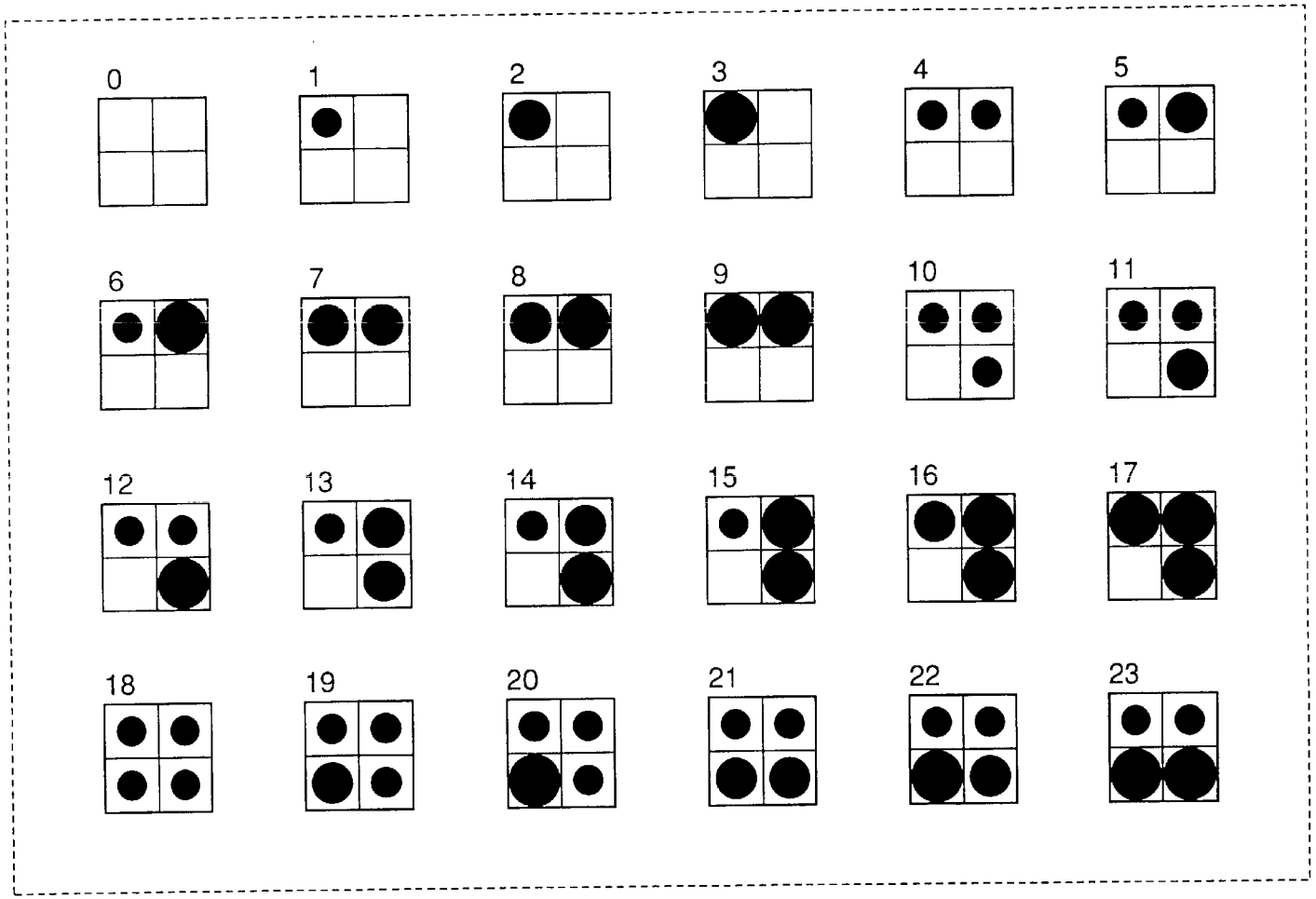
FIG.87 RELATED ART
FIGS. 87 and 88 show a 28-tone dot matrixes forming an image printed by an ink jet printer as Conventional Example 3-3.
Figure 88:
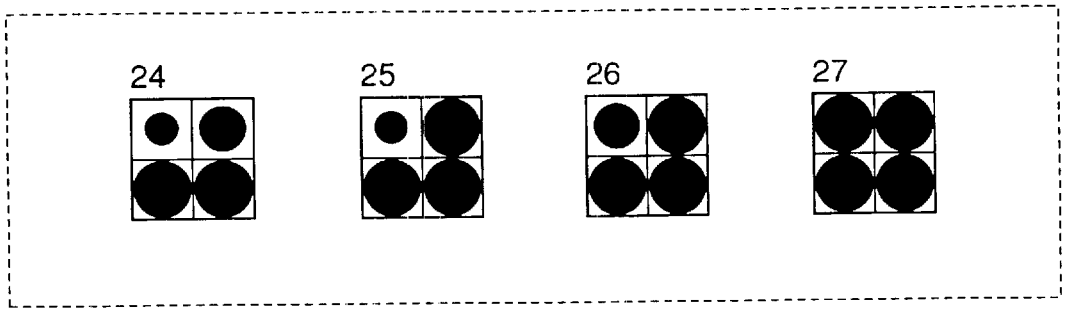
FIG.88 RELATED ART

FIGS. 87 and 88 show dot matrixes of 28 tones forming an image printed by the ink jet printer as Conventional Example 3-3.

For the ink jet printer as Conventional Example 3-3, dots forming the dot matrixes have three different, large, intermediate and small diameters and 27 tones can thus be represented with a matrix formed of two rows and two columns.

However, the ink jet printer as Conventional Examples 3-1 to 3-3 do not always provide images which are sufficiently smooth and of high quality to users.

The present embodiment eliminates such disadvantages and can provide an image forming apparatus capable of improving image quality while reducing the manufacturing cost thereof.

Figure 89:
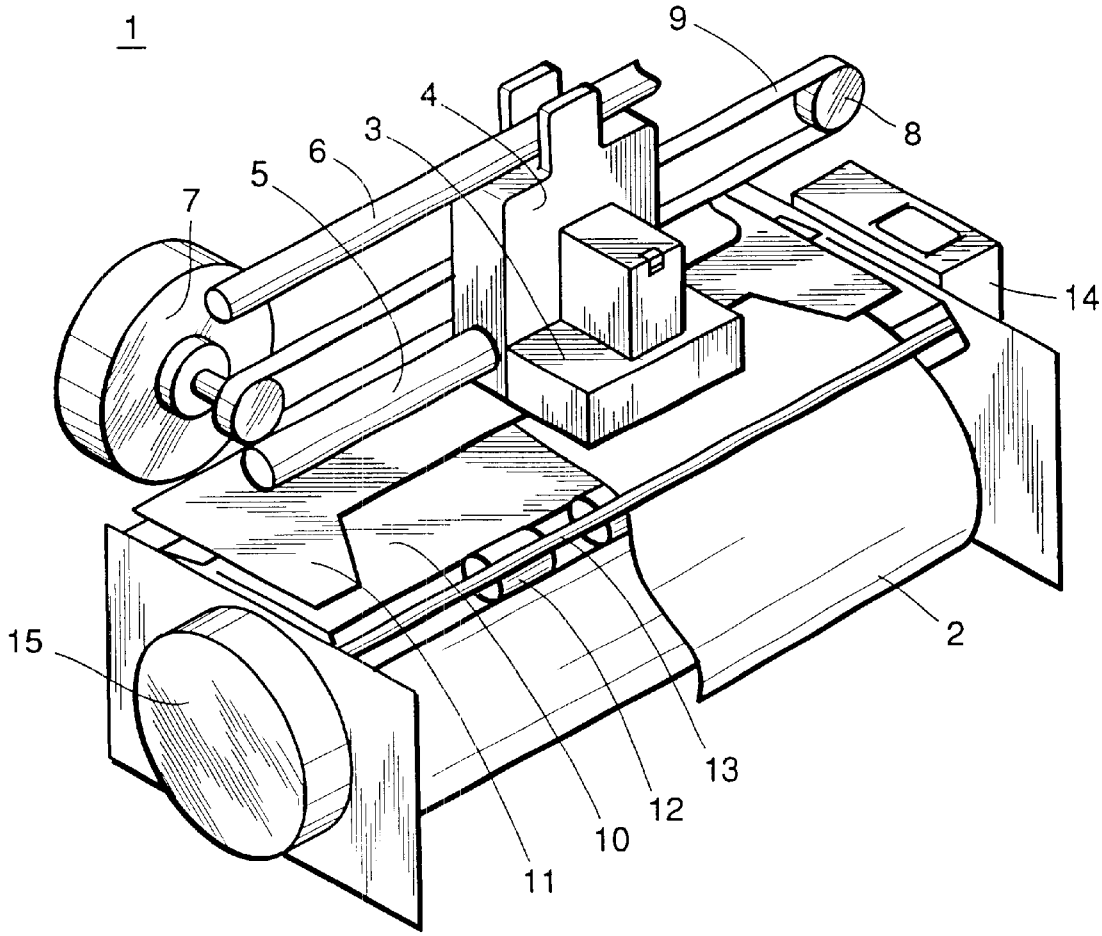
FIG. 89 is a perspective view schematically showing a structure of an ink jet printer 1 as Example 3-1 of the present invention.

FIG. 89 is a perspective view schematically showing a structure of an ink jet printer 1 according to Embodiment 3-1 of the present invention.

The numeral characters in the figure correspond to those in FIG. 1 and thus a description thereof will not be repeated.

FIGS. 90–93 show a configuration of a periphery of carriage 4 and a configuration of an ink jet head 3.

Figure 90:
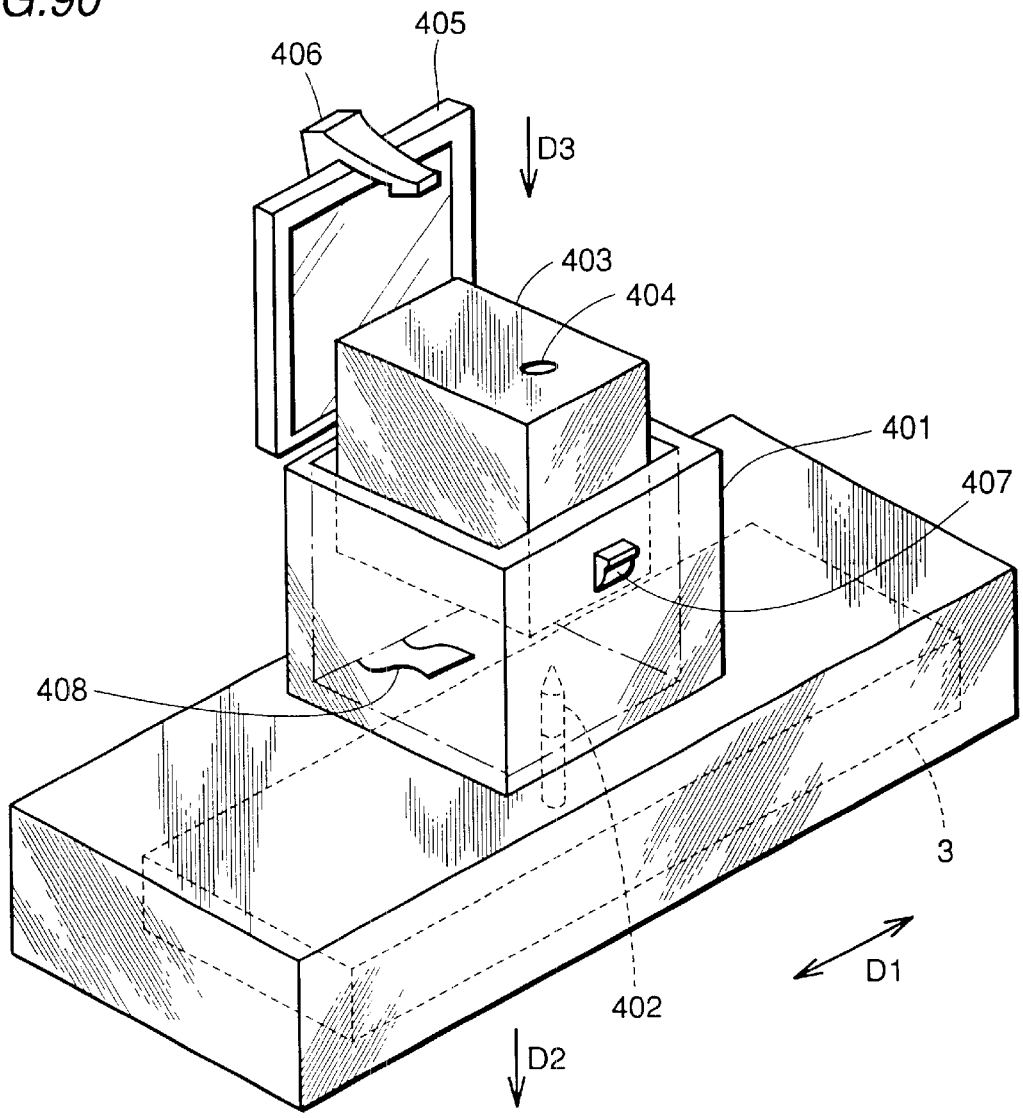
FIG. 90 is a perspective view illustrating a configuration of a periphery of a carriage 4.

FIG. 90 is a perspective view showing the configuration of the periphery of carriage 4.

Provided at the periphery of carriage 4 are: an ink cartridge 403 which stores ink and also has a ventilation hole 404; a casing 401 for housing ink cartridge 403; a lid 405 of casing 401; an ink receiver and feeder pin 402 which renders ink cartridge 403 removable and also receives and feeds ink to ink jet head 3; a biased clutch 406 for fixing lid 405 to casing 401 when lid 405 is closed; a biased clutch stopper 407; and a plate spring 408 which cooperates with lid 406 to hold ink cartridge 403 while pressing ink cartridge 403 in the direction opposite to that in which ink cartridge 403 is housed (i.e., the direction indicated by arrow D3). When carriage 4 moves in the direction indicated by arrow D1 in the figure, main scanning is provided to a recording sheet and ink drops are jetted in the direction indicated by arrow D2.

The ink in ink cartridge 403 includes normal ink of yellow, magenta, cyan and black and photo ink of magenta, cyan and black, i.e., seven colors. The compositions of these types of ink are as described in FIGS. 11–14 and 16–18.

Figure 91:
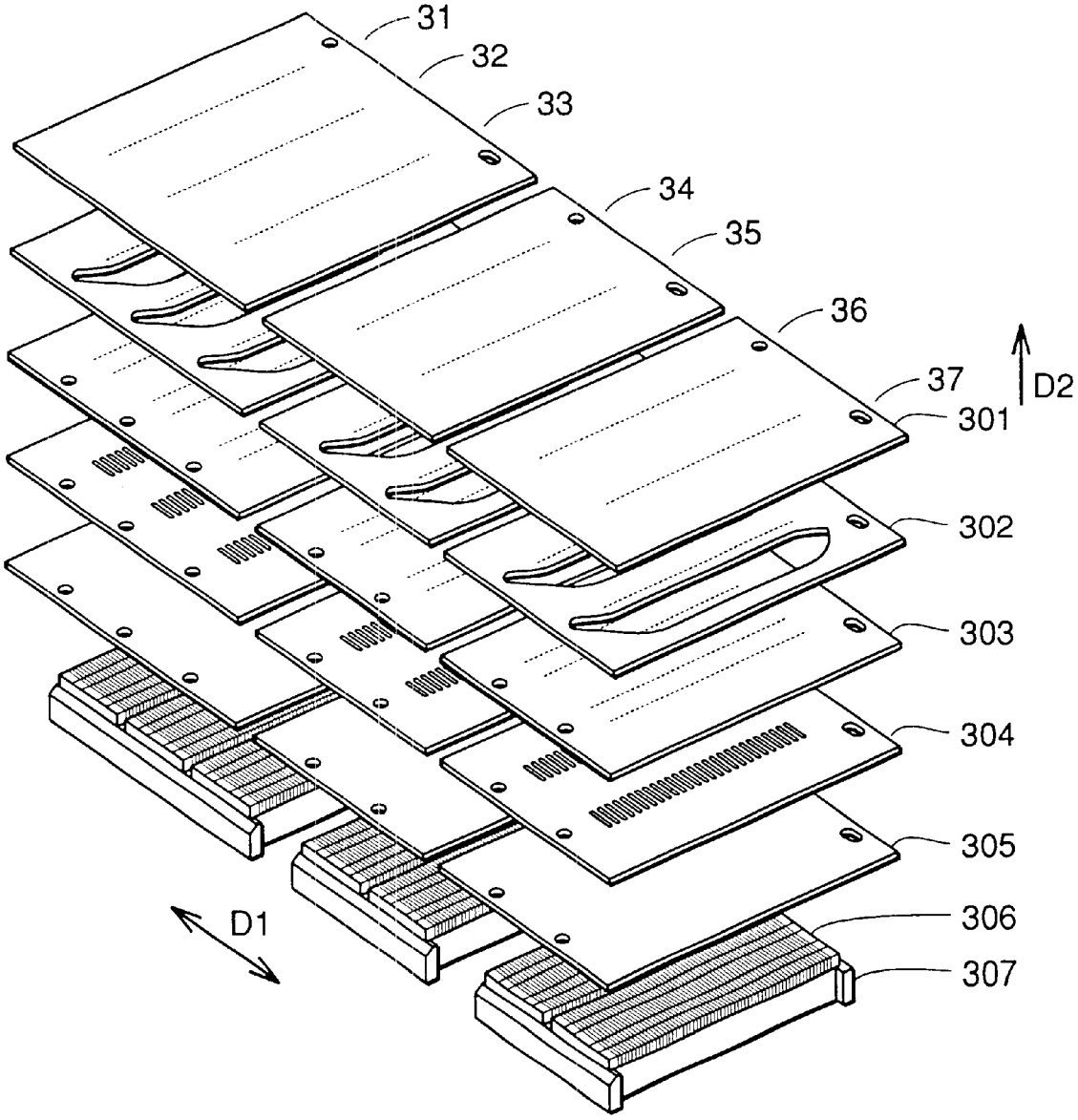
FIG. 91 is a perspective view showing assembling of ink jet head 3.
Figure 92:
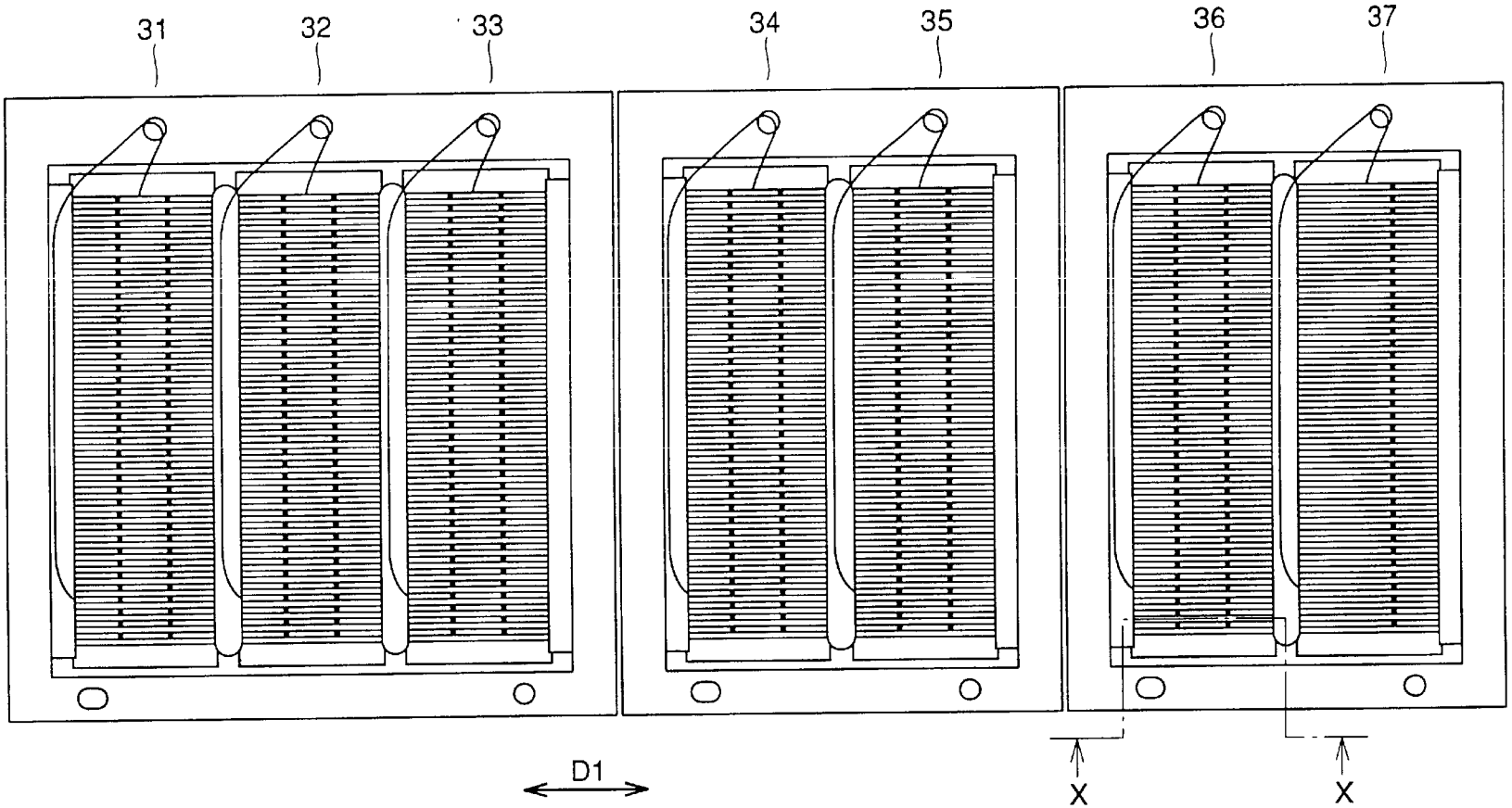
FIG. 92 is a top view of ink jet head 3.
Figure 93:
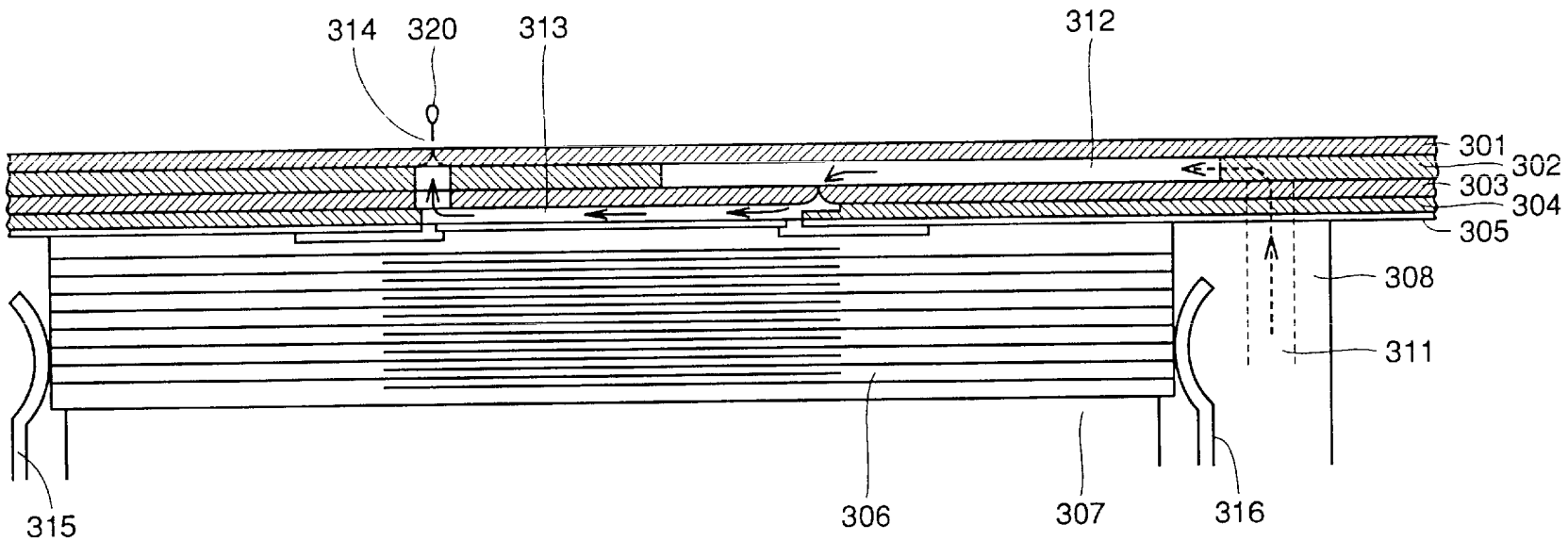
FIG. 93 is a cross section taken along line X—X of FIG. 92, for illustrating a flow of ink in ink jet head 3.

FIGS. 91–93 are views for illustrating a structure of an ink jet head 3 (shown in FIG. 90). FIG. 91 is a perspective view of an assembly of ink jet head 3, FIG. 92 is a top view of ink jet head 3, and FIG. 93 is a cross section taken along line X—X of FIG. 92, for illustrating a flow of ink in ink jet head 3.

As shown in FIG. 92, ink jet head 3 includes a head 31 for normal yellow ink, a head 32 for normal magenta ink and a head 33 for normal cyan ink for jetting normal ink of yellow, magenta and cyan, respectively, a head 34 for photo magenta ink and a head 35 for photo cyan ink for jetting photo ink of magenta and cyan, respectively, and a head 36 for normal black ink and a head 37 for photo black ink for jetting black normal ink and black photo ink, respectively.

Heads 31–37 for their respective colors in ink jet head 3 are structured by deposition of a nozzle plate 301 having a nozzle which jets ink drops, a common ink chamber plate 302 for forming an ink path, an inlet plate 303, a channel plate 304, a diaphragm 305, a piezoelectric element 306 which causes distortion when voltage is applied to fly ink drops, and a ceramic base 307. A side portion thereof is formed by a head holder 301, and piezoelectric element 306 are connected to lead frames 315 and 316.

As shown in FIG. 93, plates 301–305 form for each of heads 31-37 an ink path including common ink chamber 312, ink chamber 313 and nozzle 314. Common ink chamber 312 is connected to and thus supplied with ink from ink cartridge 403 (shown in FIG. 90) via an ink introducing path 311 provided in head holder 308 and receiver and feeder pin 402 (shown in FIG. 90).

The operation of ink jet head 3 thus structured is controlled by a control portion of ink jet printer 1. Head jet drive portion 105 of the control portion applies a predetermined pulse voltage based on image data between lead frames 315 and 316 and piezoelectric element 306 is deformed such that it pushes diaphragm 305. The deformation of piezoelectric element 306 is transferred to diaphragm 305. Thus, pressure is applied to the ink in ink chamber 313 and an ink drop 20 thus flies towards recording sheet 2 (shown in FIG. 89) via nozzle 314.

The control portion of ink jet printer 1 is the same as that shown in FIG. 7.

The data corresponding to a pulse voltage applied to piezoelectric element 306 from head jet drive portion 105 is processed so that dot patterns previously stored in ROM 103, as described later, are printed depending on levels of tone.

Figure 94:
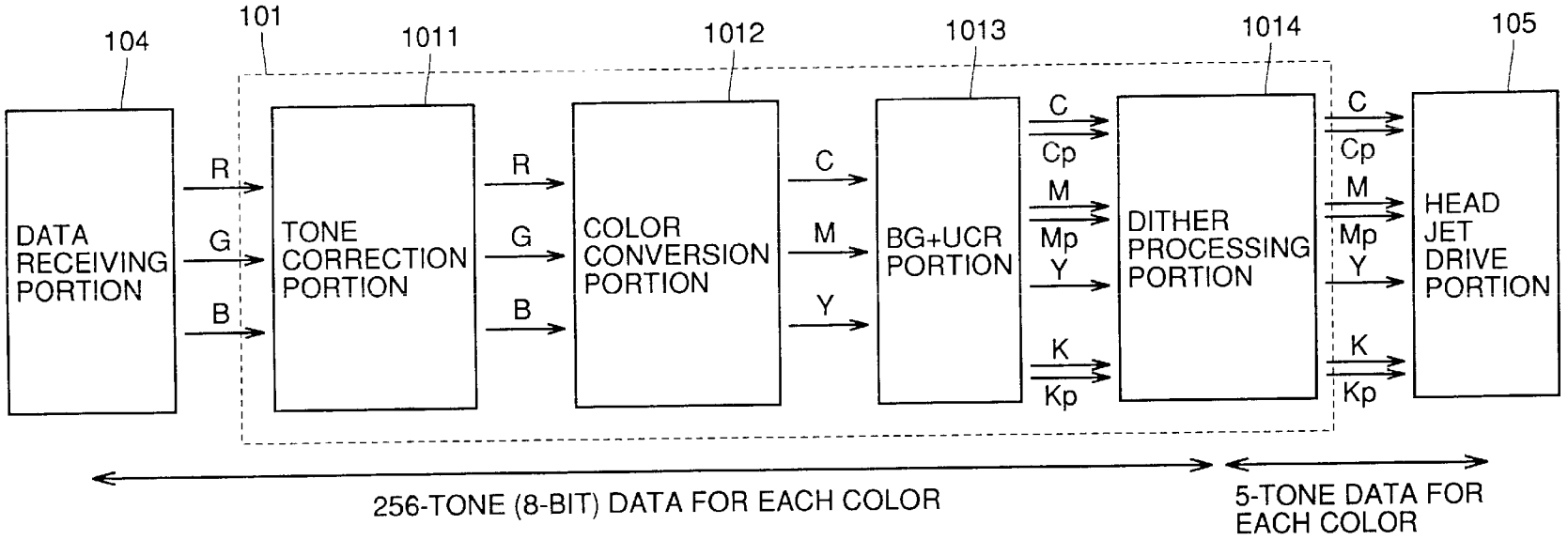
FIG. 94 is a block diagram for illustrating a procedure of an image data processing provided by CPU 101.

A procedure of a processing for the image data described above will now be described. FIG. 94 is a block diagram for illustrating a procedure of an image data processing provided by CPU 101.

Image data of 256 tones corresponding to each color of red, green and blue, which can be referred to as R, G and B, respectively, hereinafter, from data receiving portion 104 (shown in FIG. 7) is initially corrected in tone at a tone correction portion 110. The R, G and B image data corrected in tone are converted into image data corresponding to C, M and Y at a color conversion portion 1012. Then, a BG+UCR portion 1013 separates gray component from the converted C, M and Y image data, and produces K image data and image data corresponding to Cp, Mp and Kp.

These image data are subjected to dither processing at a dither processing portion 1014, and image data of 256 tones for each color is converted into data corresponding to a pulse voltage applied to piezoelectric element 306 from head jet drive portion 105.

Dot patterns printed as a single pixel corresponding to a single image data described above, and an effect of thus using dots will now be described with reference to FIGS. 95–97.

Figure 95:
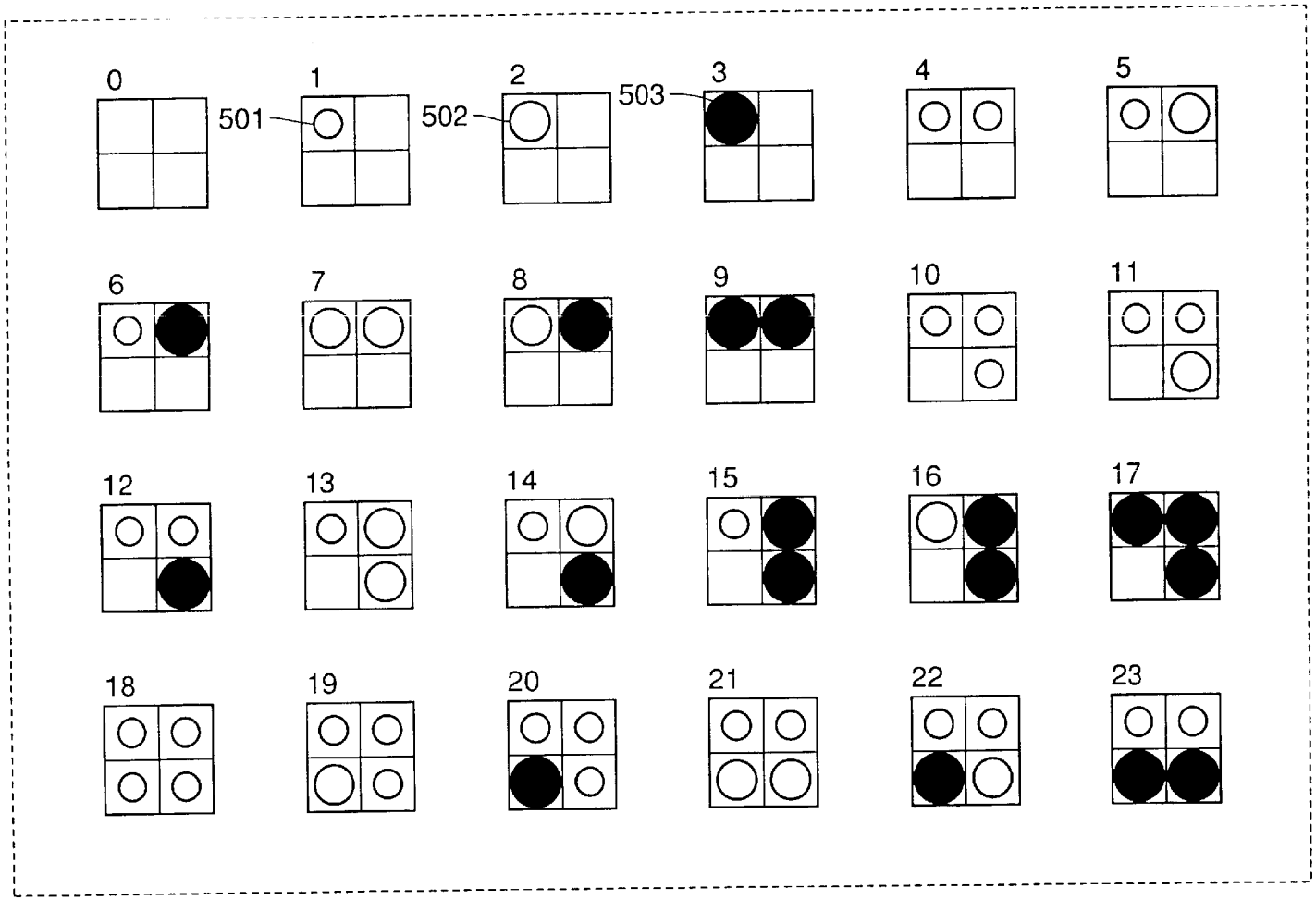
FIG. 95 is a first view showing dot patterns printed by ink jet printer 1.
Figure 96:
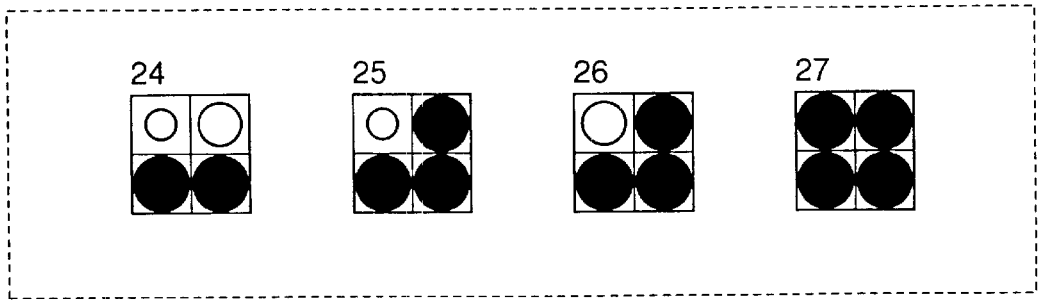
FIG. 96 is a second view showing dot patterns printed by ink jet printer 1.

FIGS. 95 and 96 show dot patterns printed by ink jet printer 1.

A dot matrix corresponding to a single pixel that forms an image printed by ink jet printer 1 is formed of two rows and two columns. A dot 501 in the matrix representing tones 1 is a dot of small diameter in photo ink, a dot 502 in the matrix representing tones 2 is a dot of intermediate diameter in photo ink, and a dot 503 in the matrix representing tones 3 is a dot of large diameter in normal ink. Practically, any of Cp, Mp and Kp is applied to dot 501 and dot 502 and any of C, M, Y and K is applied to dot 503.

When image data corresponding to a single pixel corresponds to tone 22 shown in FIG. 95, for example, dot 501 of small diameter in photo ink is printed in the matrix corresponding to the pixel that is segmented like a grid of 2×2 at each of the segment in the first row and the first column and the segment in the first row and the second column, dot 503 of large diameter in normal ink at the segment in the second row and the first column and dot 502 of intermediate diameter in photo ink at the segment in the second row and the second column such that the center of each dot is aligned with the center of the respective segment.

Figure 97:
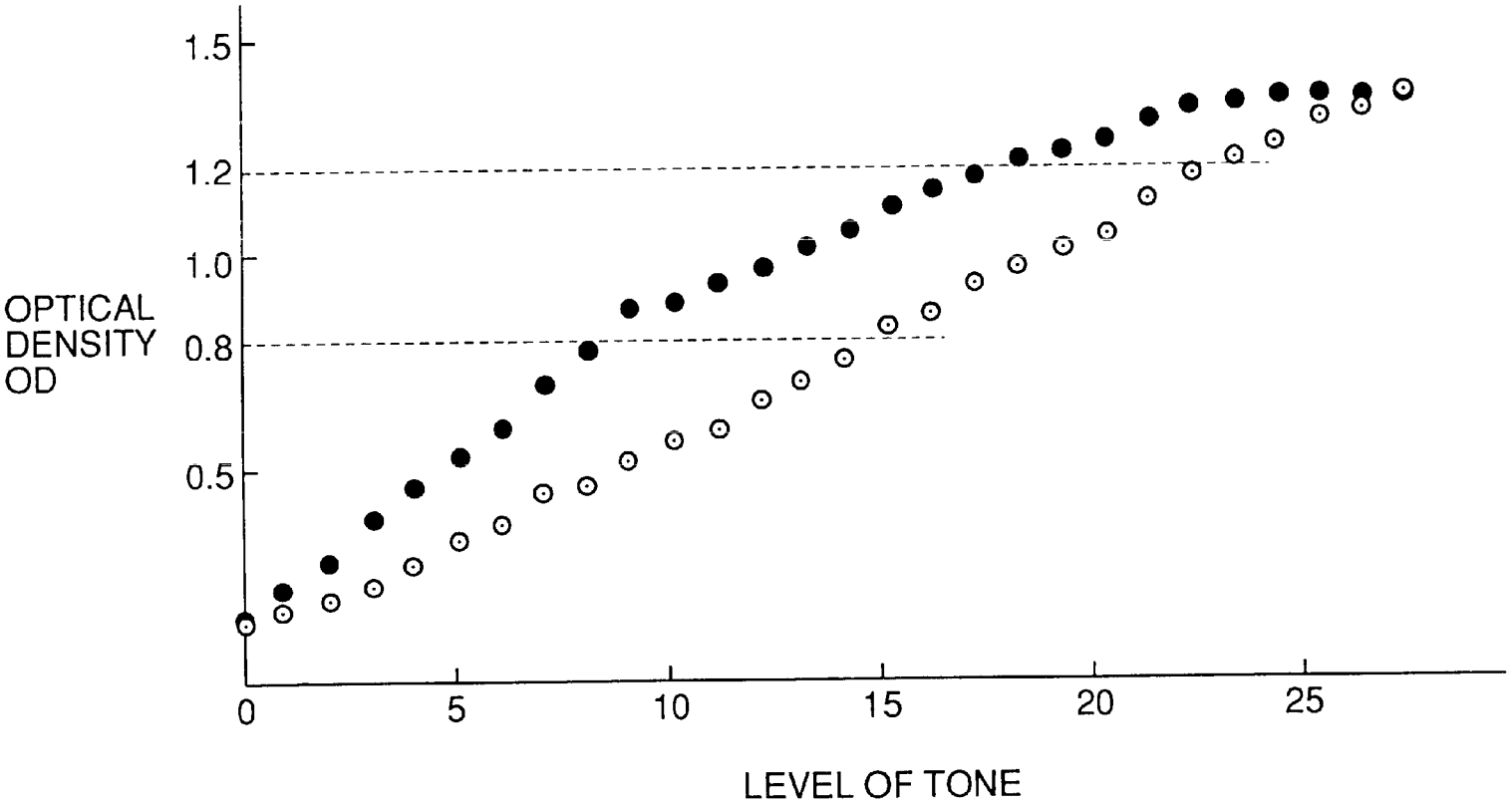
FIG. 97 is a view presented for comparison between optical densities for dot patterns printed by ink jet printer 1 and those for dot patterns printed by an ink jet printer as Conventional Example 3-3.
Figure 98:
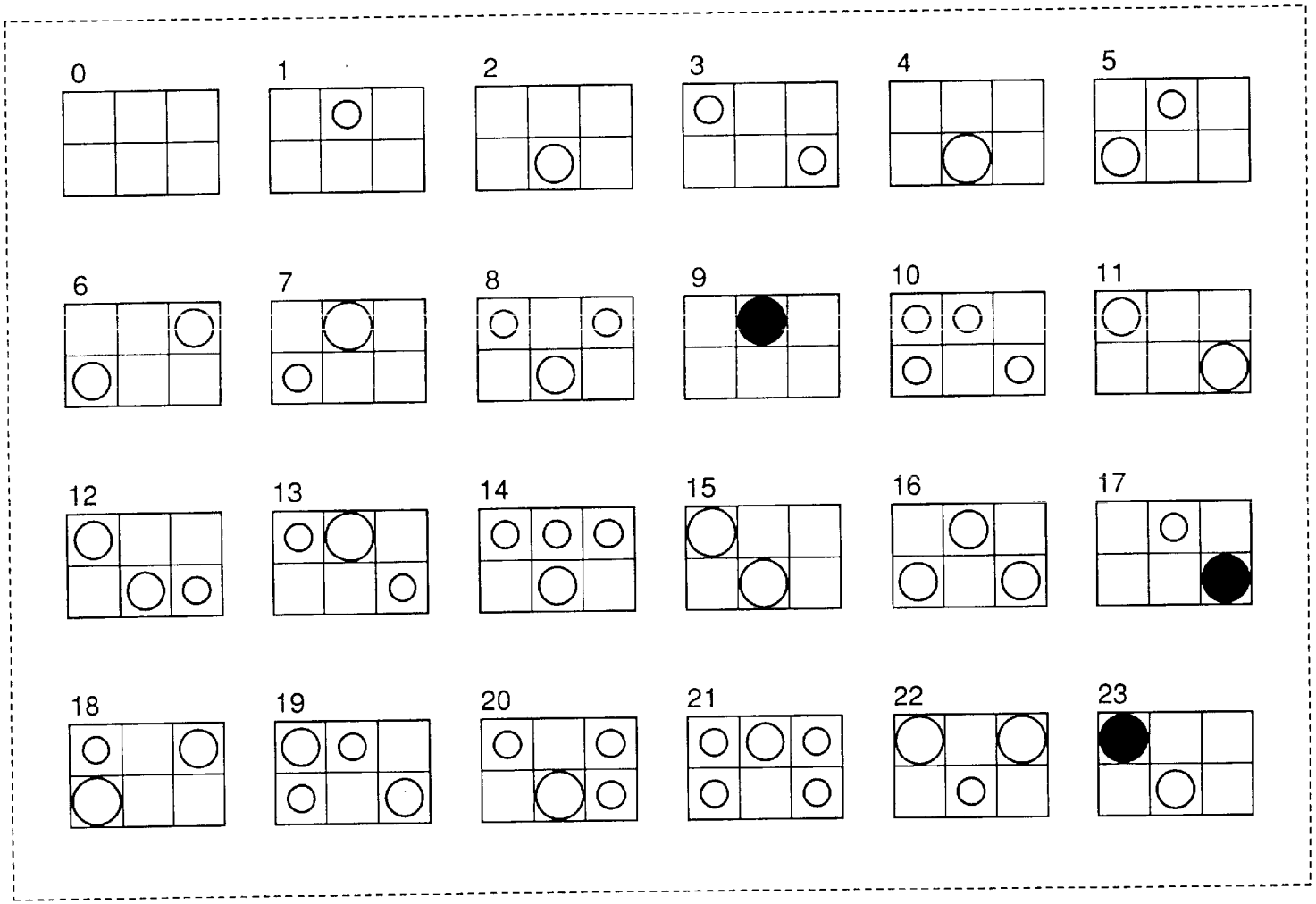
FIGS. 98–105 is a first view showing dot patterns printed by an ink jet printer as Embodiment 3-2.
Figure 99:
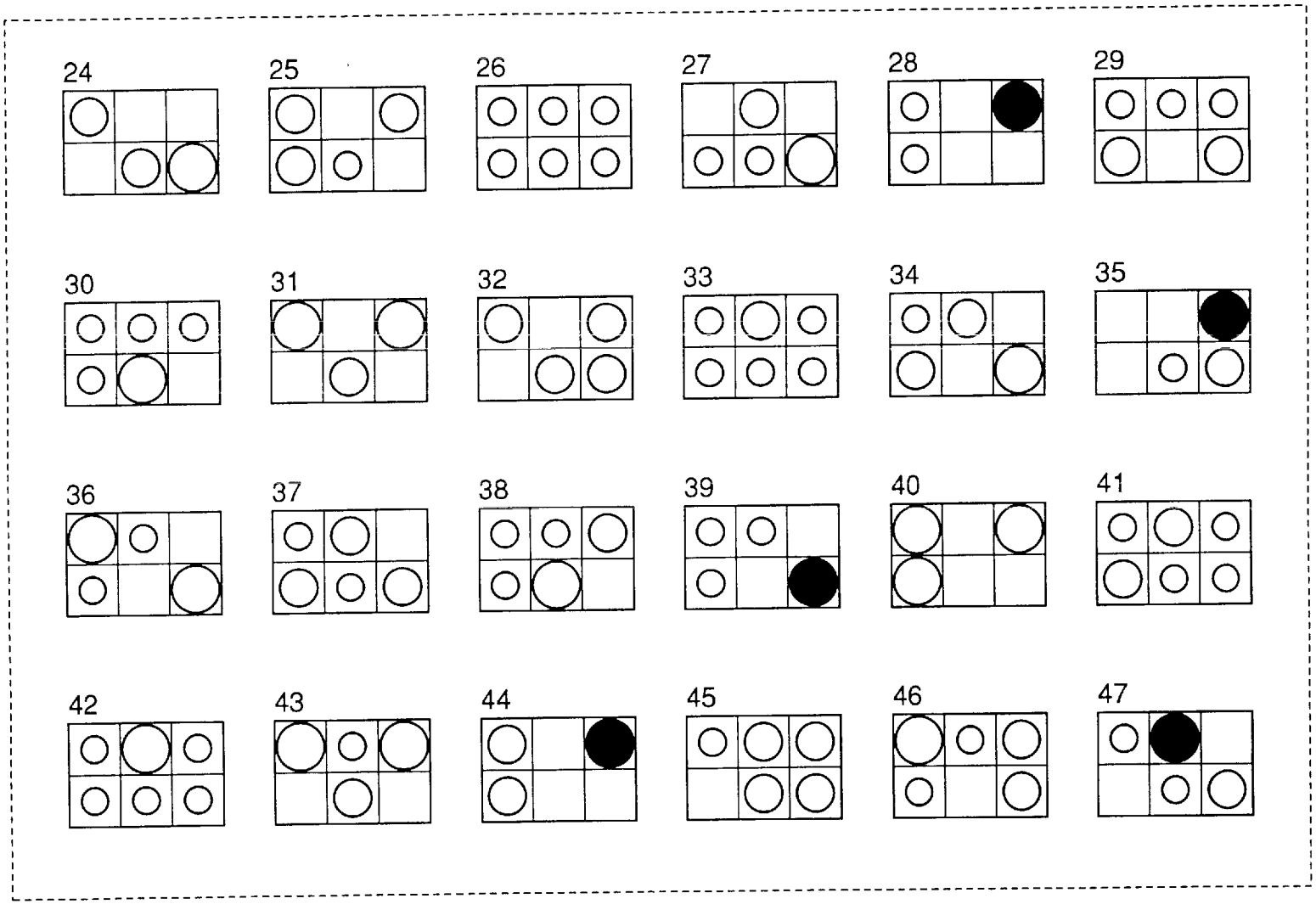
Figure 100:
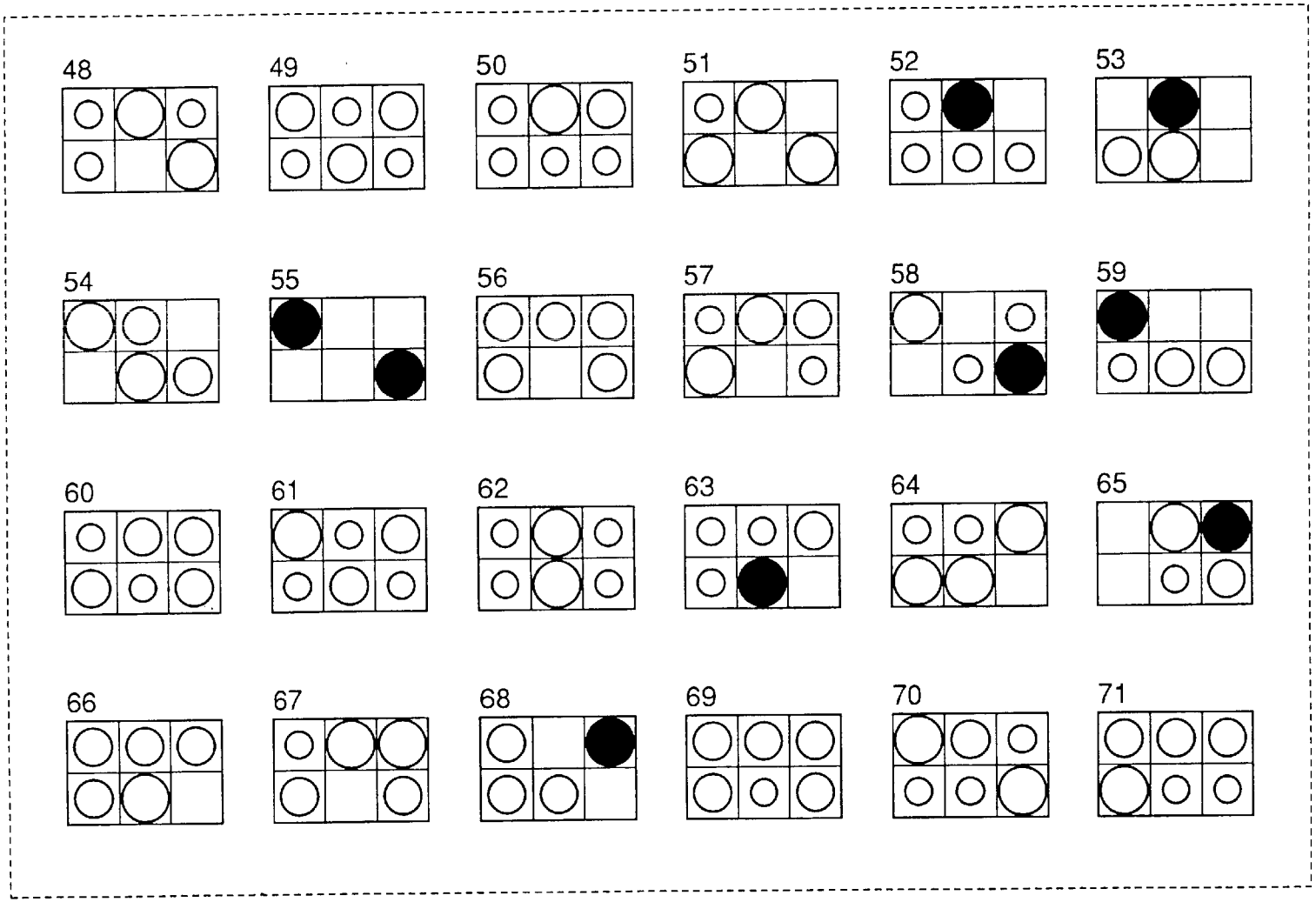
Figure 101:
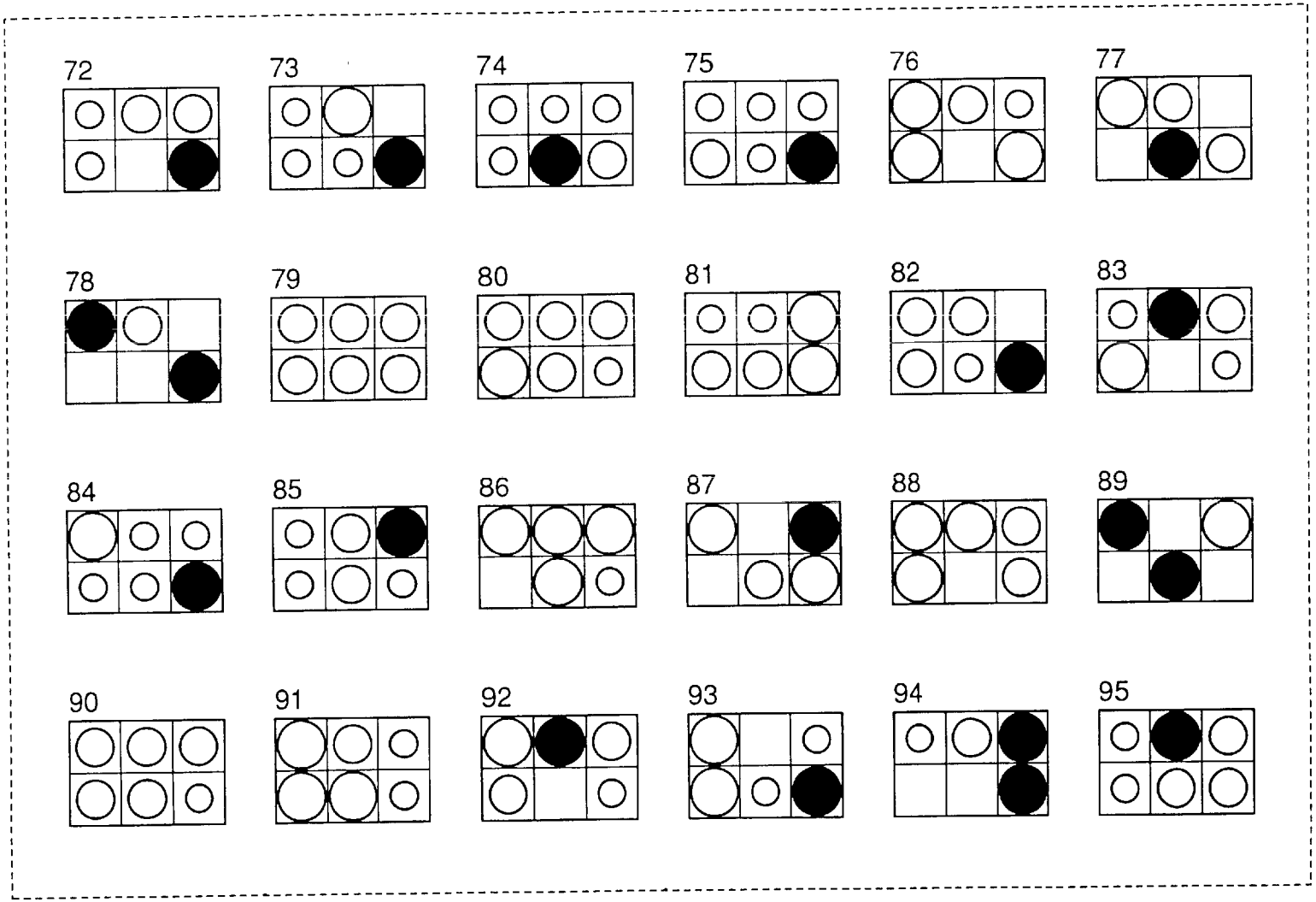
Figure 102:
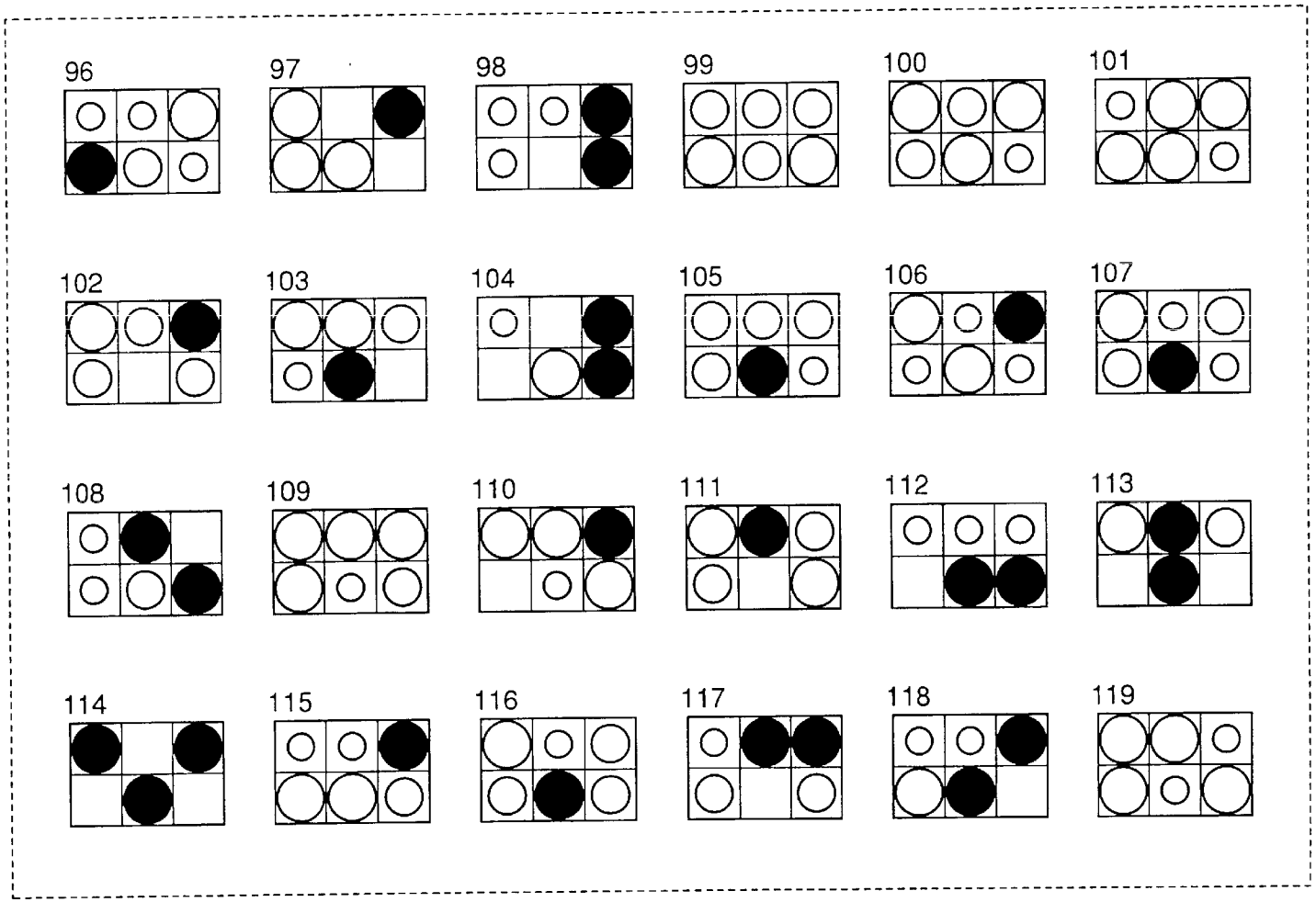
Figure 103:
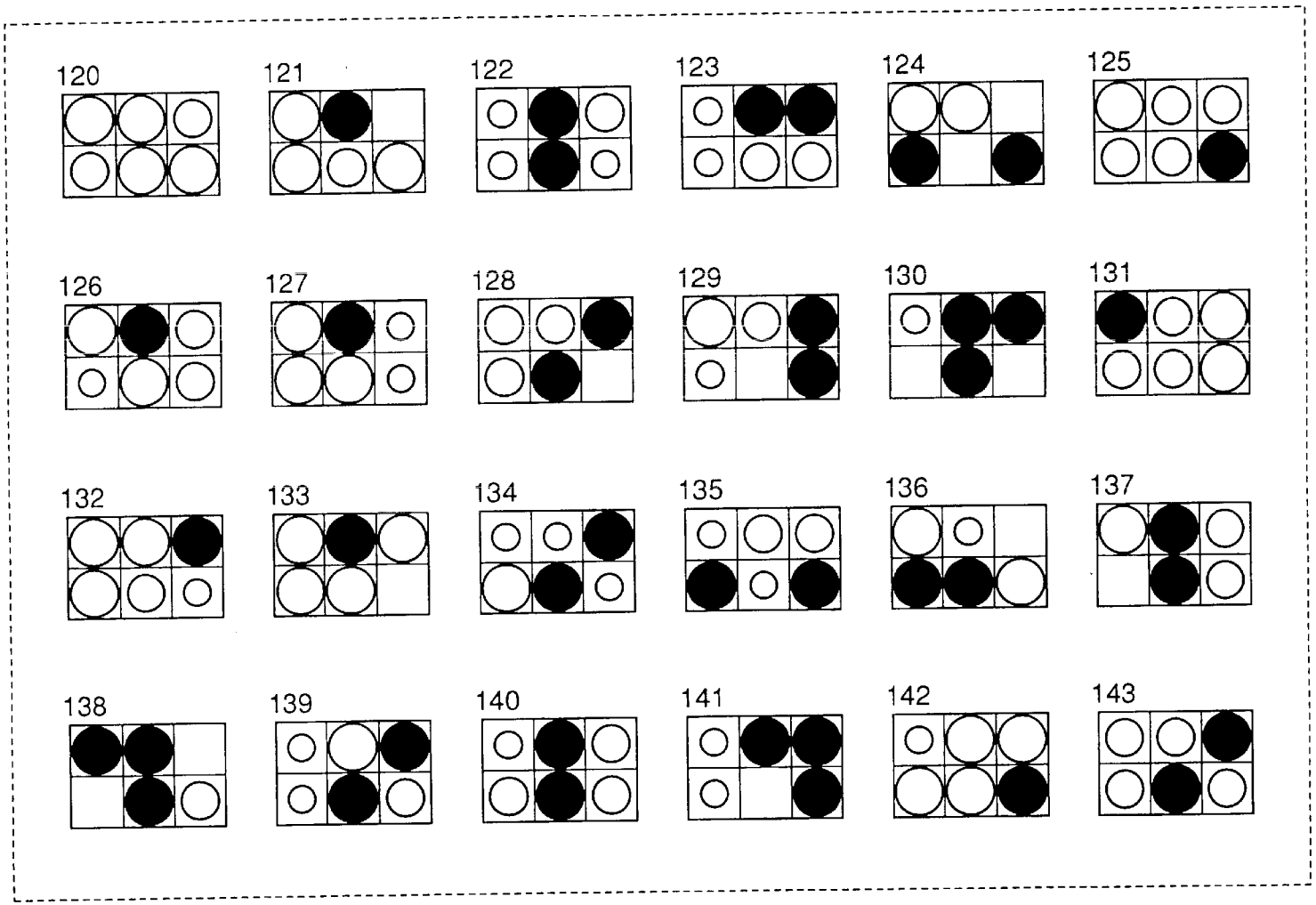
Figure 104:
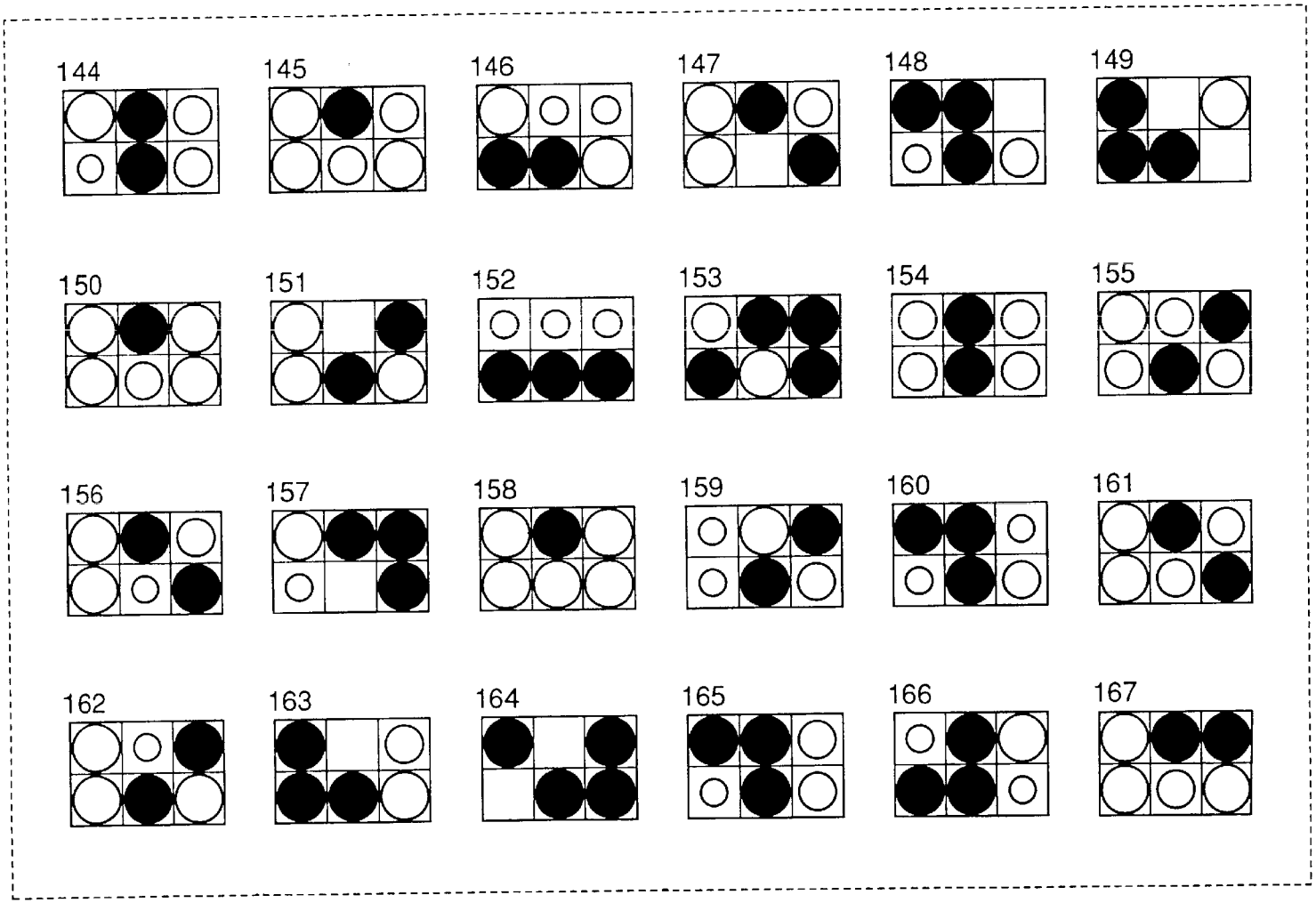
Figure 105:
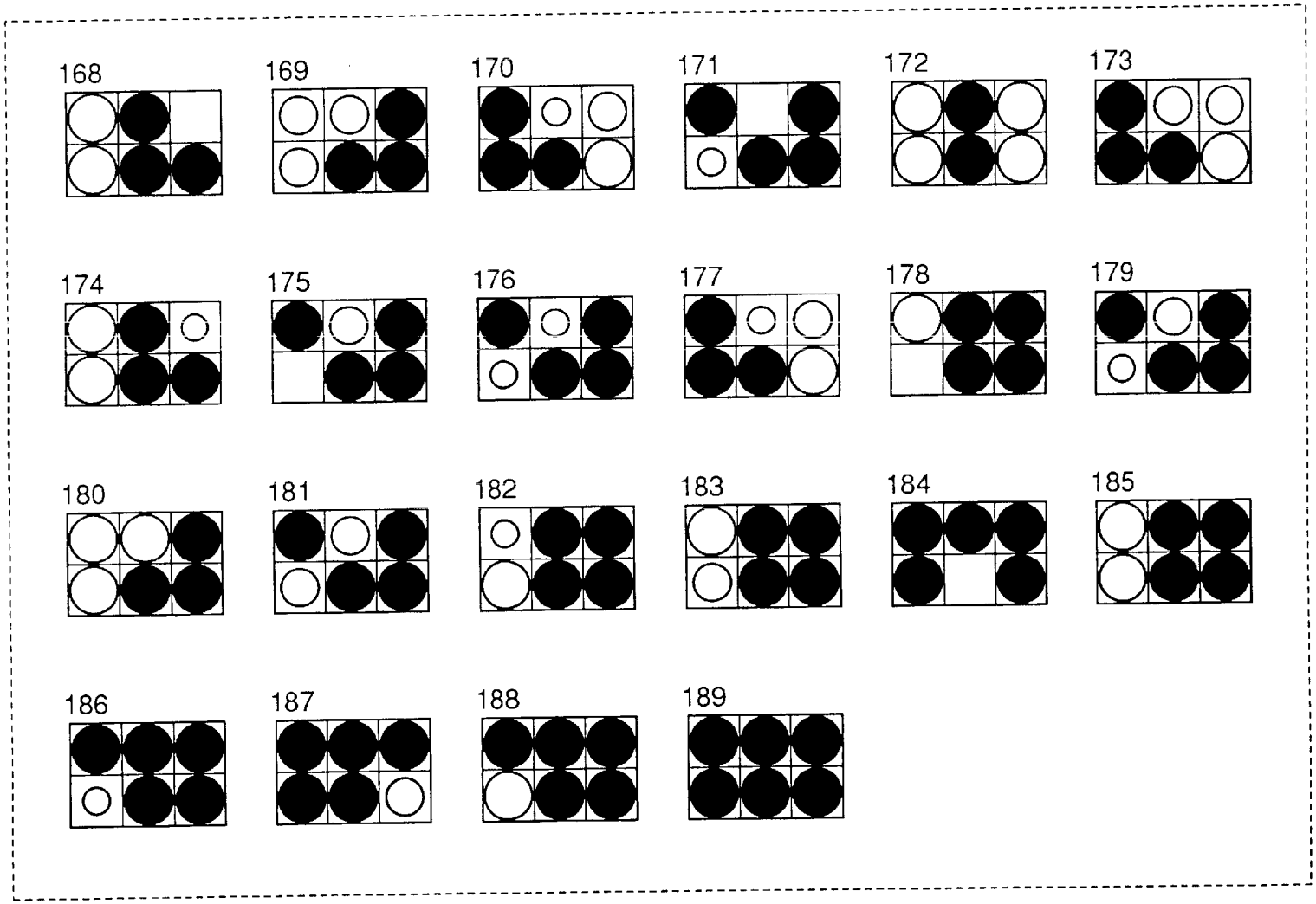

FIG. 97 is a diagram for comparison between the optical density for dot patterns printed by ink jet printer 1 and that for dot patterns printed by an ink jet printer as conventional example 3-3.

In FIG. 97, the horizontal axis represents the tones which have the dot patterns as shown in FIGS. 95 and 96 (FIGS. 87 and 88) and the vertical axis represents optical density corresponding to the tones. The white dots correspond to ink jet printer 1 of the present embodiment and the black dots correspond to the ink jet printer as Conventional Example 3-3.

The graph shown in FIG. 97 is obtained by measuring the optical density of an image printed for each one tone. High Grade Color KJHA4100, a sheet for printers and word processors of the IJ system manufactured by Kao Corp. is used as the recording sheet. The ink used is those with the compositions described above. The optical density measuring device used is Sakura Densitometer (PDA65) manufactured by Sakura (KONIKA CORP. incumbent).

The ink described above is used to print the dot patterns of the tones corresponding to the horizontal axis of the graph (i.e., the FIGS. 95 and 96 dot patterns printed by ink jet printer 1 and the FIGS. 87 and 88 dot patterns printed by the ink jet printer as a Conventional Example 3-3) that each forms a region of at least 5 mm×5 mm on a recording sheet and the optical densities thereof are measured by the measuring device described above.

It should be noted that for any of images printed by ink jet printer 1 and the ink jet printer as Conventional Example 3-3, the optical density of the recording sheet itself, which corresponds to tone 0, is approximately 0.1, and the optical density of a solid recording sheet, which corresponds to tone 27, is approximately 1.5.

Referring to the result, a gradient $\gamma$ of optical density with respect to tone for an image printed by the ink jet printer as Conventional Example 3-3 is slightly larger than that for an image printed by ink jet printer 1 for tones 0–9, and has almost the same value as ink jet printer 1 for tones 10–18. As the tone is further increased, the value $\gamma$ for the ink jet printer as Conventional Example 3-3 is gradually decreased and is nearly equal to zero around tone 27.

It is also seen from the result that for an optical density ranging from 0.1 to 0.8, 9 tones are allotted to the ink jet printer as Conventional Example 3-3 and 15 tones to ink jet printer 1, and that for an optical density ranging from 1.2 to 1.5, 10 tones are allotted to the ink jet printer as Conventional Example 3-3 and 6 tones to ink jet printer 1.

This specifically means that more delicate difference of tone at less dense portions (i.e., highlighted portions) can be reproduced in images printed by ink jet printer 1 than those printed by the ink jet printer as Conventional Example 3-3.

The matrix set to provide multi-value printing (i.e., printing dots of a plurality of diameters) for photo ink and binary printing (i.e., printing dots of a single diameter) for normal ink allows printing images which have smooth tones particularly at highlighted portions. Smooth reproduction of highlighted image as a region to which human vision is sensitive improves the quality of the entire image. Furthermore, ink jet printers which print such images do not require a drive circuit for performing complicated processings and thus do not increase the manufacturing cost thereof.

Dot patterns printed by an ink jet printer as Embodiment 3-2 will now be described. The entire structure of the ink jet printer as Embodiment 3-2, and the configuration of a printer head, the configuration of a control portion and the like are similar to those of the ink jet printer as Embodiment 3-1.

FIGS. 98–105 show dot patterns printed by the ink jet printer as Embodiment 3-2.

A dot matrix corresponding to a single pixel that forms an image printed by the ink jet printer as Embodiment 3-2 is formed of two rows and three columns. A dot 506 in the matrix representing tone 1 is a dot of small diameter in photo ink. A dot 507 in the matrix representing tone 2 is a dot of intermediate diameter in photo ink. A dot 508 in the matrix representing tone 4 is a dot of large diameter in photo ink. A dot 509 in the matrix representing tone 9 is a dot of large diameter in normal ink. In practice, any of Cp, Mp and Kp is applied for dots 506–508 and any of C, M, Y and K is applied for dot 509.

For example, when image data corresponding to a single pixel corresponds to tone 47 (shown in FIG. 99), dot 506 of small diameter in photo ink is printed in the matrix segmented like a grid of 2×3 for the single pixel at each of the segment in the first row and the first column and the segment in the second row and the second column, dot 507 of small diameter in photo ink is printed at the segment in the second row and the third column and dot 509 of large diameter in normal ink is printed at the segment in the first row and the second column such that the center of each dot is aligned with the center of the respective segment.

Such dot matrixes also allow an effect similar to that provided by the ink jet printer as Embodiment 3-1 and images can be printed with smooth tones particularly at the highlighted portions thereof. The smooth reproduction of a highlighted image as a region to which human vision is sensitive improves the quality of the entire image. Furthermore, ink jet printers which print such images do not require a drive circuit for providing complicated processings and thus do not increase the manufacturing cost thereof.

Now, the image quality indices of the ink jet printers as Embodiments 3-1 and 3-2 and those of the ink jet printers as Conventional Examples 3-1 to 3-3 will be calculated.

Figure 106:
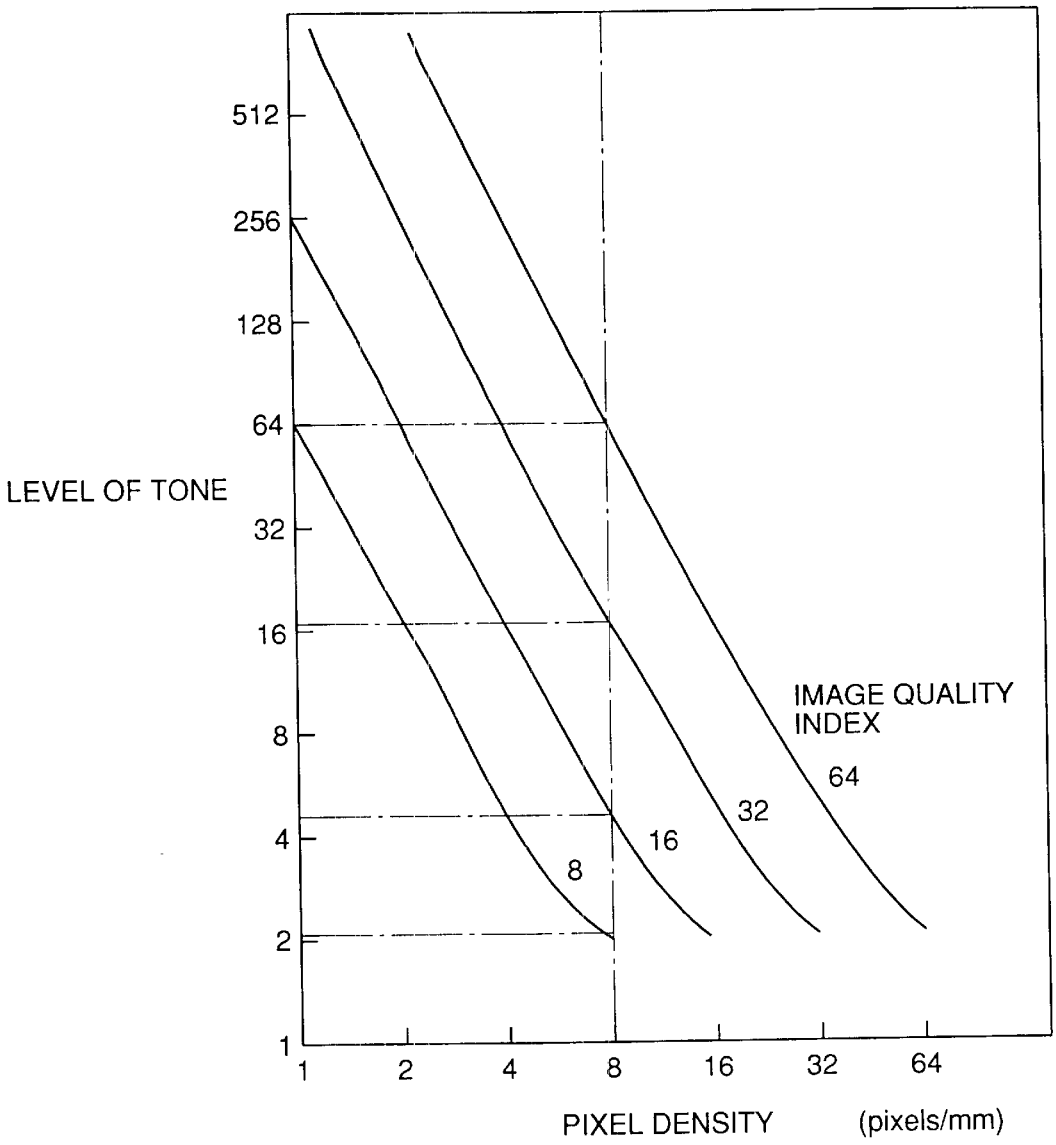
FIG. 106 represents image quality index with respect to tone level and pixel density.

An image quality index Q is a value used as a reference in estimating the smoothness of an image and is represented as $Q=M\times\sqrt{(N-1)}$, wherein M represents pixel density (pixels/mm) and N represents tone number, which is represented as shown in FIG. 106.

For the ink jet printer of the present embodiment, dot density is approximately 400 (360 dpi) and dot pitch is approximately 63.5 $\mu$m.

For the ink jet printer of Embodiment 3-1, the dot matrix is of two rows and two columns, and the pitch of a pixel is 63.5 $\mu$m×2=127 $\mu$m and the pixel density M=1/127 $\mu$m≈8 pixels/mm. Thus, an image quality index $Q1=8\times\sqrt{(28-1)}\approx 42$.

For the ink jet printer of Embodiment 3-2, an image quality index Q2 is calculated with respect to a main scanning direction (i.e., the direction in which three dots are aligned within one pixel). The image density M=1/(63.5 $\mu$m×3)≈5.3 pixels/mm and the image quality index $Q2=5.3\times\sqrt{(190-1)}\approx 73$.

Similarly, the image indices are calculated with respect to the ink jet printers as Conventional Examples 3-1 to 3-3, the pixel densities of which are similar to that of the ink jet printer of Embodiment 3-1, i.e., a pixel density of 8 pixels/mm.

For the ink jet printer as Conventional Example 3-1, the number of tones N is 5 and the image quality index Q3=8×

$\sqrt{(5-1)}=16$. For the ink jet printer as Conventional Example 3-2, the number of tones N=15 and the image quality index Q4=$8\times\sqrt{(15-1)}\approx30$. For the ink jet printer as Conventional Example 3-3, the number of tones N is 28 and the image quality index Q5=$8\times\sqrt{(28-1)}\approx42$.

The image quality index Q for devices and equipments for office automation is generally larger than 32 and smaller than 64. According to the image quality indices Q1–Q5 calculated as above, the ink printer as Embodiment 3-1 and the ink printer as Conventional Example 3-3 have their respective image quality indices in this range and the ink jet printer as Embodiment 3-2 has its image quality index Q exceeding the range. Images printed by these ink jet printers are sufficiently smooth as full color images printed for office automation.

It should be noted that while the value Q of the ink jet printer as Embodiment 3-1 is the same as that of the ink jet printer as Conventional Example 3-3, the ink jet printer as Embodiment 3-1 can print smoother images due to the reason described with reference to FIG. 97. The ink jet printer as Embodiment 3-2 has its image quality index Q4 exceeding 64 and thus prints further smoother, full color images.

While the ink jet printers of the embodiments provided above are described with respect to the dot matrixes of two rows and two columns and two rows and three columns, a dot matrix of no less than three rows and no less than three columns may be applied, as with an ink jet printer as a modification of the present invention described below.

Figure 107:
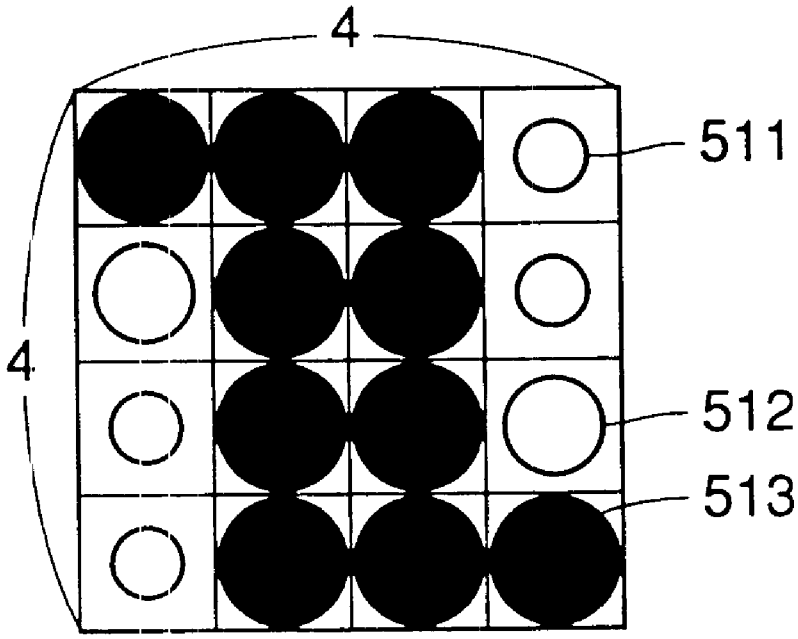
FIG. 107 is a view for illustrating a dot matrix forming an image printed by an ink jet printer as a modification of the present invention.

FIG. 107 is a view for illustrating a dot matrix which forms an image printed by the ink jet printer as the modification of the present invention.

The dot matrix for the modified ink jet printer is formed of four rows and four columns and employs a dot 511 of small diameter in photo ink, a dot 512 of intermediate diameter in photo ink and a dot 513 of large diameter in normal ink. An image quality index Q6 calculated in a manner similar to that applied to the ink jet printers described above is $4\times\sqrt{(16-1)}\approx16$ and is at the same level as that of Conventional Example 3-1. This fact reflects that a pixel index is the product of a pixel density of 1st order and the number of tones of 0.5th order and is thus affected more readily by pixel density than the number of tones. Thus, a sufficiently increased resolution is required in obtaining a large dot matrix.

Thus, the ink jet printer of the present embodiment can smoothly change the level of tones of images printed without a drive circuit for providing complicated processings and can thus improve image quality while reducing manufacturing cost.

Embodiment 4-1

Figure 108:
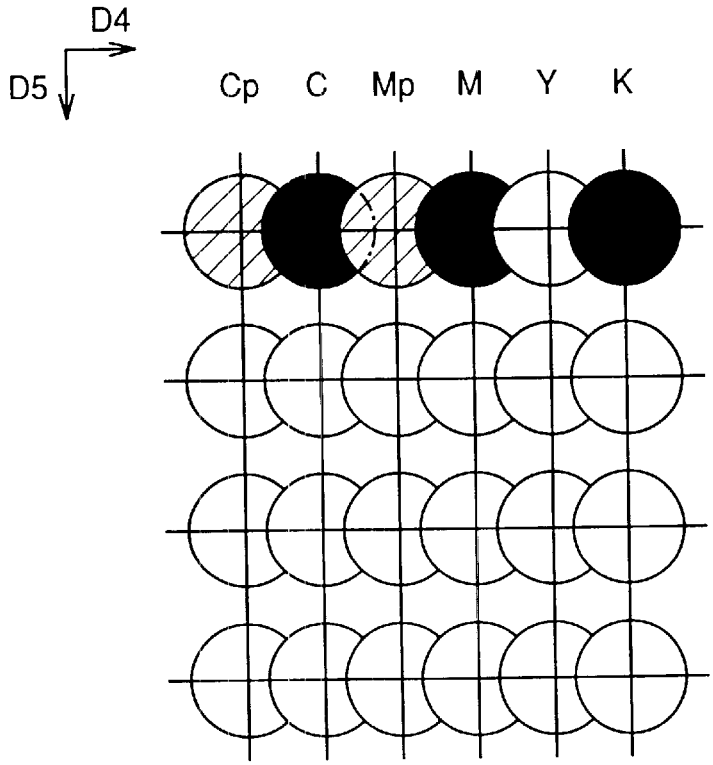
FIG.108 RELATED ART
FIGS. 108 and 109 are first and second views, respectively, for illustrating an order of printing normal color and photo color dots by means of an ink jet printer as Conventional Example 4-1.
Figure 109:
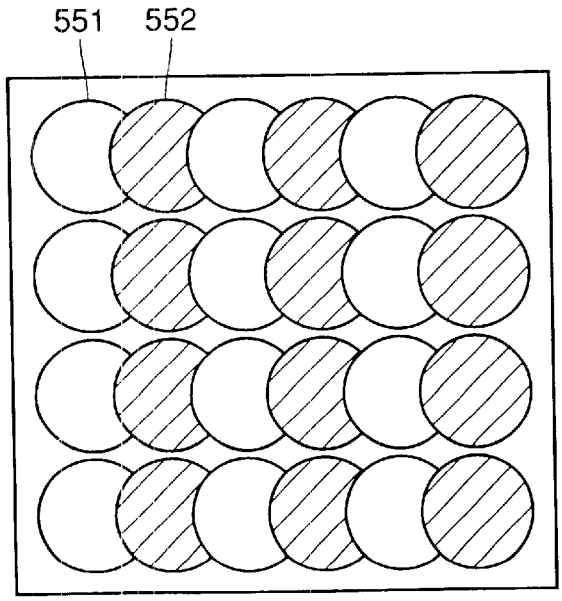
FIG.109 RELATED ART
Figure 110:
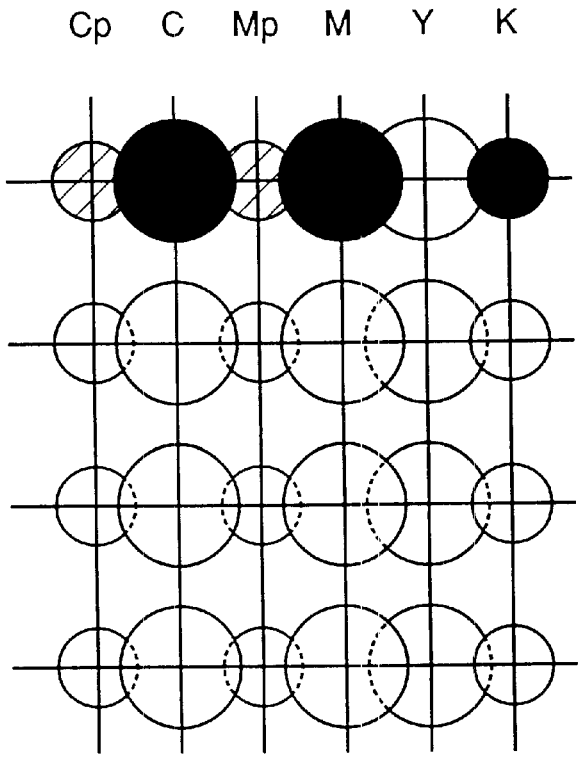
FIG.110 RELATED ART
FIGS. 110 and 111 are first and second views, respectively, for illustrating an order of printing normal color and photo color dots by means of an ink jet printer as Conventional Example 4-2.
Figure 111:
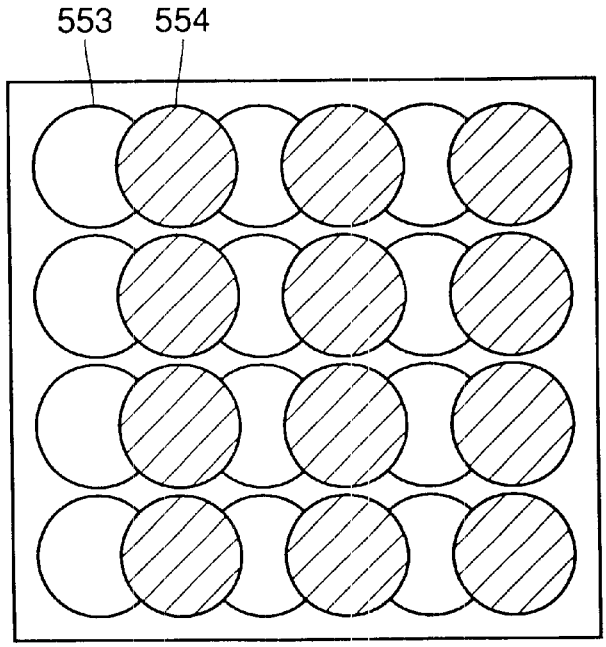
FIG.111 RELATED ART

FIGS. 108 and 109 are views for illustrating an order of printing dots in normal color and photo color by means of an ink jet printer as Conventional Example 4-1. FIGS. 110 and 111 are views for illustrating an order of printing dots in normal color and photocolor by means of an ink jet printer as Conventional Example 4-2. In FIGS. 108 and 110, the pitch in a main scanning direction (i.e., the direction indicated by arrow D4 in FIG. 108) is 360 dpi, and the pitch in a subscanning direction (i.e., a direction indicated by arrow D5 in FIG. 108) is 108 dpi. Hereinafter, a similar pitch is applied in a similar view.

With the ink jet printer as Conventional Example 4-1, dots of the same diameter are printed in the order of Cp→C→Mp→M→Y→K, as shown in FIG. 108. This means that with the ink jet printer as Conventional Example 4-1, a dot 551 of a relatively light color and a dot 552 of a relatively dark color are alternately printed, as shown in FIG. 109.

With the ink jet printer as Conventional Example 4-2, dots of small diameter in Cp and Mp and a dot of large diameter in Y are printed earlier than dots of large diameter in C and M and a dot of small diameter in K, as shown in FIG. 110. This means that with the ink jet printer as Conventional Example 4-2, a dot 553 of a relatively light color is printed earlier than a dot 554 of a relatively dark color, as shown in FIG. 111.

While the six types of color dots in normal color and photo color are printed on recording sheets in the orders described above, an image thus printed has the dots in the normal color more remarkable and can be disadvantageously rough. Furthermore, the image thus printed is not either an image which is sufficiently smooth and is balanced in color or an image closer to photograph, and can thus not be said to have sufficiently high image quality.

The present embodiment provides an image forming apparatus capable of solving such disadvantages and thus improving the quality of printed images.

The schematic configuration of an ink jet printer 1 according to Embodiment 4-1 is similar to those shown in FIGS. 89 and 90.

The ink in ink cartridge 403 includes the six colors of yellow, magenta, cyan and black in normal ink and magenta and cyan in photo ink. Their compositions are as described as follows.

Normal yellow ink contains water of 76.6%, polyhydric alcohol/DEG of 11.0%, polyhydric alcohol ether/TGB of 6.5%, and a thickener/PEG #400 of 3.0% as the solvent. It also contains a dye/Bayer Y-CA51092 of 2.5% as a coloring material and a surfactant/Olfine E1010 of 0.8% and a pH adjusting agent/$NaHCO_3$ of 0.2% as additives.

Normal magenta ink contains water of 75.8%, polyhydric alcohol/DEG of 11.0%, polyhydric alcohol ether/TGB of 6.5% and a thickener/PEG #400 of 3.2% as the solvent. It also contains a dye/BASF Red FF-3282 of 2.5% as a coloring material, and a surfactant/Olfine E1010 of 0.8% and a pH adjusting agent/$NaHCO_3$ of 0.2% as additives.

Normal cyan ink contains water of 75.5%, polyhydric alcohol/DEG of 11.0%, polyhydric alcohol ether/TGB of 6.5% and a thickener/PEG #400 of 3.0% as the solvent. It also contains a dye/Bayer CY-BG of 3.0% as a coloring material, and a surfactant/Olfine E1010 of 0.8% and a pH adjusting agent/$NaHCO_3$ of 0.2% as additives.

Normal black ink contains water of 79.1%, polyhydric alcohol/DEG of 6.0%, polyhydric alcohol ether/TGB of 6.0%, and a thickener/PEG #400 of 4.5% as the solvent. It also contains a dye/Bayer BK-SP of 3.4% as a coloring material, and a surfactant/Olfine E1010 of 0.8% and a pH adjusting agent/$NaHCO_3$ of 0.2% as additives.

Photo magenta ink contains water of 76.3%, polyhydric alcohol/DEG of 11.0%, polyhydric alcohol ether/TGB of 6.5% and a thickener/PEG #400 of 4.5% as the solvent. It also contains a dye/BASF RED FF-3282 of 0.7% as a coloring material, and a surfactant/Olfine E1010 of 0.8% and a pH adjusting agent/$NaHCO_3$ of 0.2% as additives.

Photo cyan ink contains water of 76.2%, polyhydric alcohol/DEG of 11.0%, polyhydric alcohol ether/TGB of 6.5% and a thickener/PEG #400 of 4.5% as the solvent. It also contains a dye/Bayer CY-BG of 0.8% as a coloring material, and a surfactant/Olfine E1010 of 0.8% and a pH adjusting agent/$NaHCO_3$ of 0.2% as additives.

Figure 112:
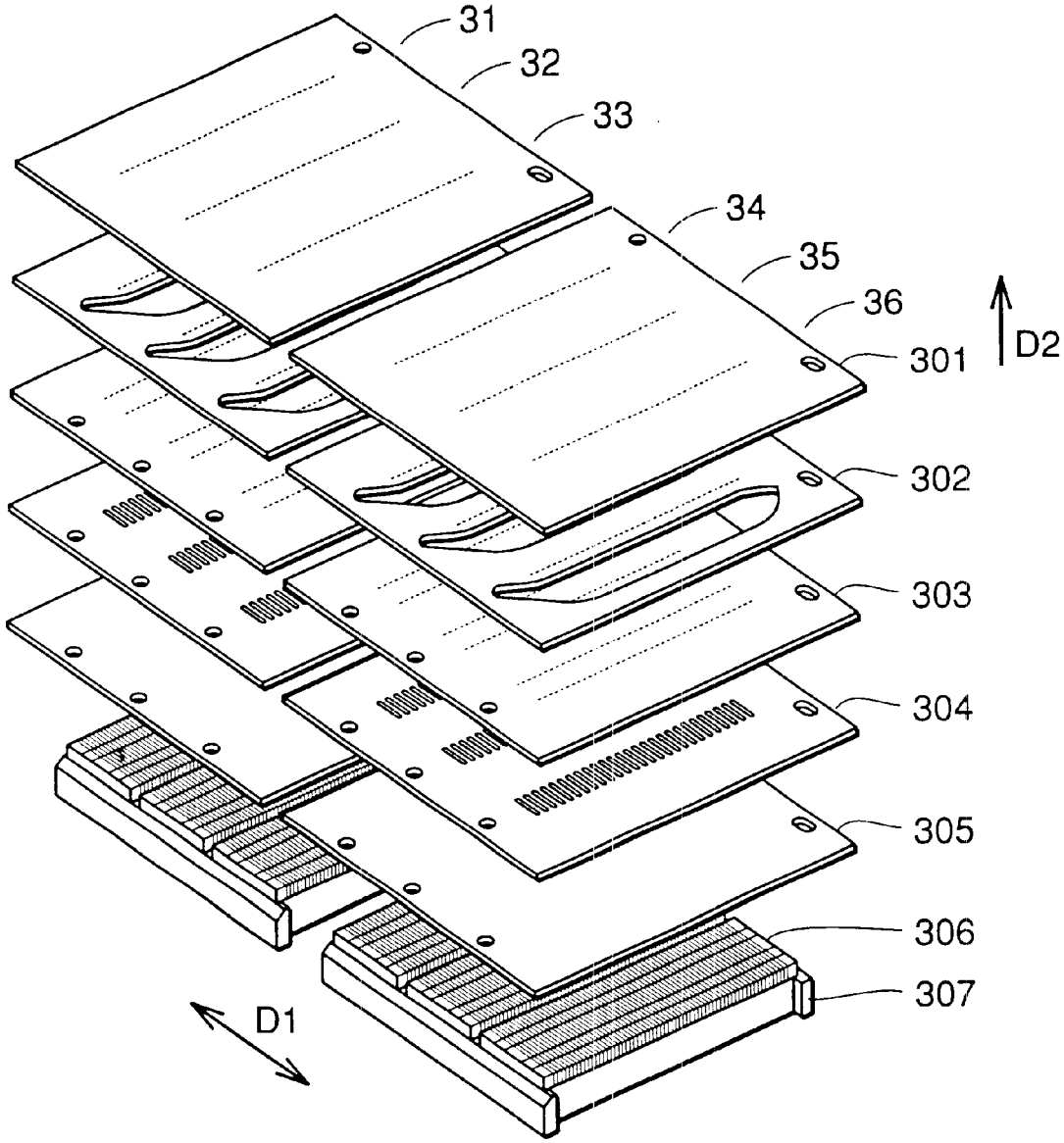
FIG. 112 is a perspective view showing assembling of ink jet head 3 in Embodiment 4-1.
Figure 113:
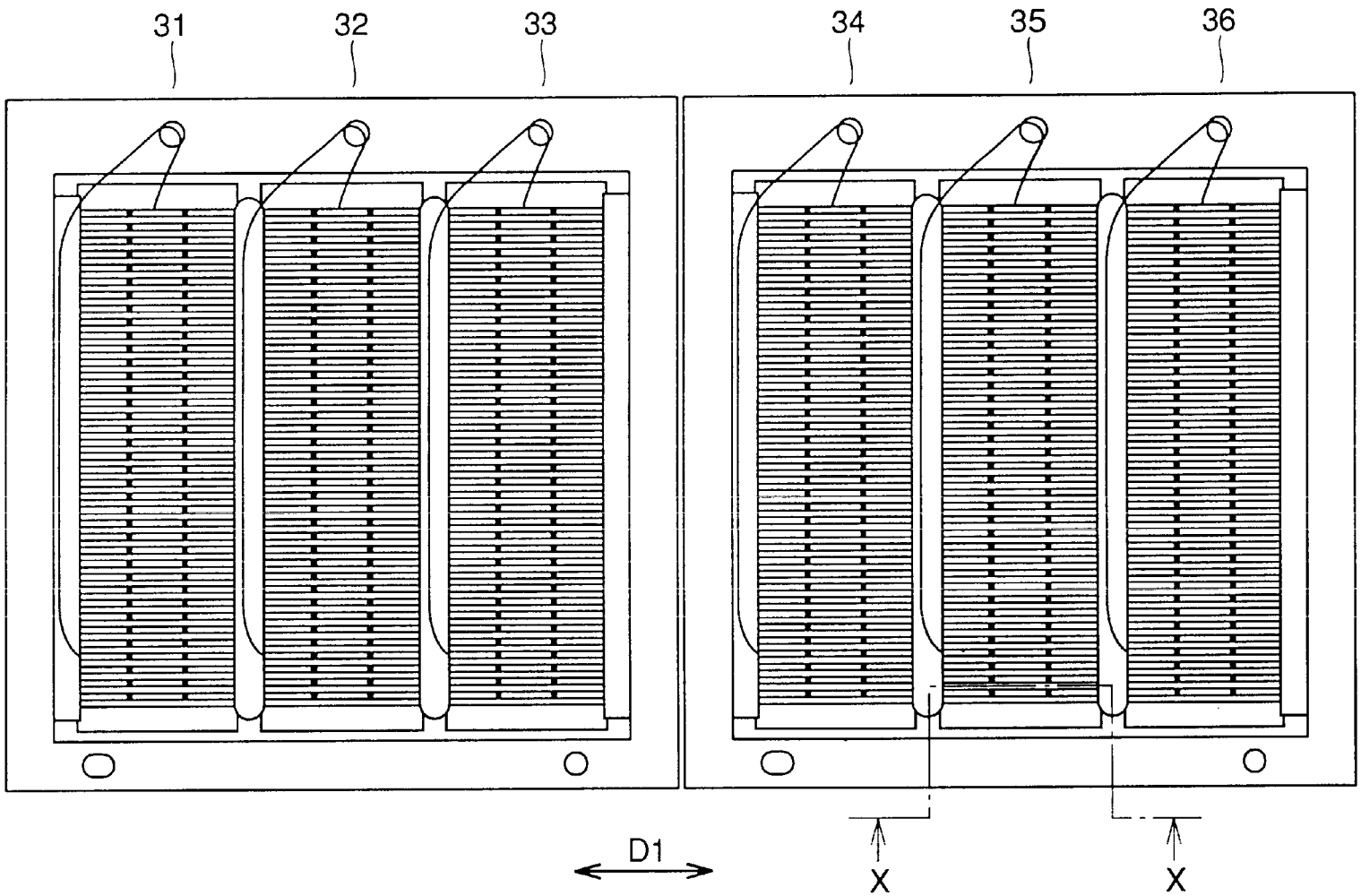
FIG. 113 is a top view of ink jet head 3.

FIGS. 112 and 113 are views for illustrating a structure of ink jet head 3 (shown in FIG. 2). FIG. 112 is a perspective view of an assembling of ink jet head 3 and FIG. 113 is a top view of ink jet head 3. A cross section taken along line X—X of FIG. 113 for illustrating a flow of ink in ink jet head 3 is similar to FIG. 93.

As shown in FIG. 113, ink jet head 3 includes a head 31 for normal yellow ink, a head 32 for normal magenta ink and a head 33 for normal cyan ink for jetting normal ink of yellow, magenta and cyan, respectively, a head 34 for photo magenta ink and a head 35 for photo cyan ink for jetting photo ink of magenta and cyan, respectively, and a head 36 for normal black ink for jetting black normal ink.

Head 31–36 for their respective colors in ink jet head 3 is structured by deposition of nozzle plate 301 having a nozzle for jetting ink drops, a common chamber plate 302 for forming an ink path, an inlet plate 303, a channel plate 304, a diaphragm 305, a piezoelectric element 306 which causes distortion when voltage is applied to fly ink drops, and a ceramic base 307. A side portion is formed by a head holder 308 and piezoelectric element 306 connects with lead frames 315 and 316.

The control portion of ink jet printer 1 is similar to that shown in FIG. 7.

Image data corresponding to a pulse voltage applied from head jet drive portion 105 to piezoelectric element 306 is processed so that a dot pattern previously stored in ROM 103 is printed depending on the level of tone.

Figure 114:
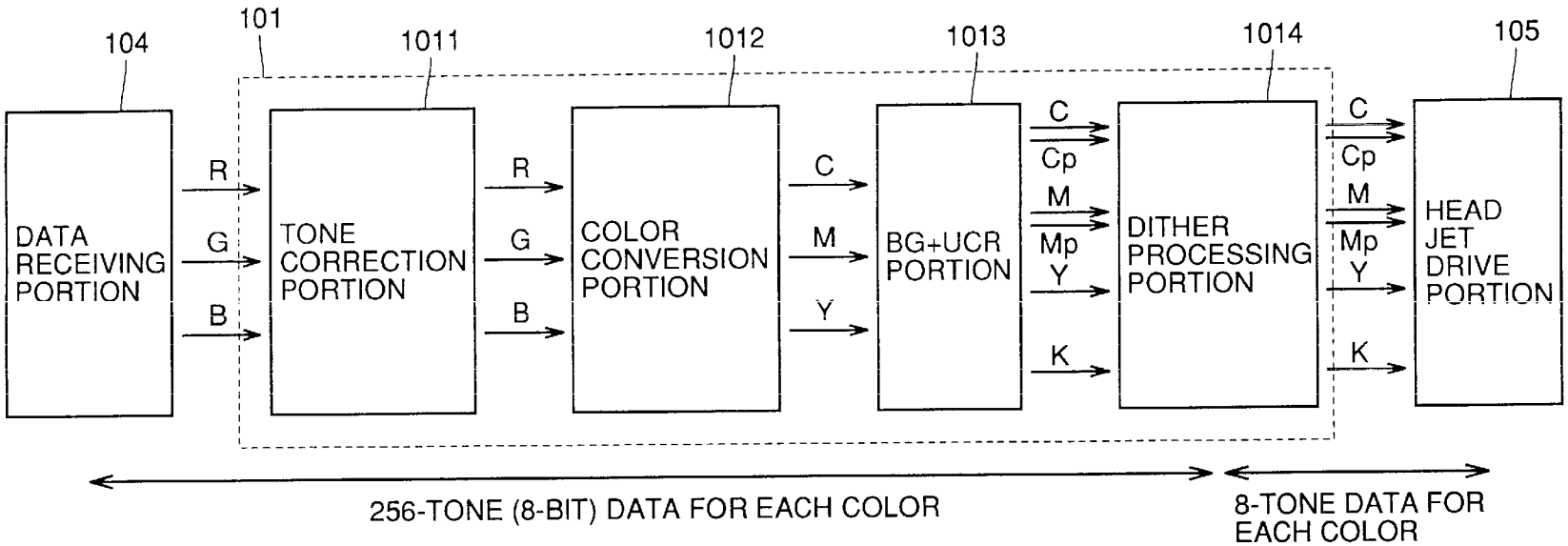
FIG. 114 is a block diagram illustrating a procedure of an image data processing provided by CPU 101.

A procedure of a processing for such image data as described above will now be described. FIG. 114 is a block diagram for illustrating a procedure of an image data processing provided by CPU 101.

Image data of 256 tones corresponding to each color of red, green and blue, which can be respectively referred to as R, G and B hereinafter, from data receiving portion 104 (shown in FIG. 7) is initially corrected in tone at tone correction portion 1101. The R, G and B image data corrected in tone are converted into image data corresponding to C, M and Y at color conversion portion 1012. Then, BG+UCR portion 1013 separates gray component from the converted C, M and Y image data, produces K image data and also produces image data corresponding to Cp and Mp.

These image data are subjected to dither processing at dither processing portion 1014 and image data of 256 tones for each color is converted into data of eight tones for each color corresponding to the pulse voltage applied from head jet drive portion 105 to piezoelectric element 306.

An order of printing each color on a recording sheet will now be described with respect to an image printed according to the image data as described above.

Figure 115:
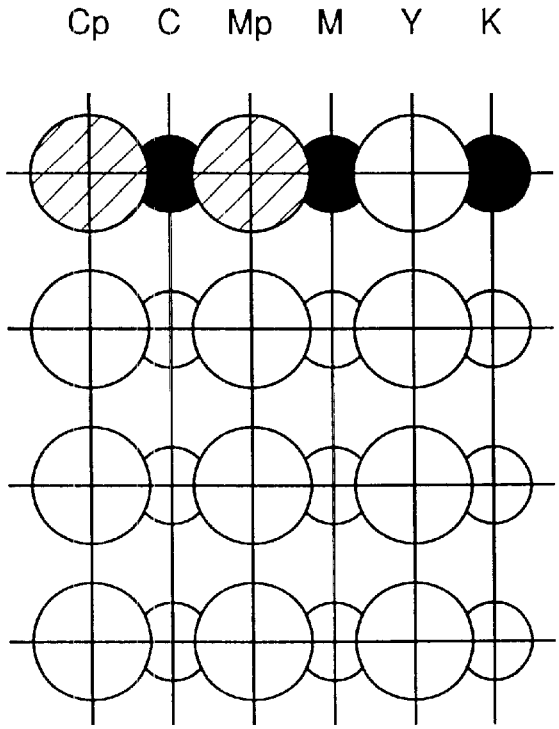
FIGS. 115 and 116 are first and second views for illustrating an order of printing each color.
Figure 116:
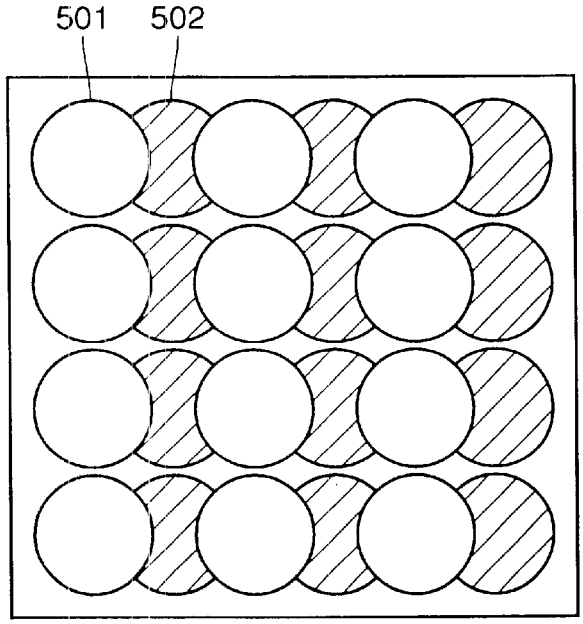

FIGS. 115 and 116 are views for illustrating an order of printing each color in an image provided by ink jet printer 1.

With jet ink printer 1, dots of small diameter (approximately 50 $\mu$m) in C, M and K are printed earlier than those of large diameter (approximately 110 $\mu$m) in Cp, Mp and Y, as shown in FIG. 115. This means that with ink jet printer 1, a dot 502 of small diameter in a relatively dark color is printed earlier than a dot 501 of large diameter in a relatively light color.

Respective orders of printing dots in the various colors by ink jet printers as Embodiments 4-2 and 4-3 will initially be described with reference to FIGS. 117 to 119, and then an effect of an image printed by an ink jet printer as Embodiment 4-1 will be described with reference to FIGS. 120 and 121 and effects of images printed by ink jet printers as Embodiments 4-1 to 4-3 will be described with reference to FIG. 122 by comparing them with images printed by ink jet printers as Conventional Examples 4-1 and 4-2 shown in FIGS. 108–111. The ink jet printers as Embodiments 4-2 and 4-3 are similar to that according to Embodiment 4-1 in the entire configuration, the structure of the print head, the structure of the control portion and the like.

Figure 117:
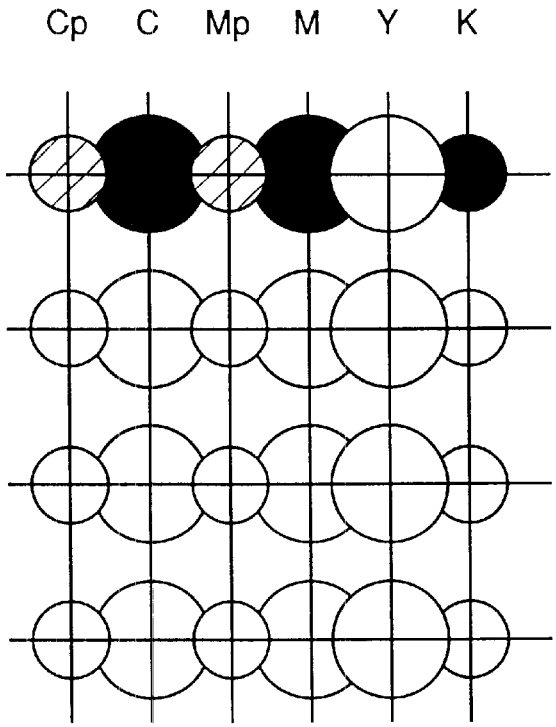
FIGS. 117 and 118 are first and second views, respectively, for illustrating an order of printing each color in an image provided by an ink jet printer as Embodiment 4-2.
Figure 118:
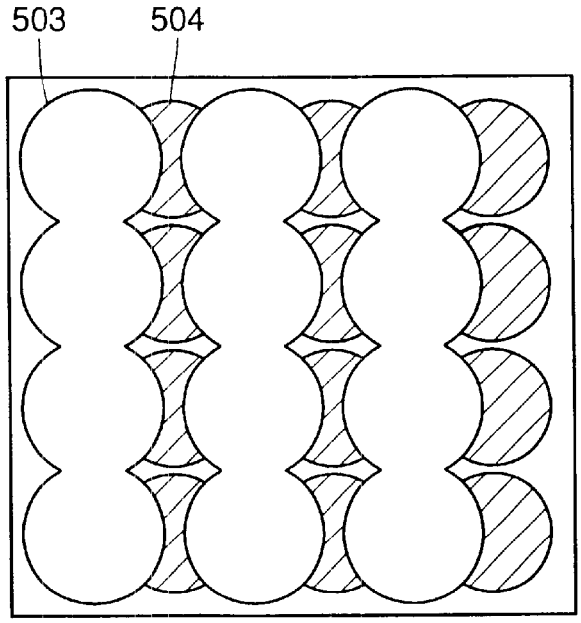

FIGS. 117 and 118 are views for illustrating an order of printing the various colors in an image provided by the ink jet printer as Embodiment 4-2.

With the ink jet printer as Embodiment 4-2, dots of large diameter (approximately 100 $\mu$m) in C and M and a dot of small diameter (approximately 50 $\mu$m) in K are printed earlier than dots of small diameter in Cp and Mp and a dot of large diameter in Y, as shown in FIG. 117. This means that with the ink jet printer as Embodiment 4-2, a dot 504 in a relatively dark color is printed earlier than a dot 503 in a relatively light color regardless of the size of diameter, as shown in FIG. 118.

Figure 119:
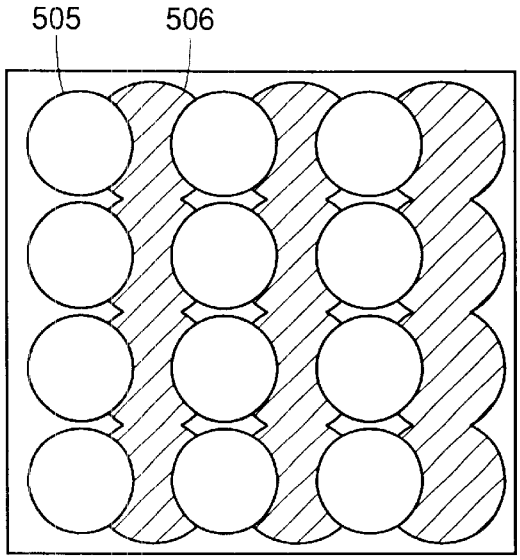
FIG. 119 is a view for illustrating an order of printing each color in an image provided by an ink jet printer as Embodiment 4-3.

FIG. 119 is a view for illustrating an order of printing the various colors in an image provided by the ink jet printer as Embodiment 4-3.

With the ink jet printer as Embodiment 4-3, dots of large diameter (approximately 100 $\mu$m) in the relatively dark colors C, M and K are printed earlier than dots 505 of small diameter (approximately 50 $\mu$m) in the relatively light color Cp, Mp and Y, as shown in FIG. 119.

Figure 120:
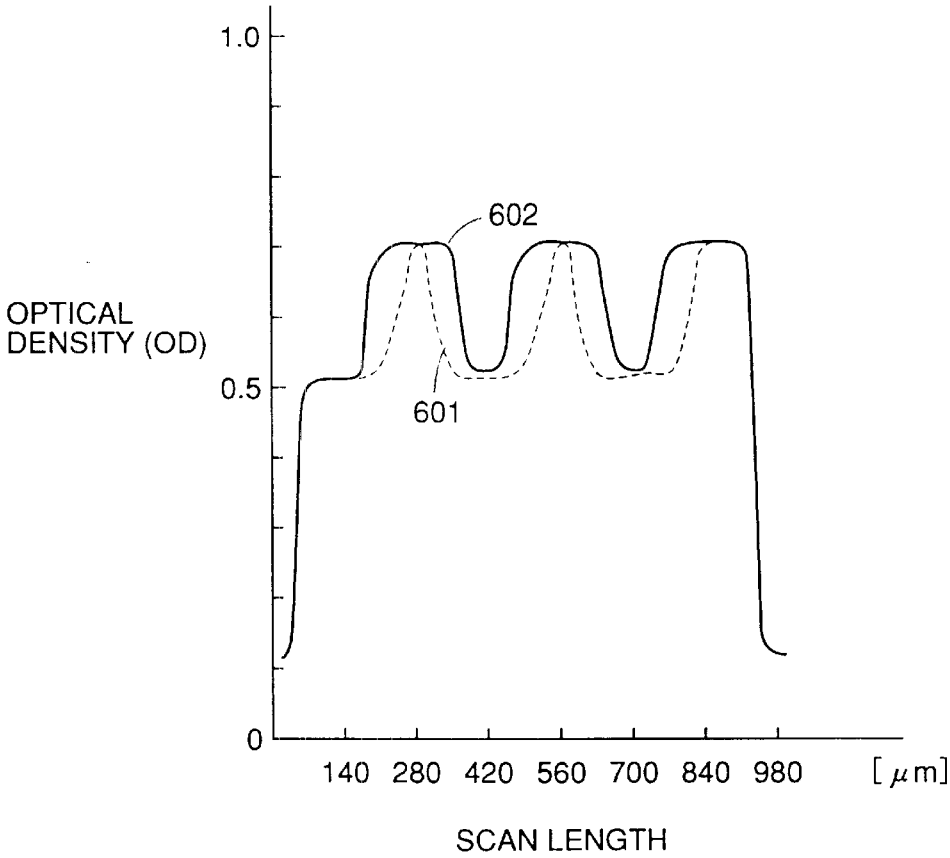
FIGS. 120 and 121 are first and second views, respectively, representing optical density measurements of the image shown in FIG. 115 printed by an ink jet printer as Embodiment 4-1 and the image shown in FIG. 110 printed by an ink jet printer as Conventional Example 4-1.
Figure 121:
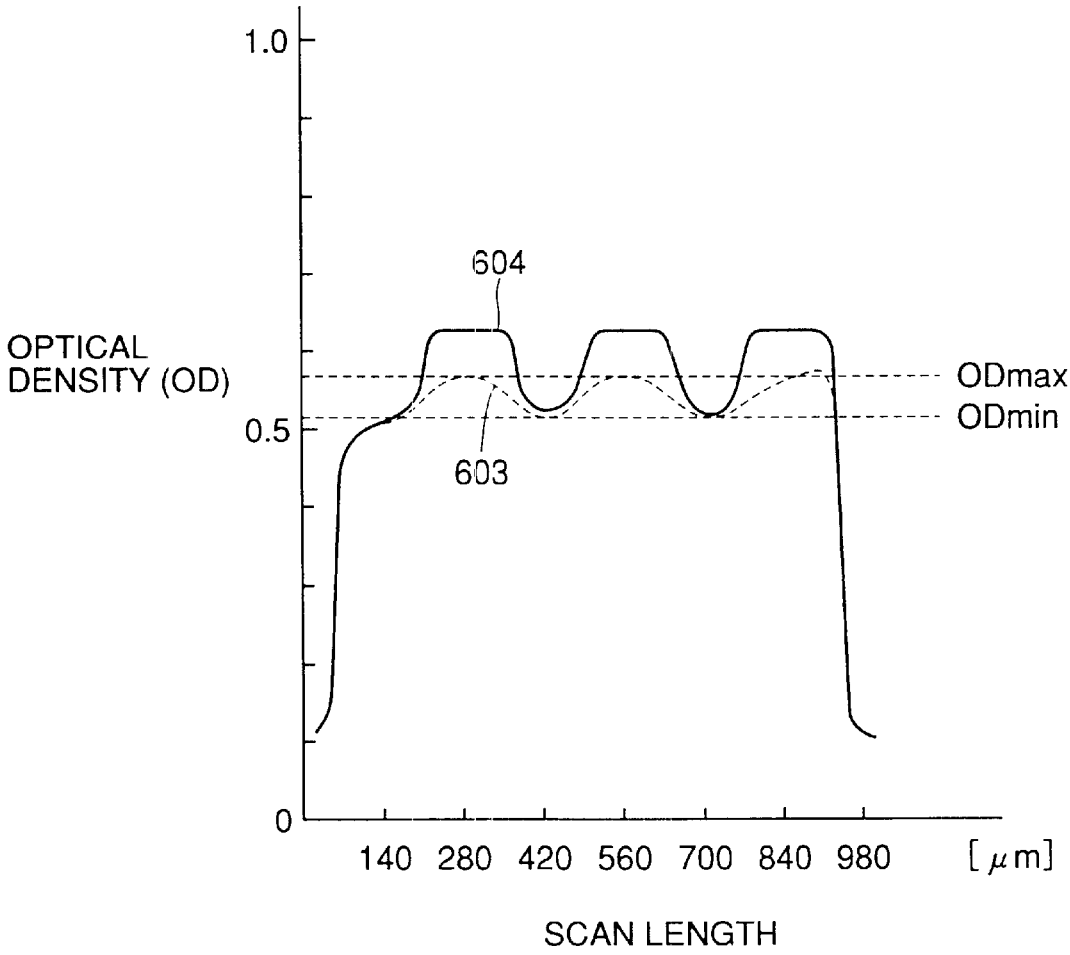

FIGS. 120 and 121 show results of measurement of an optical density of the FIG. 115 image printed by the ink jet printer as Embodiment 4-1 and that of the FIG. 110 image printed by the ink jet printer as Conventional Example 4-1. FIG. 120 show the results of measurement of optical density at a resolution higher than human vision and FIG. 21 shows the results of measurement of optical density at a resolution similar to human vision.

In measuring the optical densities, a sheet for printers and word processors of the IJ system, High Grade Color KJHA 4100 manufactured by Kao Corp. is used as a recording sheet. The ink used is of the compositions described above, and the optical density measuring device used is Sakura Densitometer (PDA 65) manufactured by Sakura (KONIKA CORP. incumbent).

In measuring optical densities, a detect head of PDA 65 scans a recording sheet with the images shown in FIGS. 115 and 110 printed thereon with the ink described above, while moving at a speed of 10 sec/mm. The detect head has a light source which illuminates the recording sheet, a slit for dividing the reflected light from the recording sheet, and a photoelectric tube for measuring an optical density according to the light passing through the slit.

The measurement results shown in FIGS. 120 and 121 are shown with the horizontal axis representing a scanned length of the images shown in FIGS. 115 and 110 from the left to the right and the vertical axis representing the optical density of each image corresponding to the scanned length.

The two levels of resolution applied to measure optical density are provided by adjusting the width of the slit of the detect head. The FIG. 120 resolution, which is higher than human vision, is provided through a slit width of 20 $\mu$m and the FIG. 121 resolution, which is similar to human vision, is provided through a slit width of 40 $\mu$m.

FIGS. 120 and 121 show curves 601 and 603 representing relations between optical density and scan length with the ink jet printer as Embodiment 4-1 and curves 602 and 604 representing relations between optical density and scanned length with the ink jet printer as Conventional Example 4-1 at the two levels of resolution. $OD_{max}$ indicates the largest value of optical density within dots of the relatively dark color and ODmin indicates the smallest value of optical density in dots of the relatively light color, as shown in FIG. 121.

It can be seen from the measurement results in optical density shown in FIG. 120 that the dots corresponding to the relatively dark colors C, M and K shown in FIGS. 115 and 110 have an optical density of approximately 0.7, the dots corresponding to the relatively light colors Cp, Mp and Y have an optical density of approximately 0.5 and a white, unprinted portion of the recording sheet has an optical density of approximately 0.1. Furthermore, it is also understood that the width of scanned length for which optical density reaches a maximum value of approximately 0.7 is narrower in curve 601 obtained with the ink jet printer as Embodiment 4-1 than curve 602 obtained with the ink jet printer as Conventional Example 4-1.

The measurement results of optical density shown in FIG. 121 show that for the FIG. 110 image provided by the ink jet printer as Conventional Example 4-1, human vision clearly identifies tones at a portion at which optical density peaks as described above, whereas for the FIG. 115 image provided by the ink jet printer as Embodiment 4-1, human vision does identify tones but not so clearly as with the ink jet printer as Conventional Example 4-1.

Since images printed by the ink jet printer as Embodiment 4-1 have dots of relatively dark colors printed earlier than those of relatively light colors, the tones are not clearly identified by human vision and are thus observed blurred and such tones are observed as a smooth, intermediate tone.

FIG. 122 describes estimations of images printed on a recording sheet by the ink jet printers as Embodiments 4-1 to 4-3 and images printed on a recording sheet by the ink jet printers as Conventional Examples 4-1 and 4-2.

Smoothness of image and whether any tone jump is found are estimated. Five ink jet printers are subjected to the measurement of optical density performed for obtaining the graph shown in FIG. 121 in order to obtain a difference $\Delta OD = OD_{max} - OD_{min}$ for estimation of smoothness of image, wherein $OD_{max}$ represents the maximum optical density within dots of relatively dark colors and $OD_{min}$ is the minimum optical density within dots of relatively light colors. Smoothness of image is estimated as ○ when $\Delta OD < 0.1$, Δ when $0.1 \leqq \Delta OD < 0.2$, and x when $\Delta OD \geqq 0.2$.

It can be understood from the measurement results that images printed by the ink jet printers as Conventional Examples 4-1 and 4-2 are respectively estimated as x and Δ in smoothness, while images printed by the ink jet printers as Embodiments 4-1 to 4-3, which print dark ink dots before light ink dots, are estimated as ○ and are thus advantageously smoother. It also found that the images printed by the ink jet printers as Conventional Examples 4-1 and 4-2 have tone jumps whereas the ink jet printers as Embodiments 4-1 to 4-3 do not have tone jumps. The improved smoothness and reduced tone jumps as described above result in an image which is less rough and also well balanced in color.

Since ink dots in relatively dark colors C, M and K are printed on a recording sheet before ink dots in relatively light colors Cp, Mp and Y, the roughness which can be found in images printed by conventional ink jet printers is removed, better color balance is achieved than conventional and the quality of printed images can thus be improved.

Embodiment 5-1

Figure 123:
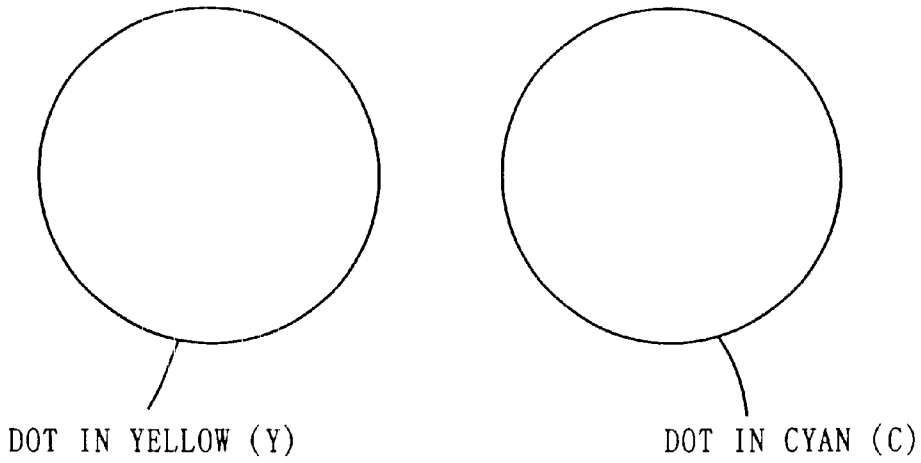
FIG. 123 RELATED ART
FIG. 123 shows one example of a method of representing a secondary color with a conventional image forming apparatus.
Figure 124:
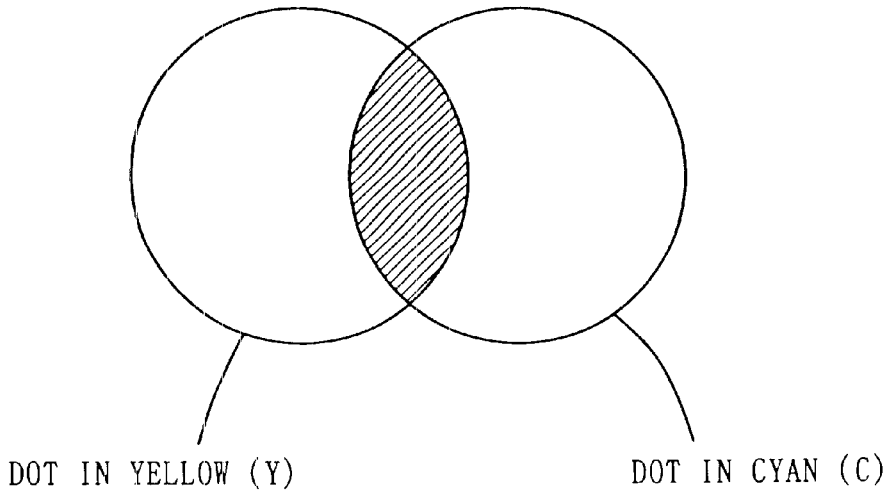
FIG. 124 RELATED ART
FIG. 124 illustrates another example of the method of representing a secondary color with a conventional image forming apparatus.

In mixing a plurality of colors of ink in conventional image forming apparatuses to express secondary colors, such as purple, green, red and orange, ink dots of different colors are placed adjacent to or overlap with one another. For example, in using Y ink and C ink to express green as a secondary color, ink dots in the two colors Y and C are placed adjacent to each other, as shown in FIG. 123, or they overlap as shown in FIG. 124. It should be noted that the hatched portion in FIG. 124 is an overlapping portion of dots in two colors of ink.

In expressing secondary colors in the method described above, however, dots of different colors placed adjacent to each other as shown in FIG. 123 render the granularity of the ink of each color more remarkable in a formed image, and different colors of ink overlapping with each other as shown in FIG. 124 exaggerate the outline of each dot at the overlapping portion of the dots, disadvantageously resulting in a poor image.

The present embodiment can solve such disadvantages and forms smooth images.

Figure 125:
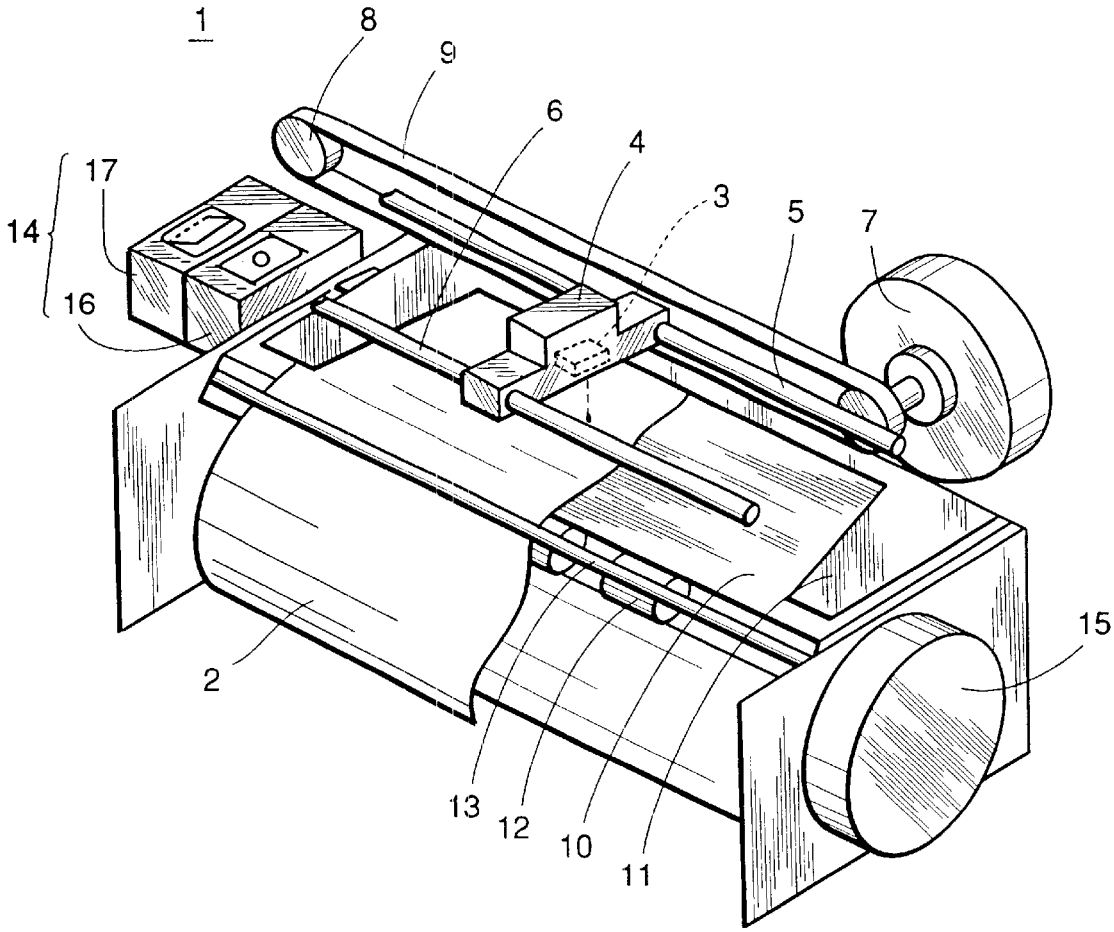
FIG. 125 is a perspective view schematically showing a structure of an ink jet printer as Embodiment 5-1.

FIG. 125 is a perspective view of a schematic structure of an ink jet printer 1 according to Embodiment 5-1. Ink jet printer 1 is for printing an ink image on a recording sheet 2 as a recording medium, such as a printing sheet and a thin plastic film. Ink jet printer 1 includes a printer head 3 as an ink-jet printer head, a carriage for holding printer head 3, sliding axes 5 and 6 for reciprocating carriage 4 in parallel with the recording side of recording sheet 2, a drive motor 7 for driving carriage 4 such that carriage 4 reciprocates along sliding axes 5 and 6, an idle pulley 8 for transforming the revolution of drive motor 7 into reciprocation of carriage 4, and a timing belt 9.

It should be noted that in the present embodiment, a printing sheet generally refers to a sheet used in image forming apparatuses, such as printers and copiers, and includes a sheet for PPC, for example.

Ink jet printer 1 also includes a platen 10 which also serves as a guide plate for guiding recording sheet 2 along a sheet transporting path, a sheet presser plate 11 which presses recording sheet 2 between platen 10 and sheet presser plate 11 to prevent recording sheet 2 from rising, a discharging roller 12 for discharging recording sheet 2, a spurring roller 13, a recovery system 14 which washes a nozzle surface of printer head 3 that jets ink to recover a good condition of the ink jetting portion and a sheet feeding knob 15 for manually transporting recording sheet 2. Recovery system 14 includes a suction unit 16 for sucking the nozzle of printer head 3, and a wiping device 17 which wipes a surface of printer head 3 that is provided with the nozzle.

Recording sheet 2 is fed manually or by a sheet feeding device, such as a cut sheet feeder, to a recording portion at which printer head 3 is opposed to plate 10. Meanwhile, the revolution of a sheet feeding roller (not shown) is controlled to control transportation of the sheet to the recording portion.

For printer head 3, a piezoelectric element (PZT) is applied as an energy source for flying ink drops. The piezoelectric element receives voltage and is distorted accordingly. The distortion changes the volume of a channel within printer head 3 that is filled with ink. Thus, the ink is jetted from a nozzle provided at the channel so that recording is provided on recording sheet 2.

By means of drive motor 7, idle pulley 8 and timing belt 9, carriage 4 provides main scanning of recording sheet 2 in the lateral direction, i.e., the direction in which recording sheet 2 is traversed, and printer head 3 mounted to carriage 4 records one line of an image. Each time one line is completely recorded, recording sheet 2 is fed in the longitudinal direction and subjected to subscanning to record the image at the next line.

An image is thus recorded on recording sheet 2. Recording sheet 2 which has passed through the recording portion is discharged by discharging roller 12 arranged downstream of the sheet transportation path and by spurring roller 13 pressed against discharging roller 12.

The configuration in the periphery of carriage 4 is the same as shown in FIG. 2.

Figure 126:
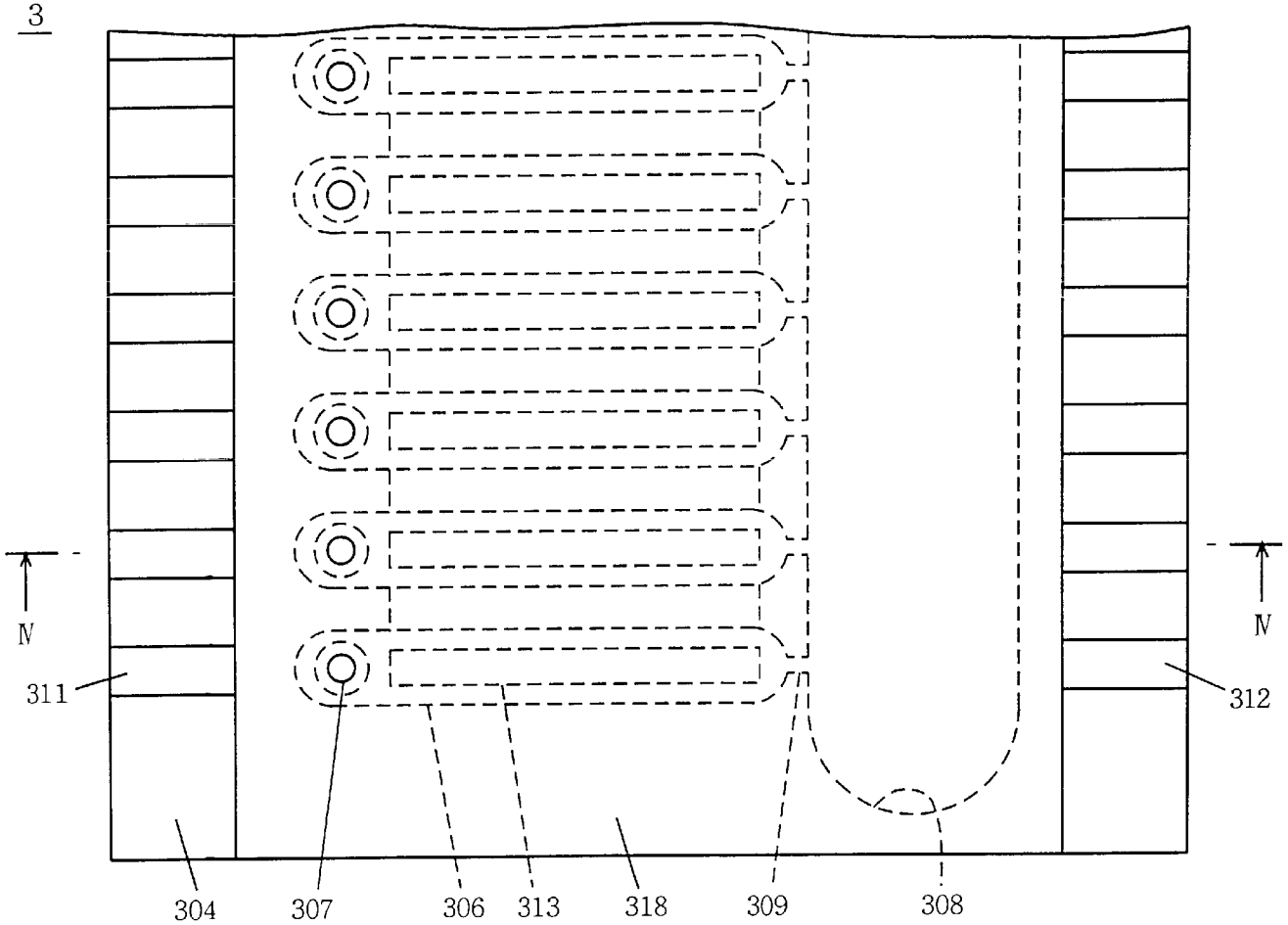
FIG. 126 is a plan view of a portion of a side of the printer head shown in FIG. 125 that is provided with a nozzle.
Figure 127:
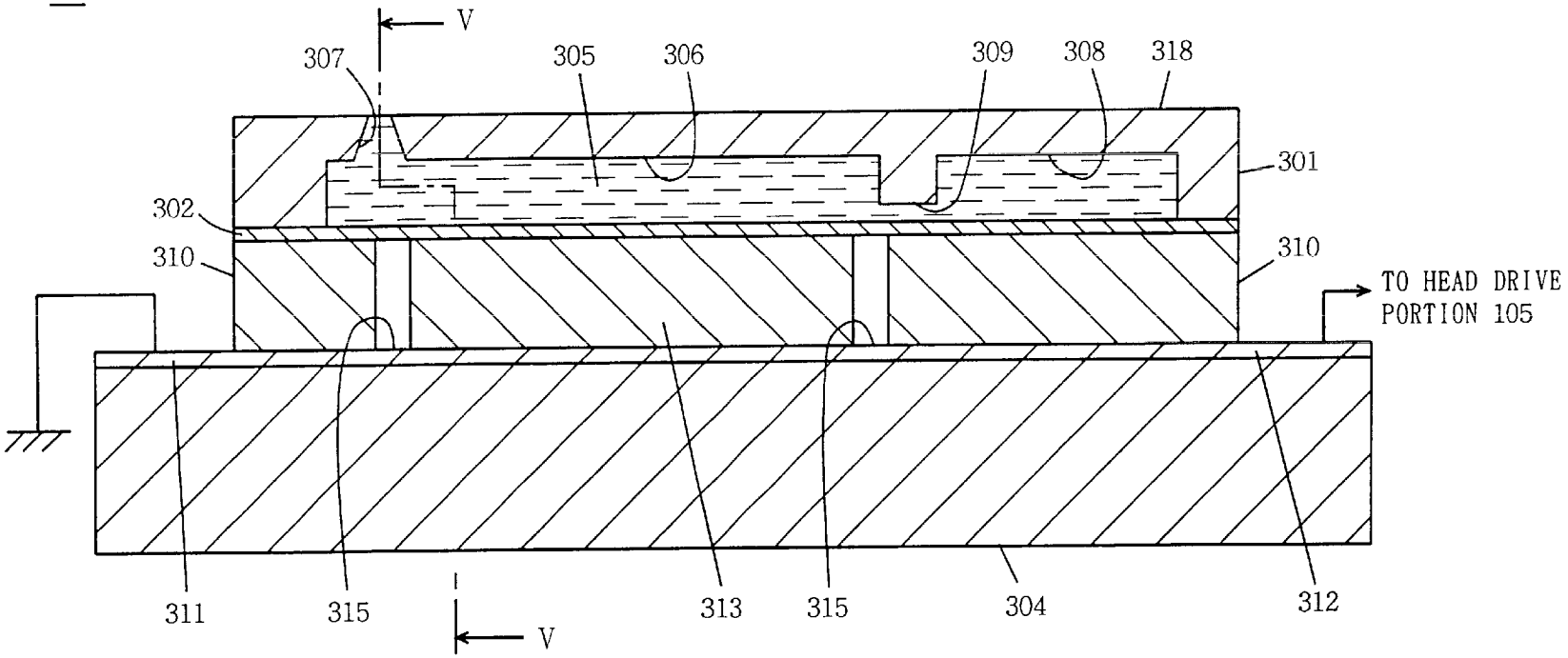
FIG. 127 is a cross section taken along line IV—IV of FIG. 126.
Figure 128:
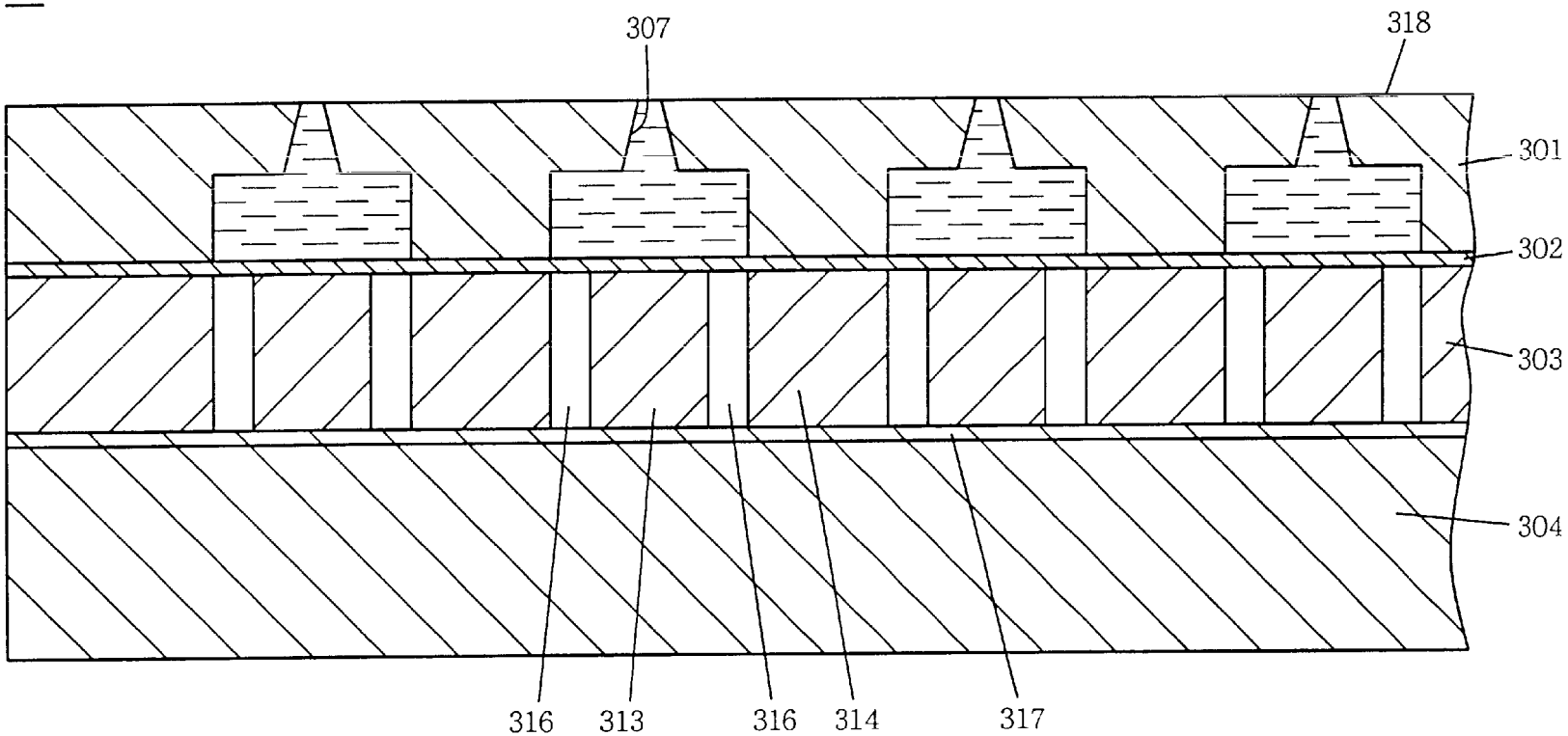
FIG. 128 is a cross section taken along line V—V of FIG. 127.

FIGS. 126–128 are views illustrating a configuration of printer head 3. FIG. 126 is a plan view of a portion of a side of printer head 3 provided with a nozzle. FIG. 127 is a cross section taken along line IV—IV of FIG. 126. FIG. 128 is a cross section taken along line V—V of FIG. 4.

Referring to FIGS. 126–128, printer head 3 is structured of a nozzle plate 301, a diaphragm 302, a vibration plate 303 and a substrate 304 which are integrally deposited. Nozzle plate 301 is formed of metal or synthetic resin, includes a nozzle, and has an ink repelling layer on a surface 388. Diaphragm 302 is formed of thin film and is fixed between nozzle plate 301 and vibration plate 303.

Formed between nozzle plate 301 and diaphragm 302 are a plurality of ink channels 306 which accommodate ink 305, and an ink inlet 309 which links each ink channel 306 to an ink feeder chamber 308. Ink feeder chamber 308 is connected to an ink tank (not shown) and ink 305 in ink feeder chamber 308 is fed to ink channels 306.

Vibration plate 303 includes a plurality of piezoelectric elements 313 for the respective ink channels 306. Piezoelectric element 313 is formed by processing vibration plate 303. Initially, vibration plate 303 is fixed by an insulating adhesive to a substrate 304 having a wiring portion 317 and is then diced to form a separation gap 315, 316 so that vibration plate 303 is cut off. This separates each piezoelectric element 313 for a respective ink channel 306, a piezoelectric element pillar 314 located between adjacent piezoelectric elements 313, and a wall 310 surrounding them.

Wiring portion 317 on substrate 304 has a wiring portion 311 arranged closer to a common electrode that is earthed and commonly connected to all of the piezoelectric elements 313 in printer head 3, and a wiring portion 317 arranged closer to individual electrodes that is individually connected to each piezoelectric element 313 in printer head 3. Wiring portion 311 closer to a common electrode that is provided on substrate 304 is connected to a common electrode within piezoelectric elements 313. Wiring portion 312 closer to individual electrodes is connected to an individual electrode within piezoelectric element 313. Wiring portion 312 closer to individual electrodes is also connected to head jet drive portion 105 of the control portion of ink jet printer 1.

An operation of printer head 3 thus configured is controlled by the control portion of ink jet printer 1. Printer head jet drive portion 105 of the control portion applies a predetermined voltage as a print signal between the common electrode and an individual electrode provided in piezoelectrode element 313 and piezoelectric element 313 is deformed such that it pushes diaphragm 302. The deformation of piezoelectric element 313 is transferred to diaphragm 302 and a pressure is thus applied to ink 305 in ink channel 306 so that ink drops fly towards recording sheet 2 (shown in FIG. 125) via nozzle 307.

It should be noted that the degree of deformation of piezoelectric element 313 is changed as the voltage applied by head jet drive portion 105 to piezoelectric element 313 is changed. Thus, controlling the voltage applied by head jet drive portion 105 allows controlling the amount of ink jetted by one deformation of piezoelectric element 313 and thus changing the diameter of a dot to be printed on recording sheet 2.

Figure 129:
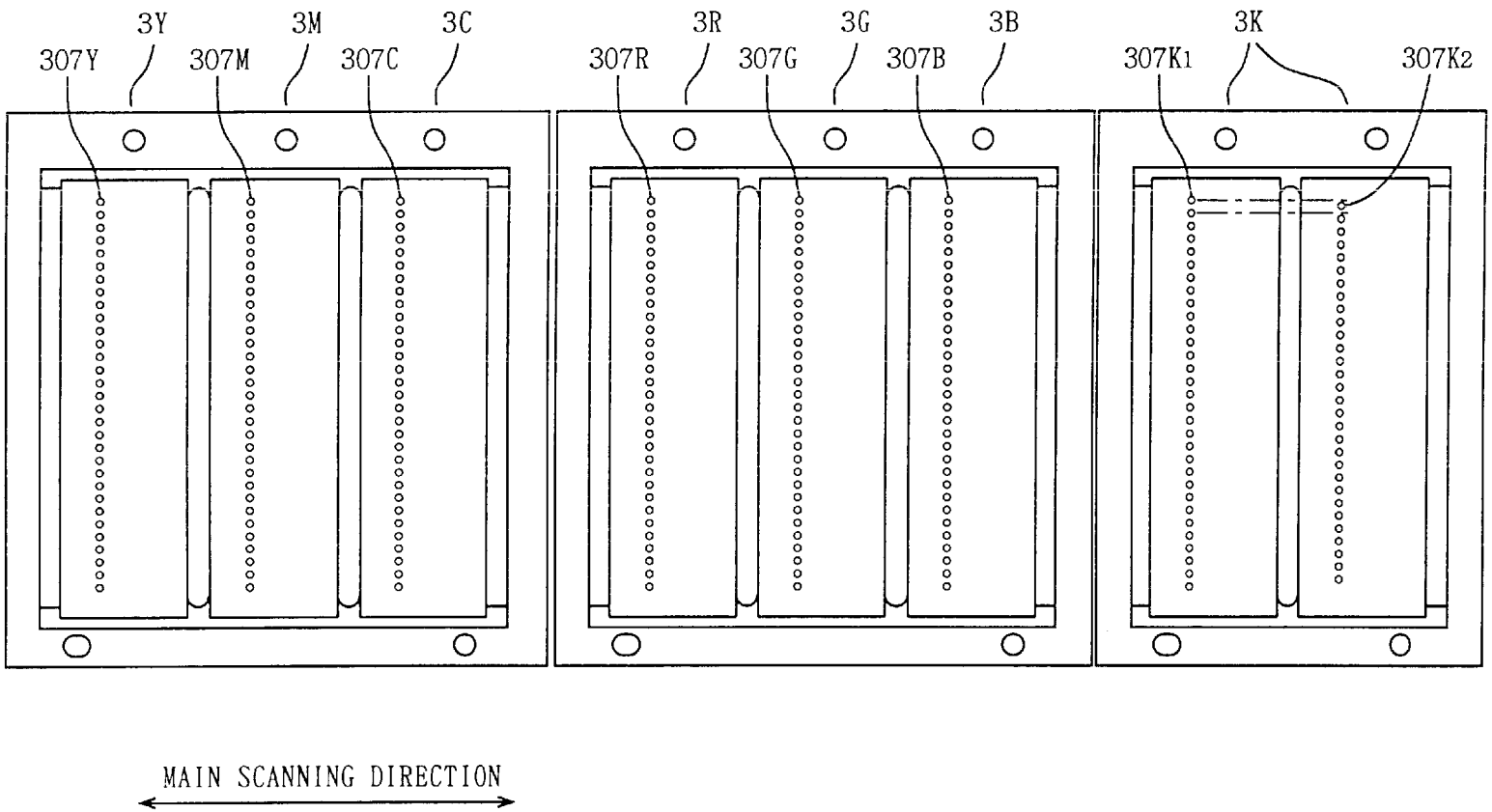
FIG. 129 is a plan view of the printer head shown in FIG. 125.

FIG. 129 is a plan view of a side of the FIG. 125 printer head 3 that is provided with a nozzle. Referring to FIG. 129, printer 3 includes a yellow (y) head 3Y, a magenta (m) head 3M and a cyan (c) head 3C for jetting ink of yellow, magenta and cyan, respectively. Printer head 3 also includes a blue (b) head 3B, a green (g) head 3G and a red (r) head 3R for respectively jetting ink of blue, green and red as complementary colors to yellow, magenta and cyan, respectively, and also includes a black (k) head 3K for jetting black ink. Heads 3Y to 3K are provided with their respective nozzles 307Y, 307M, 307C, 307B, 307G, 307R, 307$K_1$ and 307$K_2$, respectively. The nozzle for black head 3K is twice that for each of the other color heads and the adjacent nozzles 307$K_1$ and 307$K_2$ are staggered, vertically offset from each other. It should be noted that the arrow in FIG. 129 indicates the main scanning direction of printer head 3.

The schematic configuration of the control portion of ink jet printer 1 is the same as shown in FIG. 7.

Figure 130:
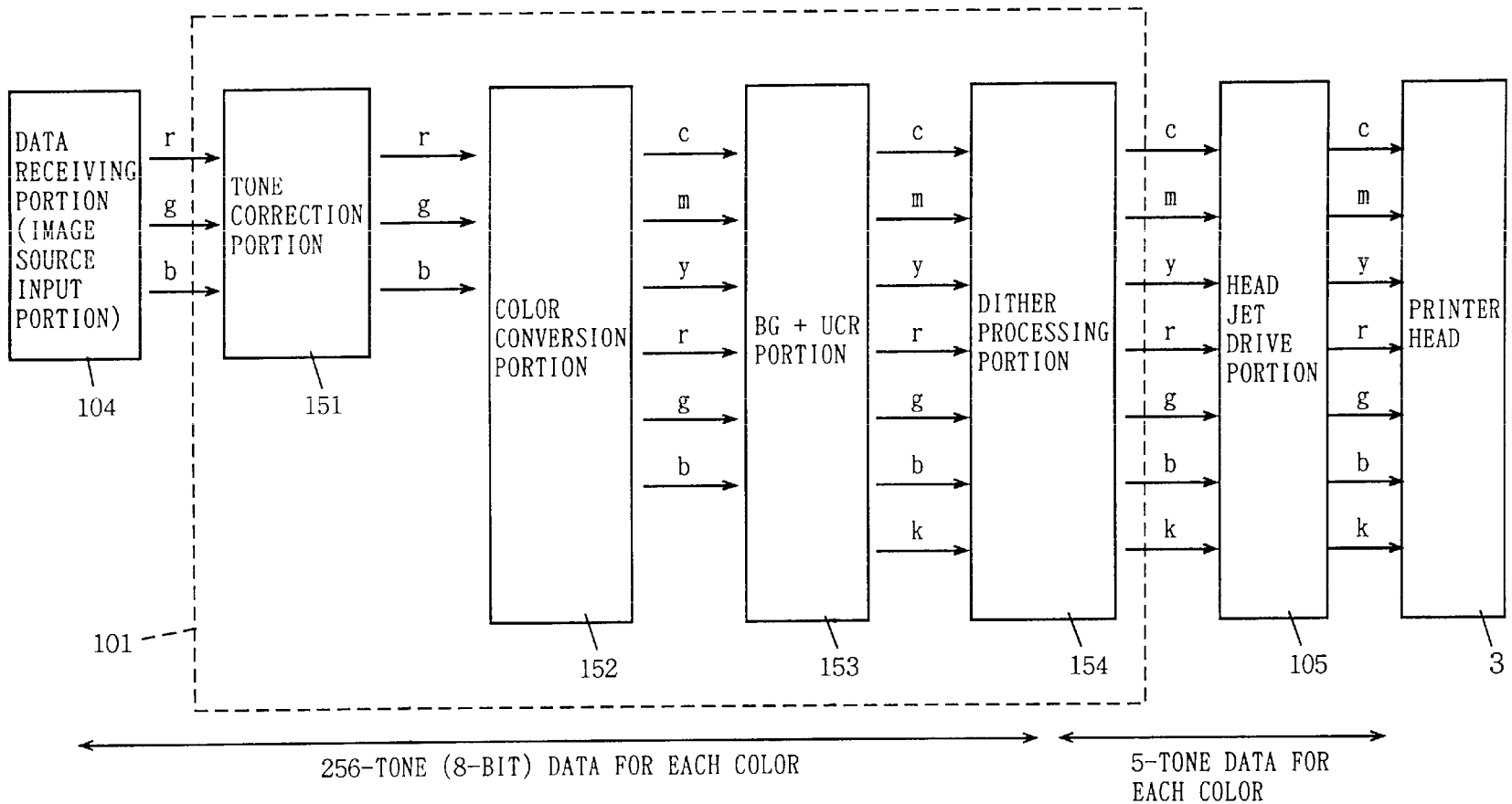
FIG. 130 is a block diagram showing a configuration of a CPU and a periphery thereof.

FIG. 130 is a block diagram showing a configuration of a CPU 101 and that of a periphery thereof. CPU 101 includes a tone correction portion 151 which receives data r, g and b respectively corresponding to red, green and blue from data receiving portion (image source input portion) 104 and applies tone correction to the data, a color conversion portion 152 which converts the data r, g and b corrected in tone into data of c, m, y, r, g and b (c, m and y correspond to cyan, magenta and yellow, respectively), a BG+UCR portion 153 which separates gray component in the converted data of the six colors and replaces the separated gray component with a black signal to output data k corresponding to black color together with the data of c, m, y, r, g and b, and a dither processing portion 154 which applies dither processing to the data output from inking+UCR portion 154. The dithered data is input to head jet drive portion 105 which drives each of color heads 3C–3B of printer head 3.

Figure 131:
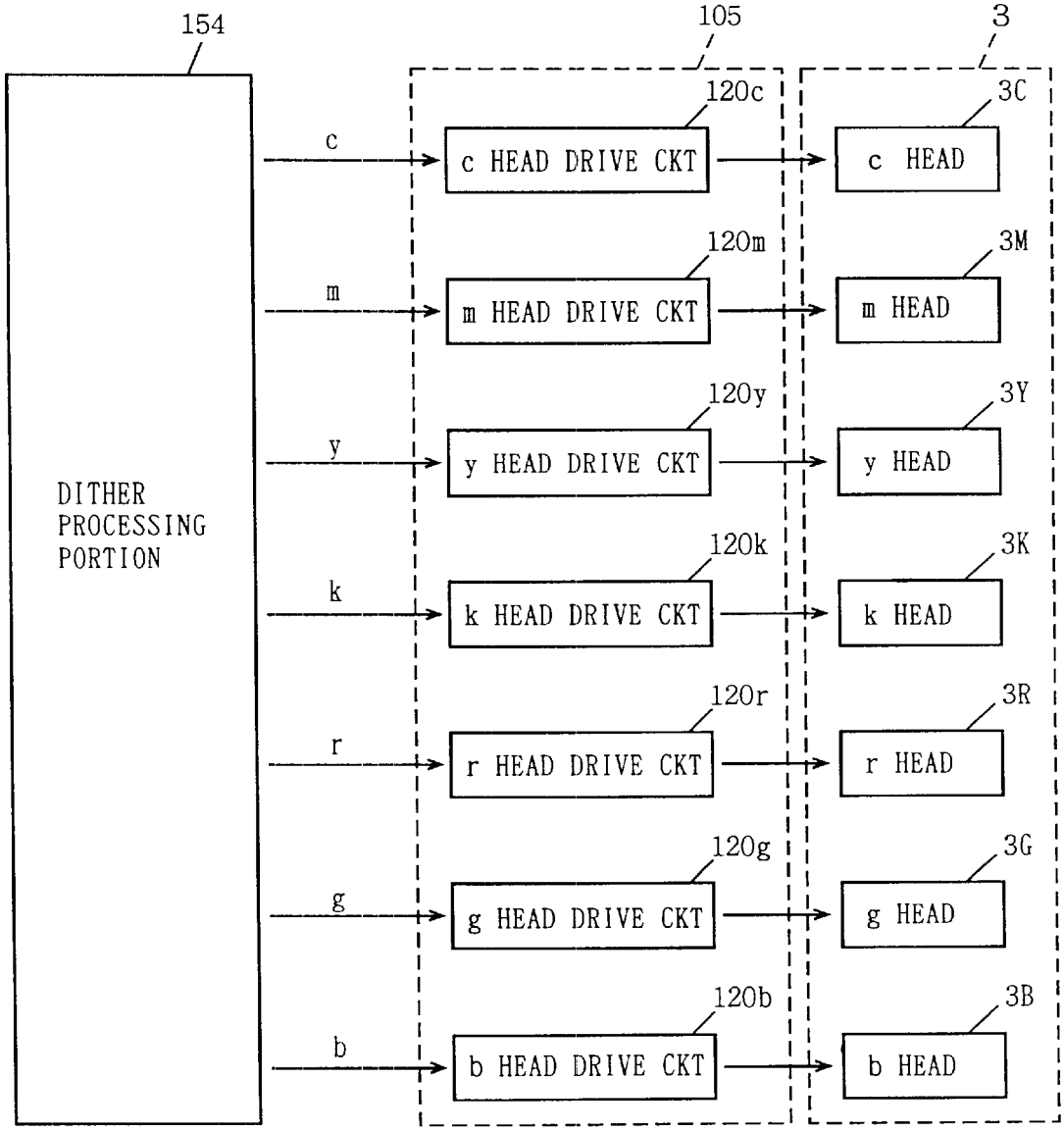
FIG. 131 is a block diagram showing a configuration of the dither processing portion, printer head jet drive portion and each color head shown in FIG. 130.

FIG. 131 is a block diagram showing a configuration of dither processing portion 154, head jet drive portion 105 and printer head 3. Referring to FIG. 131, head jet drive portion 105 includes a c head drive circuit 120*c*, a m head drive circuit 120*m*, a y head drive circuit 120*y*, a k head drive circuit 120*k*, a r head drive circuit 120*r*, a g head drive circuit 120*g* and a b head drive circuit 120*b*. As has been described with reference to FIG. 6, printer head 3 includes c head 3C, m head 3M, y head 3Y, k head 3K, r head 3R, g head 3G and b head 3B connected to drive circuits 120*c*-120*b*, respectively.

In ink jet printer 1 according to the present embodiment, head drive circuits 120*c*, 120*m*, 120*y*, 120*k*, 120*r*, 120*g* and 120*b* of head jet drive portion 105 control the voltage applied to piezoelectric element 313 of each of color heads 3C, 3M, 3Y, 3K, 3R, 3G and 3B, respectively, of printer head 3 to control the amount of ink jetted from each color head. The diameter of a dot to be printed can thus be changed depending on the tone.

The compositions of the ink of yellow, magenta, cyan and black used in ink jet printer 1 according to the present embodiment are as described in FIGS. 11–14.

In addition to the ink of Y, M, C and K described above, the present embodiment also uses ink of blue, green and red which are higher in permeability into printing sheets than the ink mentioned above and also complementary colors to yellow, magenta and cyan, respectively. Hereinafter, the ink of blue, green and red will generally be referred to as "complementary color ink" and the ink of Y, M and C as "normal color ink".

It should be noted that a complementary color ink used in the present embodiment is each type of the ink of blue, green and red of the compositions described in FIGS. 132–134 that contains a penetrant described later. For convenience of description, blue ink, green ink and red ink which do not contain a penetrant are referred to as "Bo ink", "Go ink" and "Ro ink", respectively, and those which contain a penetrant as "B ink", "G ink" and "R ink", respectively.

FIGS. 132, 133 and 134 respectively describe compositions of blue ink (Bo ink), green ink (Go ink) and red ink (Ro ink) in the present embodiment.

The Bo ink, Go ink and Ro ink described above will now be compared in the permeability into a printing sheet with the Y ink, M ink and C ink described above. Permeabilities of the various types of ink into a printing sheet are compared by comparing the spread of an image of an ink drop on a printing sheet with that of an image of another ink drop on the printing sheet by means of the optical measuring device shown in FIG. 135.

Figure 135:
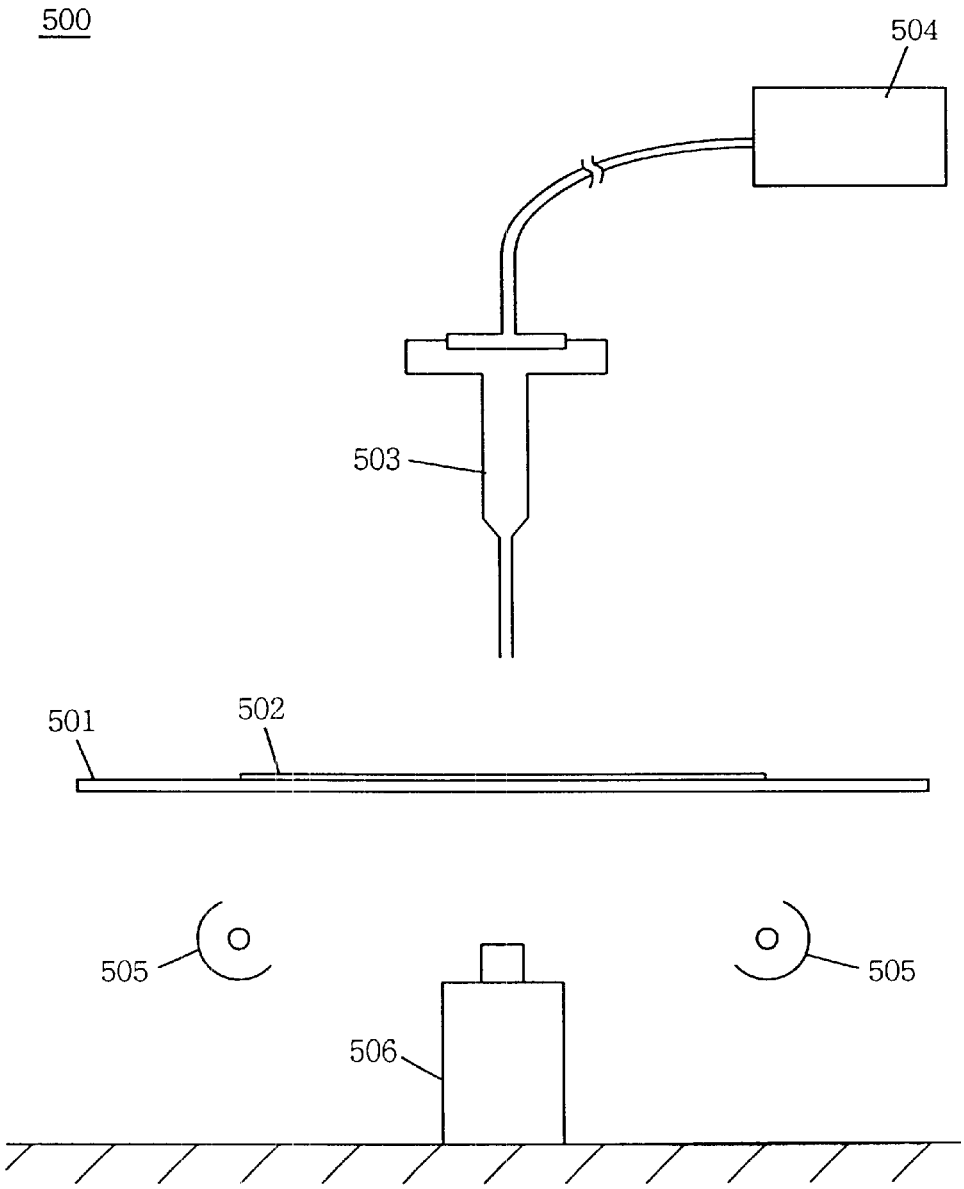
FIG. 135 shows an optical measuring device employed in an embodiment of the present invention.

FIG. 135 shows an optical measuring device 500 for optically measuring how an ink drop spreads on a printing sheet. In optical measuring device 500, the ink stored in a container 504 is supplied to a syringe 503 and an appropriate amount of ink is dropped from syringe 503 towards a printing sheet 502 placed on a sheet support 501. Provided under sheet support 501 are a lamp 505 and a CCD video camera 506 which surrounds and analyzes the image of a dot of the ink dropped onto printing sheet 502 to measure any changes in the diameter of the dot with time.

Figure 136:
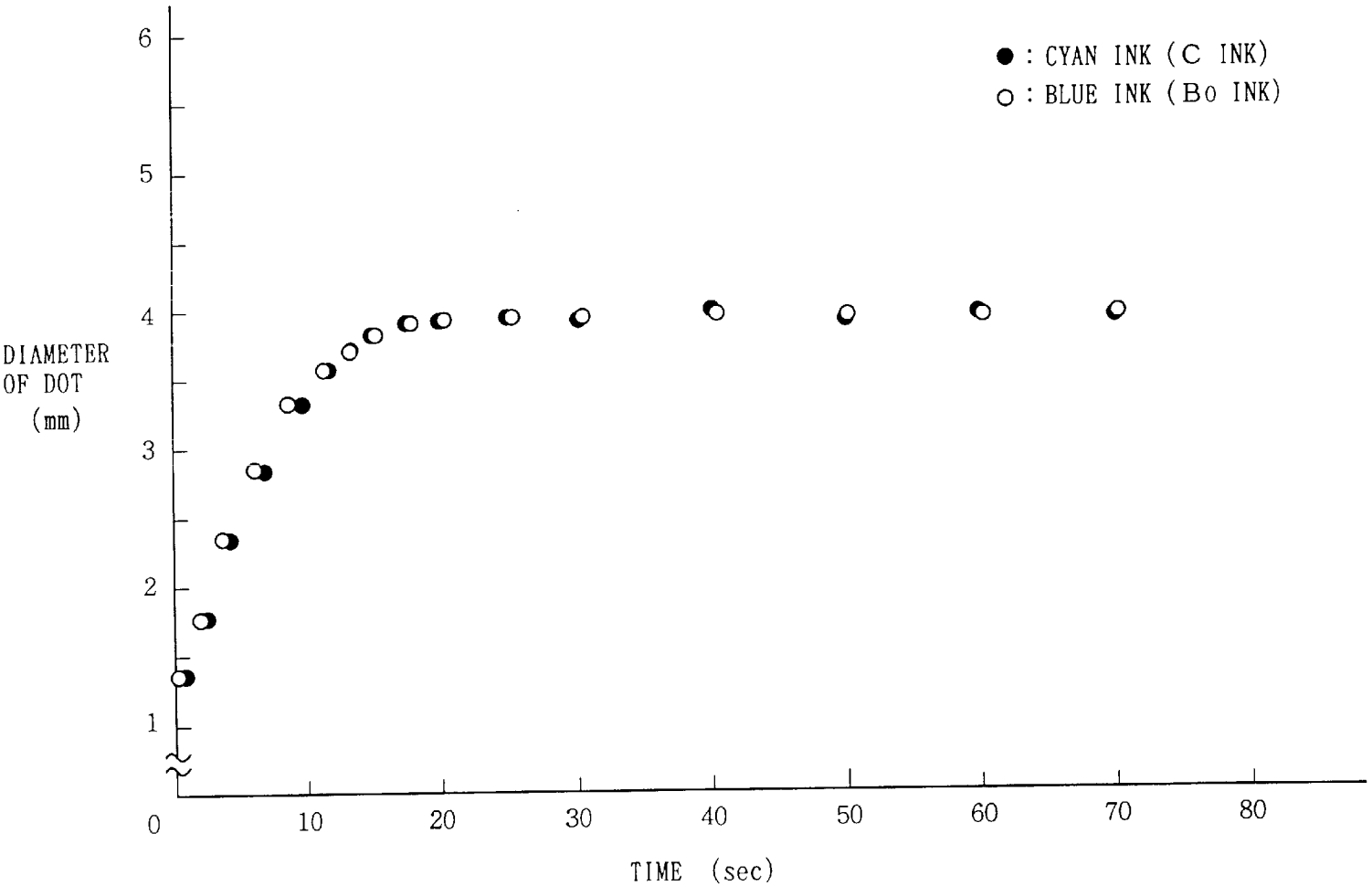
FIG. 136 represents how the diameters of dots of C ink and Bo ink change with time in an embodiment of the present invention.

FIG. 136 shows how the diameter of a dot of C ink (cyan ink) of one 1 $\mu$l and that of a dot of Bo ink (blue ink) of one $\mu$l change with time. In FIG. 136, the horizontal axis represents the time which elapses after the both types of ink are dropped and the vertical axis represents the diameter of a dot of dropped ink.

Referring to FIG. 136, the diameter of a dot in either ink increases with time for approximately 20 seconds since the ink is dropped, and thereafter remains almost unchanged at 4 mm. It can also be seen that the diameter of a C ink dot changes with time in an almost similar manner to the diameter of a Bo ink dot. It should also be noted that the diameters of dots of other types of ink (Y, M, Go and Ro) measured similarly changed with time. Thus, it can be said that the complementary color ink to which a penetrant is not added (Bo ink, Go ink and Ro ink) and normal color ink are almost the same in the permeability into printing sheets.

A penetrant for increasing the permeability into printing sheets is now added to each of Bo ink, Go ink and Ro ink, as described above, to prepare B ink, G ink and R ink. The penetrant includes lower alcohol, such as ethanol and isopropyl alcohol, and the present embodiment employs ethanol as an example. In adding the penetrant to each ink, the weight of the water in the composition of each ink described in FIGS. 132–134 is reduced by the weight of the penetrant added to prepare the ink. Accordingly, the value in weight % (wt %) of each of the other components of the composition is not changed.

Figure 137:
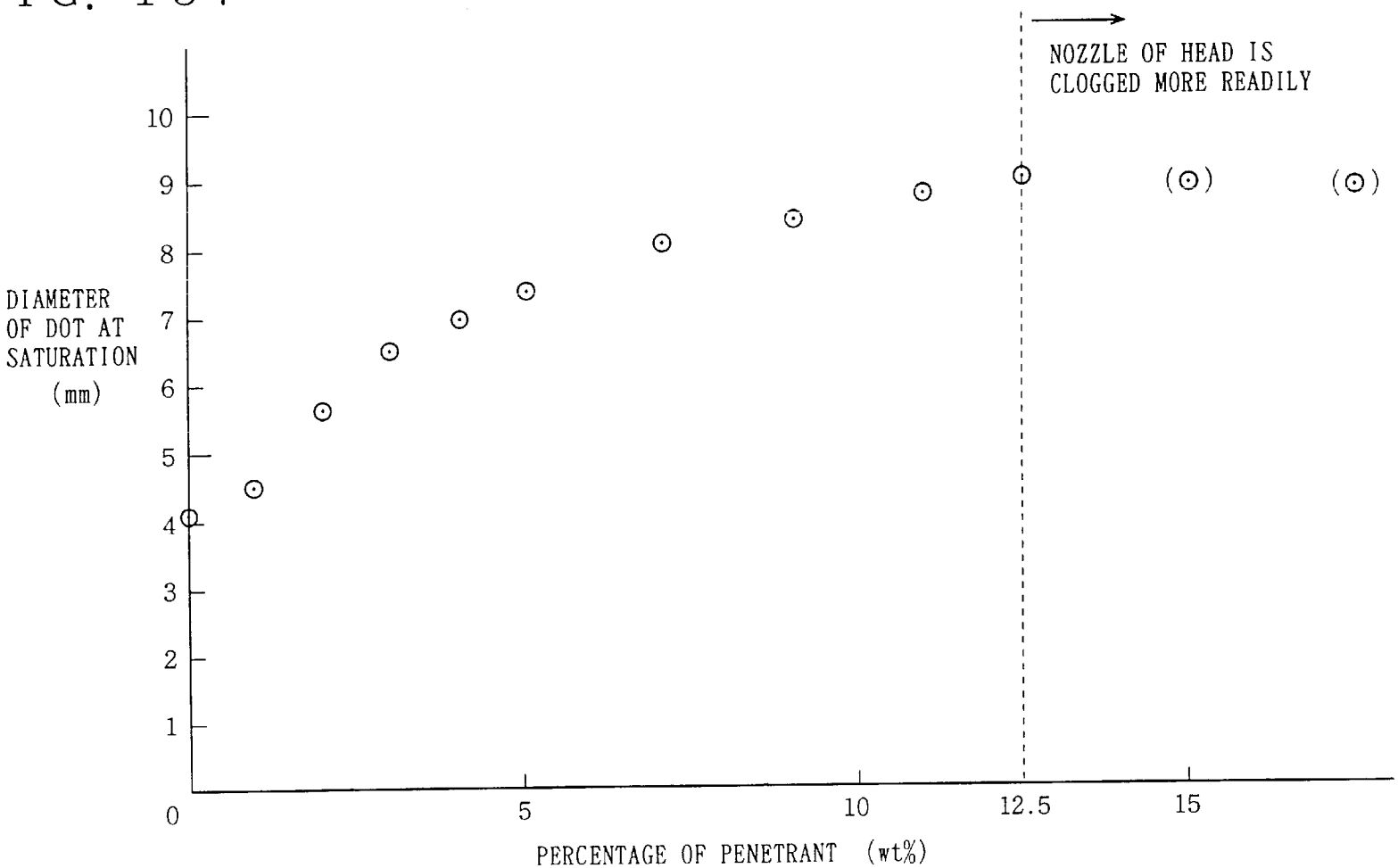
FIG. 137 represents the diameter of a penetrant-containing Bo ink dot with respect to the content by percentage of the penetrant added to the Bo ink in an embodiment of the present invention.

FIG. 137 shows how the diameter of a dot of B ink (i.e. the ink obtained by adding the penetrant to Bo ink) of one $\mu$l changes with respect to the percentage of the penetrant. It should be noted that the diameter of a dot at saturation in FIG. 137 is the diameter of the dot when 30 seconds have elapsed since the ink is dropped. The period of 30 seconds before measuring the diameter of an ink dot results from the idea that the diameter of the dot of the dropped ink is no longer increased and thus remains almost constant, as described with reference to FIG. 136.

Referring to FIG. 137, for a percentage of the penetrant ranging from 1 to 12.5 wt %, the diameter of a dot at saturation increases as the percentage of the penetrant is increased. Thus, it is understood that for a percentage of the penetrant ranging from 1 to 12.5 wt %, the permeability of the ink into printing sheet is increased as the percentage of the penetrant is increased. When the percentage of the penetrant exceeds 12.5%, the nozzles of the print head are more readily clogged. Thus, with ethanol used as a penetrant, the upper limit of the percentage of the penetrant is preferably 12.5%.

A penetrant of different percentages is also added to Go ink and Ro ink for preparing G ink and R ink to similarly measure the diameters of dots at saturation with respect to the percentages of the penetrant. The results obtained are similar to that for B ink. Also, the viscosity of any ink is lowered as the percentage of the penetrant is increased.

In ink jet printer 1 according to the present embodiment, the Y ink, M ink, C ink and K ink described above and B ink, G ink and R ink obtained by adding ethanol as a penetrant to Bo ink, Go ink and Ro ink are used for image formation. It should be noted that in the present embodiment, ink dot patterns are provided such that an end of a dot in each of Y ink, M ink and C ink are covered with R ink, G ink and B ink in order to eliminate the roughness caused in color image formation by means of conventional Y ink, M ink and C ink.

Figure 138:
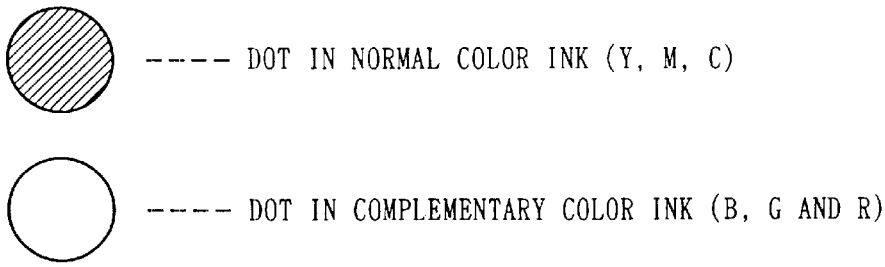
FIG. 138 illustrates the types of dots for illustrating the FIGS. 139–143 dot patterns according to an embodiment of the present invention.

FIG. 138 illustrates the types of dots for illustrating dot patterns of the present embodiment shown in FIGS. 139–143. Referring to FIG. 138, a dot in any ink of Y, M and C as normal color ink is referred to as a "normal color ink dot" and is depicted as a hatched circle, and a dot in any ink of B, G and R as complementary color ink is referred to as a "complementary color ink dot" and depicted as a circle.

Figure 139:
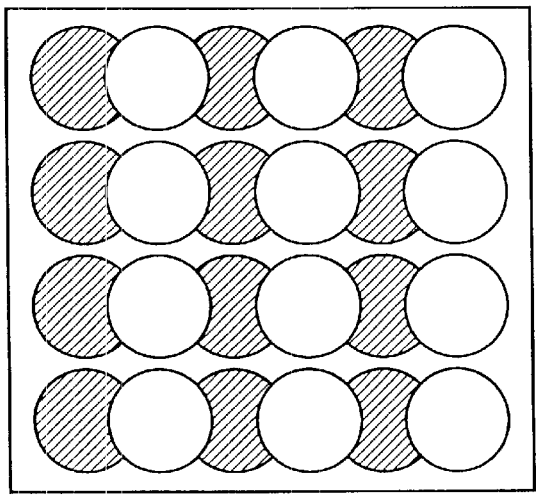
FIGS. 139–143 show dot patterns according to an embodiment of the present invention.

FIG. 139 shows a first dot pattern. For this pattern, normal color ink dots are initially printed and a complementary color ink dot is then printed between adjacent, normal color ink dots. In expressing green color, for example, dots in Y ink and C ink as normal color ink are initially printed adjacent to each other and a dot in G ink is then printed between the adjacent Y and C ink dots.

Figure 140:
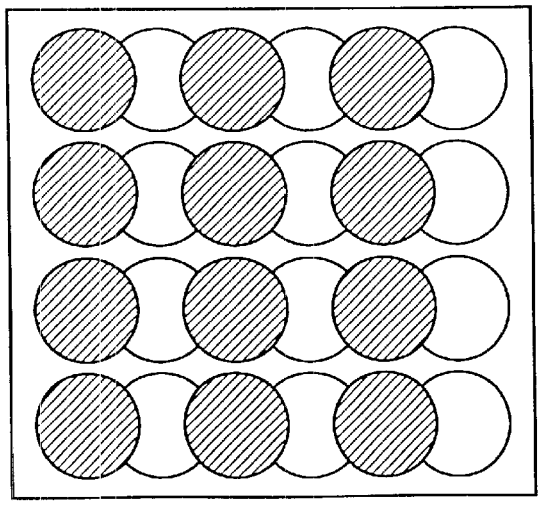

FIG. 140 shows a second dot pattern. For this pattern, complementary color ink dots are initially printed and a normal color ink dots is then printed between adjacent, complementary color ink dots.

Figure 141:
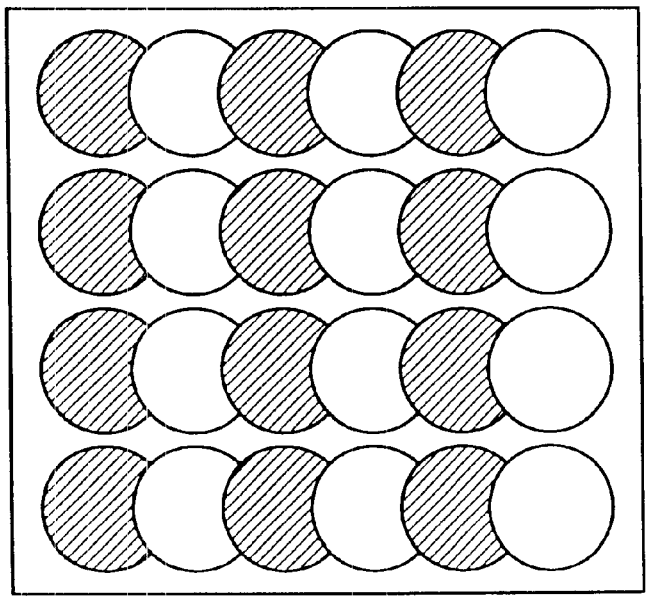

FIG. 141 shows a third dot pattern. For this pattern, a normal color ink dot and a complementary color ink dot are printed alternately from the left end of a printing sheet.

Figure 142:
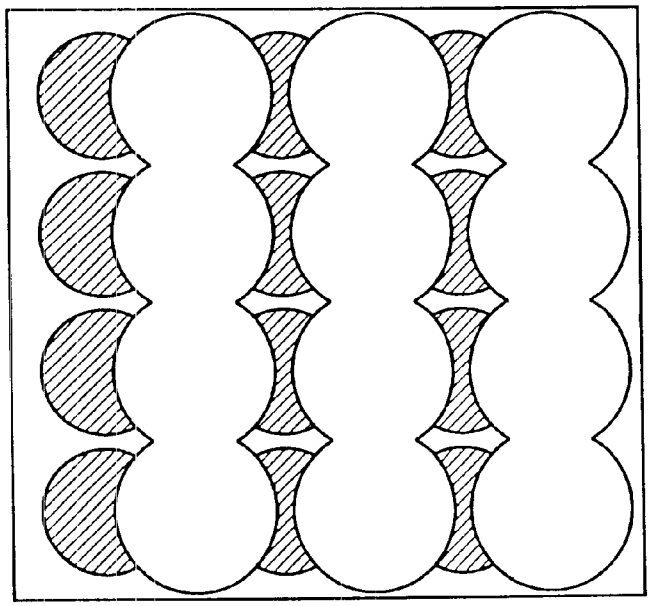

FIG. 142 shows a fourth dot pattern. For this pattern, normal color ink dots are initially printed and a complementary color ink dot which is larger in diameter than the previously printed, normal color ink dots is then printed between adjacent, normal color ink dots. It should be noted that in printer head 3 of ink jet printer 1 according to the present embodiment, the voltage which head jet drive portion 105 applies to piezoelectric element 313 can be changed to change the diameter of an ink dot to be printed, as has been described. In other words, head jet drive portion 105 configures a dot diameter controlling portion which provides control to change the diameter of a dot to be printed by the printer head.

Figure 143:
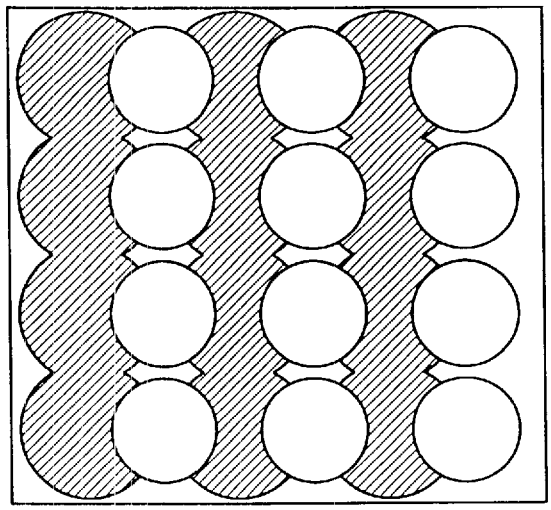

FIG. 143 shows a fifth dot pattern. For this pattern, normal color ink dots are initially printed and a complementary color ink dot which is smaller in diameter than the previously printed, normal ink color dots is then printed between adjacent, normal color ink dots.

When an image is formed according to the patterns described with reference to FIGS. 139–143, a normal color ink dot overlaps with a complementary color ink dot. Since the complementary color ink used here contains a penetrant, the complementary color ink is higher in the permeability into printing sheet than the normal color ink. Accordingly, when a normal color ink dot overlaps with a complementary color ink dot to express a secondary color, the normal color ink dot bleeds due to the complementary color ink dot and the outline of each dot as conventionally exaggerated will thus be eliminated at overlapping portions of the dots. Thus, smoother images can be formed.

Since the dot diameter control portion configured of head jet drive portion 105 can change the diameter of a dot to be printed by a head, the bleeding of a normal color ink dot due to the complementary color ink can be adjusted at a desired degree of bleeding.

Figure 144:
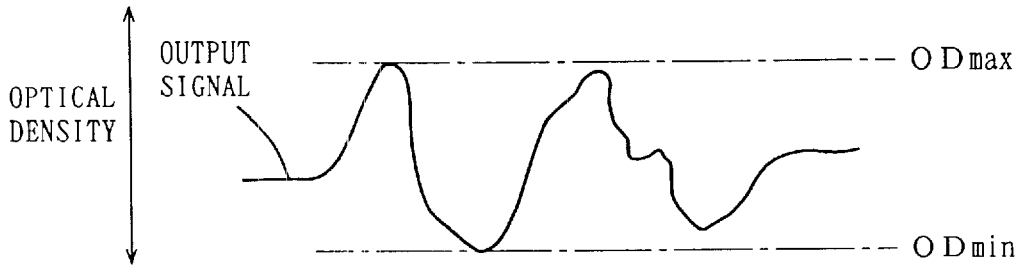
FIG. 144 shows one example of an output waveform of an optical densitometer in an embodiment of the present invention.

In order to verify the smoothness obtained by using complementary color ink to which a penetrant is added together with normal color ink, ΔD is measured which indicates the smoothness of an image with respect to the diameter of a dot in the complementary color ink at saturation (shown in FIG. 137). ΔD is the difference between the maximum optical density ($OD_{max.}$) and the minimum optical density ($OD_{min.}$) indicated in an output waveform of a densitometer when the densitometer continuously measures the optical density (color density) of a sheet printed with the ink. More specifically, when the densitometer provides measurement, an output signal is obtained in the waveform as shown in FIG. 144. Obtained from the waveform are $OD_{max.}$ and $OD_{min.}$ of the optical density (the vertical direction in FIG. 144) of a sheet printed with ink. ΔD is then obtained according to the following equation:

$$\Delta D=|OD_{max.}-OD_{min.}|.$$

It can be said from the fact that ΔD is obtained as described above, that an image is smoother as value ΔD is reduced. It should be noted that the densitometer used in the present embodiment is Sakura DENSITOMETER PDA5 manufactured by Sakura (KONIKA CORP. incumbent).

Figure 145:
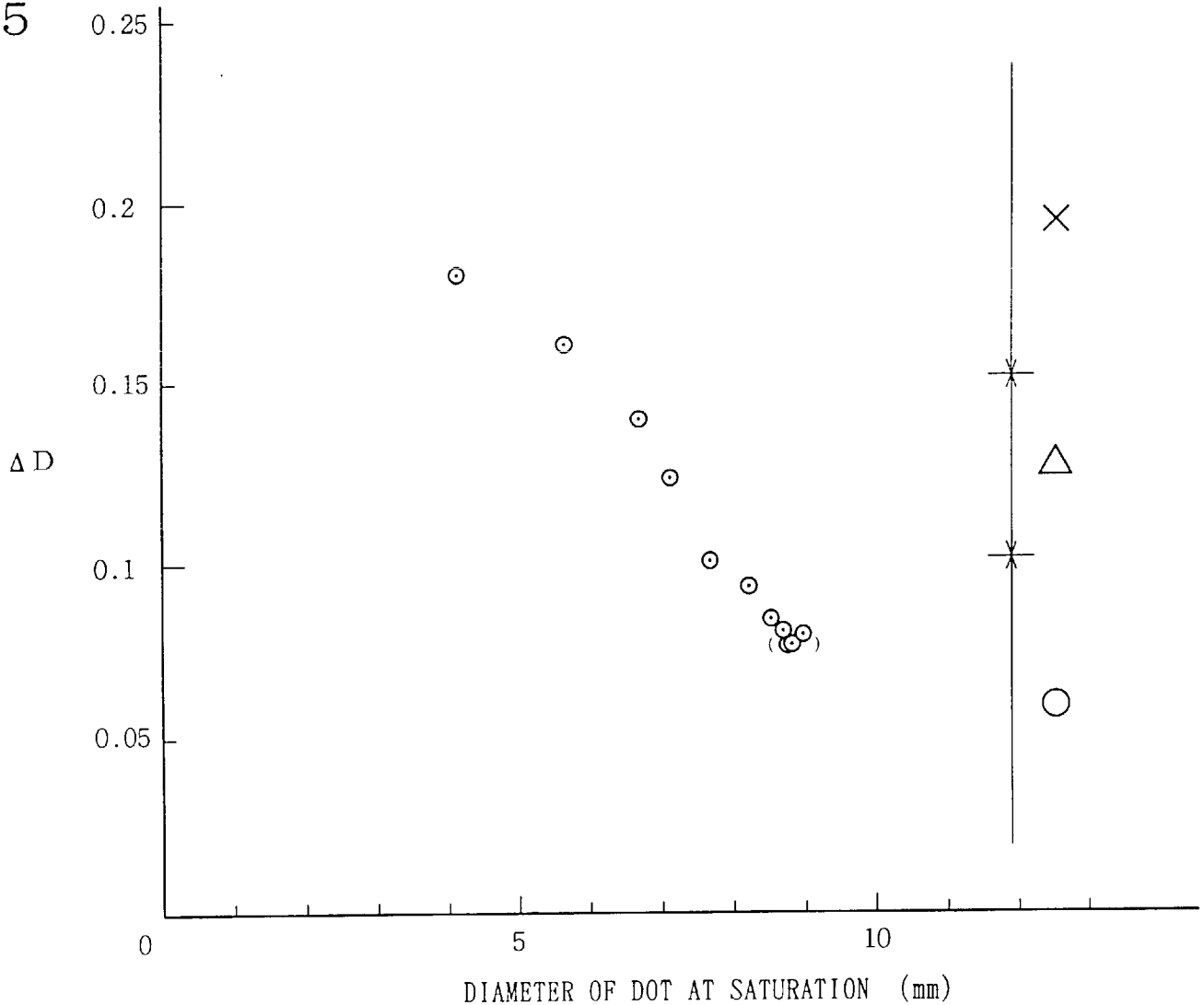
FIG. 145 represents the smoothness of an image with respect to the diameter of a dot in a complementary color ink at the point of saturation in an embodiment of the present invention.

FIG. 145 shows a measurement result of ΔD with respect to the diameter of a dot of B ink at saturation when C ink and B ink are respectively used as normal color ink and complementary color ink to print in the fifth dot pattern shown in FIG. 143. It should be noted that, as has been described previously, the value in wt % of the penetrant added is changed to change the diameter of the dot in B ink at saturation. It should also be noted that the printing pattern shown in FIG. 143 is considered as most readily causing uneven print density among the five dot patterns exemplified in the present embodiment.

Referring to FIG. 145, as the diameter of a dot of the B ink at saturation is increased, the value of ΔD is decreased. In other words, the smoothness of an image is increased as the percentage of the penetrant in B ink as complementary color ink is increased and its permeability into printing sheet is increased.

In practically forming images, their image qualities can be estimated as ○, Δ or X, depending on the value of ΔD, as described below:

$\Delta D \leqq 0.1$: ○ (smooth, good tone)

$0.1<\Delta D \leqq 0.15$: Δ (smoothness without any practical problems)

$0.15<\Delta D$: X (practically not tolerable, including noise and the like)

This evaluation is also given in FIG. 145. An evaluation of X is given when a penetrant is not contained (i.e., for a diameter of a dot of 4 mm at saturation). The evaluation is, however, gradually improved to Δ and then ○ as the percentage of the penetrant, the diameter of the dot at saturation, and the permeability of the complementary color ink into printing sheet are increased.

Furthermore, ΔD is similarly measured with respect to the diameter of a dot of complementary color ink at saturation, with Y ink and G ink respectively used as normal color ink and complementary color ink, and also with M ink and R ink respectively used as normal color ink and complementary color ink. In these examples also, the value of ΔD is reduced as the percentage of the penetrant in the complementary color ink and its permeability into printing sheet are increased.

Thus, it is understood that the smoothness of image is affected by changes in the permeability of complementary color ink into printing sheet.

Modification

The above embodiment can be modified as described below:

(1) A substance which increases the permeability of ink into printing sheet other than lower alcohol can be applied as a penetrant. In other words, the penetrant is not limited to lower alcohol and need only be a substance which increases the permeability of ink into printing sheet. In the present embodiment, complementary color ink, to which a penetrant is added, not only increases its permeability into printing sheet, as compared with normal color ink, but also lowers its viscosity. The lowered viscosity of complementary color ink allows the complementary color ink to more rapidly spread on a printing sheet and normal color ink dots to bleed more uniformly.

(2) A nozzle for jetting white ink other than the colors of R, G and B can be added to improve color reproduction of the lowest density in highlight and thus increase the brightness of an image.

(3) A nozzle for jetting brown ink other than the colors of R, G and B can be added to improve reproduction of e.g., skin color of human and thus better express an image.

(4) A nozzle for jetting gray ink other than the colors of R, G and B can be added to improve reproduction of halftone in monochrome.

Embodiment 6-1

When such photo ink as described above has a lower concentration of color material than normal ink, it has an increased percentage of water as the solvent accordingly. When ink has an increased percentage of water, it will has an increased contact angle with respect to printing sheet and hence a reduced permeability into printing sheet. Thus, the photo ink has its permeability into printing sheet further reduced, as compared with the corresponding normal ink. Accordingly, a dot in such photo ink overlapping with normal ink results in the both types of ink unsatisfactorily spreading on a printing sheet at the overlapping portion of dots and thus mixing with each other on the printing sheet to a reduced extent, and the outline of each dot is disadvantageously exaggerated and thus poorly represented at the overlapping portion.

The present embodiment solves such disadvantages and forms smooth images.

The schematic configuration of an ink jet printer 1 according to Embodiment 6-1 of the present invention is similar to that shown in FIGS. 125–128.

Figure 147:
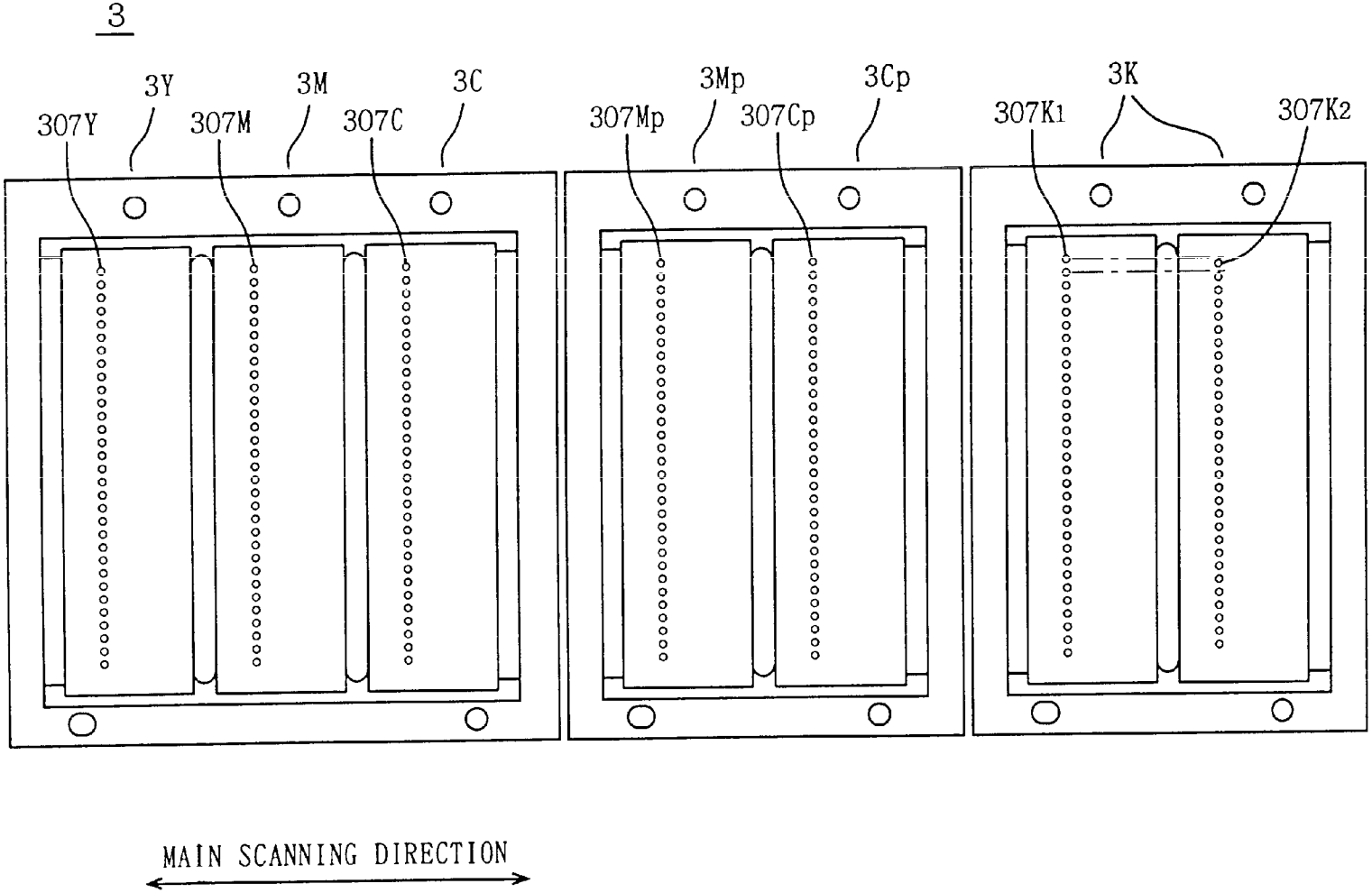
FIG. 147 is a plan view of a printer head according to Embodiment 6-1.

FIG. 147 is a plan view of a side of a printer head 3 that is provided with a nozzle. Printer head 3 shown in FIG. 147 includes a yellow (y) head 3Y, a magenta (m) head 3M and a cyan (c) head 3C for jetting ink of yellow, magenta and cyan, respectively. Printer head 3 also includes a magenta photo (mp) head 3Mp and a cyan photo (cp) head 3Cp for respectively jetting photo ink of magenta and cyan, and a black (k) head 3K for jetting black ink. It should be noted that the photo ink used in the present embodiment is lower in the concentration of coloring material and higher in the permeability into printing sheet than the ink of yellow, magenta and cyan. Heads 3Y-3K are provided with nozzles 307Y, 307M, 307C, 307Mp, 307Cp, 307$K_1$ and 307$K_2$, respectively. An arrangement density of the nozzles of black head 3K is twice that of each of the other color heads and the adjacent nozzles 307$K_1$ and 307$K_2$ are staggered, vertically offset from each other. The arrow shown in FIG. 147 indicates the direction in which printer head 3 provides main scanning.

The schematic configuration of the control portion of ink jet printer 1 is the same as shown in FIG. 7.

Figure 148:
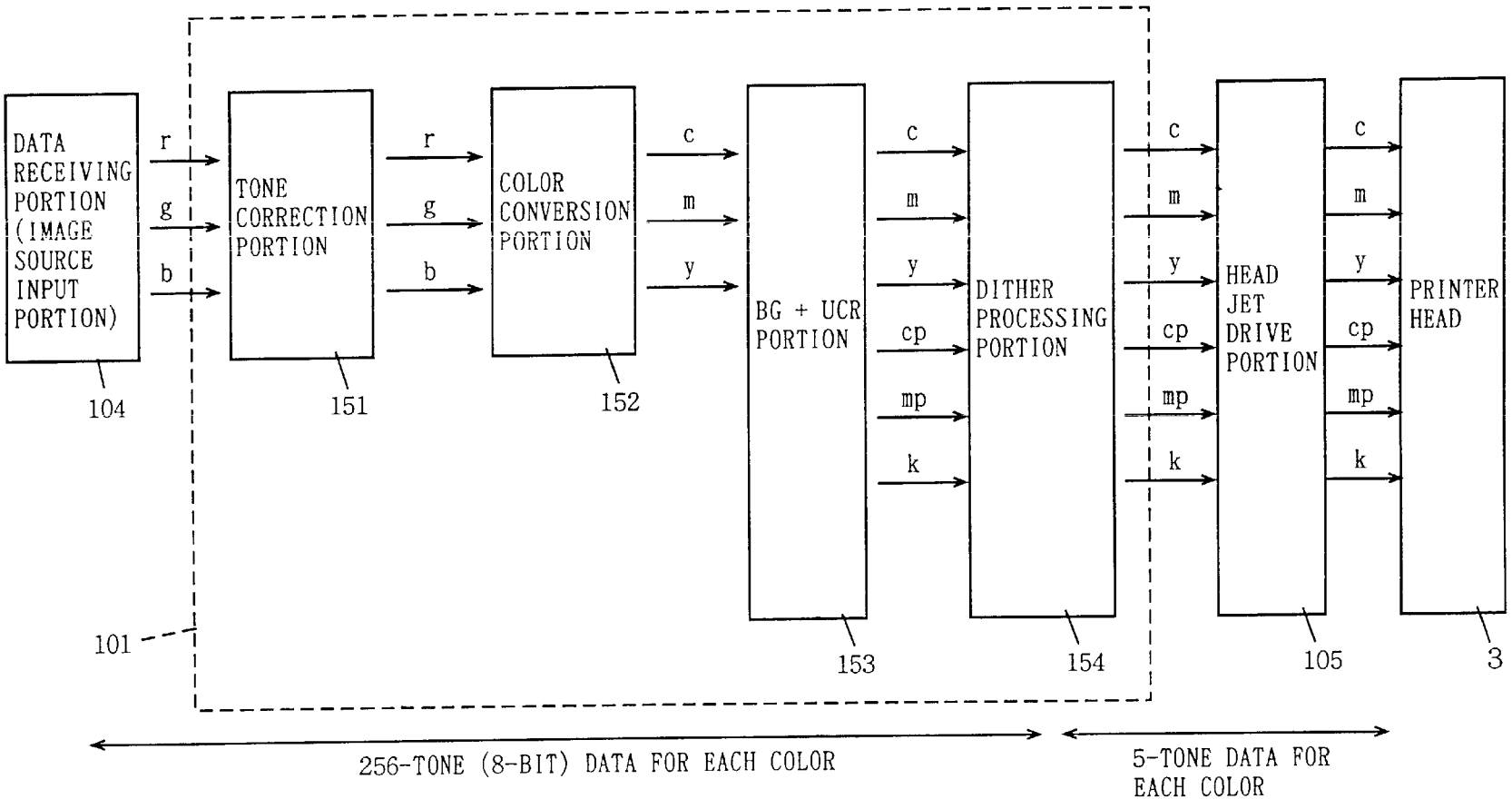
FIG. 148 is a block diagram showing a configuration of a CPU and a periphery thereof.

FIG. 148 is a block diagram showing a configuration of a CPU 101 and a periphery thereof. CPU 101 includes a tone correction portion 151 which receives data r, g and b respectively corresponding to the colors of red, green and blue from a data receiving portion (an image source input portion) 104 and provides tone correction to the data r, g and b, a color conversion portion 152 which converts the data r, g and b corrected in tone into data of c, m and y, a BG+UCR portion 153 which separates gray component from the converted data of the three colors and data of cp and mp for replacement with a black signal to also output data k corresponding to black color, and a dither processing portion 154 which applies dither processing to the data output from BG+UCR portion 153. The data which has been subjected to dither processing is input to head jet drive portion 105. Each color data of cyan, magenta, yellow and black which has been subjected to dither processing is five-tone data. Cyan has the upper two tones and the lower three tones represented with cyan ink (corresponding to the c data) and cyan photo ink (corresponding to the cp data), respectively. Magenta has the upper two tones and the lower three tones represented with magenta ink (corresponding to the m data) and magenta photo ink (corresponding to the mp data), respectively. Head jet drive portion 105 drives each of color heads 3C–3K.

Figure 149:
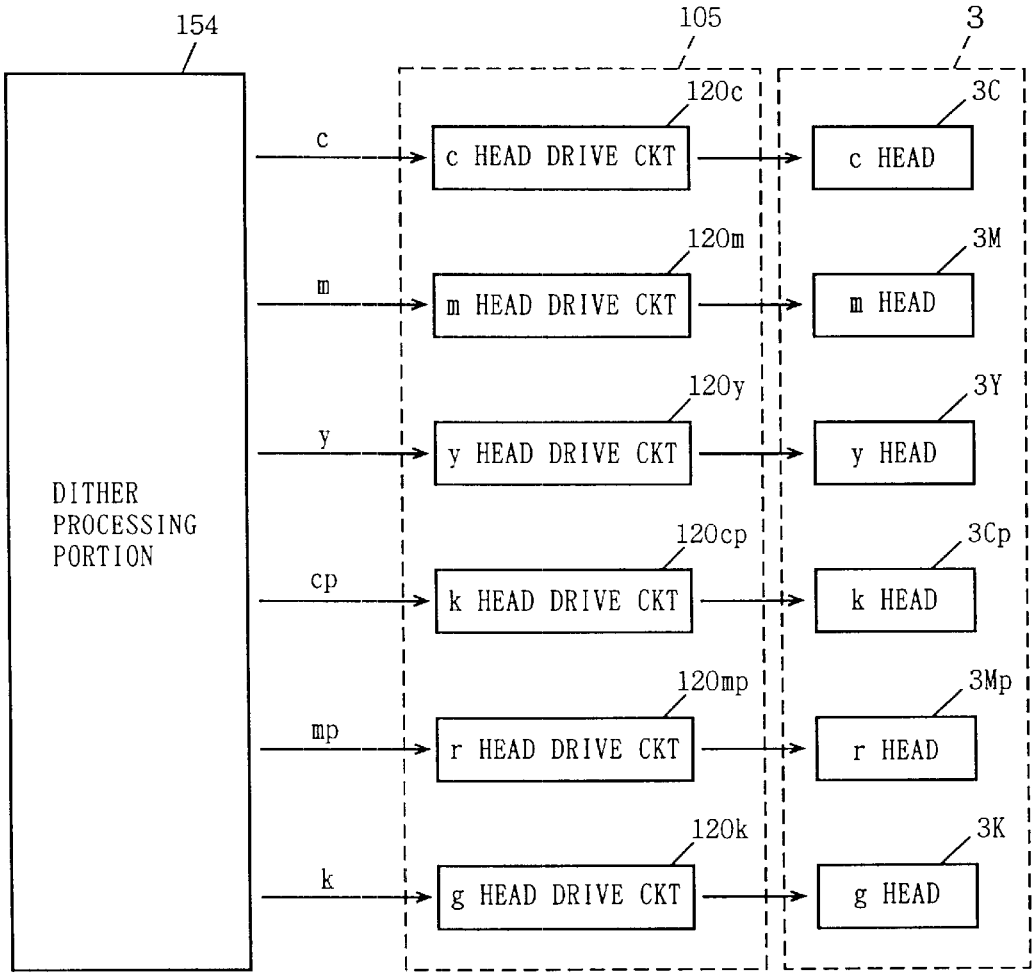
FIG. 149 is a block diagram showing the dither processing portion, printer head jet drive portion and each color head shown in FIG. 148.

FIG. 149 is a block diagram showing a configuration of the dither processing portion 154, head jet drive portion 105 and each color printer head 3 shown in FIG. 148. Referring to FIG. 149, head jet drive portion 105 includes a c head drive circuit 120*c*, a m head drive circuit 120*m*, a y head drive circuit 120*y*, a cp head drive circuit 120*cp*, a mp head drive circuit 120*mp*, and a k head drive circuit 120*k*. Printer head 3 includes c head 3C, m head 3M, y head 3Y, cp head 3Cp, mp head 3Mp and k head 3K, as described with reference to FIG. 147, which are connected to drive circuits 120*c*–120*k*, respectively.

In ink jet printer 1 according to the present invention, head drive circuits 120*c*, 120*m*, 120*y*, 120*cp*, 120*mp* and 120*k* can control the voltage applied to a piezoelectric element 313 of each of their respective color heads 3C, 3M, 3Y, 3Cp, 3Mp and 3K of printer head 3 to control the amount of ink jetted from each color head and thus change the diameter of a dot to be printed depending on the tone.

The compositions of the ink of yellow, magenta, cyan and black used in the ink jet printer according to the present embodiment are the same as described in FIGS. 11–14.

The present embodiment also employs the aforementioned photo ink of M ink and C ink in addition to each of the aforementioned ink of the colors of Y, M, C and K, as described above. Hereinafter, the aforementioned Y, M, C and K color ink will generally be referred to as "normal color ink", as opposed to photo ink.

The photo ink used in the present embodiment is each of light magenta ink and light cyan ink described in FIGS. 150 and 151 which contains a penetrant described later. For convenience of description, the light magenta ink and light cyan ink which do not contain the penetrant will be referred to as "Mpo ink", and "Cpo ink", respectively, and the light magenta ink and light cyan ink which contain the penetrant to obtain the photo ink according to the present embodiment will be referred to as "Mp ink", and "Cp ink", respectively.

FIGS. 150 and 151 respectively describe compositions of the light magenta ink (Mpo ink) and light cyan ink (Cpo ink) used in ink jet printer 1 according to the present embodiment.

A penetrant is added to each of the aforementioned Mpo ink and Cpo ink to prepare Mp ink and Cp ink with an increased permeability into printing sheet to examine how the permeabilities of these types of ink into printing sheet change as the percentage of the penetrant is changed. The penetrant includes lower alcohol, such as ethanol and isopropyl alcohol, and the present embodiment employs ethanol as one example thereof.

The ink jet printer according to the present invention can also be provided with a head for jetting photo ink of each of Y ink and K ink the compositions of which are respectively described in FIGS. 11 and 14, i.e., Yp ink and Kp ink.

Accordingly, the aforementioned penetrant is also added to light yellow ink (Ypo ink) and light black ink (Kpo ink) the compositions of which are as described in FIGS. 152 and 153 to prepare Yp ink and Kp ink to examine how the permeabilities of the both types of ink into printing sheet change as the percentage of the penetrant is changed.

FIGS. 152 and 153 describe compositions of light yellow ink (Ypo ink) and light black ink (Kpo ink) which can be used in ink jet printer 1 according to the present embodiment.

In adding the penetrant to each type of ink, the weight of water in the composition of each ink described in FIGS. 150–153 is reduced by the weight of the added penetrant to prepare ink. Thus, the weight percentage (wt %) of each of the other components of the composition is unchanged.

Permeability of each type of ink into printing sheet is determined depending on the diameter of a dot of an ink drop on a printing sheet that is obtained by measuring the spreading of the image of the dot by means of the optical measuring device shown in FIG. 135 as described previously.

A printing sheet 502 is LX Jetseries Paper HP 51634z available from HP Company.

Initially, ethanol of 4 wt % is added to each type of the aforementioned ink Mpo, Cpo, Ypo and Kpo to prepare photo ink. The ink of each type is dropped onto a printing sheet and the diameter of a dot thereof is measured by the optical measuring device shown in FIG. 135.

Figure 154:
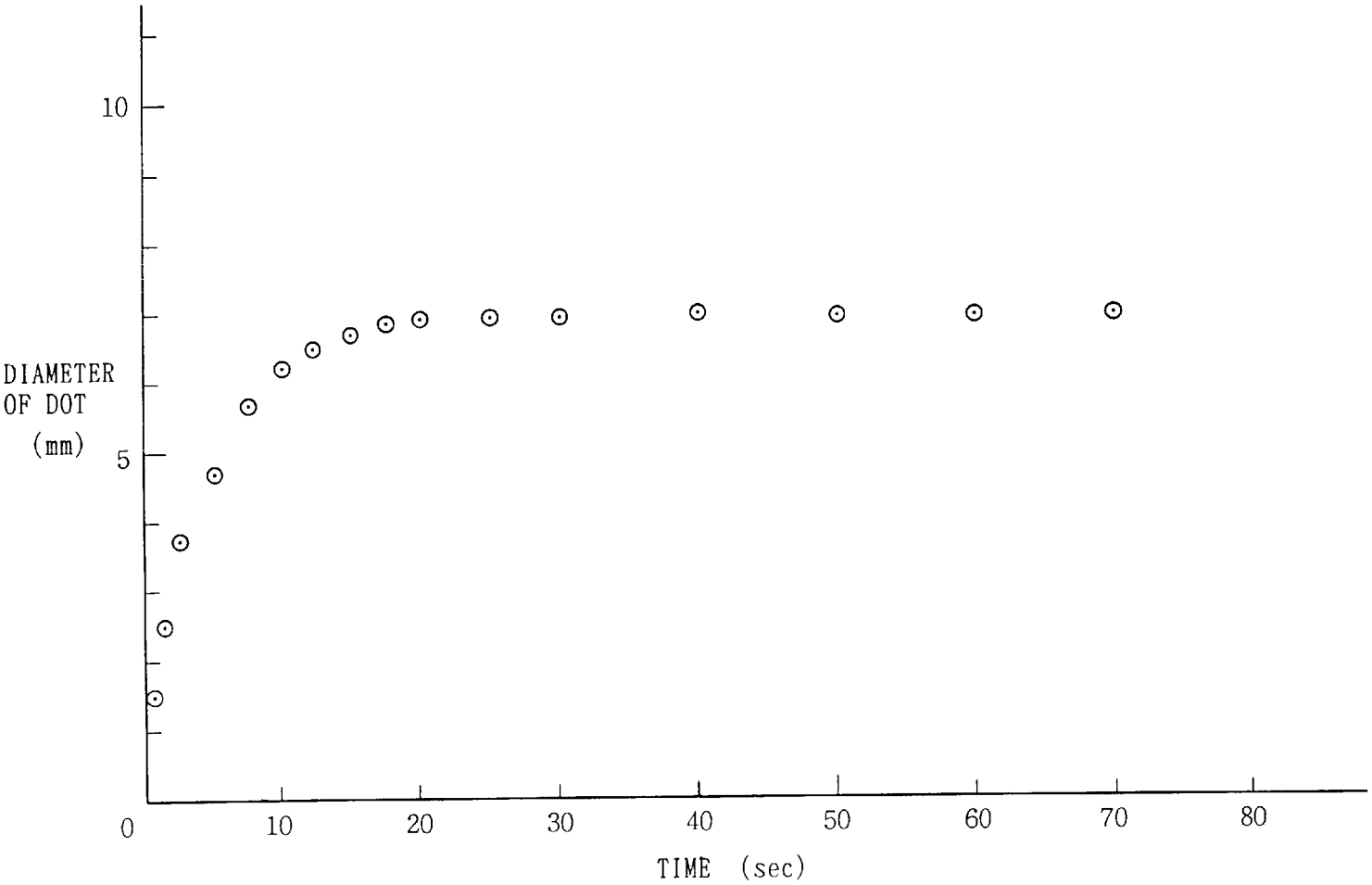
FIG. 154 represents how the diameter of a Kp ink dot changes with time in an embodiment of the present invention.

FIG. 154 represents how the diameter of a dot of Kp ink (i.e., Kpo ink to which ethanol of 4 wt % is added as a penetrant) of 1 $\mu$l changes with time. In FIG. 154, the horizontal axis represents the time which has elapsed since the ink is dropped and the vertical axis represents the diameter of a dot of the ink dropped.

Referring to FIG. 154, for approximately 20 seconds since the ink is dropped, the diameter of a dot of the ink increases with time. After the period oximately 20 seconds, however, the diameter of the dot remains almost unchanged, being 7 mm. Diameters of dots of other types of photo ink (Mo, Co, Yo) with ethanol of 4 wt % contained therein are also measured and found to similarly change with time.

The wt % of ethanol added to each type of the aforementioned ink of Mpo, Cpo, Ypo and Kpo is now changed to prepare photo ink. The prepared photo ink of each type is dropped onto a printing sheet to measure the spreading of the image of the dropped ink.

Figure 155:
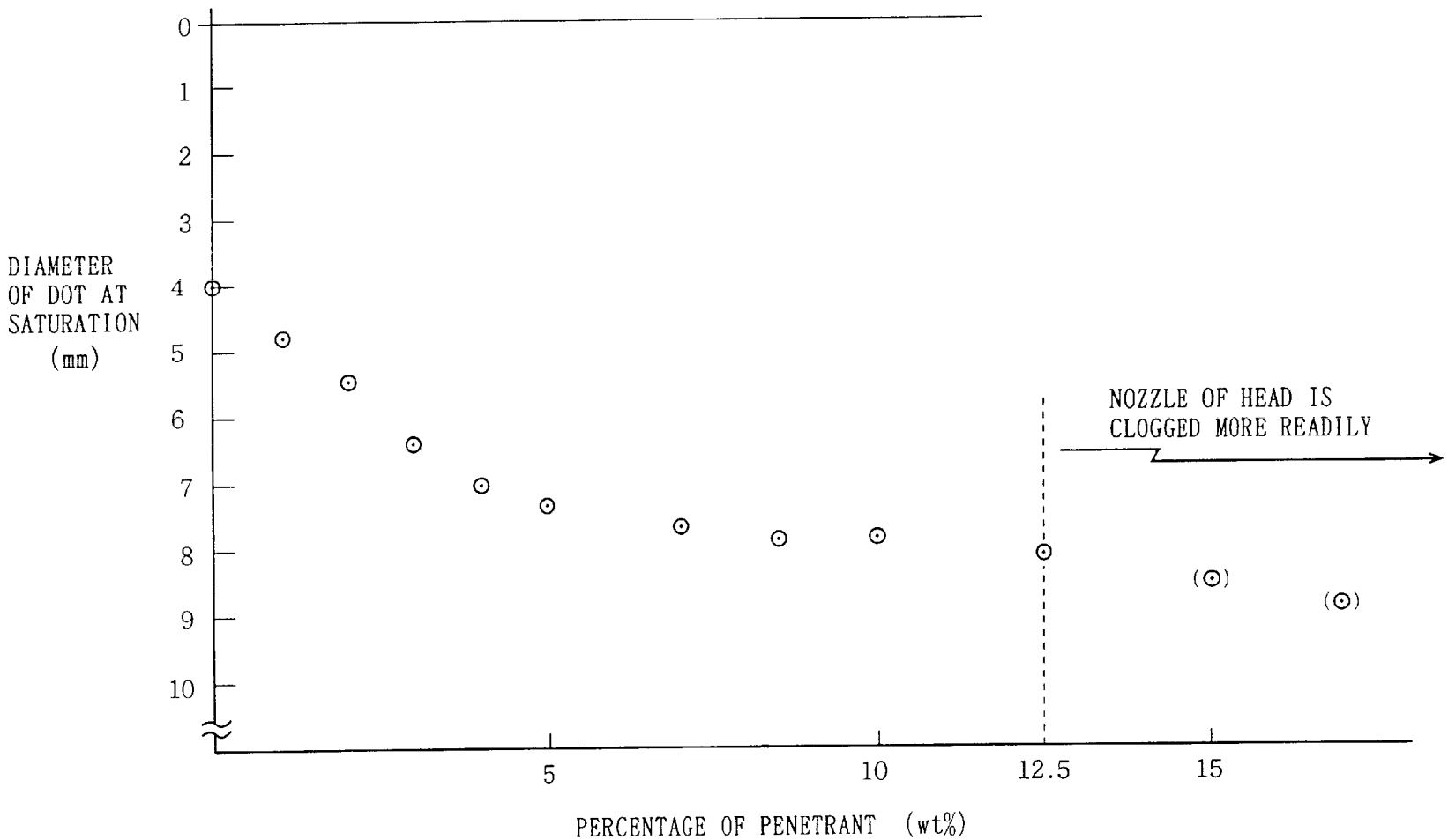
FIG. 155 represents the diameter of a penetrant-containing Kpo ink dot with respect to the content by percentage of the penetrant added to the Kpo ink in an embodiment of the present invention.

FIG. 155 represents how the diameter of a dot of Kp ink of 1 $\mu$l obtained by adding a penetrant to Kpo ink changes with respect to the percentage of the penetrant. It should be noted that the diameter of a dot in FIG. 155 is the diameter of the dot when 30 seconds have elapsed since the ink is dropped. The period of 30 seconds set before the diameter of a dot is measured is derived from the idea that the diameter of a dot of the ink dropped no longer increases and remains almost constant, as has been described with reference to FIG. 154.

Referring to FIG. 155, the diameter of a dot at saturation is 4 mm for a percentage of penetrant of 0%, and increases for a range of 1 to 12.5 wt % as the percentage of the penetrant is increased. Thus, it is understood that for a range of the percentage of penetrant of 1 to 12.5 wt %, the permeability of Kp ink into printing sheet is increased as the percentage of the penetrant is increased. When the percentage of the penetrant exceeds 12.5%, the nozzles of the print head are clogged more readily. Thus, with ethanol used as a penetrant, it is preferable that the upper limit of the percentage of the penetrant is set at 12.5%.

Mp, Cp and Yp with varied percentage of the penetrant also had their respective changes in the diameter of a dot similarly measured with respect to the percentage of the penetrant and the measurement results were similar to that of the aforementioned Kp ink. It is also found that the viscosity of any type of ink is reduced as the percentage of the penetrant is increased.

Meanwhile, the various types of ink of Y, M, C and K as normal color ink are dropped and the diameters of their respective dots are measured after 30 seconds. They are approximately 4 mm. Thus, it can be said each of the ink of Mp, Cp, Yp and Kp containing a penetrant is higher in the permeability into printing sheet than normal color ink.

Ink jet printer 1 of the present embodiment uses the normal color ink (ink of Y, M, C and K) and photo ink (ink of Mp and Cp) as described above, and can also use Yp ink and Kp ink as photo ink.

In forming images with such various types of ink, it is preferable to print images in ink in the dot patterns described below. The dot patterns of ink preferred in the present embodiment will now be described below.

FIG. 156 shows the types of dots for illustrating dots patterns of the present embodiment. Referring to FIG. 156, a dot in any ink of Y, M, C and K as normal color ink will be referred to as a "normal color ink dot" and depicted as a hatched circle, and a dot in any ink of Yp, Mp, Cp and Kp as photo ink will be referred to as a "photo ink dot" and depicted as a circle.

A first dot pattern is as shown in FIG. 139. For this pattern, normal color ink dots are initially printed and a photo ink dot is then printed between adjacent normal color ink dots. To represent black color, for example, dots in K ink as normal color ink are initially printed and a dot in Kp ink is then printed between adjacent K ink dots.

A second dot pattern is as shown in FIG. 140. For this pattern, photo ink dots are initially printed and a normal color ink dot is then printed between adjacent photo ink dots.

A third dot pattern is as shown in FIG. 141. For this pattern, a normal color ink dot and a photo ink dot are printed alternately from the left end of a printing sheet.

A fourth dot pattern is as shown in FIG. 142. For this pattern, normal color ink dots are initially printed and a photo ink dot which is larger in diameter than the previously printed, normal color ink dots is then printed between adjacent normal color ink dots. It should be noted that in printer head 3 of ink jet printer according to the present invention, head jet drive portion 105 can change the voltage applied to piezoelectric element 313 to change the diameter of an ink dot to be printed. In other words, head jet drive portion 105 configures a dot diameter control portion which provides control so that the printer head changes the diameter of a dot to be printed.

A fifth dot pattern is as shown in FIG. 143. For this pattern, normal color ink dots are initially printed and a photo ink dot which is smaller in diameter than the previously printed, normal ink color dots is then printed between adjacent normal color ink dots.

When images are formed in each pattern described with reference to FIGS. 139–143, a photo ink dot overlaps with an end portion of a normal color ink dot. Since the photo ink used here contains penetrant, it is higher in the permeability into printing sheet than normal color ink. Accordingly, when a photo ink dot according to the present embodiment overlaps with a normal color ink dot to form an image, the photo ink dot allows an end of the normal color ink dot to bleed. Thus, the outlines of dots of each type of ink is not exaggerated as conventional in a formed image at overlapping portions of dots and the formed image appears smoother.

Furthermore, since the dot diameter control portion configured by head jet drive portion 105 can change the diameter of a dot to be printed by a head, the bleeding of a normal color ink dot caused by photo ink can be adjusted at a desired degree.

In order to verify the smoothness obtained by using photo ink containing a penetrant together with normal color ink, $\Delta D$ is measured which indicates smoothness of image with respect to the diameter of ink dot. $\Delta D$ is the difference between the maximum optical density ($OD_{max.}$) and the minimum optical density ($OD_{min.}$) indicated in an output waveform of a densitometer when the densitometer continuously measures optical density (color density) of a sheet printed with ink. More specifically, when optical density is measured by the densitometer, an output signal of waveform is obtained as shown in FIG. 144 and $OD_{max.}$ And $OD_{min.}$ of the optical density of the sheet printed with ink (represented in FIG. 144 in the vertical direction) are obtained from the waveform. $\Delta D$ is then obtained according to the following equation:

$$\Delta D=|OD_{max.}-OD_{min.}|$$

It can be said from the fact that $\Delta D$ is obtained as described above, that an image is smoother when the value of $\Delta D$ is smaller. The optical densitometer used for measurement in the present embodiment is Sakura DENSITOMETER PDA5 manufactured by Sakura (KONIKA CORP. incumbent).

Figure 157:
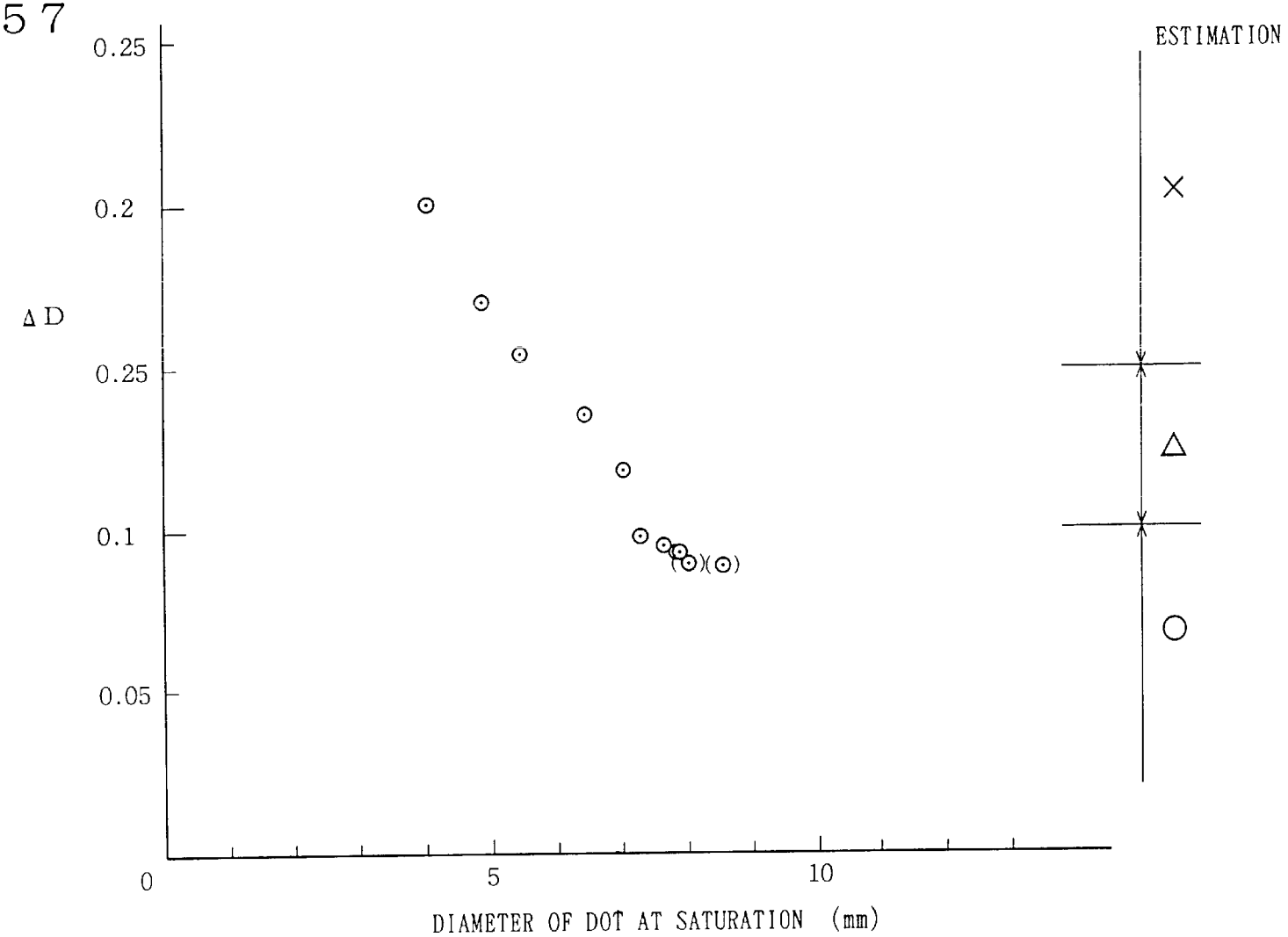
FIG. 157 represents the smoothness of an image with respect to the diameter of a photo ink dot in an embodiment of the present invention.

FIG. 157 shows a measurement result of $\Delta D$ with respect to the diameter of a Kp ink dot when the fifth dot pattern shown in FIG. 47 is printed with K and Kp used as normal color ink and photo ink, respectively. It should be noted that the diameter of the Kp ink dot is changed by changing the value in wt % of a penetrant added, as described previously. It should also be noted that the printing pattern shown in FIG. 143 is considered as causing the most uneven printing density among the five dot patterns exemplified in the present embodiment.

Referring to FIG. 157, the value of ΔD is decreased as the diameter of a dot in the Kp ink used is increased. In other words, an image is smoother as Kp ink as photo ink has a percentage of the penetrant increased and a permeability into printing sheet increased accordingly. Thus, it can be seen that with Kp ink used as photo ink, changes in the permeability of the photo ink into the printing sheet affect smoothness of images.

In practically forming images, image quality can be estimated as ○, Δ and X based on ΔD, as described below:

ΔD≦0.1: estimated as ○ (in smooth, good tone)

0.14<ΔD≦0.15: estimated as Δ (practically tolerable smoothness)

0.15<ΔD: estimated as X (practically not tolerable, including noise and the like)

Photo ink of other types are also used together with normal ink of the corresponding types for printing in the fifth dot pattern to measure ΔD. The photo ink of the other types are labeled as Embodiments 6-1 to 6-3, with three different percentages of a penetrant (ethanol) of 2 wt %, 4 wt % and 7 wt % added to the photo ink. It should be noted that for this range, any type of the ink has its permeability into printing sheet increased as the amount of the penetrant added is increased. Also, in order to clarify the effect of adding a penetrant, normal ink and light color ink corresponding thereto, i.e., the ink of Mpo, Cpo, Ypo and Kpo of the compositions described in FIGS. 150–153, which does not contain a penetrant, are used for printing in the fifth dot pattern to measure ΔD. For the measurements, image quality is estimated as the ○, Δ, or X as described above. The measurement results are shown in FIG. 158.

It is understood from FIG. 158 that any ink of Mp, Cp and Kp provides smoother image quality than Comparative Example 6-1 without a penetrant. It can also be said that generally for the ink of Mp, Cp and Kp, an image formed is smoother when the percentage of the penetrant is increased. Accordingly, it can be said that for these types of ink, an image formed is smoother when the permeability of photo ink to the printing sheet is increased. It should be noted that FIG. 158 does not provide any results with respect to Yp, since it is basically difficult to measure optical density with respect to Y and Yp and a measurement was not able to be obtained with respect to Y and Yp.

Modification

The above embodiment can be modified as described below:

(1) A substance which increases the permeability of ink into printing sheet other than lower alcohol is used as penetrant. In other words, the penetrant is not limited to lower alcohol and need only be a substance which increases the permeability of ink into printing sheet. It should be noted that when a penetrant is added to photo ink in the present embodiment, the photo ink obtains a higher permeability into printing sheet and a lower viscosity than normal color ink. When the viscosity of photo ink is lowered, the photo ink can spread on a printing sheet more rapidly so that dots in normal color ink can bleed more uniformly.

(2) A nozzle for jetting white color ink other than the colors of R, G and B is added to improve color reproduction in the lowest density in highlight and thus improve the brightness of images.

(3) A nozzle for jetting brown color ink other than the colors of R, G and B is added to improve reproduction of the skin color of human and the like and thus better express images.

(4) A nozzle for jetting gray color ink other than the colors of R, G and B is added to improve reproduction of halftone in monochrome.

Embodiment 7-1

Figure 146:
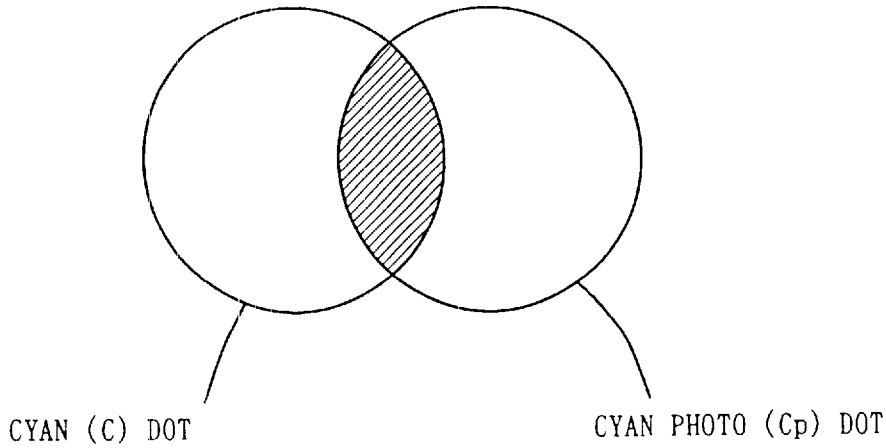
FIG. 146 RELATED ART
FIG. 146 shows one example of a dot pattern in image formation by a conventional image forming apparatus.

Conventionally, a photo ink dot overlapping a normal ink dot, as shown in FIG. 146, has resulted in each type of ink unsatisfactorily spreading on a printing sheet at the overlapping portion of the dots and thus the both types of ink mixing with each other on the printing sheet to a reduced extent, and the outline of each dot is disadvantageously exaggerated and poorly represented at the overlapping portion.

The present embodiment solves such a disadvantage and forms smooth images.

The schematic configuration of an ink jet printer 1 as Embodiment 7-1 of the present invention is the same as that of Embodiment 6-1.

The normal color ink of Y, M, C and K used for the ink jet printer as Embodiment 7-1 is the same as that for Embodiment 6-1. Embodiment 7-1 is also the same as Embodiment 6-1 in that a penetrant is added to Mpo ink and Cpo ink which do not contain a penetrant to obtain Mp ink and Cp ink.

The ink jet printer according to the present embodiment may also be provided with heads for jetting photo Y ink and photo K ink (Yp ink and Kp ink). Yp ink and Kp ink which do not contain a penetrant, i.e., Ypo ink and Kpo ink are the same as those in Embodiment 6-1.

The percentage of ethanol as a penetrant is changed in each type of the ink of Mpo, Cpo, Ypo and Kpo described above to examine changes of the permeability thereof into printing sheet. Ink is dropped onto a printing sheet to measure the spreading of the image of an ink dot by an optical measuring device and the permeability into the printing sheet is determined based on the diameter of the dot. The optical measuring device used is as the same as that shown in FIG. 135.

Figure 159:
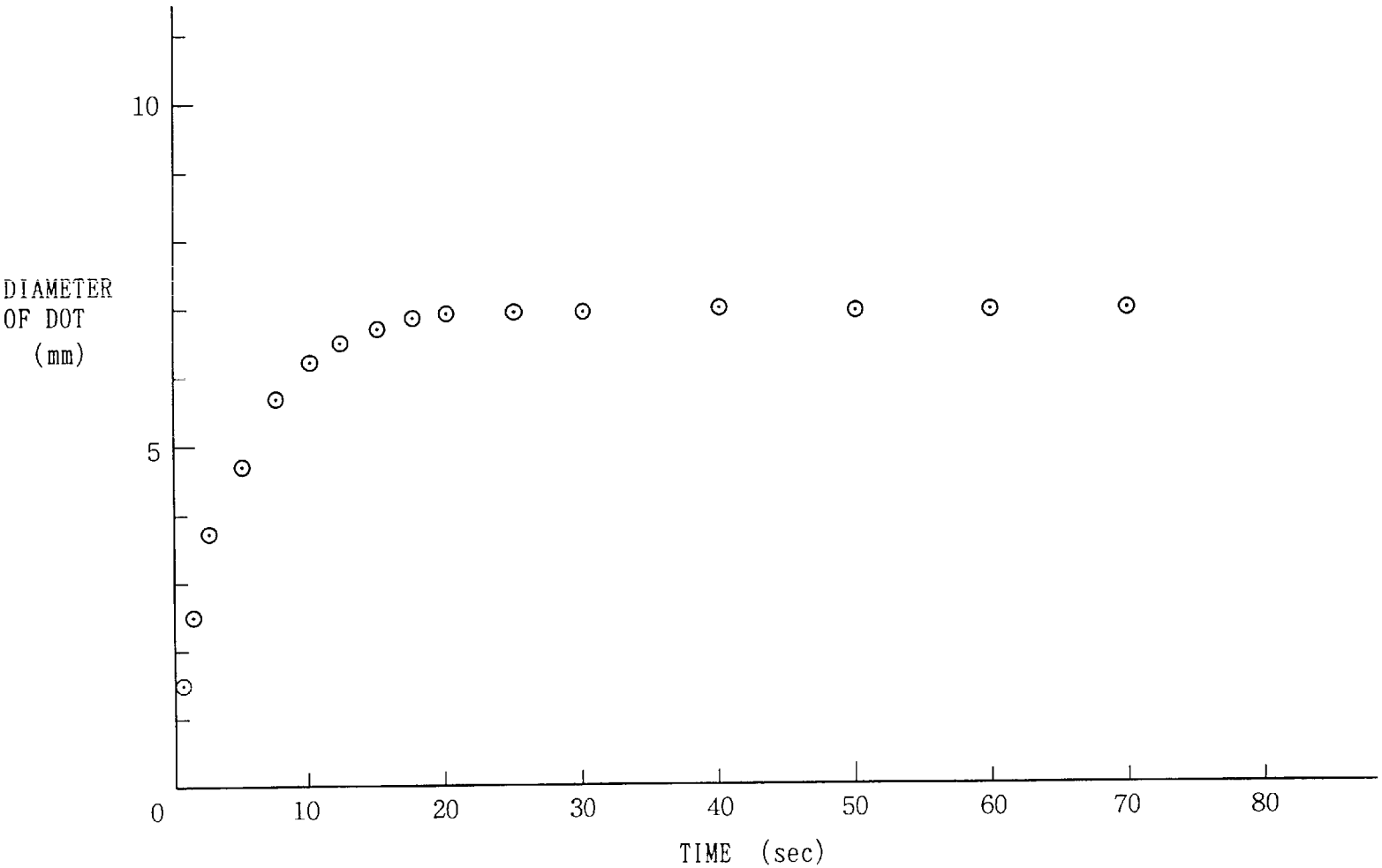
FIG. 159 represents how the diameter of a Kp ink dot changes with time in an embodiment of the present invention.

FIG. 159 shows how the diameter of a dot in Kp ink (Kpo ink to which ethanol of 1.2 wt % is added as a penetrant) of one 1 μl changes with time. In FIG. 159, the horizontal axis represents the time which has elapsed since the ink is dropped and the vertical axis represents the diameter of the dropped ink dot.

Referring to FIG. 159, the diameter of the dot increases with time for approximately 20 seconds since the ink is dropped, and remains almost unchanged after the period of 20 seconds, being 7 mm. For each of photo ink of other types (Mp, Cp and Yp) also, the diameter of a dot measured similarly changed with time, with a percentage of ethanol of 1.2 wt %.

Mpo ink, Cpo ink, Ypo ink and Kpo ink containing ethanol as a penetrant have their respective viscosities lower than the original Mpo ink, Cpo ink, Ypo ink and Kpo ink. As such, the diameter of a dot dropped on a printing sheet is measured to examine how the permeability into the printing sheet changes with respect to changes in the viscosity of each type of Mp ink, Cp ink, Yp and Kp ink associated with different percentages of ethanol in each type of the ink.

Figure 160:
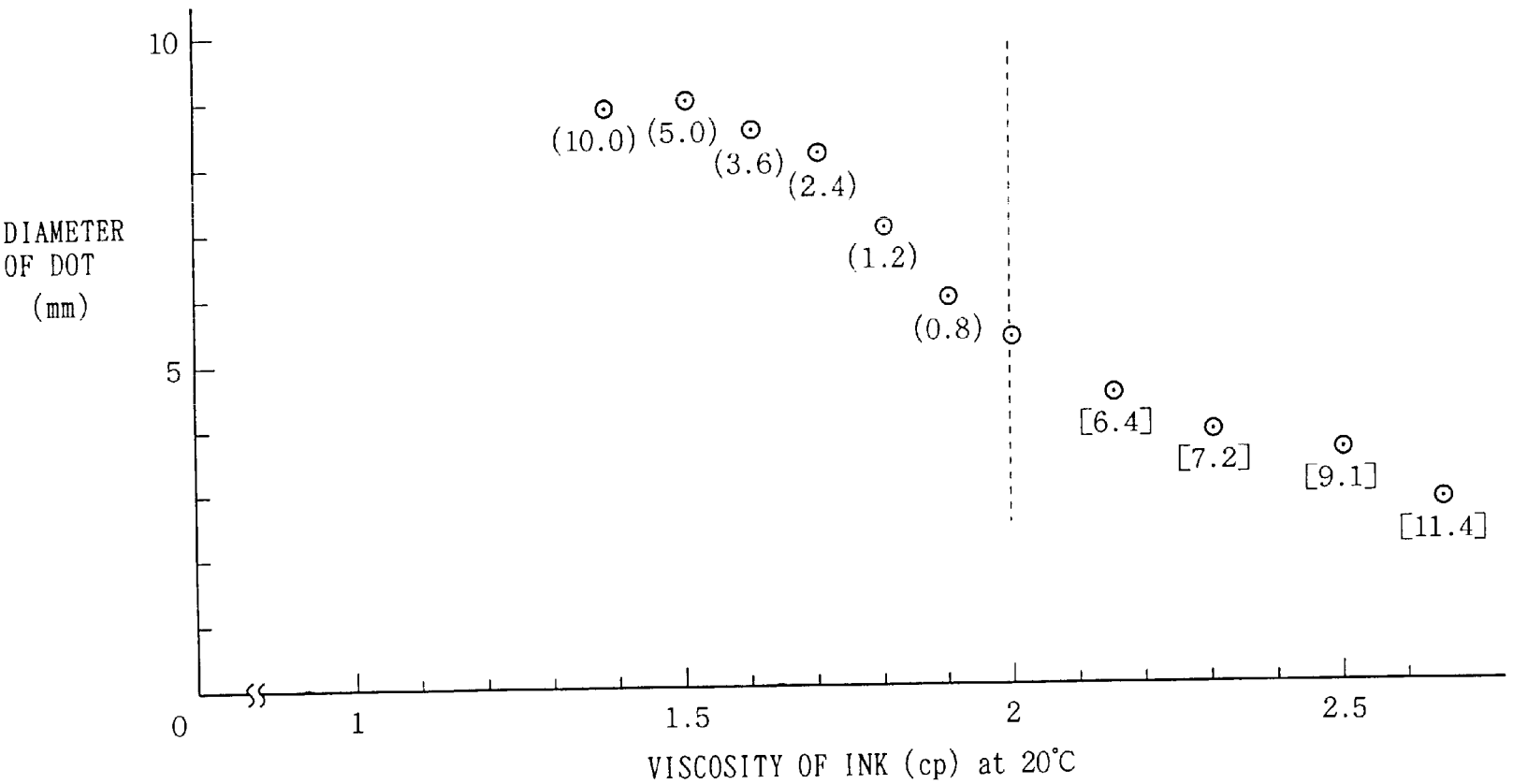
FIG. 160 represents the diameter of a penetrant-containing Kpo ink dot with respect to the content by percentage of the penetrant added to the Kpo ink in Embodiment 7-1 of the present invention.

FIG. 160 shows how the diameter of a dot of Kp ink (Kpo ink which contains a penetrant) of 1 μl changes with respect to the viscosity of the ink. In FIG. 160, the viscosity represented with the horizontal axis is represented in centipoise. The diameter of a dot in FIG. 160 is that of a dot when 30 seconds have elapsed since the ink is dropped. The period of 30 seconds before a measurement is taken is derived from the idea that the diameter of a dot of the ink dropped no longer increases and remains almost constant, as has been described with reference to FIG. 159. It should be noted that Kpo ink which do not contain a penetrant has a viscosity of 2 cp and that the data on the viscosity lower than 2 cp is associated with Kpo ink to which ethanol as a penetrant is added, as described above.

As a further comparison, FIG. 160 also shows the data on the ink the viscosity of which is increased by increasing the wt % of PEG #400 in the aforementioned Kpo in the composition described in FIG. 153 and reducing water in the composition by the same weight percentage. More specifically, FIG. 160 indicates the diameter of a dot in Kpo ink (corresponding to the data on a viscosity of 2 cp), the diameter of a dot in Kpo ink plus ethanol (corresponding to each data on a viscosity of less than 2 cp), and the diameter of a dot in Kpo ink with an increased weight percentage of PEG #400 (corresponding to each data on a viscosity exceeding 2 cp). A weight percentage of ethanol is indicated under each data in the ( ) bracket and an increased weight percentage of PEG #400 is indicated under each data in the [ ] bracket. The initial weight percentage of PEG #400 is 4.5% (shown in FIG. 153).

Referring to FIG. 160, Kpo ink which do not contain ethanol and is not changed in the weight percentage of PEG #400 from the composition described in FIG. 153 provides a diameter of an ink dot of 5 mm. For the region less than a viscosity of 2 cp, the diameter of an ink dot increases as the weight percentage of ethanol is increased and the viscosity of the ink is thus reduced. For the region more than a viscosity of 2 cp, the diameter of an ink dot is reduced as the weight percentage of PEG #400 is increased and the viscosity of the ink is thus increased. That is, ink is more permeable to printing sheet when the viscosity of the ink is lowered.

Mp, Cp and Yp are also changed in the weight percentages of ethanol and PEG #400 to measure the diameter of a dot with respect to the viscosity of each type of a ink and a result is obtained that ink is more permeable to printing sheet when the viscosity of the ink is lowered, as with the aforementioned Kp ink.

Meanwhile, the ink of Y, M, C and K as normal color ink are each dropped to measure the diameter of a dot when 33 seconds have elapsed since the ink is dropped. The diameter of a dot of each type of the ink is approximately 4 mm. Thus, it can be said that any ink of Mp, Cp, Yp and Kp which contains a penetrant is higher in the permeability to printing sheet than normal color ink.

Ink jet printer 1 of the present embodiment employs such normal color ink (ink of Y, M, C and K) and photo ink (ink of Mp and Cp) as described above. Yp ink and Kp ink can also be used as photo ink. In forming images with such types of ink, it is preferable to print with ink in the dot patterns similar to those shown in FIGS. 156 and 139–143.

When an image is formed in each pattern described with reference to FIGS. 139–143, a normal color ink dot overlaps with a photo ink dot. Since the photo ink used here contains a penetrant, the photo ink has a lower viscosity and a higher permeability to printing sheet than normal color ink. Accordingly, when a normal color ink dot overlaps with a photo ink dot to form an image, the photo ink dot causes an end portion of the normal color ink dot to bleed and thus the outline of each ink dot is not exaggerated as conventional in the formed image at the overlapping portion of the dots. Thus, the formed image is smoother.

Furthermore, since the dot diameter control portion configured by head jet drive portion 105 can change the diameter of a dot to be printed by a head, the bleeding of a normal color ink dot owing to the photo ink dot can be adjusted at a desired degree.

In order to verify the smoothness obtained by using photo ink which contains a penetrant together with normal color ink, ΔD is measured which indicates the smoothness of an image with respect to the diameter of an ink dot. ΔD is the difference between the maximum optical density ($OD_{max.}$) and the minimum optical density ($OD_{min.}$) indicated in an output waveform from an optical densitometer when the optical densitometer continuously measures the optical density (color density) of a sheet printed with ink. More specifically, when a measurement is taken by the optical densitometer, an output signal of waveform is obtained as shown in FIG. 144 and $OD_{max.}$ and $OD_{min.}$ of optical density of the sheet printed with ink (represented in FIG. 144 in the vertical direction) are obtained from the waveform. Then, ΔD is obtained according to the following equation:

$$\Delta D=|OD_{max.}-OD_{min.}|$$

It can be said from the fact that ΔD is obtained as described above, that an image is smoother when the value of ΔD is smaller. The optical densitomer used for measurement in the present embodiment is Sakura DENSITOMER manufactured by Sakura (KONIKA CORP. incumbent).

Figure 161:
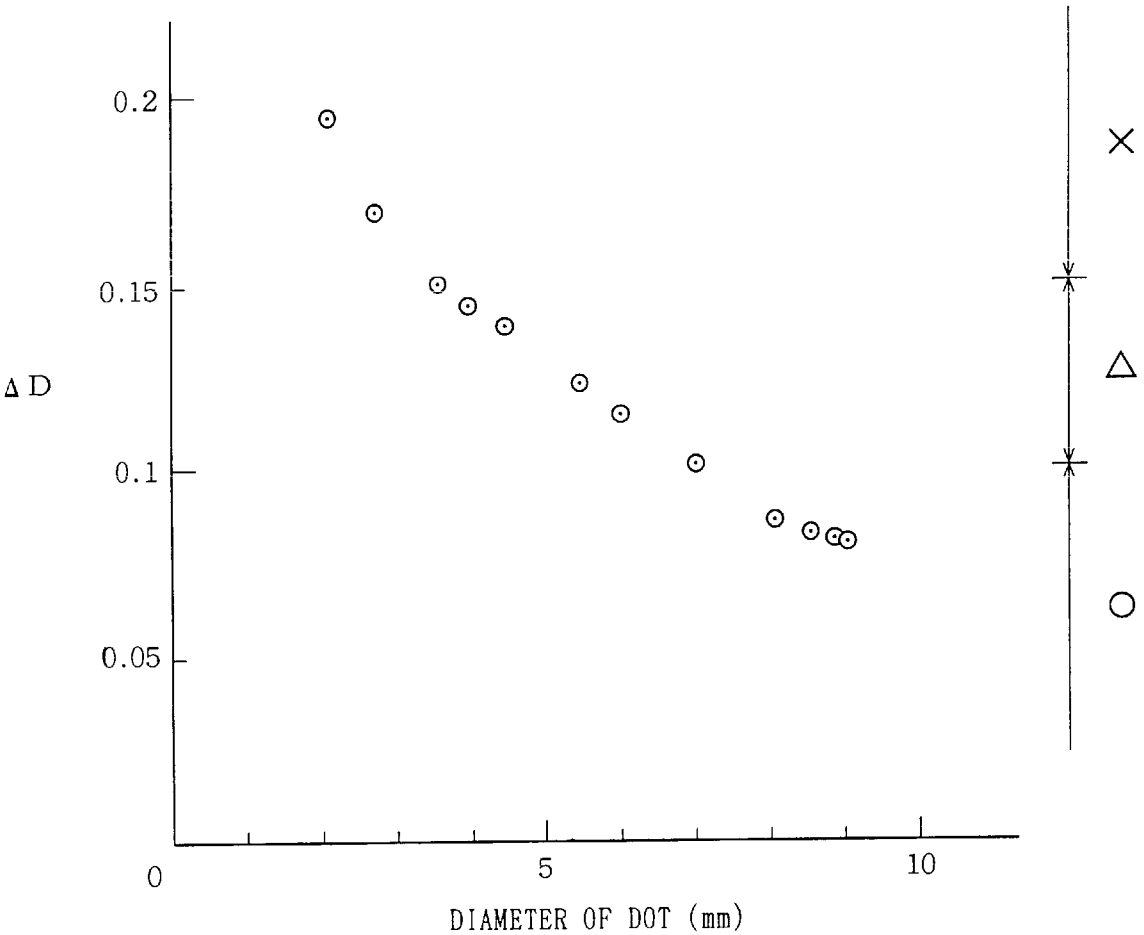
FIG. 161 represents the smoothness of an image with respect to the diameter of a photo ink dot in an embodiment of the present invention.

FIG. 161 shows a measurement result of ΔD with respect to the diameter of a dot in Kp ink when printing is provided in the fifth dot pattern shown in FIG. 143 with K and Kp used as normal color ink and photo ink, respectively. The diameter of the Kp ink dot is changed by changing the value in weight percentage of ethanol or PEG #400, as described above. The printing pattern shown in FIG. 114 is considered as causing the most uneven print density among the five dot patterns exemplified in the present embodiment.

Referring to FIG. 161, the value of ΔD is decreased as the diameter of the Kp ink dot used is increased. In other words, an image is smoother when the percentage of the penetrant is increased in Kp ink as photo ink and the viscosity of the ink is thus reduced. It is thus understood that with Kp ink used as photo ink, the smoothness of an image is affected by changes in the viscosity of the photo ink.

In practically forming images, image quality can be estimated as ○, Δ or X based on the value of ΔD, as described below:

$\Delta D \leqq 0.1$: estimated as ○ (in smooth, good tone)

$0.1 < \Delta D \leqq 0.15$: estimated as Δ (practically tolerable smoothness)

$0.15 < \Delta D$: estimated as X (practically not tolerable, including noise and the like).

Photo ink of other types are also used together with corresponding normal ink to print in the fifth dot pattern to measure ΔD. The photo ink is prepared with three different percentages of a penetrant (ethanol) of 2 wt %, 4 wt % and 7 wt % contained therein, and they are labeled as Embodiments 7-1 to 7-3, respectively. For this range, the viscosity of any ink is decreased as the amount of the penetrant added is increased. In order to clarify the effect of adding the penetrant, normal ink and light color ink corresponding thereto (Mpo ink, Cpo ink, Ypo ink and Kpo ink of the compositions described in FIGS. 150–153, which do not contain a penetrant) are used as Comparative Example 7-1 for printing in the fifth dot pattern to measure ΔD for evaluation according to the ○, Δ, and X described above. The results are shown in FIG. 162.

Referring to FIG. 162, any ink of Mp, Cp and Kp that contains a penetrant is lower in the value of ΔD and smoother in image quality than Comparative Example 7-1 without the penetrant. Generally speaking, any ink of Mp, Cp and Kp with larger weight percentage of the penetrant tends to result in smoother image. Thus, it can be said that for these types of ink, a smoother image is formed as the viscosity of photo ink is lowered. It should be noted that the smoothness of images in Yp is unabled to be measured, since it is basically difficult to measure optical density of Y and Yp.

Modification

The above embodiment can be modified as described below.

(1) A substance which lowers the viscosity of ink other than lower alcohol is used as a penetrant. In other words, the penetrant is not limited to lower alcohol and need only be a substance which lowers the viscosity of ink.

(2) A nozzle for jetting white color ink other than the colors of R, G and B is added to improve color reproduction in the lowest density in highlight and thus increase the brightness of images.

(3) A nozzle for jetting brown color ink other than the colors of R, G and B to improve reproduction of such a color as the skin color of human and better express images.

(4) A nozzle for jetting gray color ink other than the colors of R, G and B is added to improve reproduction of halftone in monochrome.

Embodiment 8-1

Dot matrixes will now be described which form images printed by ink jet printers as Conventional Examples 8-1 to 8-4. These dot matrixes correspond to respective tones of images printed and are each specified by a number, starting from 0. For example, dot matrixes having five tones are specified as tones 0–4, respectively. In FIGS. 163–166 showing dot matrixes of the ink jet printers as Conventional Examples 8-1 to 8-4, tone numbers for specifying respective tones are shown on top of respective dot matrixes. It should be noted that the tone corresponding to an unprinted, white portion of a recording sheet is specified as tone 0.

Figure 163:
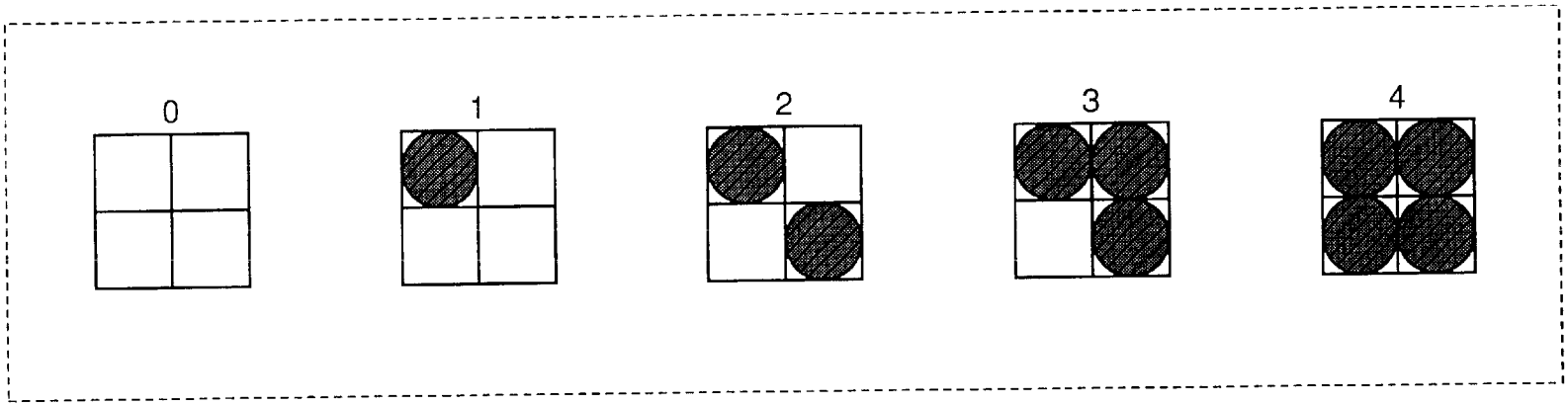
FIG. 163 RELATED ART
FIG. 163 shows dot matrixes of five tones which form images printed by an ink jet printer as Conventional Example 8-1.

FIG. 163 shows dot matrixes having five tones forming images printed by the ink jet printer as Conventional Example 1-1.

With the ink jet printer as Conventional Example 8-1, dot matrixes are formed of dots of only a single type and five tones can be represented with each dot matrix formed of two rows and two columns.

Figure 164:
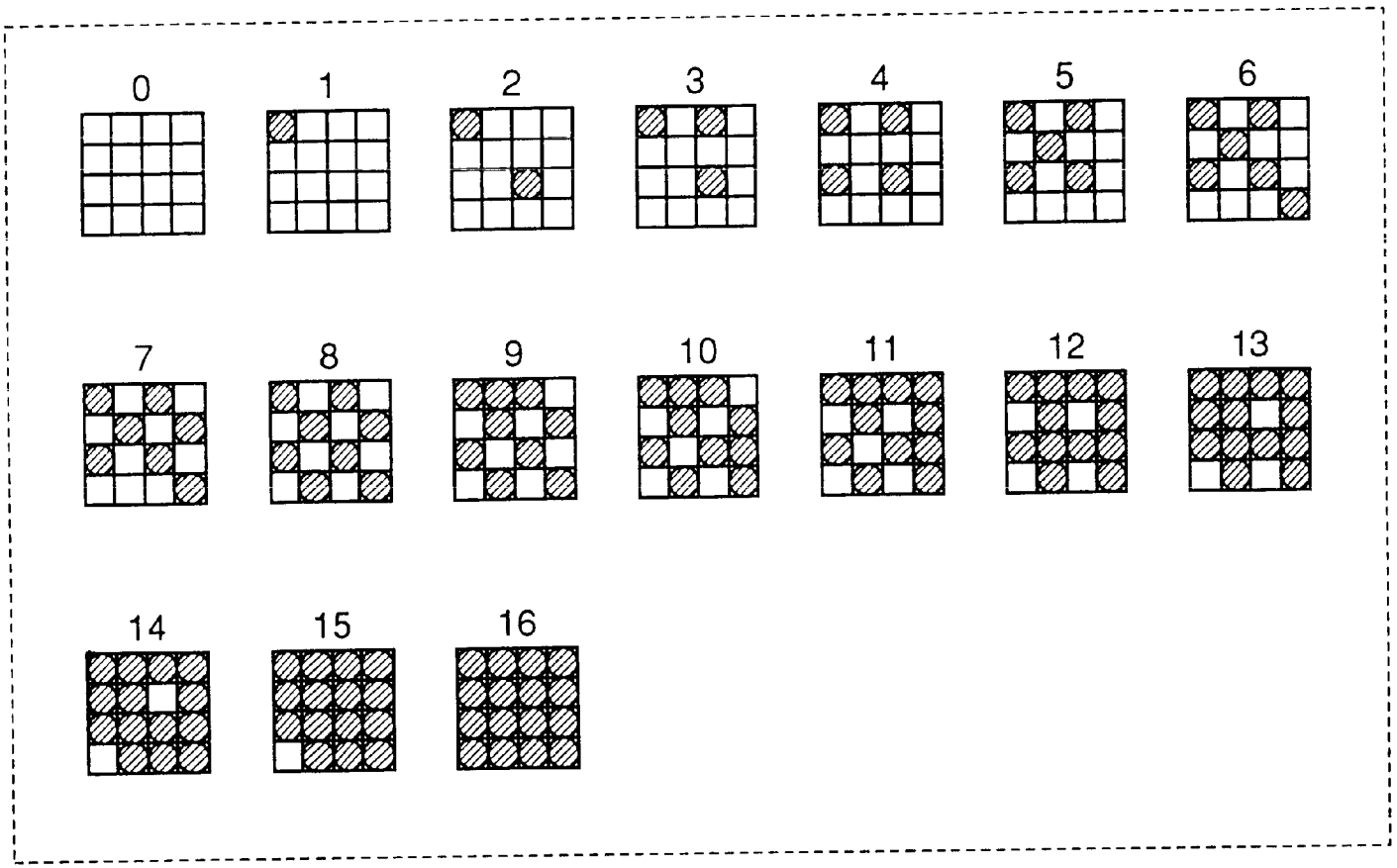
FIG. 164 RELATED ART
FIG. 164 shows dot matrixes having 17 tones forming images printed by an ink jet printer as Conventional Example 8-2.

FIG. 164 shows dot matrixes having 17 tones forming images printed by the ink jet printer as Conventional Example 8-2. The dot matrixes of 17 tones are known as the dot matrixes of Bayer Type and are filled with dispersed dots as tone number increases.

With the ink jet printer as Conventional Example 8-2, dot matrixes are formed of dots of only a single type and 17 tones can be represented with each dot matrix formed of four rows and four columns.

Figure 165:
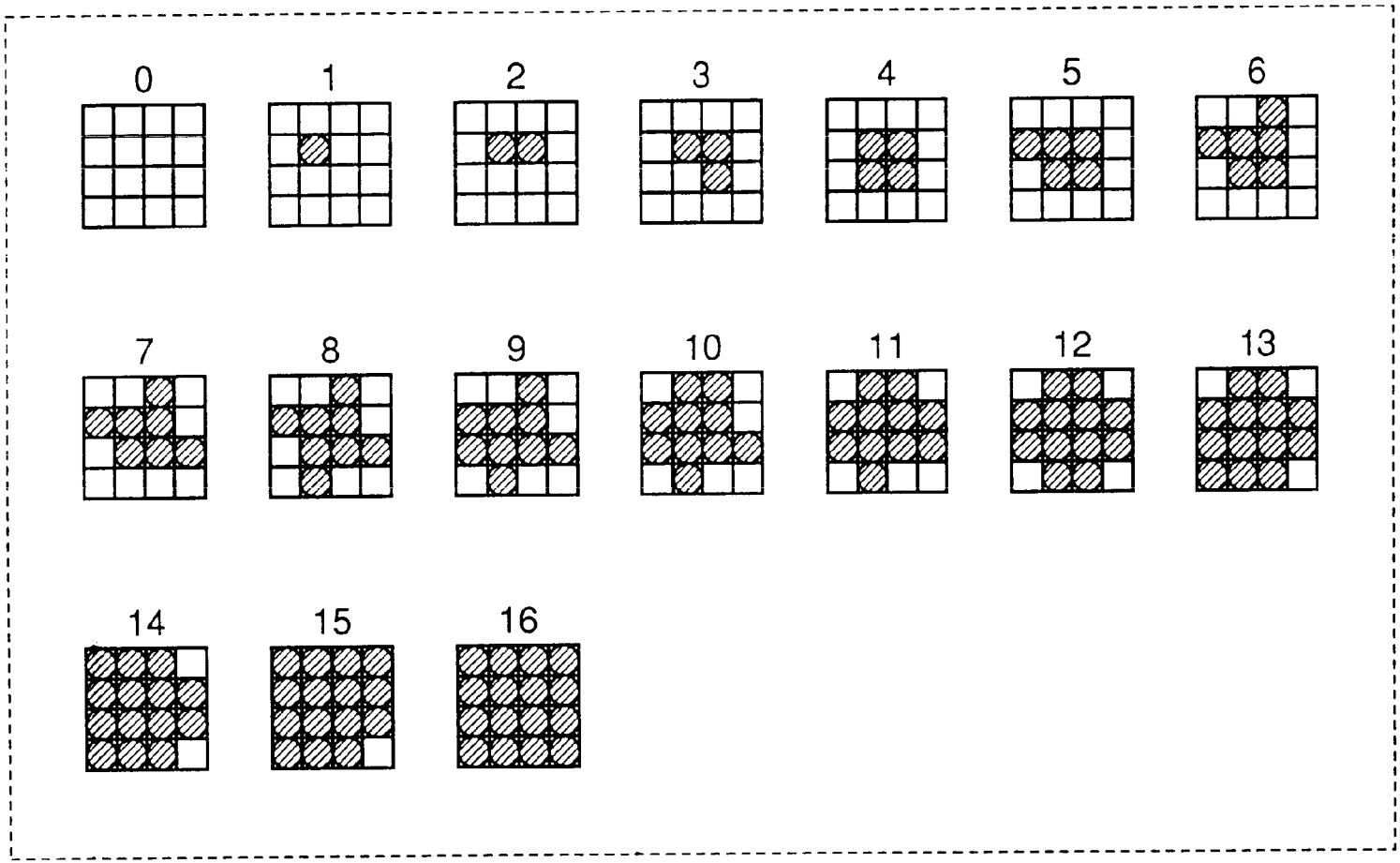
FIG.165 RELATED ART
FIG. 165 shows dot matrixes having 17 tones forming images printed by an ink jet printer as Conventional Example 8-3.

FIG. 165 shows dot matrixes having 17 tones forming images printed by the ink jet printer as Conventional Example 8-3. The dot matrixes of 17 tones are known as the dot matrixes of Fattening Type and are filled with dots with the center as the core as tone level increases.

With the ink jet printer as Conventional Example 8-3, dot matrixes are formed of dots of only a single type and 17 tones can be represented with each matrix formed of four rows and four columns.

Figure 166:
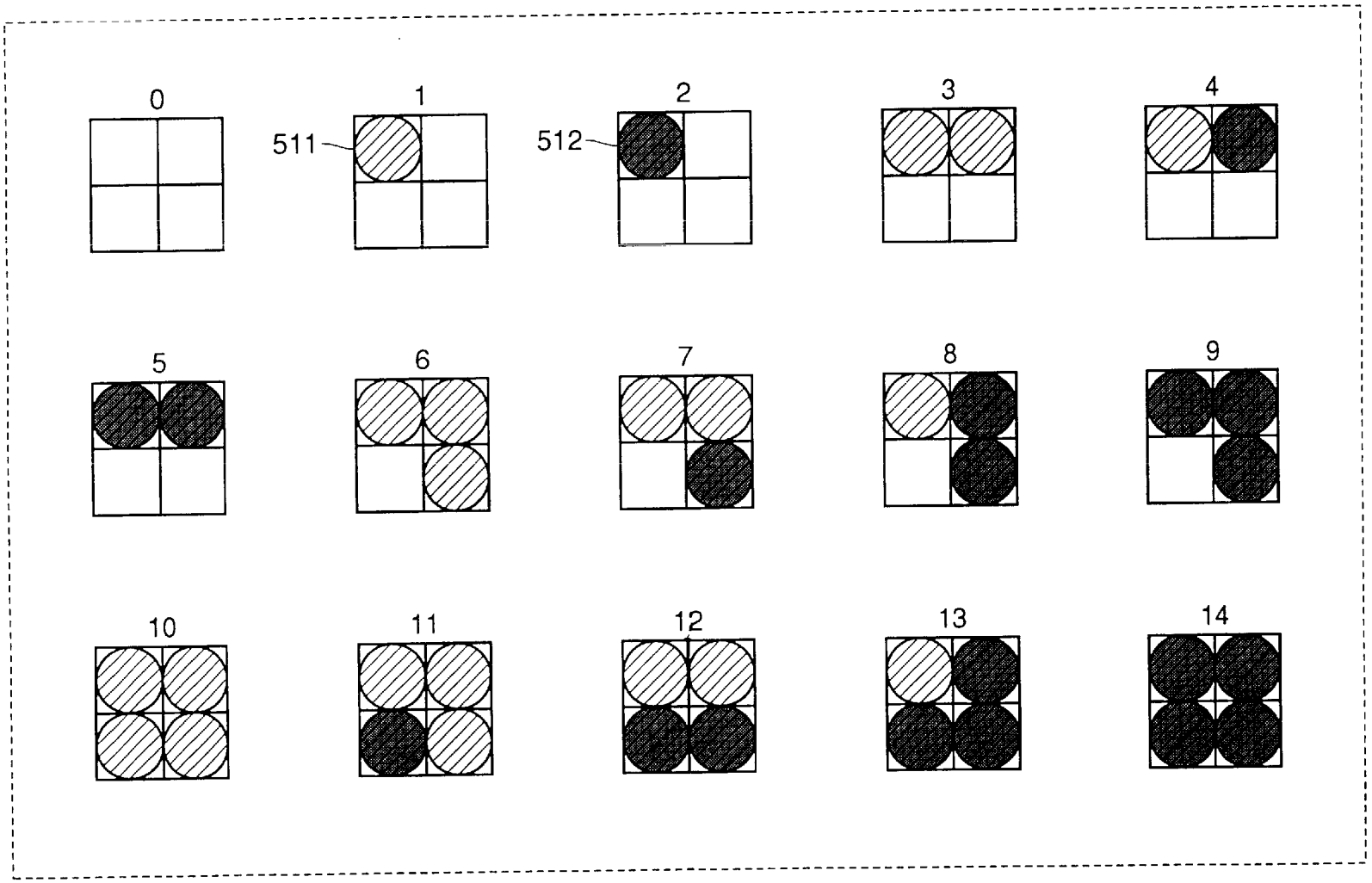
FIG.166 RELATED ART
FIG. 166 shows dot matrixes having 15 tones forming images printed by an ink jet printer as Conventional Example 8-4.

FIG. 166 shows dot matrixes having 15 tones forming images printed by the ink jet printer as Conventional Example 8-4.

With the ink jet printer as Conventional Example 8-4, dot matrixes are formed of dots of two types, i.e., a photo color ink dot 511 and a normal color ink dot 152 of a same diameter, and 15 tones can be represented with each dot matrix formed of two rows and two columns.

Figure 167:
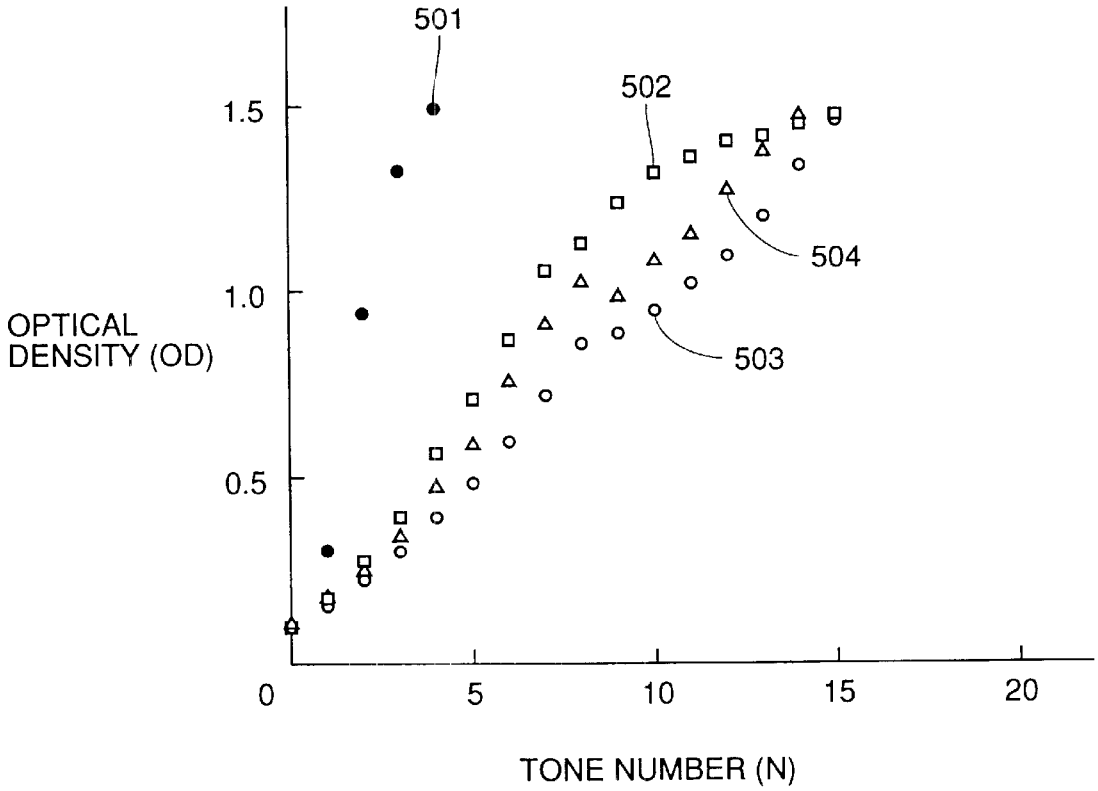
FIG. 167 is a diagram for comparing optical densities provided by dot matrixes printed by the ink jet printers as Conventional Examples 8-1 to 8-4.

FIG. 167 is a diagram for comparing optical densities provided by dot matrixes printed by the ink jet printers as Conventional Examples 8-1 to 8-4 described above. Data 501–504 each show a relation between optical density and tone for dot matrixes provided by each of the ink jet printers as Conventional Examples 8-1 to 8-4. Each relation is obtained by taking measurement similar to that of optical density described later with reference to FIG. 176.

It is understood from FIG. 167 that: the ink jet printer as Conventional Example 8-1 results in a gradient of optical density, which can be referred to as "γ" hereinafter, being steep with respect to tone level and is thus not suitable for representing images in intermediate tone; the ink jet printer as Conventional Example 8-2 provides a steep γ around the intermediate tone and also a saturated tone in the vicinity of higher tone and is thus not suitable for representation in intermediate tone; with each of the ink jet printers as Conventional Examples 8-3 and 8-4, the optical density around the intermediate tone do not smoothly increase while tone level increases (i.e., tone jump or the like is caused); and the like. Thus, it is difficult for the ink jet printers as Conventional Examples 8-1 to 8-4 to reproduce medium tone.

In the field of ink jet printer described above, the technique of changing the amplitude of the pulse voltage applied to a piezoelectric element and thus causing distortion of a different magnitude in the piezoelectric element to adjust the amount of an ink drop to be flied is known other than the technique of representing tones by means of dot matrixes and the technique of printing color images. Such adjustment of the amount of an ink drop allows printing ink dots of different diameters on a recording sheet. Furthermore, a matrix with ink dots of different diameters arranged on a plane can correspond to a single pixel of an image to be printed and the dot pattern in the matrix (i.e., a dot matrix) can be changed in accordance with tones of the image to represent more tones.

However, the quality of images printed by the ink jet printers described above has not reached the standard which satisfies users and higher image quality is sought for.

The present embodiment provides an image forming apparatus capable of forming images of high image quality while reducing the manufacturing cost thereof.

An ink jet printer according to an embodiment of the present invention will now be described with reference to the drawings.

The schematic configuration of an ink jet printer 1 is similar to that shown in FIG. 89.

A configuration of a periphery of carriage 4 and a configuration of head unit 3 will now be described with reference to FIGS. 168 and 91–93. Although head unit 3 includes print heads for seven colors, as will be described later with reference to FIG. 92, FIG. 168 shows a print head for one color that is one of heads 31–37 shown in FIG. 92 and is referred to as head 31.

Figure 168:
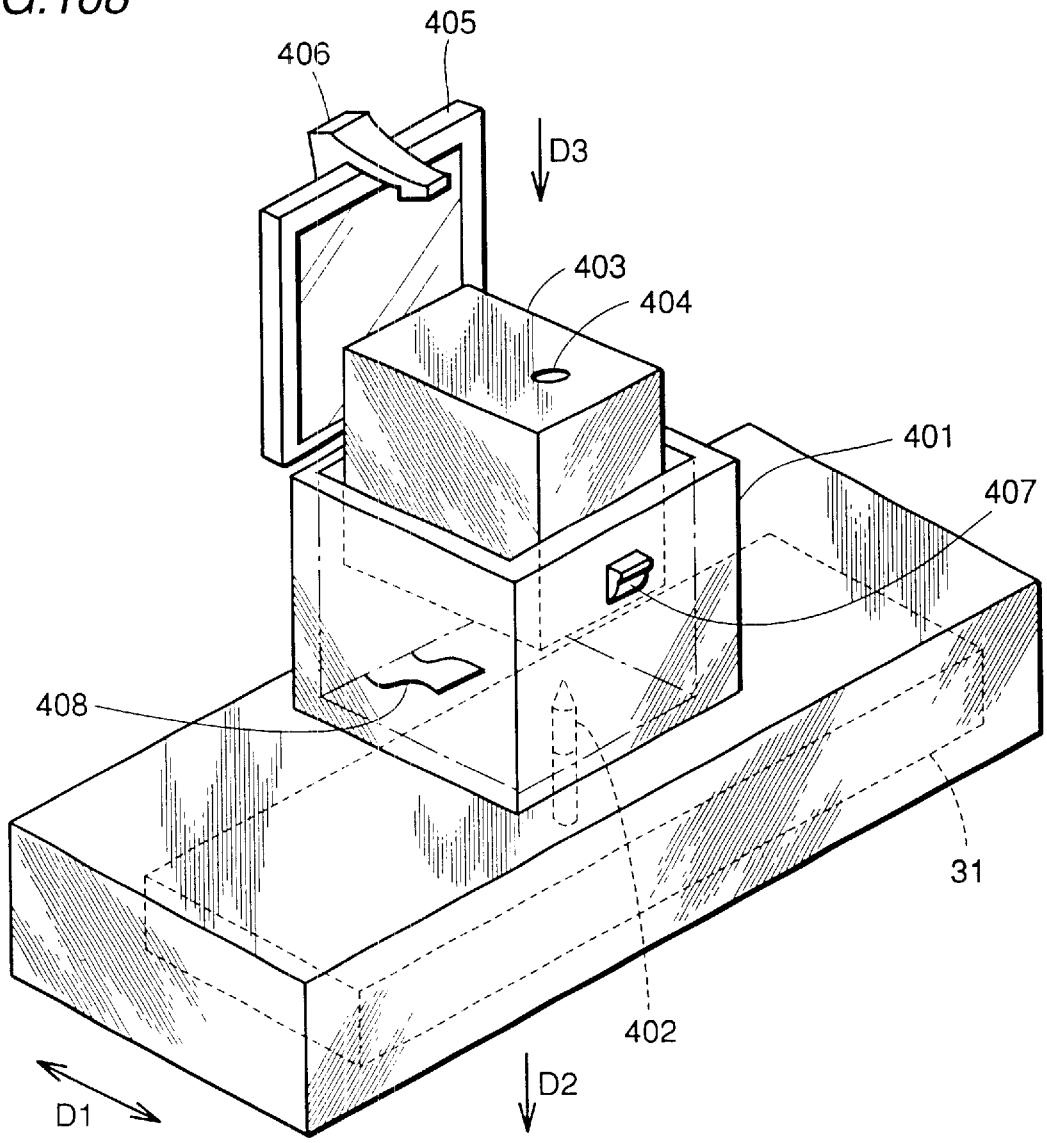
FIG. 168 is a perspective view illustrating a configuration of a periphery of carriage 4 including head 31.

FIG. 168 is a perspective view for illustrating the configuration of the periphery of carriage 4 including head 31.

The periphery of carriage 4 includes an ink cartridge 403 which stores ink and has a ventilation hole 404, a casing 401 for housing ink cartridge 403, a lid 405 of casing 401, an ink receiver and feeder pin 402 which renders ink cartridge 403 removable and also receives and feeds ink to print head 31, a biased clutch 406 for fixing lid 405 to casing 401 when lid 405 is closed, a bias clutch stopper 407, and a plate spring 408 which cooperates with lid 406 to hold ink cartridge 403 while pushing ink cartridge 403 in a direction opposite to a direction in which ink cartridge 403 is housed (i.e., the direction indicated by arrow D3). When carriage 4 moves in the direction indicated by arrow D1 shown in the figure, main scanning is provided on a recording sheet and ink drops are jet in the direction indicated by arrow D2.

The ink in ink cartridge 403 is different for each of heads 31–37 (shown in FIG. 92) and includes seven colors, i.e., normal ink of yellow, magenta, cyan and black and photo ink of magenta, cyan and black. The compositions of these types of ink are the same as those according to Embodiment 1-1.

FIGS. 91–93 are views illustrating a configuration of head unit 3 (shown in FIG. 168), which is similar to that described previously.

The control portion of ink jet printer 1 is the same in configuration as shown in FIG. 7.

Figure 169:
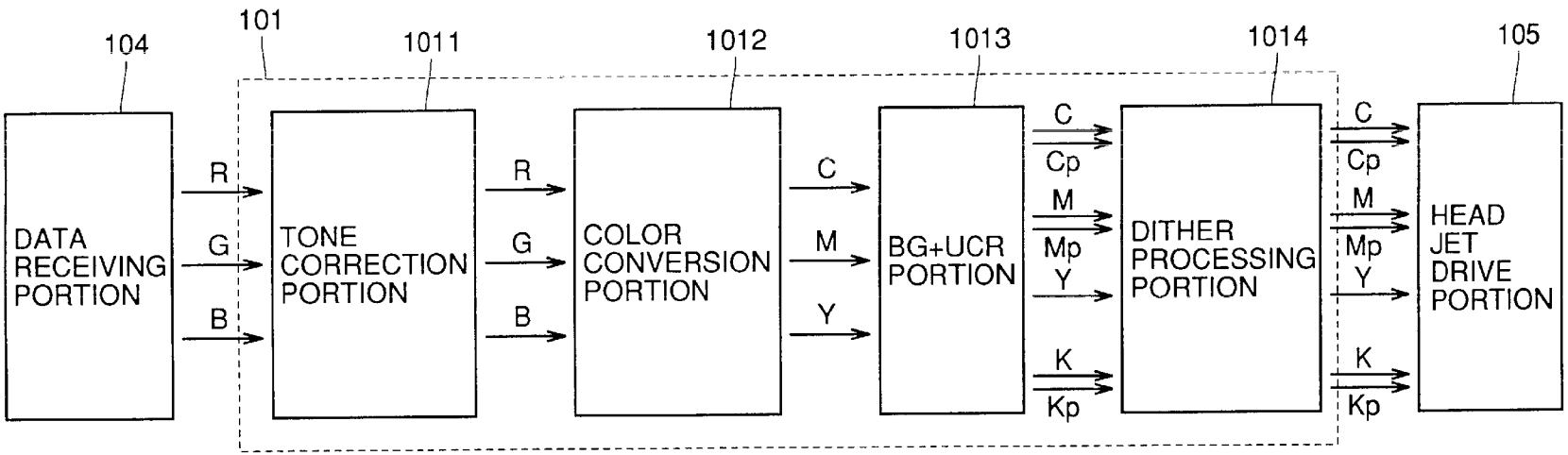
FIG. 169 is a block diagram illustrating a procedure of an image data processing provided by CPU 101.

A procedure of a processing provided to such image data as described above will now be described. FIG. 169 is a block diagram for illustrating a procedure of an image data processing provided by CPU 101.

Image data of 256 tones for each color of red, green and blue, which will respectively be referred to as R, G and B, from data receiving portion 104 (shown in FIG. 7) is initially corrected in tone at tone correction portion 1101. The R, G and B image data corrected in tone are converted into image data corresponding to C, M and Y at color conversion portion 1012. Then, BG+UCR portion 1013 separates gray component from the converted C, M and Y image data, produces K image data, and also produces image data corresponding to Cp, Mp and Kp.

The image data are subjected to dither processing at dither processing portion 1014. Image data of 256 tones for each color is converted into data corresponding to the pulse voltage applied from head jet drive portion 105 to piezoelectric element 306.

A dot matrix printed as a single pixel corresponding to one image data described above that is printed by ink jet printer 1 will now be described with reference to FIGS. 170 and 171.

Figure 170:
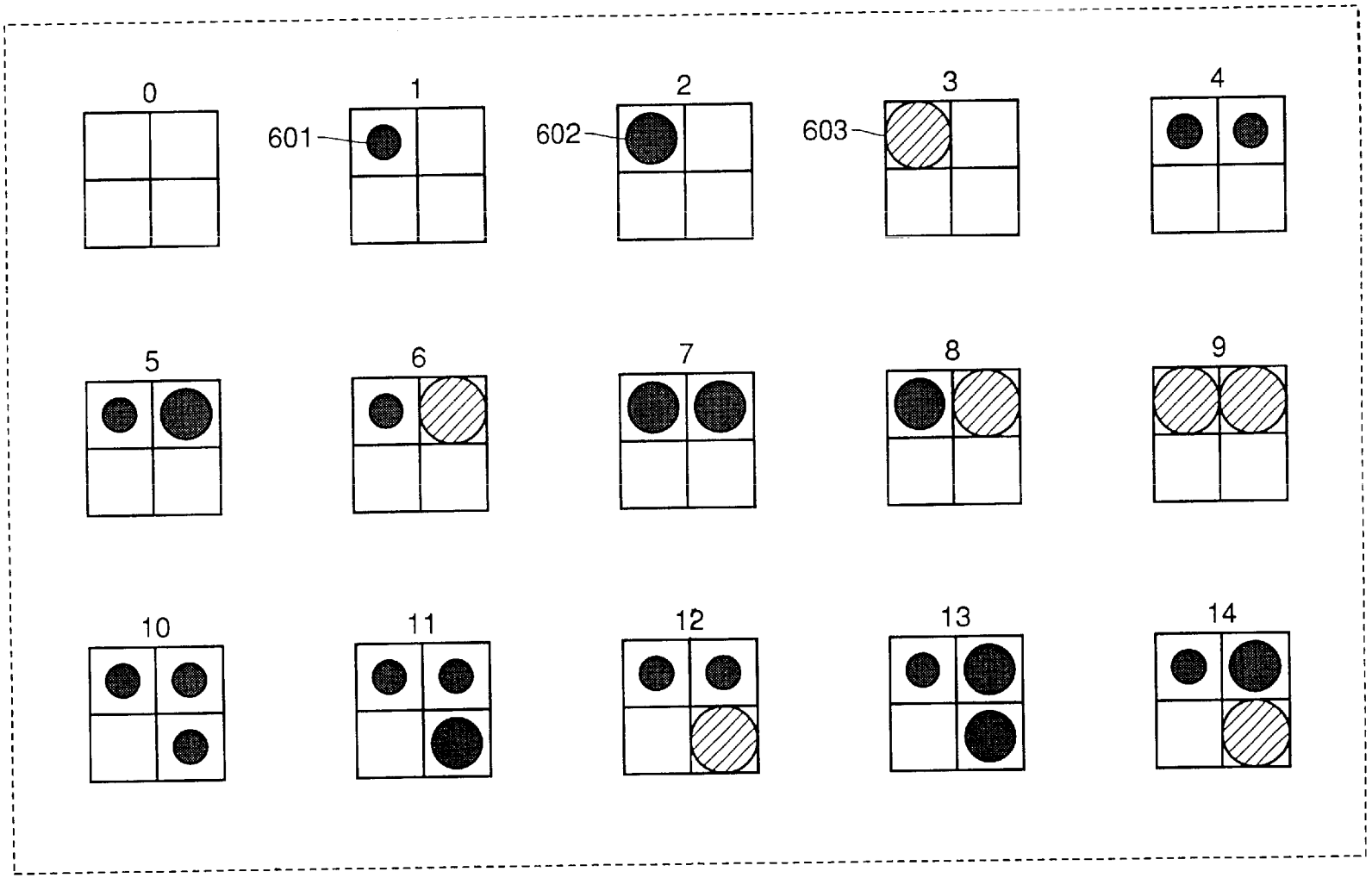
FIG. 170 is a first diagram showing dot matrixes printed by an ink jet printer as Embodiment 8-1.
Figure 171:
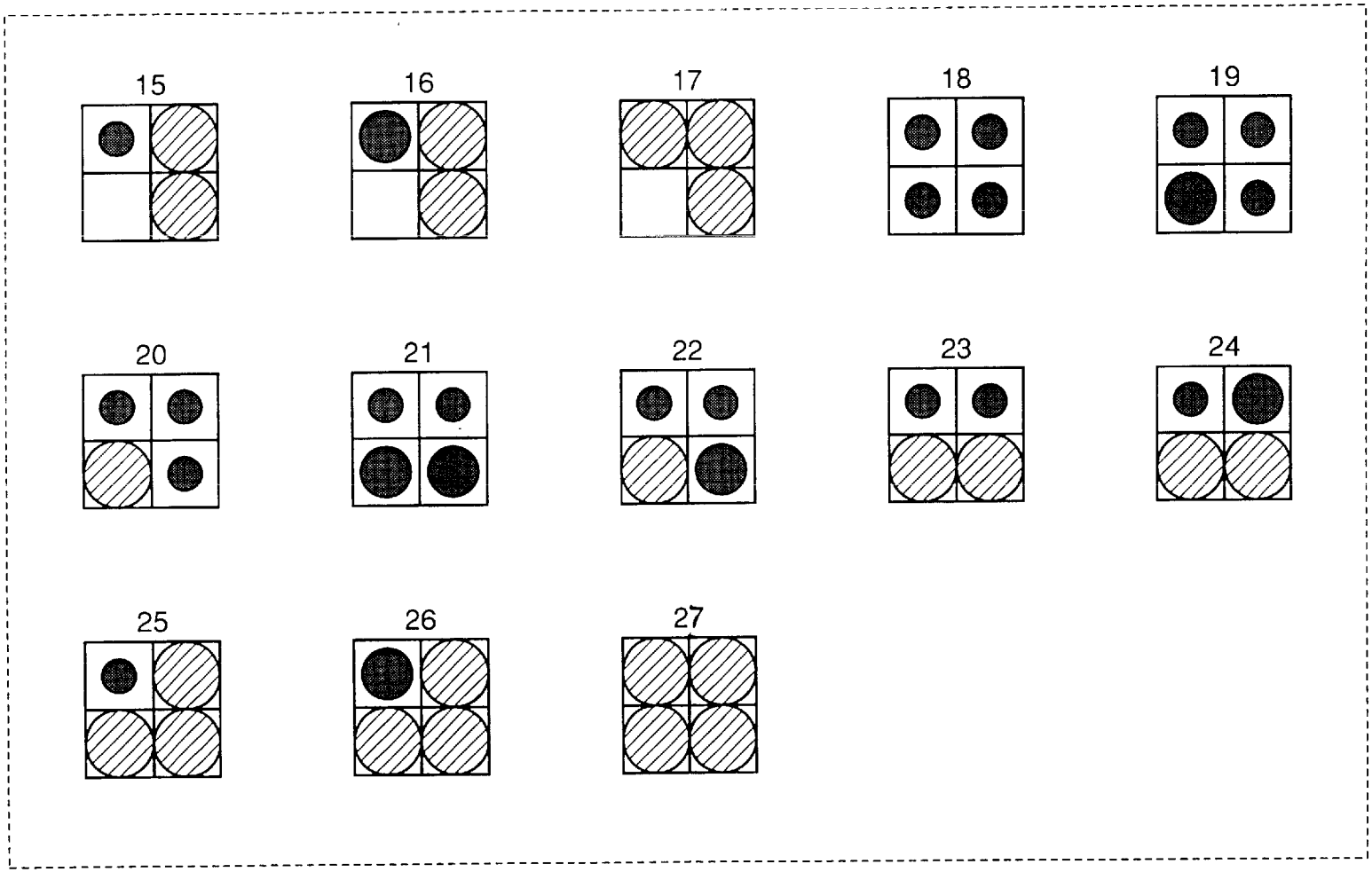
FIG. 171 is a second diagram showing dot matrixes printed by ink jet printer 1.
Figure 172:
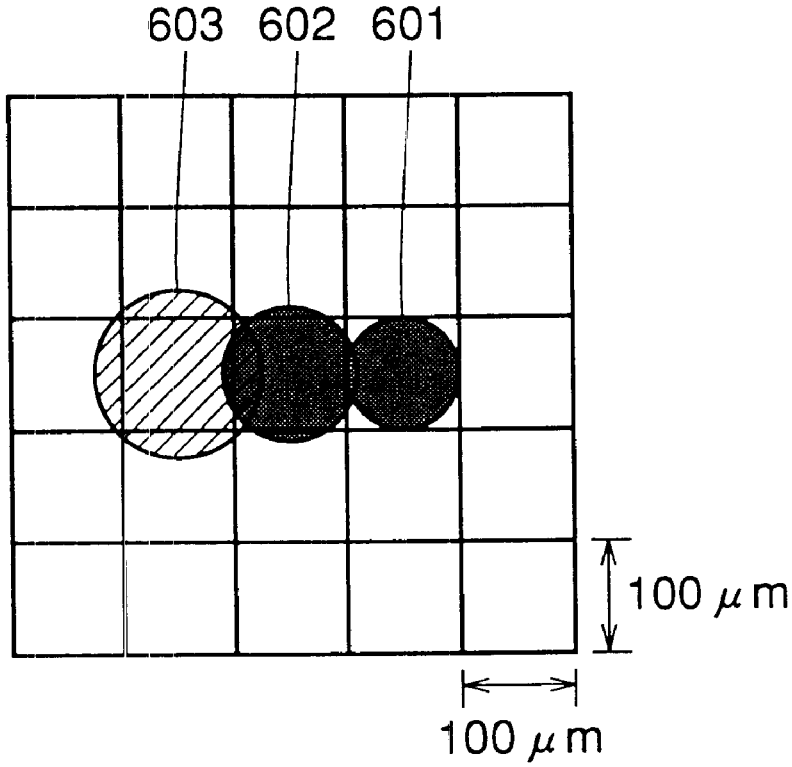
FIG. 172 shows sizes of dots 601–603.

FIGS. 170 and 171 show dot matrixes printed by ink jet printer 1, and FIG. 172 shows the sizes of dots 601–603 which form these dot matrixes.

A dot matrix corresponding to a single pixel that forms an image printed by ink printer 1 is formed of two rows and two columns. Dot 601 in the matrix representing tone 1 is a dot of a small diameter (approximately 100 $\mu$m) in normal color ink. Dot 602 in the matrix representing tone 2 is a dot of an intermediate diameter (approximately 120 $\mu$m) in normal color ink. Dot 603 in the matrix representing tone 3 is a dot of a large diameter (approximately 150 $\mu$m) in photo color ink. In practice, dots 601 and 602 are provided in any ink of C, M, Y and K, and dot 603 is provided in any ink of Cp, Mp and Kp.

When image data corresponding to a single pixel has tone 14 shown in FIG. 170, for example, tone 14 is represented by printing dot 601 of the small diameter in normal color ink in a matrix segmented like a grid of two rows and two columns for the pixel at the segment in the first row and the first column, dot 602 of the intermediate diameter in normal color ink at the segment in the first row and the second column and dot 603 of the large diameter in photo color ink at the segment in the second row and the second column such that the center of each dot is aligned with the center of the respective segment. The effect of using such dot matrixes will be described later with reference to FIGS. 178–181.

Embodiment 8-2

Figure 173:
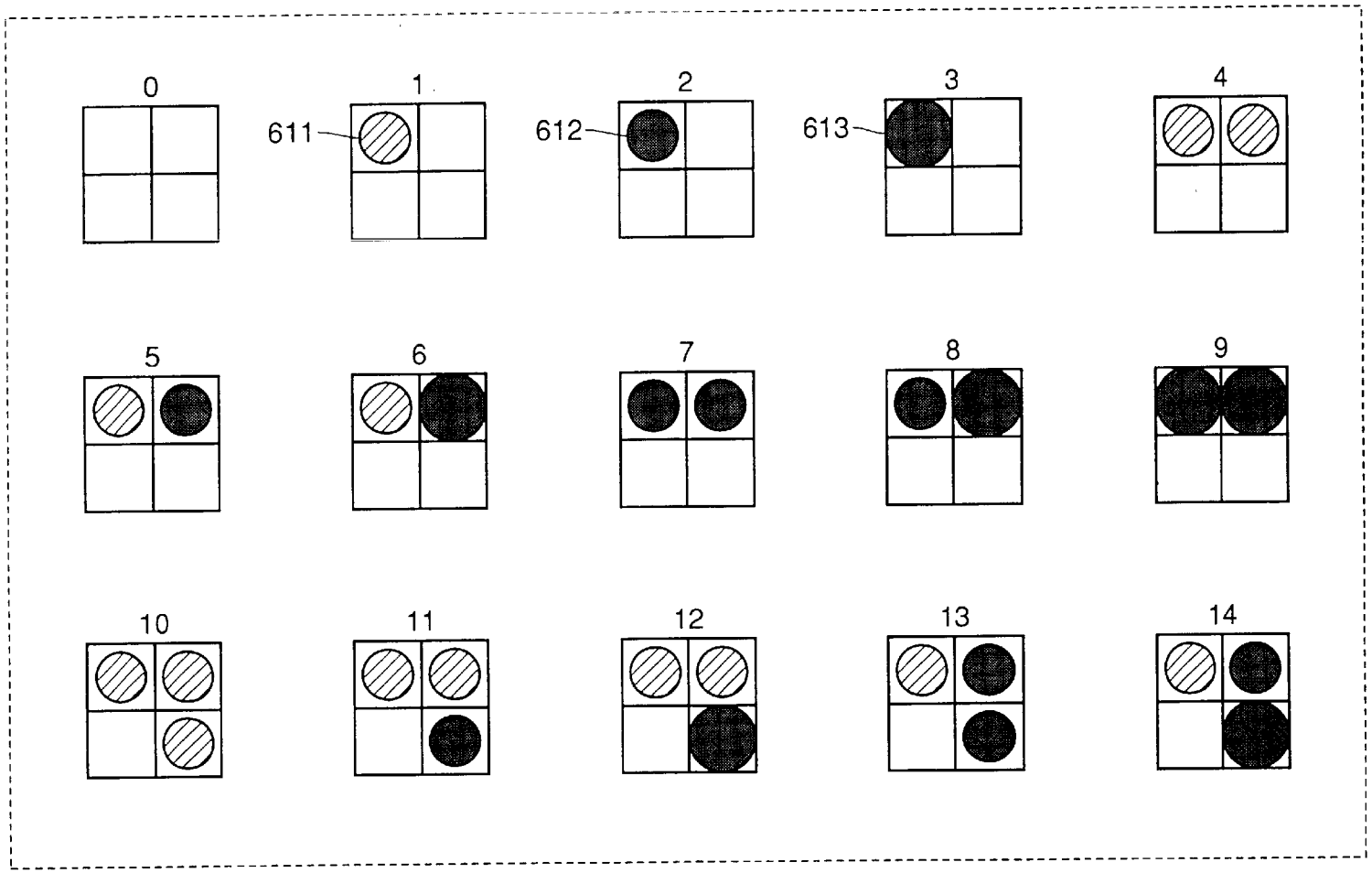
FIG. 173 is a first diagram showing dot matrixes printed by an ink jet printer as Embodiment 8-2.
Figure 174:
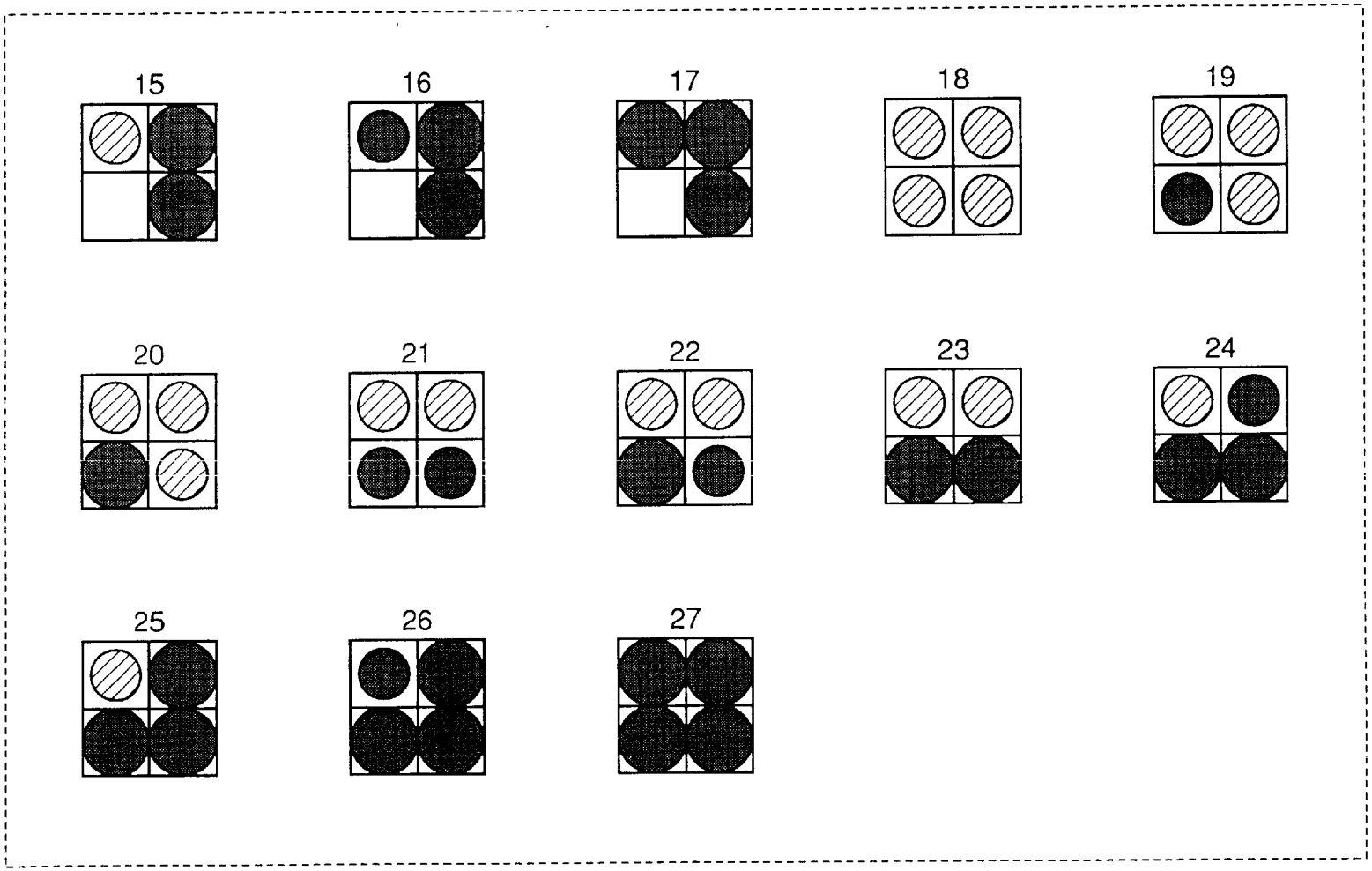
FIG. 174 is a second diagram showing dot matrixes printed by the ink jet printer as Embodiment 8-2.

It is also possible to use the dot matrix as described below. FIGS. 173 and 174 show dot matrixes printed by the ink jet printer as Embodiment 8-2. The entire configuration of the ink jet printer as Embodiment 8-2, the configuration of the print head, the configuration of the control portion and the like are similar to those of the ink jet printer as Embodiment 8-1.

A dot matrix corresponding to a single pixel that forms images printed by the ink jet printer as Embodiment 8-2, is formed of two rows and two columns. A dot 611 in the matrix representing tone 1 is a dot of intermediate diameter in photo color ink. A dot 612 in the matrix representing tone 2 is a dot of intermediate diameter in normal color ink. A dot 613 in the matrix representing tone 3 is a dot of large diameter in photo color ink. In practice, dot 611 is provided in any ink of Cp, Mp and Kp, and dots 162 and 163 are provided in any ink of C, M, Y and K.

When image data corresponding to a single pixel corresponds to tone 14 shown in FIG. 173, for example, tone 14 is represented by printing dot 611 of intermediate diameter in photo color ink in a matrix segmented like a grid of two rows and two columns for the pixel at the segment in the first row and the first column, dot 612 of intermediate diameter in normal color ink at the segment in the first row and the second column and dot 613 of large diameter in normal color ink at the segment in the second row and the second column such that the center of each dot is aligned with the center of the respective segment. The effect of using such dot matrixes will be described later together with the ink jet printer as Embodiment 8-1 with reference to FIG. 178.

Figure 175:
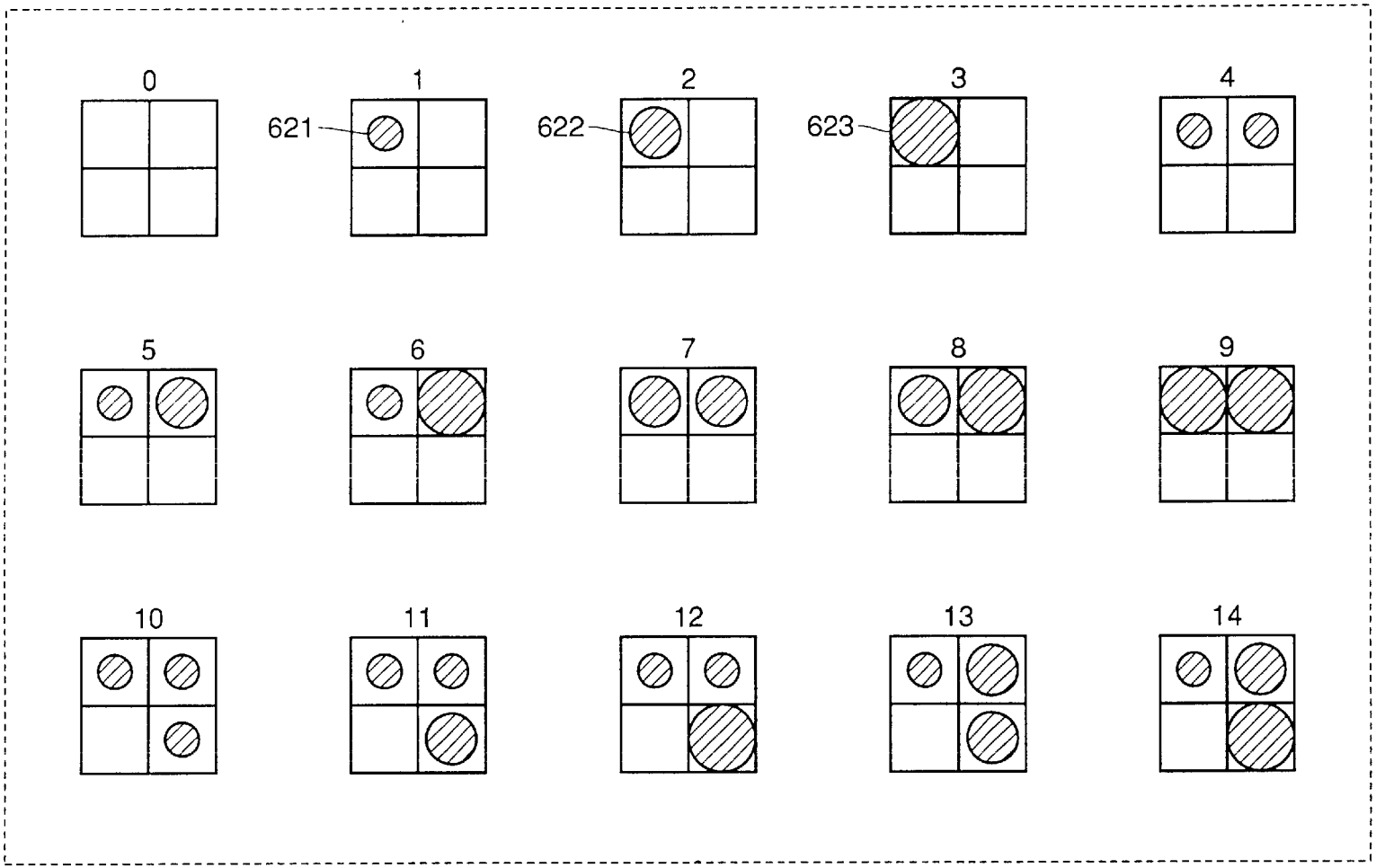
FIG. 175 is a first diagram showing dot matrixes printed by an ink jet printer as a comparative example.
Figure 176:
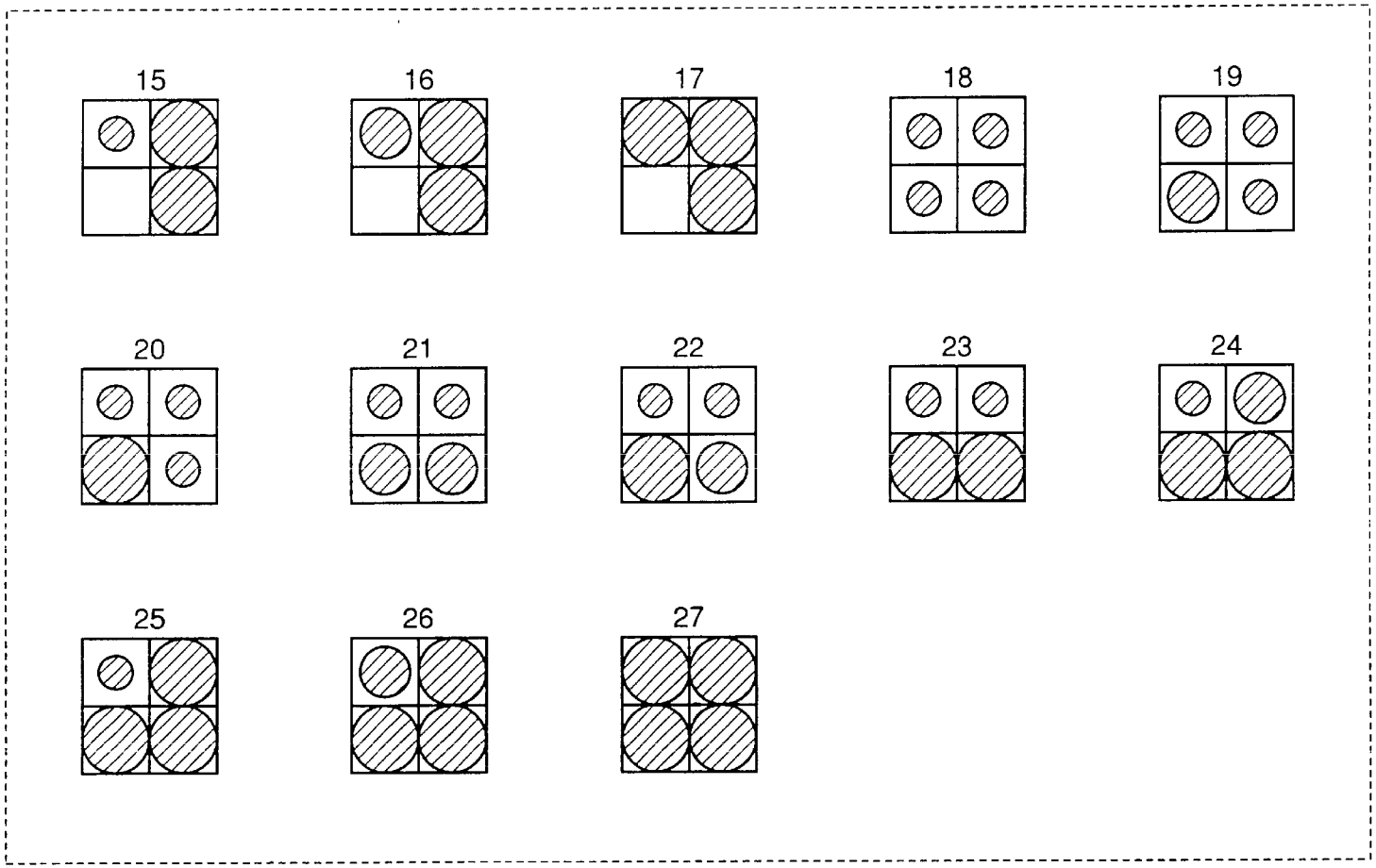
FIG. 176 is a second diagram showing dot matrixes printed by an ink jet printer as a comparative example.
Figure 177:
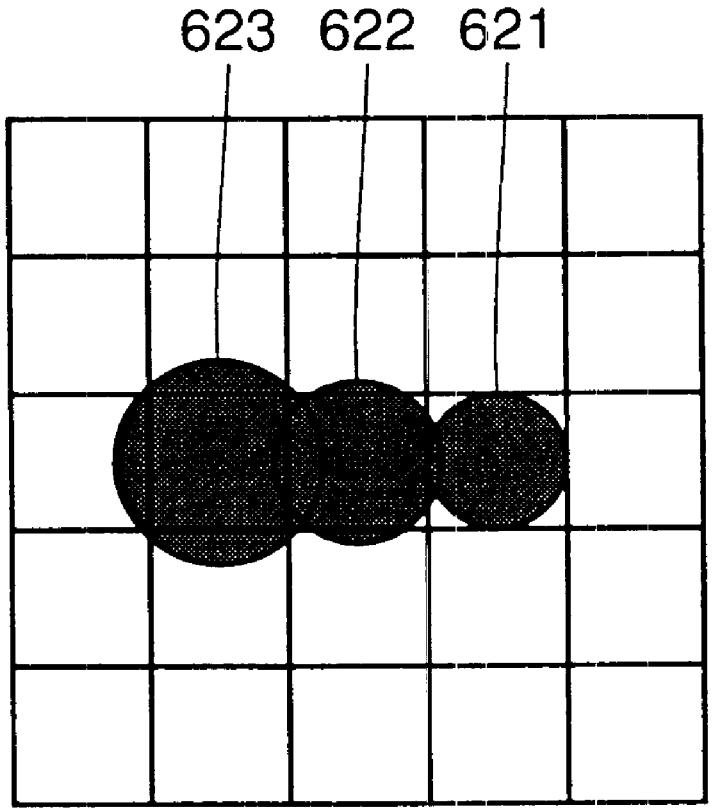
FIG. 177 shows sizes of dots 621–623.
Figure 178:
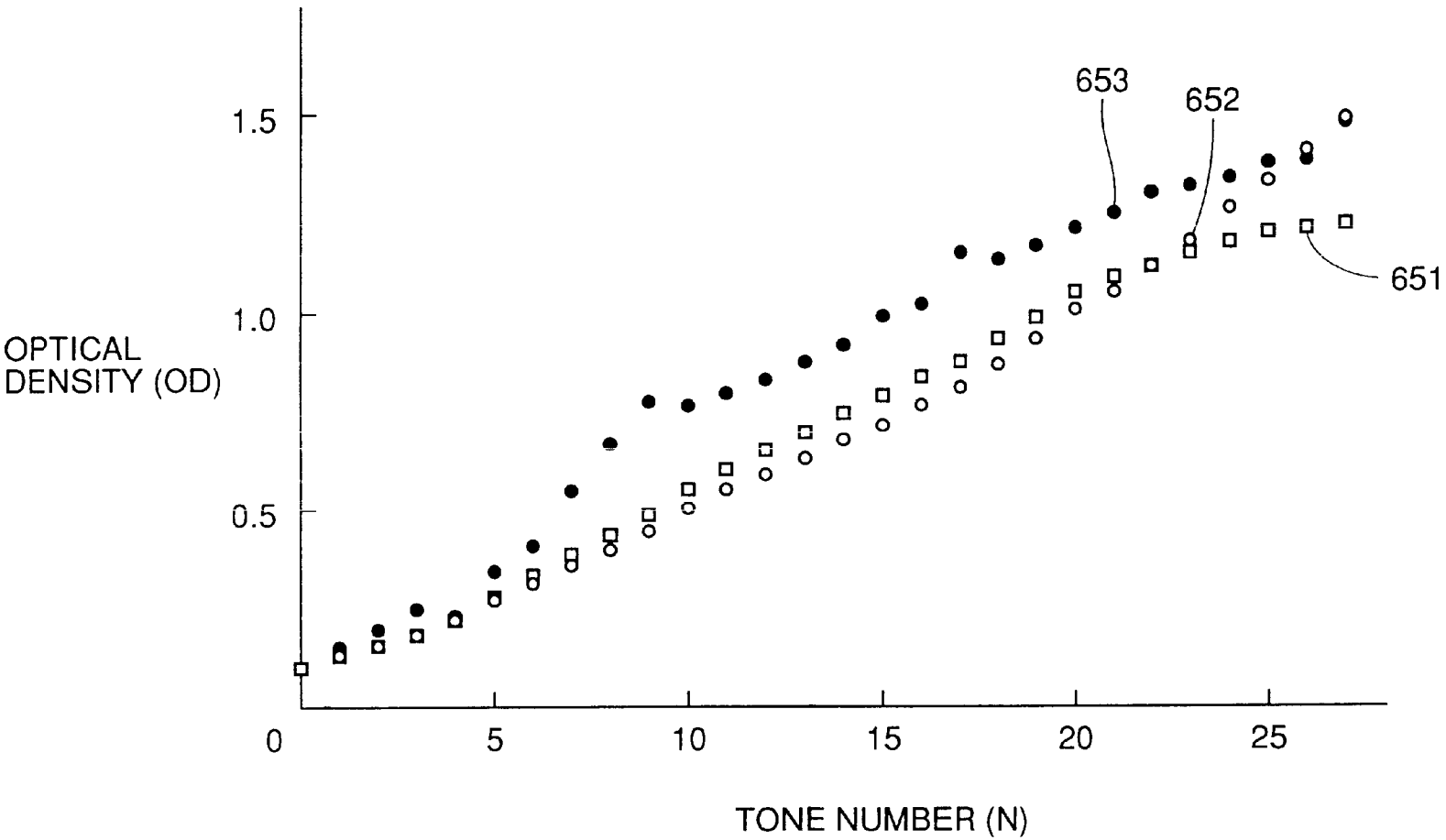
FIG. 178 is a diagram for comparing optical densities provided by dot matrixes printed by the ink jet printers as Embodiment 8-1 and 8-2 with that provided by a dot matrix printed by an ink jet printer as a comparative example.

FIGS. 175–177 show dot matrixes printed by an ink jet printer as a Comparative Example for comparison with the ink jet printers as Embodiments 8-1 and 8-2, and FIG. 178 is a diagram for comparing the dot matrixes provided by the ink jet printers as Embodiments 8-1 and 8-2 with the dot matrixes provided by the ink jet printer as the Comparative Example.

FIGS. 175 and 176 show dot matrixes printed by the ink jet printer as the Comparative Example, and FIG. 177 shows the sizes of dots 621–623 which form the dot matrixes.

A dot matrix corresponding to a single pixel that forms images printed by the ink jet printer as the Comparative Example, is formed of two rows and two columns. Dot 621 in the matrix representing tone 1 is a dot of a small diameter (approximately 100 $\mu$m). Dot 622 in the matrix representing tone 2 is a dot of intermediate diameter (approximately 120 $\mu$m). Dot 623 in the matrix representing tone 3 is a dot of large diameter (approximately 150 $\mu$m). Dots 621–623 are provided in normal color ink. In practice, dots 621–623 are each provided in any ink of C, M, Y and K.

When image data corresponding to a single pixel corresponds to tone 14 shown in FIG. 175, for example, the tone 14 is represented by printing dot 621 of the small diameter in normal color ink in a matrix segmented like a grid of two rows and two columns for the pixel at the segment in the first row and the first column, dot 622 of intermediate diameter in normal color ink at the segment in the first row and the second column and dot 623 of the large diameter in normal color ink at the segment in the second row and the second column such that the center of each dot is aligned with the center of the respective segment.

FIG. 178 is a diagram for comparing optical densities provided by dot matrixes printed by the ink jet printers as Embodiments 8-1 and 8-2 with those provided by dot matrixes printed by the ink jet printer as the Comparative Example.

FIG. 178 is a graph with the horizontal axis representing tones of such dot matrixes as shown in FIGS. 170 and 171, 173 and 174, and 175 and 176, and the vertical axis representing optical densities corresponding the tones. Data 651 represents a relation between tone and optical density for the dot matrixes of the ink jet printer as Embodiment 8-1. Data 652 represents a relation between tone and optical density for the dot matrixes of the ink jet printer as Embodiment 8-2. Data 653 represents a relation between tone and optical density for the dot matrixes of the ink jet printer as the Comparative Example.

The graph shown in FIG. 178 is obtained by measuring the optical density of an image printed for each one tone. The recording sheet used is a sheet for IJ printers and word processors, High Grade Color KJHA 4100. The ink used is that with the composition shown together with FIG. 2. The optical density measuring device used is Sakura Densitometer (PDA 65) manufactured by Sakura (KONIKA CORP. incumbent).

The aforementioned types of ink are used to print the FIGS. 170 and 171 dot matrixes printed by the ink jet printer as Embodiment 8-1, the FIGS. 173 and 174 dot matrixes printed by the ink jet printer as Embodiment 8-2 and the FIGS. 166 and 167 dot matrixes printed by the ink jet printer as the Comparative Example that have the tones corresponding to the horizontal axis of the graph on a recording sheet over a region of at least 3 mm×3 mm and the aforementioned measuring device measures optical density from the dot matrixes five times so that the measurements obtained are averaged to obtain a final measurement.

Any ink jet printer provides an optical density of approximately 0.1 for the recording sheet itself corresponding to tone 0. The ink jet printer as Embodiment 8-1 provides an optical density of approximately 1.2 for a solid recording sheet corresponding to tone 27. The ink jet printer as Embodiment 8-2 and the ink jet printer as the Comparative Example provide an optical density of approximately 1.5 for a solid recording sheet corresponding to tone 27.

It can be seen from FIG. 178 that the ink jet printers as Embodiments 8-1 and 8-2 each have a gentle gradient $\gamma$ and a good linearity, and particularly a better tone reproduction at the highlight portion (i.e., the lower tone region) than the ink jet printer as the Comparative Example. By contrast, the ink jet printer as the Comparative Example causes tone jumps at tones 9 and 17 and can be said to provide poor tone reproduction.

In order to describe an effect of the present invention, a print pattern is actually printed on a recording sheet to measure an optical density continuously varying in the images.

Figure 179:
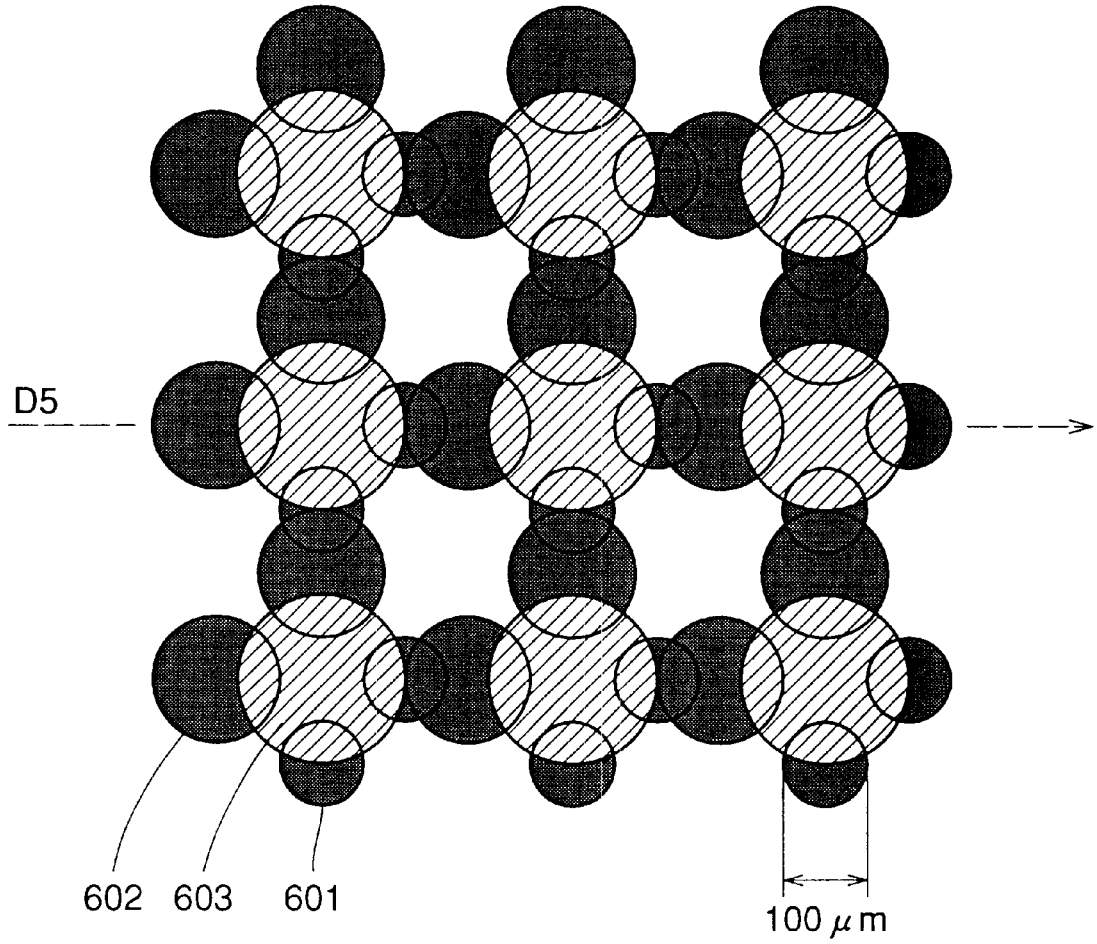
FIG. 179 shows an exemplary image printed by the ink jet printer as Embodiment 8-1.
Figure 180:
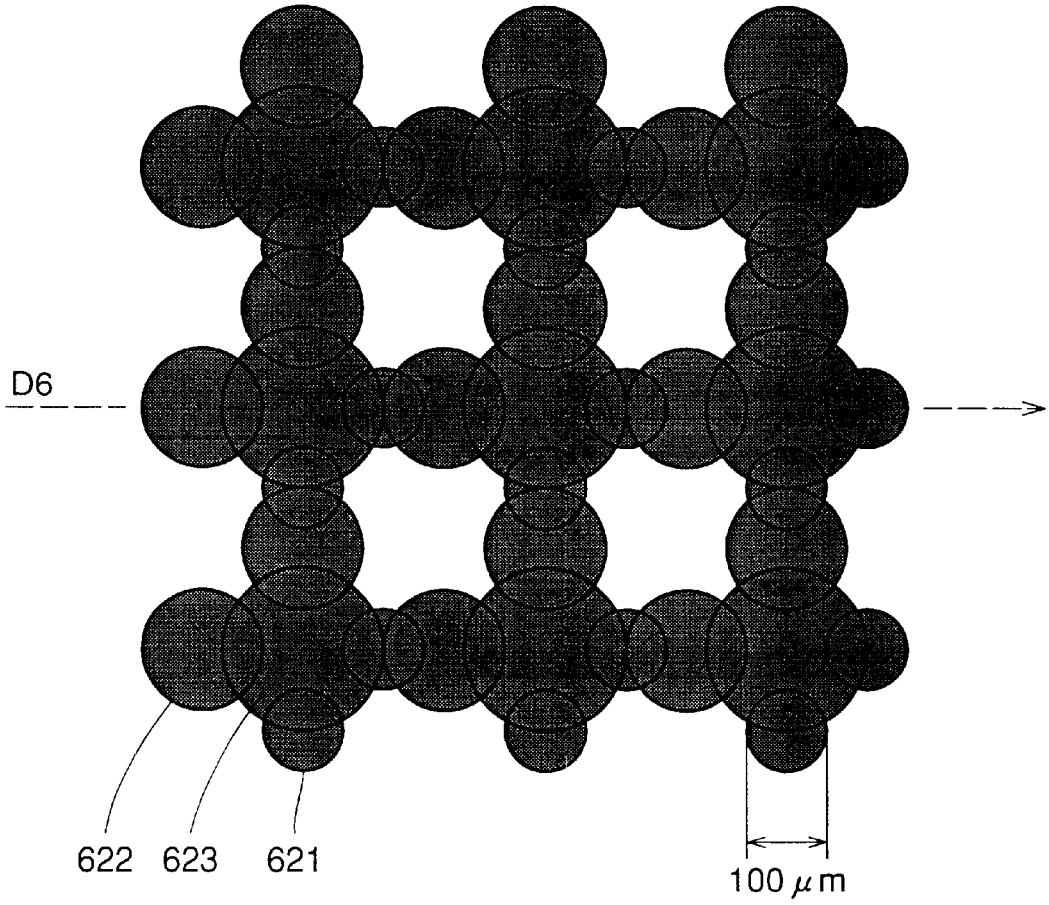
FIG. 180 shows an exemplary image printed by an ink jet printer as a comparative example.
Figure 181:
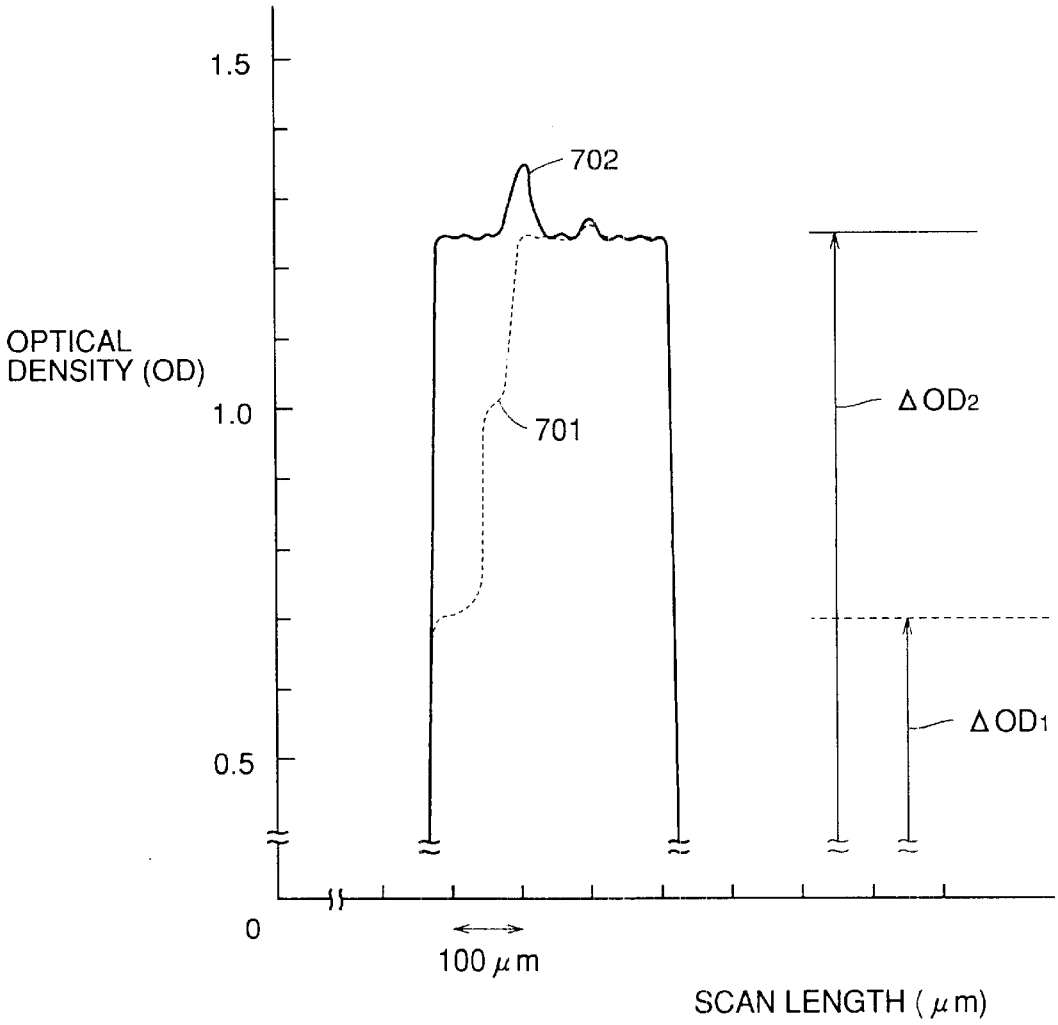
FIG. 181 is a graph obtained by measuring optical densities of the images shown in FIGS. 179 and 180.

FIG. 179 shows an exemplary image printed by the ink jet printer as Embodiment 8-1, and FIG. 180 shows an exemplary image printed by the ink jet printer as the Comparative Example. FIG. 181 is a graph obtained by measuring optical density while scanning the images shown in FIGS. 179 and 180 in the directions indicated by arrows D5 and D6, respectively. The recording sheet, ink and measuring device used in measurement of optical density are similar to those described previously.

In taking the measurements, a detect head of PDA 65 provides scanning on a recording sheet on which the FIGS. 179 and 180 images are printed with the aforementioned types of ink while the detect head is moved at a speed of 0.1 mm/sec. The detect head has a light source for illuminating the recording sheet, a slit for dividing the reflected light from the recording sheet, and a phototube for measuring the optical density according to the light passing through the slit. The width of the slit is set at 40 $\mu$m, which provides approximately the same resolution that human eye has.

FIG. 181 shows measurement results with the vertical axis representing the scanned length on the FIGS. 179 and 180 images from the left to right and the vertical axis representing the optical densities of the images with respect to the scanned length. A curve 701 corresponds to the FIG. 179 image printed by the ink jet printer as Embodiment 8-1 and a curve 702 corresponds to the FIG. 180 image printed by the ink jet printer as the Comparative Example. Although the optical densities practically measured include high frequency component, curves 701 and 702 have their high frequency components cut and are thus represented schematically.

From these measurement results together with the fact that the aforementioned measurements provide an optical density of approximately 0.1 at an unprinted, white portion of a recording sheet, it is understood that while the ink jet printer as the Comparative Example provides a difference in optical density $\Delta$OD2 of approximately 1.1 between an unprinted, white portion and a toned portion, the ink jet printer as Embodiment 8-1 provides a smaller difference in optical density $\Delta$OD1 of approximately 0.6 between an unprinted, white portion and a toned portion. This fact shows that the ink jet printer as the Comparative Example provides a more remarkable granularity of dots and the images provided thereby appear rough, whereas the ink jet printer as Embodiment 8-1 provides a less remarkable granularity of dots and the images provided thereby appear less rough.

As described above, when a normal color ink dot is provided in multi-valued printing (i.e., any of dots having a plurality of diameters is or is not printed) and a photo color ink dot is provided in binary printing (i.e., a dot is or is not printed), the dots are printed such that the less dense, photo color ink mixes with the denser, normal color ink and thus they bleed appropriately on a recording sheet. Accordingly, the granularity of the normal color ink dot is advantageously degraded to provide a less rough image. The dots thus printed also allows a gentle gradient and hence a good linearity of optical density curve, and hence a superior tone reproduction from lightly toned portion to heavily toned portion.

The ink jet printers of the present embodiment as described above can reduce their manufacturing costs without employing a drive circuit for providing complicated processings, and is capable of forming images of higher image quality.

Furthermore, since photo color ink dots can be displaced in position and printed in an overlapping manner, the overlapping portions can enhance tone and thus increase the levels of tones.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a first print head using a first chromatic toning material to form a first image on a recording medium;

a second print head using a second chromatic toning material to form a second image on said recording medium, said second chromatic toning material being different in tone from said first chromatic toning material; and a controller for controlling said first and second print heads to form said first and second images on said recording medium, said controller being adapted to control said first print head to print at a plurality of tone levels and being adapted to control said second print head to print at only a single tone level.

2. The image forming apparatus according to claim 1, wherein said first chromatic toning material is lower in tone than said second chromatic toning material.

3. The image forming apparatus according to claim 1, wherein each of said first and second chromatic toning materials is ink.

4. The image forming apparatus according to claim 3, wherein each of said first and second print heads is an ink jet head.

5. The image forming apparatus according to claim 1, wherein said first chromatic toning material is higher in tone than said second chromatic toning material.

6. An image forming apparatus in accordance with claim 1, wherein at least one of the first and second print heads is capable of printing ink dots of different sizes.

7. An image forming apparatus in accordance with claim 1 wherein said first and second chromatic toning materials are dispersed from said print heads as dots which each adhere to said recording medium.

8. An image forming apparatus comprising:

a first group of a plurality of print heads each containing ink of a different color; and a second group of a plurality of print heads each containing ink of a different color;

wherein each type of ink contained in said second group of print heads being different in permeability to a recording sheet from each type of ink contained in said first group of print heads; and wherein each type of ink contained in said first group of print heads being complementary color ink to ink contained in said second group of print heads.

9. The image forming apparatus according to claim 8, wherein:

said print heads of said first group contain cyan ink, magenta ink and yellow ink, respectively; and said print heads of said second group contain blue ink, green ink and red ink, respectively.

10. The image forming apparatus according to claim 9, wherein each type of ink contained in said second group of print heads is higher in permeability to a recording sheet than each type of ink contained in said first group of print heads.

11. An image forming apparatus comprising:

a first group of a plurality of print heads each containing ink of a different color; and a second group of a plurality of print heads each containing ink of a different color;

wherein each type of ink contained in said second group of print heads is different in permeability to a recording sheet from each type of ink contained in said first group of print heads, wherein each type of ink contained in said first group of print heads is the same in color as and lower in tone than each type of ink contained in said second group of print heads, and wherein $\Delta D$, which is a difference between a maximum optical density $OD_{max}$ and a minimum optical density $OD_{min}$, is not more than 0.1 when printing is performed by ink contained in said first group of print heads and ink contained in said second group of print heads.

12. The image forming apparatus according to claim 11, wherein each type of ink contained in said second group of print heads is higher in permeability to a recording sheet than each type of ink contained in said first group of print heads.

13. An image forming apparatus comprising:

a first group of print heads which contain toning materials of primary colors for printing, respectively;

a second group of print heads which contain toning materials, respectively, each of the toning materials of said second group of print heads being different in color than any one of the toning materials of said first group of print heads; and a controller which controls said first and second groups of print heads, said controller being adapted to control said second group of print heads to print at a plurality of tone levels and being adapted to control each print head of said first group of print heads to respectively print at only a single tone level.

14. The image forming apparatus according to claim 13, wherein the toning materials of said second group of print heads have primary colors for printing, respectively, and each of the toning materials of said second group of print heads is different in tone than any one of the toning materials of said first group of print heads.

15. The image forming apparatus according to claim 14, wherein each of the toning materials of said second group of print heads is lower in tone than any one of the toning materials of said first group of print heads.

16. The image forming apparatus according to claim 14, wherein each of the toning materials of said second group of print heads is higher in tone than any one of the toning materials of said first group of print heads.

17. The image forming apparatus according to claim 13, wherein the toning materials of said second group of print heads are secondary colors of the toning materials of said first group of print heads, respectively.

18. The image forming apparatus according to claim 17, wherein the toning materials of said second group of print heads are complimentary colors of the toning materials of said first group of print heads, respectively.

19. An image forming apparatus in accordance with claim 13, wherein at least one of the first and second print heads is capable of printing ink dots of different sizes.

20. An image forming apparatus in accordance with claim 13 wherein said toning material is dispersed from said print heads as dots which each adhere to said recording medium.

21. An image forming apparatus comprising:

a first print head using a first chromatic toning material for printing dots on a recording medium;

a second print head using a second chromatic toning material for printing dots on said recording medium, said second chromatic toning material being different in tone from said first chromatic toning material, one of the first and second print heads being adapted to print ink dots of a plurality of sizes and the other of the first and second print heads being adapted to print ink dots of only a single size; and a controller for controlling said first and second print heads to print dots so as to form an image on said recording medium, said image comprising a plurality of pixels, wherein said controller is adapted to control a tone of each pixel by controlling therefor: (a) the diameter of dot by using said one of the first and second print heads and (b) the toning material used to print the dot by selecting one of said first and second print heads.

22. An image forming apparatus in accordance with claim 21, wherein each pixel of said image comprises a matrix of possible dot locations and said controller further controls a tone of each pixel by controlling: (c) a pattern of dots printed in the possible dot locations in the matrix.

23. An image forming apparatus in accordance with claim 21, wherein each of said dots is dispersed on said recording medium and adhered thereon.

24. An image forming apparatus comprising:

a first group of a plurality of print heads each containing ink of a different color; and a second group of a plurality of print heads each containing ink of a different color;

wherein each type of ink contained in said second group of print heads is different in permeability to a recording sheet from each type of ink contained in said first group of print heads, and wherein each of the plurality of print heads of one of the first group and the second group is capable of changing a size of dots printed.

25. An inkjet printer comprising:

a cyan inkjet head group comprising first cyan inkjet nozzles and second cyan inkjet nozzles, said first cyan inkjet nozzles being for ejecting ink drops of a first cyan color ink, said second cyan inkjet nozzles being for ejecting ink drops of a second cyan color ink which is lighter than said first cyan color ink;

a magenta inkjet head group comprising first magenta inkjet nozzles and second magenta inkjet nozzles, said first magenta inkjet nozzles being for ejecting ink drops of a first magenta color ink, said second magenta inkjet nozzles being for ejecting ink drops of a second magenta color ink which is lighter than said first magenta color ink;

a yellow inkjet head group consisting of a plurality of yellow inkjet nozzles, said yellow inkjet nozzles being for ejecting ink drops of a single yellow color ink; and a black inkjet head group comprising a plurality of black inkjet nozzles, said black inkjet nozzles being for ejecting ink drops of a single black color ink, said black inkjet nozzles being arranged such that a pitch of drops ejected therefrom is smaller than a pitch of drops ejected from any one of said first cyan inkjet nozzles, said second cyan inkjet nozzles, said first magenta inkjet nozzles, said second magenta inkjet nozzles and said yellow inkjet nozzles.

* * * * *